United States Patent [19]

Rowan

[11] Patent Number: 4,893,815

[45] Date of Patent: Jan. 16, 1990

[54] INTERACTIVE TRANSECTOR DEVICE COMMERCIAL AND MILITARY GRADE

[76] Inventor: Larry Rowan, 3440½ Caroline Ave., Culver City, Calif. 90230

[21] Appl. No.: 90,036

[22] Filed: Aug. 27, 1987

[51] Int. Cl.[4] ..... F41B 15/04

[52] U.S. Cl. ..... 273/84 ES; 42/1.16; 42/1.08; 89/1.11

[58] Field of Search ..... 273/84 ES, 84 R; 42/1.16, 1.08; 89/1.11

[56] References Cited

U.S. PATENT DOCUMENTS

| | | | |
|---|---|---|---|
| 2,195,711 | 4/1940 | Hutchison | 42/1.16 |
| 3,362,711 | 1/1968 | Larsen et al. | 273/84 ES |
| 3,545,116 | 12/1970 | Babington | 42/1.16 |

*Primary Examiner*—Leo P. Picard

*Attorney, Agent, or Firm*—Malke Leah Bas Meyer; Itzhak Ben Shlomo

[57] ABSTRACT

A multiple task user based weapons system capable of neutralizing a variety of designated target types within a real time interval well below conventional systems faced with equivalent tasks. Said weapon system is described as a transector device. Target acquisition, assignment, pursuit and engagement of said targets by dedicated systems embodied within said transector device, including automated projectiles are described in detail. Additionally, the various options or strategies involved in neutralization of said designated targets to the exclusion of equivalent or similar non-designated targets are defined in the disclosure. Further the implementation interactive expert programs, embodying statistical analysis, pruning, probablistic mechanisms and other processes are described in relation to the operation of the aforesaid transector device.

13 Claims, 136 Drawing Sheets

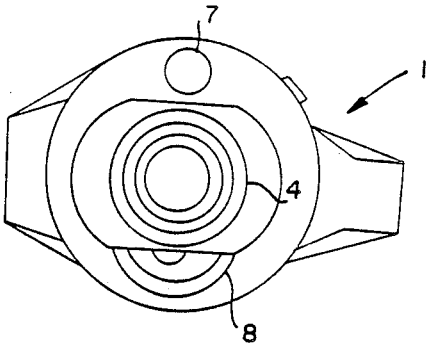
FIG. 1
FIG. 2
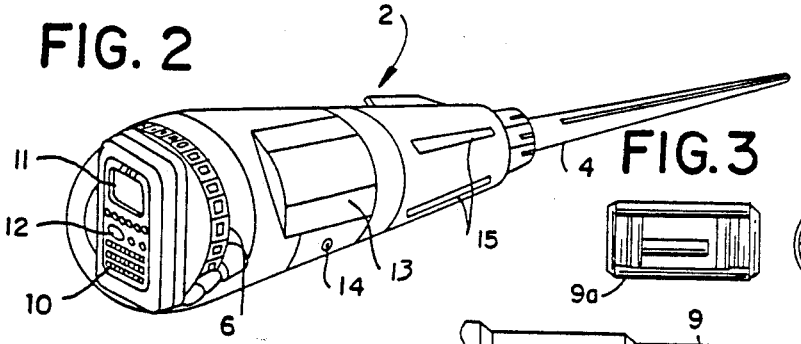
FIG. 3
FIG. 4
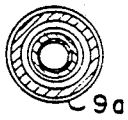
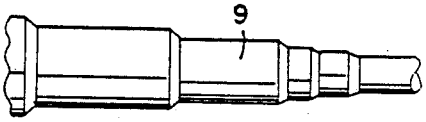
FIG. 5
FIG. 6
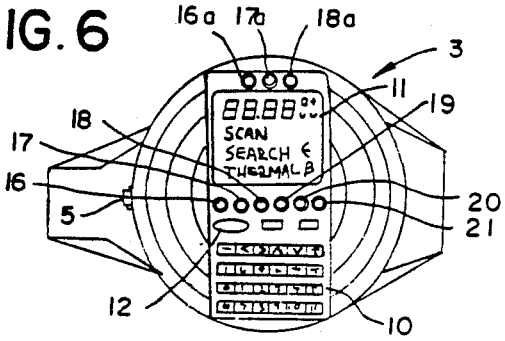

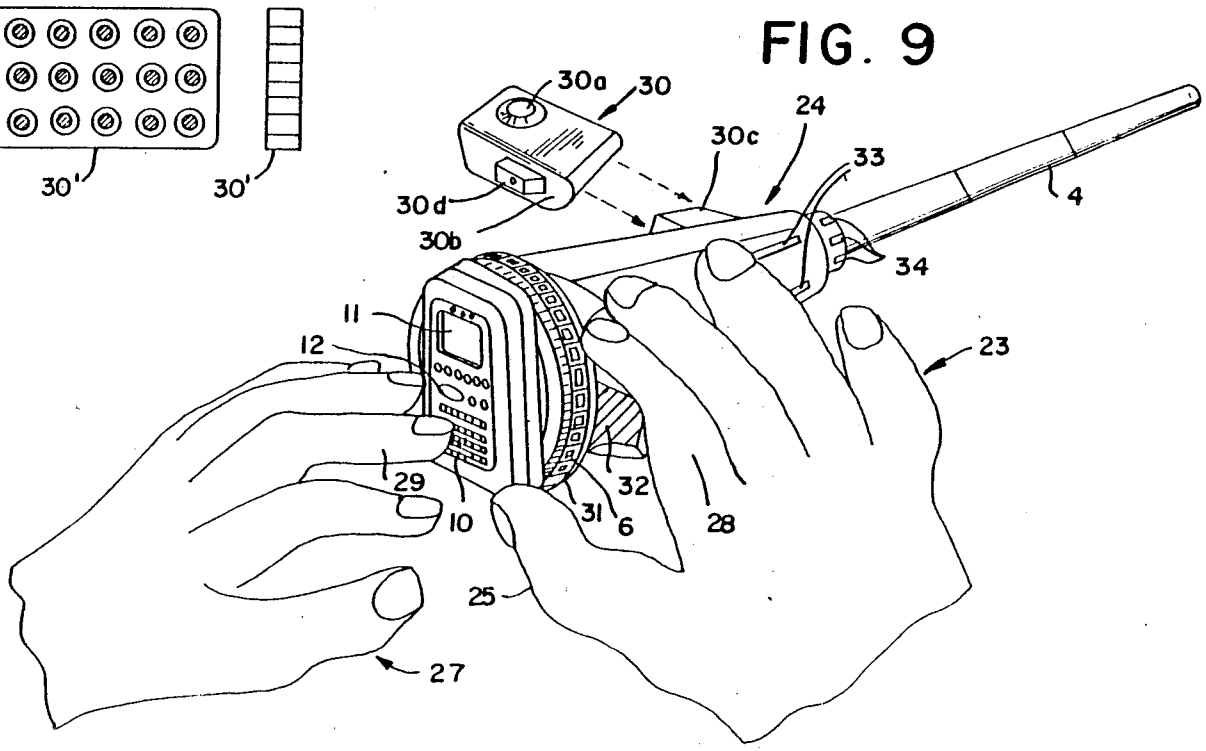
FIG. 9
FIG. 10
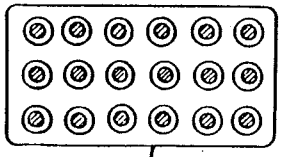
FIG. 11

103
104
105
106
107
108

103 - 108

109
110
111
112
113
114
115
116
117
118

119
120
121
121
120
119

127 - 136

122
123
124
125
126
127
128
129
130
135
136

388
381

401
294
292
391
402
295

403
404
401
389
292
292
402
390
405
406
382
383
384
385
381
296
374
387
386
372
373

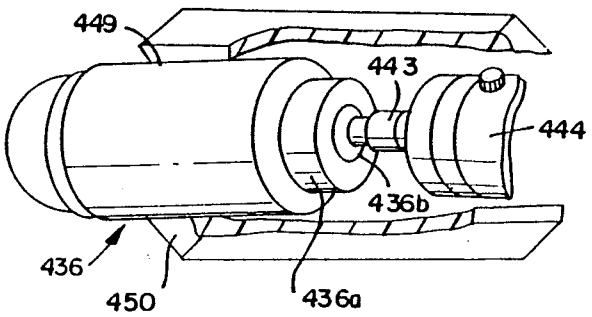
FIG. 46
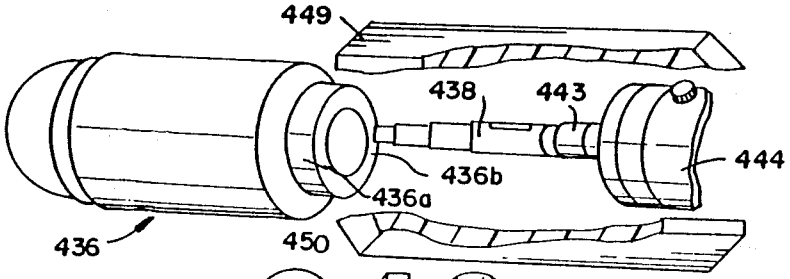
FIG. 45
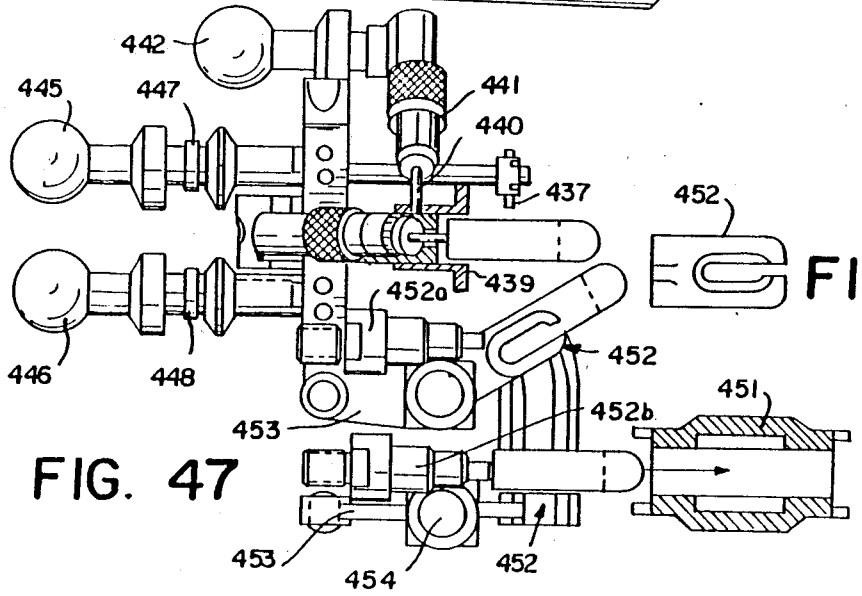
FIG. 47
FIG. 48

1
2
3
4
5
6
7
8
9
10
11
12
13
14
15
16
17
18
19
20
12345 678910abcde
+Vcc
Vcc
1-k1 Vin
Vout-k2 I1

744
746
745
747
744
744
744

$\overline{AE} = d\rho,$ $\widehat{AD} = \rho d\phi,$ $\widehat{AB} = \overline{QA}\, d\theta = \rho \sin \phi\, d\theta$ FIG. 91
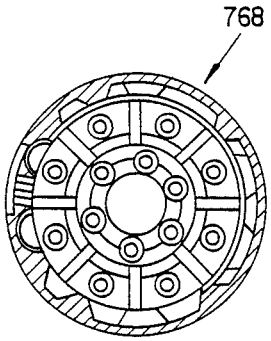
FIG. 91a
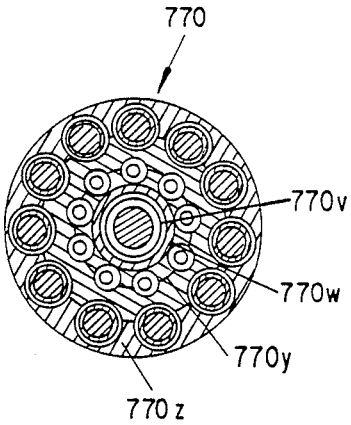
FIG. 91b
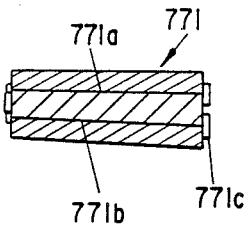
FIG. 91c
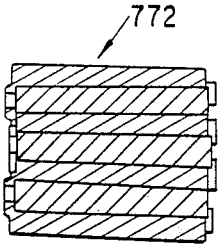
FIG. 91d
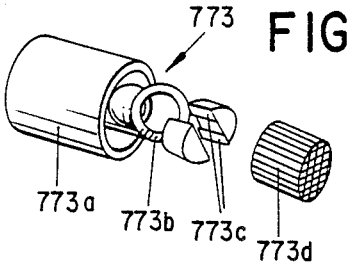
FIG. 91e
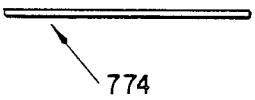
FIG. 91f
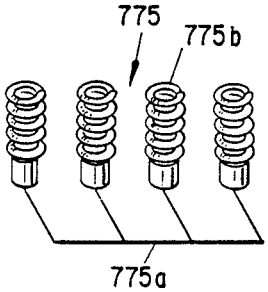
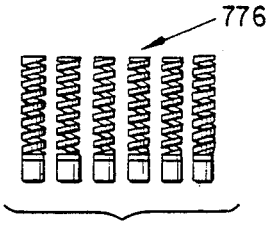
FIG. 91g

783

784

786

785

787

788

793

791
791a
791b

792

794
794a
794b
794c
794d
794e 795
795h
795f
795g

795a 795b
795c

795d 795e
795i

FIG. 97
FIG. 97b
FIG. 97a
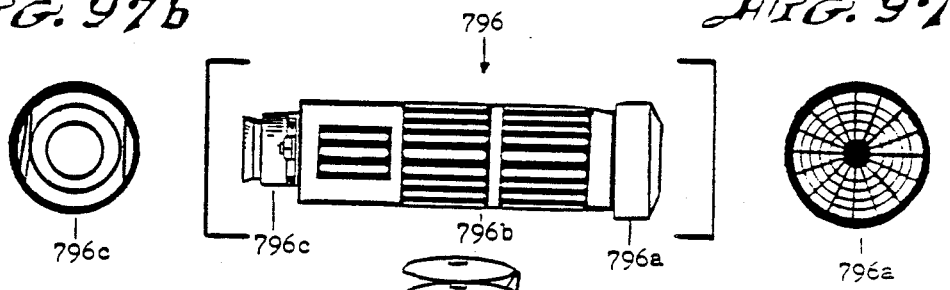
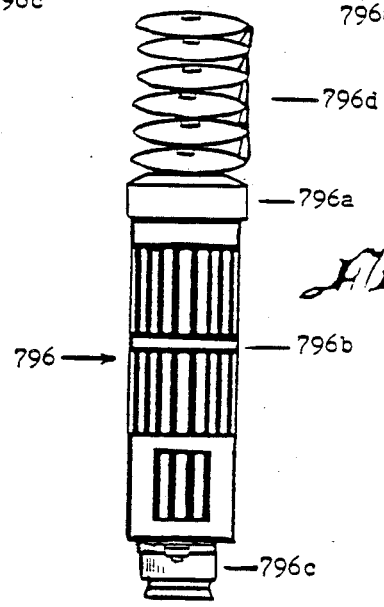
FIG. 97c
FIG. 97d
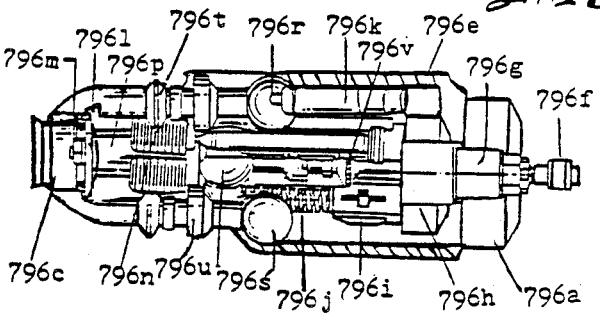
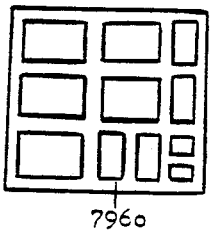
FIG. 97e 797
797a
797b
797c 797a 797c 797a 797
797a
797c
797b
778

797c

FIG. 102
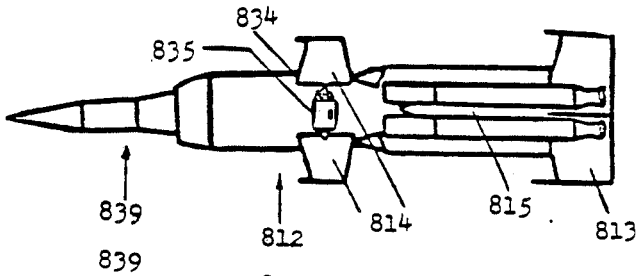
FIG. 102a
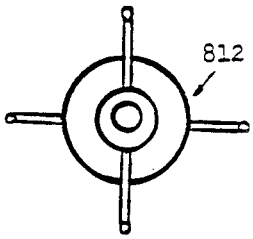
102b
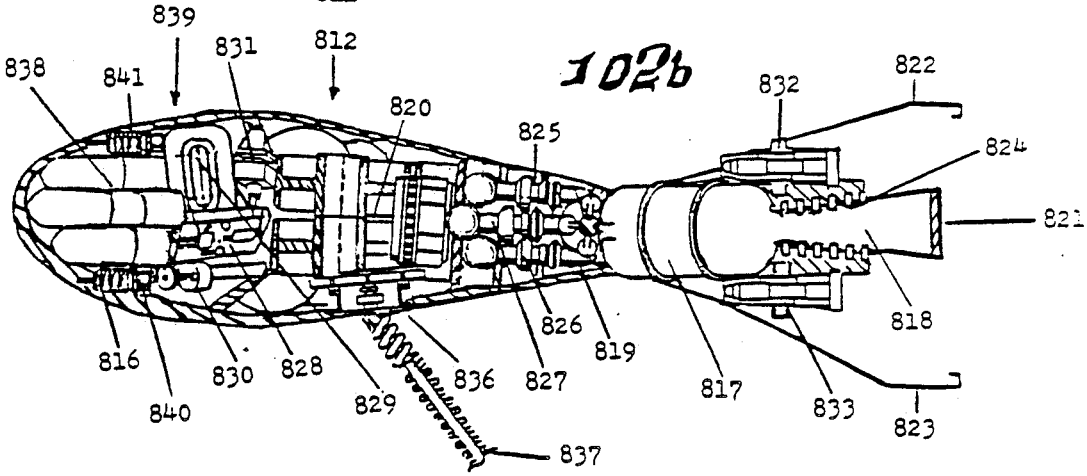

MODIFIED CLOSED LOOP SERVOMECHANISM

COMPENSATION USING OPPOSING ENVIRONMENTAL INPUTS

Electrical $V_{IN} - V = iR$

Charge $q = CV$, current $i = \frac{dq}{dt} = \frac{CdV}{dt}$ $$RC\frac{dV}{dt} + V = V_{IN}$$

i.e.

$$\tau_E\frac{dV}{dt} + V = V_{IN}, \tau_E = RC$$

FIG. 111a

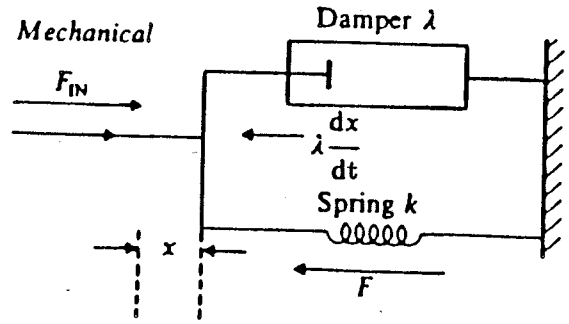

$F_{IN} - F = \lambda \frac{dx}{dt}$ $\lambda$ N s m$^{-1}$ = damping constant displacement $x = \frac{F}{k}$, $k$N m$^{-1}$ = spring stiffness $$\frac{\lambda}{k}\frac{dF}{dt} + F = F_{IN}$$

$$\tau_M \frac{dF}{dt} + F = F_{IN}, \tau_M = \frac{\lambda}{k}$$

Thermal $\tau_{Th} = \frac{MC}{UA} = R_{Th}C_{Th}; R_{Th} = \frac{1}{UA}, C_T = MC$ Fluidic $\tau_F = \frac{A_F R_F}{\rho g} = R_F C_F; \quad R_F = R_F, \quad C_F = \frac{A_F}{\rho g}$ Electrical $\tau_E = RC = R_E C_E; \quad R_E = R, \quad C_E = C$ Mechanical $\tau_M = \frac{\lambda}{k} = R_M C_M; \quad R_M = \lambda, \quad C_M = \frac{1}{k}$ Volume flowrate $Q = \frac{1}{R_F}(P_{IN} - P)$ Pressures $P_{IN} = h_{IN}\rho g$. $P = h\rho g$ $$A_F \frac{dh}{dt} = Q = \frac{\rho g}{R_F}(h_{IN} - h)$$

$$\frac{A_F R_F}{\rho g}\frac{dh}{dt} + h = h_{IN}$$

i.e.

$$\tau_F \frac{dh}{dt} + h = h_{IN}, \quad \tau_F = \frac{A_F R_F}{\rho g}$$

BASIC DIAGRAM OF MICROPROCESSOR ELEMENT

FIG. 115a

```
[ 1] ⍝ PRAQUEUE IS A FUNCTION FOR CALCULATING THE STATISTICS
[ 2] ⍝ A M/G/1 PREEMPTIVE-RESUME QUEUEING SYSTEM.  THE CALL
[ 3] ⍝ IS '' PLAPES PRAQUEUE PES2 '' WHERE PLAPES IS THE VEC
[ 4] ⍝ OF THE AVERAGE ARRIVAL RATES FOR EACH PRIORITY CLASS,
[ 5] ⍝ WITH THE VECTOR, PES, OF THE CORRESPONDING AVERAGE SE
[ 6] ⍝ PES2 IS THE VECTOR OF THE CORRESPONDING SECOND MOMENT
[ 7] ⍝ SERVICE TIMES.
[ 8] N←⍴PES2
[ 9] PLAMBDA←N↑PLAPES
[10] PES←(-N)↑PLAPES
[11] LAMBDA←+/PLAMBDA
[12] PROB←PLAMBDA÷LAMBDA
[13] ES←+/PROB×PES
[14] ES2←+/PROB×PES2
[15] PU←0,+\PLAMBDA×PES
[16] DIV1←N↑(1-PU)
[17] DIV2←(-N)↑(1-PU)
[18] PV←+\PLAMBDA×PES2
[19] PW←(PES+PV÷2×DIV2)÷DIV1
[20] PL←PLAMBDA×PW
[21] PWQ←PW-PES
[22] PLQ←PLAMBDA×PWQ
[23] WQ←+/PROB×PWQ
[24] LQ←LAMBDA×WQ
[25] W←+/PROB×PW
[26] L←LAMBDA×W
[27] 'ES =  ',⍕ES
[28] 'ES2 =  ',⍕ES2
[29] 'LAMBDA =  ',⍕LAMBDA
[30] 'RHO =  ',⍕RHO←LAMBDA×ES
[31] 'WQ =  ',⍕WQ
[32] 'W =  ',⍕W
[33] 'L =  ',⍕L
[34] 'LQ =  ',⍕LQ
[35] 'THE AVERAGE QUEUEING TIMES FOR THE
[36] 'RESPECTIVE PRIORITY CLASSES ARE;'
[37] PWQ
[38] 'THE CORRESPONDING SYSTEM TIMES ARE;'
[39] PW
[40] 'THE AVERAGE NUMBER IN THE SYSTEM FROM'
[41] 'THE RESPECTIVE PRIORITY CLASSES IS;'
[42] PL
[43] 'THE CORRESPONDING AVERAGE NUMBER QUEUEING IS;'
[44] PLQ
```

FIG. 115 a'

```
[ 1] ⍝ PAQUEUE IS A FUNCTION FOR CALCULATING THE STATISTICS FOR
[ 2] ⍝ A M/G/1 NON-PREEMTIVE QUEUEING SYSTEM, THAT IS , AN HOL SYSTEM
[ 3] ⍝ THE CALLING FORMAT IS '' PLAPES PAQUEUE PES2 ''.  HERE
[ 4] ⍝ PLAPES IS THE VECTOR, PL, OF THE AVERAGE ARRIVAL RATES FOR
[ 5] ⍝ EACH PRIORITY CLASS, CATENATED WITH THE VECTOR, PES, OF THE
[ 6] ⍝ CORRESPONDING AVERAGE SERVICE TIMES.  PES2 IS THE VECTOR
[ 7] ⍝ OF THE CORRESPONDING SECOND MOMENTS OF THE SERVICE TIMES.
[ 8] N←⍴PES2
[ 9] PLAMBDA←N↑PLAPES
[10] PES←(-N)↑PLAPES
[11] LAMBDA←+/PLAMBDA
[12] PROB←PLAMBDA÷LAMBDA
[13] ES←+/PROB×PES
[14] ES2←+/PROB×PES2
[15] PU←0,+\PLAMBDA×PES
[16] DIV1←N↑(1-PU)
[17] DIV2←(-N)↑(1-PU)
[18] PWQ←0.5×LAMBDA×ES2÷DIV1×DIV2
[19] PW←PWQ+PES
[20] PL←PLAMBDA×PW
[21] PLQ←PLAMBDA×PWQ
[22] WQ←+/PROB×PWQ
[23] LQ←LAMBDA×WQ
[24] W←WQ+ES
[25] L←LAMBDA×W
[26] 'ES=  ',⍕ES
[27] 'ES2=  ',⍕ES2
[28] 'LAMBDA=  ',⍕LAMBDA
[29] 'RHO=  ',⍕RHO←LAMBDA×ES
[30] 'WQ=  ',⍕WQ
[31] 'W=  ',⍕W
[32] 'LQ=  ',⍕LQ
[33] 'L=  ',⍕L
[34] 'THE AVERAGE QUEUEING TIMES FOR'
[35] 'THE RESPECTIVE PRIORITY CLASSES ARE;
[36] PWQ
[37] 'THE CORRESPONDING SYSTEM TIMES ARE;'
[38] PW
[39] 'THE AVERAGE NUMBER IN THE SYSTEM FROM'
[40] 'THE RESPECTIVE PRIORITY CLASSES IS:'
[41] PL
[42] 'THE CORRESPONDING AVERAGE NUMBER QUEUEING IS:'
[43] PLQ
```

FIG. 115b

```
[ 1] ⍝ MΔMΔC IS A FUNCTION FOR CALCULATING THE STATISTICS OF THE
[ 2] ⍝ M/M/C QUEUEING SYSTEM.  IT USES THE FUNCTION ERLANGΔC THE
[ 3] ⍝ CALLING SEQUENCE IS '' U MΔMΔC C,ES''  WHERE C IS THE
[ 4] ⍝ NUMBER OF SERVERS, ES IS THE AVERAGE SERVICE TIME OF EACH
[ 5] ⍝ SERVER, AND U IS THE TRAFFIC INTENSITY.
[ 6] C←X[1]
[ 7] ES←X[2]
[ 8] RHO←U÷C
[ 9] CCU←C ERLANGΔC U
[10] LQ←RHO×CCU÷1-RHO
[11] VARNQ←LQ×(1+RHO-RHO×CCU)÷1-RHO
[12] SIGNQ←VARNQ*0.5
[13] LAMBDA←U÷ES
[14] WQ←LQ÷LAMBDA
[15] VARQ←(2-CCU)×CCU×(ES*2)÷(((1-RHO)*2)×C*2)
[16] SIGQ←VARQ*0.5
[17] W←WQ+ES
[18] L←LAMBDA×W
[19] →LΔUΔCΔ1×⍳U=C-1
[20] EW2←(2×CCU×ES*2)÷(U+1-C)
[21] EW2←EW2×(1-(C-U)*2)÷(C-U)*2
[22] →LΔSIGΔW,EW2←EW2+2×ES*2
[23] LΔUΔCΔ1:EW2←((4×CCU)+2)×ES*2
[24] LΔSIGΔW:VARW←EW2-W*2
[25] SIGW←VARW*0.5
[26] K←ES÷C-U
[27] WQ90←0⌈K×⍟10×CCU
[28] WQ95←0⌈K×⍟20×CCU
[29] 'THE AVERAGE ARRIVAL RATE, LAMBDA, IS  ',⍕LAMBDA
[30] 'THE PROBABILITY THAT ALL THE SERVERS ARE BUSY IS  ',⍕CCU
[31] 'THE SERVER UTILIZATION, RHO = U÷C, IS  ',⍕RHO
[32] 'AVERAGE NUMBER IN THE QUEUE IS  ',⍕LQ
[33] 'WITH STANDARD DEVIAION  ',⍕SIGNQ
[34] 'AVERAGE TIME IN THE QUEUE IS  ',⍕WQ
[35] 'WTH STANDARD DEVIATION  ',⍕SIGQ
[36] 'AVERAGE QUEUEING TIME FOR CUSTOMERS DELAYED IS  ',⍕WQΔD←WQ÷CCU
[37] 'AVERAGE NUMBER IN THE SYSTEM IS  ',⍕L
[38] 'AVERAGE TIME IN THE SYSTEM IS  ',⍕W
[39] 'WTH STANDARD DEVIATION  ',⍕SIGW
[40] 'THE 90-TH PERCENTILE QUEUEING TIME IS  ',⍕WQ90
[41] 'THE 95-TH PERCENTILE  QUEUEING TIME IS  ',⍕WQ95
[42] 'C-SQUARED FOR SYSTEM TIME IS  ',⍕C2W←VARW÷W*2
[43] 'C-SQUARED  FOR QUEUEING TIME IS  ',⍕C2WQ←VARQ÷WQ*2
[44] 'THE MARTIN ESTIMATE OF 90-TH PERCENTILE SYSTEM TIME IS:'
[45] ⎕←W90←W+1.3×SIGW
[46] 'THE MARTIN ESTIMATE OF 95-TH PERCENTILE SYSTEM TIME IS:'
[47] ⎕←W95←W+2×SIGW
```

NESTED PROGRAM

HYPOTHESIS TREE REPRESENTATION

FIG. 118

Representation of Hypothesis Matrix

| Hypothesis Number | First Data Set | | Second Data Set | | Track Numbers Contained in Hypothesis |
|---|---|---|---|---|---|
| | $y_1(1)$ | $y_2(1)$ | $y_1(2)$ | $y_2(2)$ | |
| 1 | 0 | 0 | 0 | 0 | 0 |
| 2 | 1 | 0 | 0 | 0 | 1 |
| 3 | 0 | 2 | 0 | 0 | 2 |
| 4 | 1 | 2 | 0 | 0 | 1,2 |
| 5 | 1 | 0 | 1(3) | 0 | 3 |
| 6 | 1 | 2 | 1(3) | 0 | 2,3 |
| 7 | 0 | 2 | 2(4) | 0 | 4 |
| 8 | 1 | 2 | 2(4) | 0 | 1,4 |
| 9 | 0 | 0 | 5 | 0 | 5 |
| 10 | 1 | 0 | 5 | 0 | 1,5 |
| 11 | 0 | 2 | 5 | 0 | 2,5 |
| 12 | 1 | 2 | 5 | 0 | 1,2,5 |
| 13 | 1 | 0 | 0 | 1(6) | 6 |
| 14 | 1 | 2 | 0 | 1(6) | 2,6 |
| 15 | 1 | 2 | 2(4) | 1(6) | 4,6 |
| 16 | 1 | 0 | 5 | 1(6) | 5,6 |
| 17 | 1 | 2 | 5 | 1(6) | 2,5,6 |
| 18 | 0 | 2 | 0 | 2(7) | 7 |
| 19 | 1 | 2 | 0 | 2(7) | 1,7 |
| 20 | 1 | 2 | 1(3) | 2(7) | 3,7 |
| 21 | 0 | 2 | 5 | 2(7) | 5,7 |
| 22 | 1 | 2 | 5 | 2(7) | 1,5,7 |
| 23 | 0 | 0 | 0 | 8 | 8 |
| 24 | 1 | 0 | 0 | 8 | 1,8 |
| 25 | 0 | 2 | 0 | 8 | 2,8 |
| 26 | 1 | 2 | 0 | 8 | 1,2,8 |
| 27 | 1 | 0 | 1(3) | 8 | 3,8 |
| 28 | 1 | 2 | 1(3) | 8 | 2,3,8 |
| 29 | 0 | 2 | 2(4) | 8 | 4,8 |
| 30 | 1 | 2 | 2(4) | 8 | 1,4,8 |
| 31 | 0 | 0 | 5 | 8 | 5,8 |
| 32 | 1 | 0 | 5 | 8 | 1,5,8 |
| 33 | 0 | 2 | 5 | 8 | 2,5,8 |
| 34 | 1 | 2 | 5 | 8 | 1,2,5,8 |

• DATA POINTS

PI • EXTRAPOLATED POSITION FOR TRACK I

TRACKS ASSOCIATED WITH $H_{15}$ (T4, T6)

TRACKS ASSOCIATED WITH $H_{20}$ (T3, T7)

HYPOTHESIZED TRACK FORMATION FOR TWO DATA SCANS

FULL HYPOTHESIS MATRIX AFTER THIRD DATA SCAN

| *Hypothesis Number* | *Second Data Scan* | | *Third Data Scan* | |
|---|---|---|---|---|
| | $y_1(2)$ | $y_2(2)$ | $y_1(3)$ | $y_2(3)$ |
| 1(15) | 4 | 6 | 0 | 0 |
| 2(20) | 3 | 7 | 0 | 0 |
| 3 | 4 | 6 | 6(9) | 0 |
| 4 | 4 | 6 | 10 | 0 |
| 5 | 3 | 7 | 10 | 0 |
| 6 | 4 | 6 | 0 | 4(11) |
| 7 | 4 | 6 | 6(9) | 4(11) |
| 8 | 4 | 6 | 10 | 4(11) |
| 9 | 4 | 6 | 0 | 12 |
| 10 | 3 | 7 | 0 | 12 |
| 11 | 4 | 6 | 6(9) | 12 |
| 12 | 4 | 6 | 10 | 12 |
| 13 | 3 | 7 | 10 | 12 |

B

GATES AND OBSERVATIONS FOR THE THIRD DATA SCAN

REDUCED HYPOTHESIS MATRIX AFTER THIRD SCAN DATA

| *Hypothesis Number* | *Third Scan Data* | |
|---|---|---|
| | $y_1(3)$ | $y_2(3)$ |
| 1(3) | 9 | 0 |
| 2(7) | 9 | 11 |
| 3(11) | 9 | 12 |

FIG. 123

A

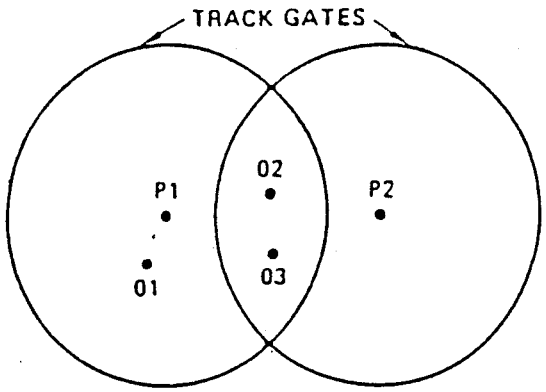

01, 02, 03 = OBSERVATION POSITIONS
P1, P2 = PREDICTED TARGET POSITION

FIG. 124

B

TARGET ORIENTED HYPOTHESIS MATRIX

| Hypothesis Number | Track Number 1 | Track Number 2 | Hypothesis Probability $P'(H_i)$ | Probability Values for Example* |
|---|---|---|---|---|
| 1 | 0 | 0 | $(1-P_D)^2\beta^1$ | $2.4\times10^{-6}(0.011)$ |
| 2 | 1 | 0 | $g_{11}P_D(1-P_D)\beta^2$ | $1.82\times10^{-5}(0.086)$ |
| 3 | 2 | 0 | $g_{12}P_D(1-P_D)\beta^2$ | $1.11\times10^{-5}(0.053)$ |
| 4 | 3 | 0 | $g_{13}P_D(1-P_D)\beta^2$ | $4.1\times10^{-6}(0.019)$ |
| 5 | 0 | 2 | $g_{22}P_D(1-P_D)\beta^2$ | $8.6\times10^{-6}(0.041)$ |
| 6 | 1 | 2 | $g_{11}g_{22}P_D^2\beta$ | $6.47\times10^{-5}(0.306)$ |
| 7 | 3 | 2 | $g_{13}g_{22}P_D^2\beta$ | $1.44\times10^{-5}(0.068)$ |
| 8 | 0 | 3 | $g_{23}P_D(1-P_D)\beta^2$ | $6.7\times10^{-6}(0.032)$ |
| 9 | 1 | 3 | $g_{11}g_{23}P_D^2\beta$ | $5.04\times10^{-5}(0.239)$ |
| 10 | 2 | 3 | $g_{12}g_{23}P_D^2\beta$ | $3.06\times10^{-5}(0.145)$ |

*Normalized values, $P(H_i)$, within parentheses.

FIG. 128

```
PROGRAM SAMPLE(INPUT, OUTPUT);
{This program illustrates the use of procedure names as
 parameters to other procedures}
 •
 •
 •
 VAR FLAG: BOOLEAN;  {Set by CHECK1 and CHECK2}

 PROCEDURE CHECK1(X, Y, Z: REAL);
     {Performs some type of validity checking on X, Y, and Z
      and sets FLAG accordingly}
     BEGIN
     •
     •
     •
     FLAG:=TRUE
     END;

 PROCEDURE CHECK2(X, Y, Z: REAL);
     {Performs a different type of validity check and sets
      FLAG accordingly}
     BEGIN
     •
     •
     •
     FLAG:=TRUE
     END;

 PROCEDURE READDATA(PROCEDURE CHECK);
     {This procedure reads in data and validates it using a
      checking procedure passed in as a parameter}
     BEGIN
     •
     •
     •
     READLN(X, Y, Z);  {Input the data}
     CHECK(X, Y, Z);  {Check it for correctness}
     IF FLAG THEN . . .
     •
     •
     •
     END;
```

FIG. 128'

```
FUNCTION POWER(X: REAL; N: INTEGER): REAL;
{Compute X raised to the power N recursively. The function
 always returns 0 for X = 0}
BEGIN
    IF X = 0.0 THEN POWER:=0.0
    ELSE IF N = 0 THEN POWER:=1.0
         ELSE IF N < 0 THEN POWER:=POWER(X, N+1)/X
                       ELSE POWER:=POWER(X, N-1)*X
    END;  {Of POWER}

      IF X>Y THEN
        BEGIN
        IF X>Z THEN
          WRITE(X)
        ELSE
          WRITE(Z)
        END
      ELSE
        BEGIN
        IF Y>Z THEN
          WRITE(Y)
        ELSE
          WRITE(X)
        END;
```

{ ACCESS CODE COMPLETED GOTO MAIN PROGRAM }

FIG. 129

COMPARISON OF CONTINUOUS-TIME AND DISCRETE-TIME TRANSFORMS

CONTINUOUS-TIME TRANSFORMS

Fourier Series $$x(t) = \sum_{k=-\infty}^{\infty} c_k e^{j2\pi kt/T}$$

$$c_k = \frac{1}{T} \int_{-T/2}^{T/2} x(t) e^{-j2\pi kt/T} dt$$

Fourier Transform $$x(t) = 1/2\pi \int_{-\infty}^{\infty} X(\omega) e^{j\omega t} d\omega$$

$$X(\omega) = \int_{-\infty}^{\infty} x(t) e^{-j\omega t} dt$$

Laplace Transform $$x(t) = 1/2\pi j \int_{Br} X(s) e^{st} ds$$

$$X(s) = \int^{\infty} x(t) e^{-st} dt$$

DISCRETE-TIME TRANSFORMS

DFT $$x(n) = 1/N \sum_{k=0}^{N-1} X_k e^{j2\pi kn/N}$$

$$X_k = \sum_{n=0}^{N-1} x(n) e^{-2\pi kn/N}$$

Fourier Transform (Discrete Signal)

$$x(n) = 1/2\pi \int_{0}^{2\pi} X(\omega) e^{j\omega n} d\omega$$

$$X(\omega) = \sum_{-\infty}^{\infty} x(n) e^{-j\omega n}$$

z Transform $$x(n) = 1/2\pi j \int_{C} X(z) z^{n-1} dz$$

$$X(z) = \sum_{n=-\infty}^{\infty} x(n) z^{-n}$$

FIG. 130

AUTOCORRELATION FUNCTION $$R_{yy}(\beta) = \lim_{T_O \to \infty} \frac{1}{T_O} \int_0^{T_O} y(t)\, y(t-\beta)\, dt$$

Autocorrelation function of a continuous signal

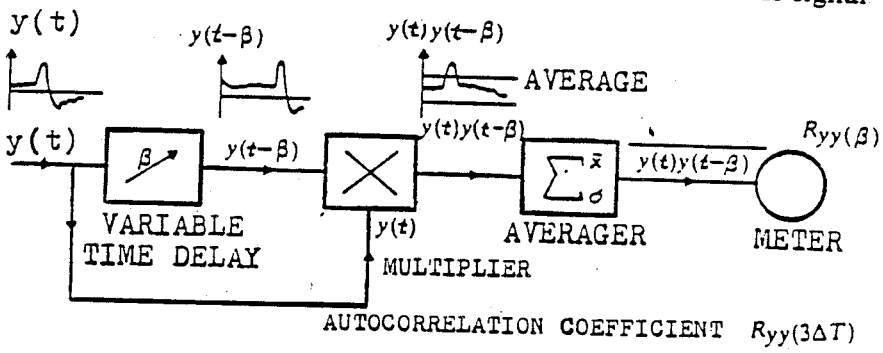

AUTOCORRELATION COEFFICIENT $R_{yy}(3\Delta T)$

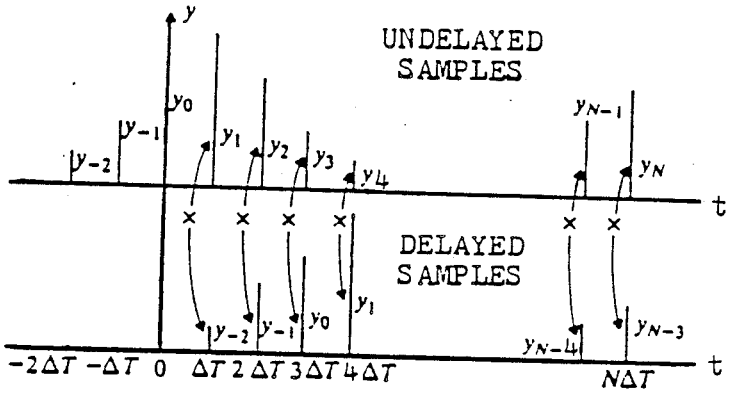

Thus, if $y(t) = b \sin(\omega_1 t + \phi)$, $$R_{yy}(\beta) = b^2 \lim_{T_O \to \infty} \frac{1}{T_O} \int_0^{T_O} \sin(\omega_1 t + \phi) \sin[\omega_1(t-\beta) + \phi]\, dt$$

$$= b^2 \lim_{T_O \to \infty} \frac{1}{T_O} \int_0^{T_O} \tfrac{1}{2}\{\cos \omega_1 \beta - \cos[\omega_1(2t-\beta) + 2\phi]\}\, dt$$

$$R_{yy}(\beta) = \frac{b^2}{2} \cos \omega_1 \beta \lim_{T_O \to \infty} \frac{1}{T_O} \int_0^{T_O} dt - \frac{b^2}{2} \lim_{T_O \to \infty} \frac{1}{T_O} \int_0^{T_O} \cos[\omega_1(2t-\beta) + 2\phi]\, dt$$

$$= \frac{b^2}{2} \cos \omega_1 \beta$$

FIG. 131

STANDARD DEVIATION AND VARIANCE

```
label 1;
var
    i    :        integer;
begin
    sumsq := 0;
    writeln ('enter -999 to exit');
    writeln;
    for i := 1 to MAXINT do
        begin
        write ('input data ',i:2,' : ');
        readln (dat[i]);
        if dat[i] = -999 then
        goto 1;
        writeln;
        sum := sum + dat[i];
        nbr := i
        end;
   1: avg := sum / nbr;
    for i := 1 to nbr do
        begin
        d := dat[i] - avg;
        sumsq := sumsq + sqr(d)
        end;
    vr := sumsq / (nbr - 1);
    pvr := sumsq / nbr;
    sd := sqrt (vr);
    psd := sqrt (pvr)
end; {inpt}

procedure print;
begin
    skip (4);
    writeln ('number of data items ',nbr:3);
    writeln;
    writeln ('average ',avg:8:4);
    writeln;
    writeln ('variance ',vr:8:4);
    writeln;
    writeln ('standard deviation ',sd:8:4);
    writeln;
    writeln ('population standard deviation ',psd:8:4)
end; {print}

begin {main}
    clear;
    skip (4);
    sum := 0;
    skip (4);
    writeln ('            Standard Deviation and Variance');
    skip (3);
    inpt;
    print
end.
```

FIG. 131a

FORMUAS RESPONSIBLE FOR ALGORITHMS EMBODIED WITHIN PROGRAM CALCULATING STANDARD DEVIATIONS

If $x_1, x_2, \ldots, x_n$ is a sample of $n$ numbers, the formula for the mean x (x bar) is:

$$\bar{x} = \frac{1}{n} \sum_{j=1}^{n} x_j$$

The standard deviation $s$ of the sample is defined by $$(n-1)s^2 = (x_1 - x)^2 + (x_2 - x)^2 + \ldots + (x_n - x)^2$$

which, using the summation notation, looks like this:

$$(n-1)s^2 = \sum_{j=1}^{n} (xj - x)^2$$

or, solving for $s$ looks like this:

$$s = \frac{(x_1 - x)^2 + (x_2 - x)^2 + \ldots + (x_n - x)^2}{n-1}$$

FIG. 132

SECOND-ORDER CURVE-FIT

```
var
    i : integer;
    x : real;
begin
    x := 1.0;
    for i := 1 to xpnt do
        x := x * mantissa;
    pwr := x
end;

procedure leastsquares (nbr : integer);
var
    i            : integer;
begin
    a0 := 1;
    a1 := 0;
    a2 := 0;
    a3 := 0;
    a4 := 0;
    b0 := 0;
    b1 := 0;
    b2 := 0;
    for i := 1 to nbr  do
        begin
        a1 := a1 + x[i];
        a2 := a2 + pwr (x[i], 2);
        a3 := a3 + pwr (x[i], 3);
        a4 := a4 + pwr (x[i], 4);
        b0 := b0 + y[i];
        b1 := b1 + x[i] * y[i];
        b2 := b2 + y[i] * pwr (x[i], 2)
        end;
    a1 := a1 / nbr;
    a2 := a2 / nbr;
    a3 := a3 / nbr;
    a4 := a4 / nbr;
    b0 := b0 / nbr;
    b1 := b1 / nbr;
    b2 := b2 / nbr;
    d := a0*(a2*a4 - a3*a3) - a1*(a1*a4 - a3*a2)+a2*(a1*a3 - a2*a2);
    a := b0*(a2*a4 - a3*a3) + b1*(a3*a2 - a1*a4)+b2*(a1*a3 - a2*a2);
    a := a / d;
    b := b0*(a3*a2 - a1*a4) + b1*(a0*a4 - a2*a2)+b2*(a2*a1 - a0*a3);
    b := b / d;
    c := b0*(a1*a3 - a2*a2) + b1*(a1*a2 - a0*a3)+b2*(a0*a2 - a1*a1);
    c := c / d;
    d := 0;
    for i := 1 to nbr do
        begin
        d1 := y[i] - a - b * x[i] - c * pwr (x[i], 2);
        d := d + pwr(d1, 2);
        end;
```

FIG. 132a $$Y = f(X)$$

Polynomial curve-fitting involves matching data to an x,y relationship. For a binomial or second-order polynomial, the relationship is $$x^2 +/- 2xy +/- y^2$$

For a third-order polynomial, it is $$x^3 +/- x^2y +/- xy^2 +/- y^3$$

SINGLE DIGITIZED SIGNAL

REPETITIVE DIGITIZED SIGNAL

FIG. 13b

DIGITIZED SIGNAL AFTER DATA REDUCTION

```
000000000000000000000000000000000000000000000000000000000000000111
000000000000000000000000000000000000000000000000000000000000001110
000000000000000000000000000000000000000000000000000000000000000111
000000000000000000000000000000000000000000000000000000000000000111
000000000000000000000000000000000000000000000000000000000000000111
011111111111111111111111111111111111111111111111111111111111111110
000000000000000000000000000000000000000000000000000000000000111000
011111111111111111111111111111111111111111111111111111111111111111
011000000000000000000000000000000000000000000000000000000000000011
```

SYMBOLIC CODE KEY
TARGET ACQISITION USER
FRIENDLY ANCILLARY SYSTEM

FIG. 136

$$X = \begin{bmatrix} 1 & -1 & 1 & -1 & 1 & -1 \\ 1 & 1 & 1 & 1 & 1 & 1 \\ 1 & -1 & 0 & 1 & -1 & 0 \\ 1 & 0 & -1 & 1 & 0 & -1 \\ 0 & 1 & -1 & 0 & 1 & -1 \\ 1 & 1 & 0 & -1 & -1 & 0 \\ 1 & 0 & -1 & -1 & 0 & 1 \\ 0 & 1 & 1 & 0 & -1 & -1 \end{bmatrix}$$

$$Y = \begin{bmatrix} 1 & -1 & 1 & -1 & 1 & -1 \\ 1 & 1 & 1 & 1 & 1 & 1 \\ 1 & -1 & 0 & 1 & -1 & 0 \\ 1 & 0 & -1 & 1 & 0 & -1 \\ 1 & 1 & -1 & 0 & 1 & -1 \\ 1 & 1 & 0 & -1 & -1 & 0 \\ 1 & 0 & -1 & -1 & 0 & 1 \\ 1 & 1 & 1 & 0 & -1 & -1 \end{bmatrix}$$

$$Z = \begin{bmatrix} 1 & -1 & 1 & -1 & 1 & -1 \\ 1 & 1 & 1 & 1 & 1 & 1 \\ 0 & -1 & 0 & 1 & -1 & 0 \\ 1 & 0 & -1 & 1 & 0 & -1 \\ 0 & 1 & -1 & 0 & 1 & -1 \\ 1 & 1 & 0 & -1 & -1 & 0 \\ 1 & 0 & -1 & -1 & 0 & 1 \\ 0 & 1 & 1 & 0 & -1 & -1 \end{bmatrix}$$

$$T = \begin{bmatrix} 1 & 1 & 1 & 1 & -1 & -1 & 1 & -1 \\ -1 & 1 & -1 & 1 & 1 & 1 & 1 & 1 \\ 1 & 1 & 1 & 1 & 0 & 1 & -1 & 0 \\ -1 & 1 & -1 & 1 & -1 & 1 & 0 & -1 \\ 1 & 1 & 1 & 1 & 1 & 0 & -1 & -1 \\ -1 & 1 & -1 & 1 & 0 & 1 & 1 & 0 \end{bmatrix}$$

FIG. 137

```
C ------------------------------------------------------------
        A COOLEY-TUKEY RADIX-8 DIF  FFT PROGRAM
        TWO BF, TABLE LOOKUP OF  W  VALUES
        COMPLEX INPUT DATA IN ARRAYS X AND Y
        TWIDDLE FACTORS ARE STORED IN TABLE
        LENGTH IS  N = 8 ** M
        SUBROUTINE  FFT8 (X,Y,N,M,WR,WI)
        REAL X(1), Y(1), WR(1), WI(1)
        C81 = 0.707106778
C-------------MAIN FFT LOOPS----------------------------
        N2 = N
        DO 10 K = 1, M
            N1 = N2
            N2 = N2/8
            DO 1 I1 = 1, N, N1
                    I2 = I1 + N2
                    I3 = I2 + N2
                    I4 = I3 + N2
                    I5 = I4 + N2
                    I6 = I5 + N2
                    I7 = I6 + N2
                    I8 = I7 + N2
                    R1 = X(I1) + X(I5)
                    R5 = X(I1) - X(I5)
                    R2 = X(I2) + X(I6)
                    R6 = X(I2) - X(I6)
                    R3 = X(I3) + X(I7)
                    R7 = X(I3) - X(I7)
                    R4 = X(I4) + X(I8)
                    R8 = X(I4) - X(I8)
                    T1 = R1 - R3
                    R1 = R1 + R3
                    R3 = R2 - R4
                    R2 = R2 + R4
                    X(I1) = R1 + R2
                    X(I5) = R1 - R2
                    R1 = Y(I1) + Y(I5)
                    S5 = Y(I1) - Y(I5)
                    R2 = Y(I2) + Y(I6)
                    S6 = Y(I2) - Y(I6)
                    S3 = Y(I3) + Y(I7)
                    S7 = Y(I3) - Y(I7)
                    R4 = Y(I4) + Y(I8)
                    S8 = Y(I4) - Y(I8)
                    T2 = R1 - S3
                    R1 = R1 + S3
                    S3 = R2 - R4
                    R2 = R2 + R4
                    Y(I1) = R1 + R2
                    Y(I5) = R1 - R2
                    X(I3) = T1 + S3
                    X(I7) = T1 - S3
                    Y(I3) = T2 - R3
                    Y(I7) = T2 + R3
```

FIG. 137a

```
T1 = R1 - R3
R1 = R1 + R3
R3 = R2 - R4
R2 = R2 + R4
X(I1) = R1 + R2
R2    = R1 - R2
S1 = Y(I1) + Y(I5)
S5 = Y(I1) - Y(I5)
S2 = Y(I2) + Y(I6)
S6 = Y(I2) - Y(I6)
S3 = Y(I3) + Y(I7)
S7 = Y(I3) - Y(I7)
S4 = Y(I4) + Y(I8)
S8 = Y(I4) - Y(I8)
T2 = S1 - S3
S1 = S1 + S3
S3 = S2 - S4
S2 = S2 + S4
Y(I1) = S1 + S2
S2    = S1 - S2
R1 = T1 + S3
T1 = T1 - S3
S1 = T2 - R3
T2 = T2 + R3
X(I5) = CO5*R2 + SI5*S2
Y(I5) = CO5*S2 - SI5*R2
X(I3) = CO3*R1 + SI3*S1
Y(I3) = CO3*S1 - SI3*R1
X(I7) = CO7*T1 + SI7*T2
Y(I7) = CO7*T2 - SI7*T1
R1 = (R6 - R8)*C81
R6 = (R6 + R8)*C81
S1 = (S6 - S8)*C81
S6 = (S6 + S8)*C81
T1 = R5 - R1
R5 = R5 + R1
R8 = R7 - R6
R7 = R7 + R6
T2 = S5 - S1
S5 = S5 + S1
S8 = S7 - S6
S7 = S7 + S6
R1 = R5 + S7
R5 = R5 - S7
R6 = T1 + S8
T1 = T1 - S8
S1 = S5 - R7
S5 = S5 + R7
S6 = T2 - R8
T2 = T2 + R8
X(I2) = CO2*R1 + SI2*S1
Y(I2) = CO2*S1 - SI2*R1
X(I8) = CO8*R5 + SI8*S5
Y(I8) = CO8*S5 - SI8*R5
X(I6) = CO6*R6 + SI6*S6
Y(I6) = CO6*S6 - SI6*R6
X(I4) = CO4*T1 + SI4*T2
Y(I4) = CO4*T2 - SI4*T1
30      CONTINUE
20    CONTINUE
10  CONTINUE
```

FIG. 137b

```
            R1 = (R6 - R8)*C81
            R6 = (R6 + R8)*C81
            R2 = (S6 - S8)*C81
            S6 = (S6 + S8)*C81
            T1 = R5 - R1
            R5 = R5 + R1
            R8 = R7 - R6
            R7 = R7 + R6
            T2 = S5 - R2
            S5 = S5 + R2
            S8 = S7 - S6
            S7 = S7 + S6
            X(I2) = R5 + S7
            X(I8) = R5 - S7
            X(I6) = T1 + S8
            X(I4) = T1 - S8
            Y(I2) = S5 - R7
            Y(I8) = S5 + R7
            Y(I6) = T2 - R8
            Y(I4) = T2 + R8
1       CONTINUE
        IF (K.EQ.M) GOTO 10
        IE = N/N1 - 1
        IA1 = 1
        DO 20 J = 2, N2
            ID  = IA1 + IE
            IA1 = 1   + ID
            IA2 = IA1 + ID
            IA3 = IA2 + ID
            IA4 = IA3 + ID
            IA5 = IA4 + ID
            IA6 = IA5 + ID
            IA7 = IA6 + ID
            CO2 = WR(IA1)
            CO3 = WR(IA2)
            CO4 = WR(IA3)
            CO5 = WR(IA4)
            CO6 = WR(IA5)
            CO7 = WR(IA6)
            CO8 = WR(IA7)
            SI2 = WI(IA1)
            SI3 = WI(IA2)
            SI4 = WI(IA3)
            SI5 = WI(IA4)
            SI6 = WI(IA5)
            SI7 = WI(IA6)
            SI8 = WI(IA7)
```

FIG. 137c

```
C----------------BUTTERFLIES WITH SAME W---------------
      DO 30 I1 = J, N, N1
          I2 = I1 + N2
          I3 = I2 + N2
          I4 = I3 + N2
          I5 = I4 + N2
          I6 = I5 + N2
          I7 = I6 + N2
          I8 = I7 + N2
          R1 = X(I1) + X(I5)
          R5 = X(I1) - X(I5)
          R2 = X(I2) + X(I6)
          R6 = X(I2) - X(I6)
          R3 = X(I3) + X(I7)
          R7 = X(I3) - X(I7)
          R4 = X(I4) + X(I8)
          R8 = X(I4) - X(I8)


C-----------DIGIT REVERSE COUNTER----------
  100     J = 1
          N1 = N - 1
          DO 104 I = 1, N1
              IF (I.GE.J) GOTO 101
              R1   = X(J)
              X(J) = X(I)
              X(I) = R1
              R1   = Y(J)
              Y(J) = Y(I)
              Y(I) = R1
 101          K = N/4
 102          IF (K*3.GE.J) GOTO 103
                  J = J - K*3
                  K = K/4
                  GOTO 102
 103          J = J + K
 104      CONTINUE
          RETURN
          END
```

FIG. 138

INITIAL MISSILE SIZING TO MEET RANGE, VELOCITY, AND MANEUVERABILITY REQUIREMENTS DONE WITH CLOSE FORM SOLUTIONS

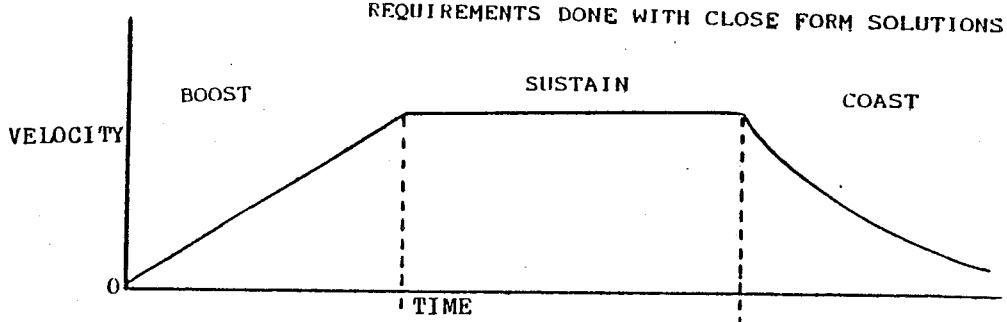

$M\dot{V} = T - \frac{1}{2}\rho V^2 S C_D$ $T >> \frac{1}{2}\rho V^2 S C_D$ $M = Mf - \dot{M}t$ $\dot{V} = \frac{T}{Mf - Mt}$ $V = \frac{T}{\dot{M}} \log \frac{\dot{M}f}{Mf - \dot{M}t}$ $Vb = g\, Isp \log \frac{Wf}{We}$ $M\dot{V} = 0$ $T = \frac{1}{2}\rho Vs^2 S C_D$ $\frac{T \cdot t}{Ws} = Isp = \frac{1}{2}\rho \frac{Vs S C_D R}{Ws}$ $Rs = \frac{2Ws\ Isp}{\rho\ Vs S C_D}$ $M\dot{V} = \frac{1}{2}\rho V^2 S C_D$ $\frac{\dot{V}}{V} = \frac{1}{2}\rho \frac{R S C_D g}{We}$ $V = Vs\, e^{-\frac{1}{2}\rho \frac{C_D S g Rc}{We}}$ $R = \frac{2We}{\rho C_D S g} \log \frac{Vs}{\dot{V}}$ $N = \frac{1}{2}\rho \frac{V^2 S C N}{W}$ $C_D$-DRAG COEFFICIENT
CN-NORMAL FORCE COEFFICIENT
Isp-SPECIFIC IMPULSE (SEC)
=TOTAL IMPULSE / PROPELLANT WEIGHT
V-VELOCITY
Vb-END OF BOOST VELOCITY
Vs-SUSTAIN VELOCITY
W-WEIGHT
M-MASS
Wf-FULL WEIGHT
Mf-FULL MASS
We-EMPTY WEIGHT
Ws-SUSTAINER PROPELLANT WEIGHT
R-RANGE
P-AIR DENSITY
S-REFERENCE AREA
T-THRUST
g-ACCELERATION DUE TO GRAVITY
N-MANEUVERABILITY
Rs-RANGE DURING SUSTAIN
Rc-RANGE DURING COAST

FIG. 139

TIME FOR MISSILE SEEKER TARGET ACQUISITION CAN BE AS LONG AS THE TERMINAL GUIDANCE TIME

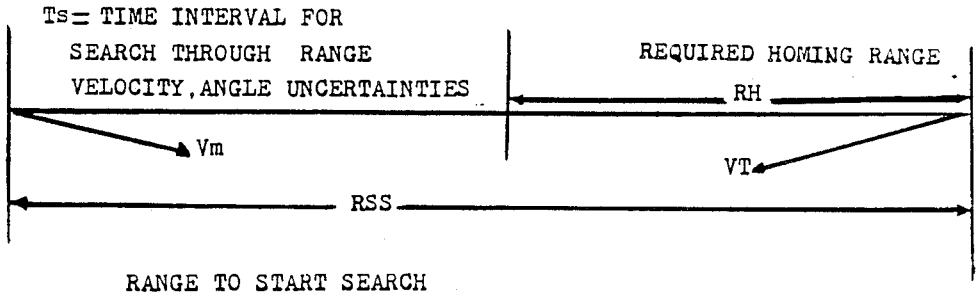

RANGE TO START SEARCH $RSS = RH + Vc\ Ts$ ($Vc$ = CLOSING VELOCITY MAGNITUDE)

RECEIVER PROCESSING BANDWIDTH, $\Delta f$ WILL BE

PROPORTIONAL TO $\frac{1}{\text{DWELL TIME}} = \frac{\text{NUMBER OF LOOKS}}{Ts}$

| TYPE SYSTEM | UV/LASER/IR | SEMI-ACTIVE RADAR | ACTIVE RADAR |
|---|---|---|---|
| SIGNAL POWER | $S \propto \frac{1}{(RH+VcTs)^2}$ | $S \propto \frac{1}{(RH+VcTs)^2}$ | $S \propto \frac{1}{(RH+VcTs)^4}$ |
| NOISE POWER | $N \propto \sqrt{\Delta f} \propto \frac{1}{\sqrt{Ts}}$ | $N \propto \Delta f \propto \frac{1}{Ts}$ | $N \propto \Delta f \propto \frac{1}{Ts}$ |
| Ts FOR MAX.S/N | $Ts = \frac{RH}{3Vc}$ | $Ts = \frac{RH}{Vc}$ | $Ts = \frac{RH}{3Vc}$ |

MAXIMIZE S/N BY FINDING Ts FOR $\frac{2\ S/N}{2\ Ts} = 0$

FOR TERMINAL GUIDANCE MOST MISSILES USE PROPORTIONAL NAVIGATION

THE BASIC PROPORTIONAL NAVIGATION EQUATION $$A_M = v\dot{\gamma}_M = \Lambda \dot{R} \dot{\sigma}$$

MISSILE MANEUVER

NAVIGATION RATIO

CLOSING VELOCITY

LINE OF SIGHT RATE

GUIDANCE RESPONSE

SEEKER FILTER $G_A(S)$ $G_S(S)$ $G_F(S)$ GUIDANCE AUTOPILOT

= VELOCITY LINE OF SIGHT RANGE

FIG. 141

DERIVATION OF $A_m/\dot{\sigma}$ TRANSFER FUNCTION

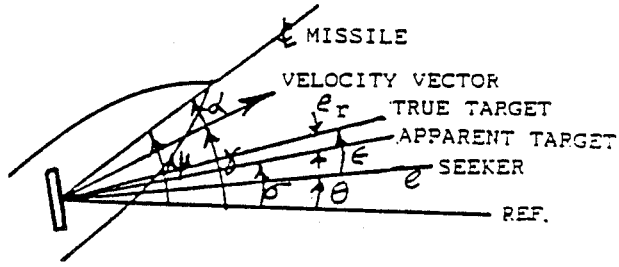

GEOMETRIC TRACK ERROR $\epsilon = \sigma - \theta$

RADOME BORESIGHT ERROR $\epsilon_r = r(\sigma - \psi)$

MEASURE TRACK ERROR $\epsilon' = \epsilon + \epsilon_r = \sigma - \theta + r(\sigma - \psi)$ ANGLE OF ATTACK $\alpha = \psi - \gamma$ AERODYNAMIC LIFT $A_M = V_M \dot{\gamma} \equiv V_M M \alpha = A V_M (\psi - \gamma); = A$ $A$ = LIFT COEFFICIENT $$\psi = \left(\frac{S}{A} + 1\right)\gamma \text{ or } \dot{\psi} = \left(\frac{S}{A} + 1\right)\frac{A_M}{V_M}$$

IDEAL TRACK LOOP $\dot{\theta} = Ks\,\epsilon' Ks(\sigma - \theta + r(\sigma - \psi)$ MEASURED LINE OF SIGHT RATE $\dot{\theta} = \dfrac{\dot{\sigma} + \dot{r}\dot{\sigma} - \dot{r}\dot{\psi}}{S/Ks + 1}$

GUIDANCE EQUATION AND AUTOPILOT $$A_M = \frac{\Lambda |\dot{R}| \dot{\theta}}{1 + 2T_A S + 2T_A{}^2 S^2 + T_A{}^3 S^3}$$

$$= \frac{|\dot{R}|((1 + r)\dot{\sigma} - r\dot{\psi})}{(1 + 2T_A S + 2T_A{}^2 S^2 + T_A{}^3 S^3)(1 + S/Ks)}$$

SUBSTITUTING FOR $\dot{\psi}$; $\dfrac{A_M}{\dot{\sigma}} =$ $$\frac{R(1 + r)}{1 + \frac{\Lambda|\dot{R}|}{V_M} r + \left(2T_A + \frac{1}{Ks} + \frac{\Lambda|\dot{R}|r}{V_M A}\right)S + \left(2T_A{}^2 + \frac{2T_A}{Ks}\right)S^2 + \left(T_A{}^3 + \frac{2T_A}{Ks}\right)S^3 + \frac{T_A{}^3}{Ks} S^4}$$

FIG. 142
THE RADOME ERROR SLOPE CAN BE THE DOMINANT FACTOR IN THE GUIDANCE RESPONSE TIME
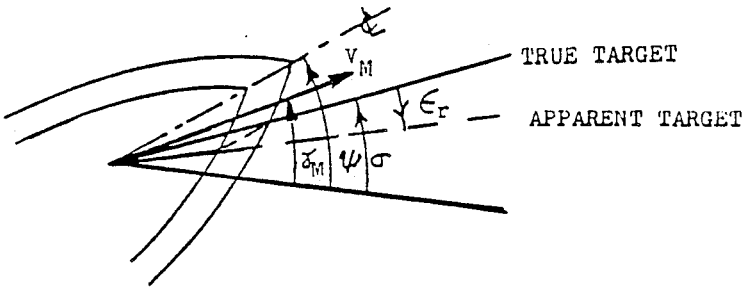
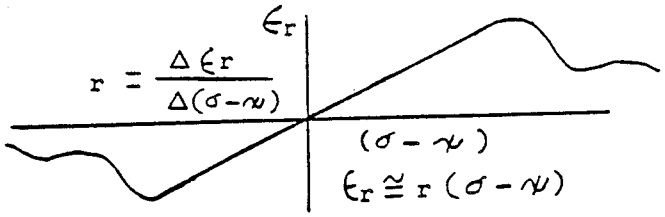
r = RADOME ERROR SLOPE
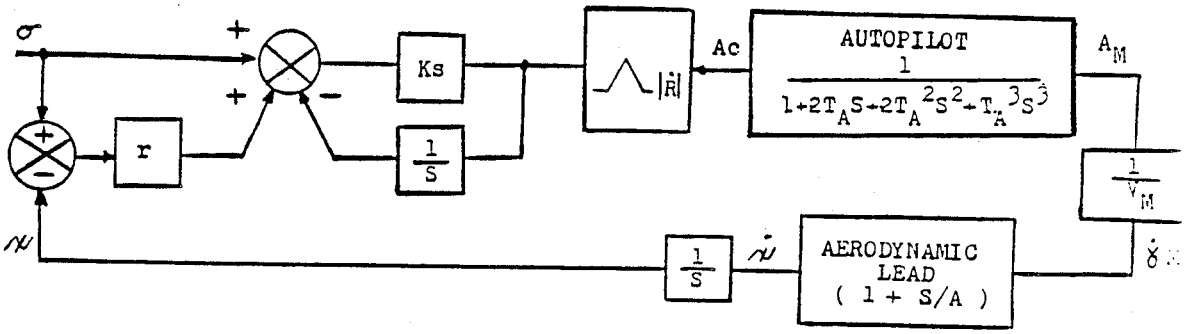
$$\frac{A_M}{\dot{\sigma}} = \frac{\Lambda|\dot{R}|(1+r)}{1+\frac{r|\dot{R}|}{V_M}r+(2T_A+\frac{1}{Ks}+\underbrace{\frac{R\,r}{V_M A}})S+(2T_A^2+\frac{2T_A}{Ks})S^2+(T_A^3+\frac{2T_A^2}{Ks})S^3+\frac{T_A^3}{Ks}S^4}$$
WITH $\frac{R}{V_M} = 6$, $r \pm 02$, $\frac{1}{A} = 10$, THIS TERM CAN BE ± 1.2 SECONDS

INTERACTIVE TRANSECTOR DEVICE COMMERCIAL AND MILITARY GRADE

BACKGROUND OF THE INVENTION

1. Field of the Invention

The scope of the invention embodies short range missile or rocket launching devices, lethal and non-lethal devices delivering gases, electric shock and projectile delivery systems with single or multiple warhead configurations. The scope of the invention further embodies short range emissive devices projecting acoustic, radiofrequency and coherent emissions at designated targets.

2. Description of the Prior Art

Bordex's patent, Ser. No. 2,634,535 teaches the use of a policeman's club, incorporating a cartridge firing mechanism and O'Brien et al patent Ser. No. 2,625,764 teaches the use of a combination flashlight, gun and Billy club element. Larsen et al Ser. No. 3,362,711 teaches the use of a night stick incorporating an electric shock means. K. Shimizu's patent Ser. No. 3,625,222 teaches the use of a device wherein needle electrodes penetrates the skin of an assailiant discharging minute voltage subdermally including a psuedo state of epilepsy. Henderson's et al patent disclosure Ser. No. 3,998,459 teaches the construction of a high voltage low current capacitance discharge means emboding a two electrode discharge spark gap forming probes which discharge when said device is motivated forward and the aforesaid probes encounter or make contact with a physical object. The patent disclosure of Yanez Patent Ser. No. 4,486,807 teaches the use of a device which simultaneously delivers an intense light capable of blinding an assailiant by administering current by discharging high voltage pulses. Yanez patent disclosure Ser. No. 4,486,807 also embodies circuitry to synchronize the delivery of said blinding light simultaneously with the aforesaid high voltage discharge to the aforesaid assailiant. The commercially available Tazer, cattle prodes or other similar such devices may also be considered references of recent prior similar or related art, which is manually operated but capable of undergoing automation. The parent patent titled Interactive Transector Device, Ser. No. 814,743 provides the basis for programming ancillary circuitry and related processes embodied within this present disclosure. The Anti-Assault Submersible Vehicular Device Ser. No. 019,064 embodies variations of probalistic mathematical constructs, methods of statistical analysis and other related parameters utilized in the present patent disclosure to specify, acquire, pursue and eventually engage designated targets. The prior art also entails portable missile launchers,* mortars, gernade launchers and SMART munitions fired from light artillery devices.

* TOW, DRAGON, RED EYE, or equivalent rockets or wire guided missiles.

SUMMARY OF THE INVENTION

The present invention relates to the construction of a portable programmable non-lethal manual multifunction device which readily provides law enforcement agents with a means wherein potentially dangerous individuals can be efficiently subdued, apprehended and appropriately detained, minimizing the possibility of the said individuals either injuring themselves or others. In the preferred embodiment the device is incorporated into a cylindrical configuration which upon the appropriate keying distends or retracts a graduated telescoping delivery means. The delivery means in effect is a multipurposed structure serving as a directional unit for dispersing reactive carrier mediated volitiles, the delivery of electric charges or the accurate projection of acoustical, chemical and or kinetic/emissive fields. A rotating or radial selector means is preferentially located in the aft section of the devices body circumferentially disposed to be operated by holding or grasping the body with one hand and rotating the switch in a radial manner with either the palm or fingers of the other hand. The specific function, its duration and subsequent intensity is governed by the particular setting the rotating selector means engages. A release button or actuator means is preferably located midway between the front of the unit's body and its aft section. The release button is ideally actuated by depressing it with either the thumb or index finger. Several fail-safe mechanisms prevent unauthorized use of the device or its accidental discharge. The device will not be actuated when placed in the position unless a keying code or key means releases the lock mechanism. The device will remain activated but inoperative when the radial selector is placed in the standby position, until the selector is rotated into an operative mode.

Target engagement of objects requires specification, acquisition and the subsequent pursuit of said target. The difficulty or extent to which targets are eventually engaged varies directly with the velocity of said targets, the quantity of targets to be neutralized, the complexity of behavior exhibited by said targets and the number of functions which must be performed by a given projectile to neutralize said targets. Difficulties arise in acquisition of hostile targets which mimic the properties of neutral non-targeted objects or individuals. Additional difficulties are manifested when certain specified targets are either obscured by elements in the ambient environment. Further difficulties arise when said targets have the capacity to immediately alter their properties prior to or immediately after the launch of the projectiles from transector unit. Target specification and acquisition are initially encoded into the volatile memory chip embodied within said projectiles by the CPU and embodied within the Transector device. The user or automated transector initially determines the type and quantity of targets engaged prior to and during dispersal of the a aforesaid projectiles. The aforementioned projectiles have the capacity to function autonomously from the Transector unit or other sources upon the execution of the initial launch sequence. The microprocessor incorporated within any given projectile is embodied within a sensory feedback network, which enables said given projectiles to home in on a variety of specified targets and make a complex sequence of course changes or maneuvers to suitably engage said targets.

Once the flight vector or glide path of a projectile coincides with those of specified targets said projectiles are locked onto said targets the target neutralization program is actuated. The target neutralization entails a service of interrelated subprograms, routines and subroutines structured to neutralize either a single target or a group of targets. The process of neutralization need not kill or destroy said targets, but may function to disable, deactivate or render said targets inert.

There are a number of scenarios wherein automated projectiles functioning autonomously from other sources are superior to conventional and/or so-called SMART munitions. The dispersal or multiple function, high velocity projectiles is essential when isolating suspected terrorist from their hostages, or negating certain structures or individuals within a group without effecting other members of the group. High velocity projectiles automated motivators to, elevate, lower or change the confirmation of aerolons or other structures to alter the glide path of said projectile to coincide with the four dimensional spatial temporal vectors of designated targets. Multiple functioned projectiles may pierce armor plated structures and destroy or disable certain specified structures or individuals to the exclusion of other similar or equivalent structures and/or individuals. Upon penetration projectile may detonate shaped explosive charged, disperse volatile gases (i.e. tranquilizers, toxins, neural inhibitors or other carrier mediated chemicals), release radiation disruptive to sensitive circuitry, or ignite various incindrary means providing thermite reaction to initiate combustion of plastics, certain metals and other structure. Hostile personel, terrorist holding hostages may have to be subjected to carrier mediated neural inhibitors, tranquilizers, or toxins; which immediately passes through clothing and/or pores of the skin entering the blood stream and effectively binding to sites located in muscle structure, neural end plates, interfer with conduction or neural impulses and/or effect metabolism of living systems.

The projectiles must in order to acquire, pursue and engage targeted objects and/or individuals to the exclusion of other similar such systems be equipted with a volatile memory, sensory feedback system and programming emboding a limited expert program. Sensory elements feedback systems, guidance control, microservosystems must all function prior to and a transitory period after engagement of targets. Certain projectiles must be nearly fully functional after impact through structures inbetween said targets and the aforesaid projectiles. Projectiles must also have the capacity to avoid engaging equivalent or similar non-designated targets from designated ones. Continueous course modifications or alterations in the glide path trajectory of said projectile is a pre-requisite for avoidance of similar or equivalent non-designated targets. White noise and other forms of interference are additionally filtered out by unique variations of Kalman filtering, probabilistic mathematics, statistical analysis and other means. Laser designation, radar, infra-red patterns and acoustical signals or other forms of target identification are applicable methods to seek and locate specified targets. Aerolons, elevators and velocity are elements regulated by microminiature motivator means. Target illumination is employed by projectiles prior to and during engagement. Sensory elements and feedback systems are preferably incorporated within the chip element or microprocessor means. Ascent, decent, elevation, pitch, roll and yaw motions and/or velocity are motivated by solenoid means controlled by impulses provided by the microprocessor unit. The aforesaid solenoid or motivator elements must have a real time operation in the microsecond range; whereas the turn around time interval for the aforementioned microprocessor is preferably within tens or hundreds of nanoseconds. The velocity of the aforesaid projectiles range from a fixed or static zero state relative to the transector device to a maximum velocity exceeding two thousand meters per second. High velocities preferably entail projectiles composed by shells containing ceramic composite materials coated by teflon and ablative surfactants.

The rapid sequential firing of high velocity multiple function projectiles are effective against designated targets at extreme range, or concealed within protective structures; whereas close range defensive and offensive systems are embodied within the Transector Device. Close range defensive and offensive systems include but are not limited to a laser flash element, acoustic emitter means, high voltage electrical generator unit, a volatile dispersal, cryogenic means and a radio-frequency emitter element. Intense concentrated acoustic emissions in short burst produce temporary disorientation, a transitory loss of hearing and localized pain without cellular damage. An intense non-injurous laser flash induces temporary blindness, if concentrated localized pain, minor cellular damage and disorientation. Intense localized radiofrequency emission induces intense localized pain and superficial or peripheral cellular damage due to subdermal thermal coagulation. Subjecting designated targeted individuals to high voltage induces intense localized pain, transitory convulations, apnea and temporarily induces atrial fibrillation. The effective range of the electric are emitted from the barrel of the Transector Device is limited to not more than ten centimeters from the terminating segment of said barrel of the device. The automated release of high pressure high velocity, carrier mediated volatiles from the sintered portion of the barrel effectively disables or neutralizes hostile individuals from a range of zero one hundred meters with an optimum pin point dispersal range of between ten to twenty-five meters. Carrier mediated tranqualizers, neural inhibitors, toxins or other volatile chemicals rapidly penetrate protective clothing, glass, metals, concrete and other protective structures. The aforesaid carrier mediated transported substances immediately penetrate the dermal barrier and are readily absorbed into the bloodstream of designated individuals whereby binding occurs at a molecular level to neural sites, muscular structures, cellular metabolic organels and other organic mechanisms embodied within said targeted individuals.

Physiological, biochemical and electrophysiological processes of designated individuals are continuously monitored by the Transector's CPU in order to avoid exceeding the lethal physiological limits of said designated targets. In regards to hand held anti-personel devices presently in use or known to be in existance, none of the aforesaid devices are known to embody the variety of functions and interactive expert programs necessary to control the entire scenarios of circumstances ranging from a single to multiple assailants.

BRIEF DESCRIPTION OF THE DRAWINGS

FIGS. 1, 2, 3, 4, 5, and 6 1E are pictorial descriptions disclosing the front, aft and angular perspective of the transector device including the barrel assembly of the aforesaid device;

FIG. 9 is a pictorial angular perspective of the transector describing in part some of the loading features for the aforesaid device;

FIGS. 10, 11 are a plan view and side elevations of a magazine or cassette containing cartridges which are side loaded into the aforesaid device;

FIGS. 29 through 48 are perspective views of the loading assemblage, rotating cylinder and selector means utilized to specify the types, quantity and range of projectiles fired from the transector device;

FIGS. 80*a*, 80*b* are cross-sections of a single projectile dispersed from the aforementioned transector device;

FIGS. 91 to 92*g* are detailed cross-sectioned views of warhead types embodied either within the warhead assembles of projectiles emboding multiple warheads or projectiles emboding a single warhead configuration;

FIGS. 96 to 96*l* are pictorial representations of two types of exploding projectiles undergoing detonation;

FIGS. 97 to 97*e* discloses in detail the internal and external structural disposition of an automated SMART decoy projectile;

FIGS. 102 to 102*b* is a concise detailed perspective of a single type of miniature missile launched from said military transector revealing the external and internal structures embodied within said missile;

FIGS. 111, 111*a*, and 111*b* are a series of concise diagrams and mathematical expressions tranducing electrical, mechanical and fluid dynamics into common parameters for the aforesaid transectors CPU, when assessing living targets in close proximity to said transector device;

FIGS. 113, 114 are modified block diagrams illustrating modified models of Boyse and Warn and Central Server Model of multiprogramming for separate and distinct CPU's and/or microprocessor elements embodied within projectiles or the CPU of said transector device;

FIGS. 115*a*, 115*b* entail concise well known programs for calculating the statistics for preemptive, non-preemptive and extended queueing of information processing and logic means embodied within said transector device;

FIG. 115*c*, 115*d* entail block diagrams disclosing the basic design features embodied within interactive programming of said transector device;

FIGS. 117, 118 illustrates the formation of a hypothesis tree and corresponding data matrix;

FIGS. 123, 124 illustrates the effects of both pruning and combination of hypotheses and the clustering of said hypotheses;

FIG. 128 denotes a concise program illustrating one type of syntex, language and structure of the type of programming format disclosed by FIGS. 127 through 127*d*, inclusive;

FIG. 129 describes concise mathematical comparisons of continuous-time and discrete-time transforms implementing programs embodied within CPU and/or microprocessor elements of the transector device and ancillary systems associated with information processing;

FIGS. 130, 130*a* describes in detail the autocorrelation function for continuous signals emitted or otherwise acquired from designated targets;

FIG. 131 describes a well understood abbreviated program and mathematical formulas embodied within said program for calculating standard deviation;

FIG. 132 describes a well known program by which data accumulated during the acquisition process for designated targets can be identified upon reduction to be placed in a second-order curve-fit;

FIG. 136 entails a concise digitized description of a single three dimensional time vector occupied by a single designated target within an arbitrary real time frame and ten microseconds;

FIGS. 137 through 137*c* describes a well known modification of a cooley-Tukey Radix-8 DIF FFT program which exemplifies in part and those types of programs used to implement data acquisition programs embodied with the CPU and/or microprocessor elements of the transector device and ancillary systems.

FIGS. 138 through 142 consist of a series of well defined diagrams and equations describing parameters of missile tracking and engagement.

DETAILED DESCRIPTION OF THE PREFERRED EMBODIMENT

Figure 7:
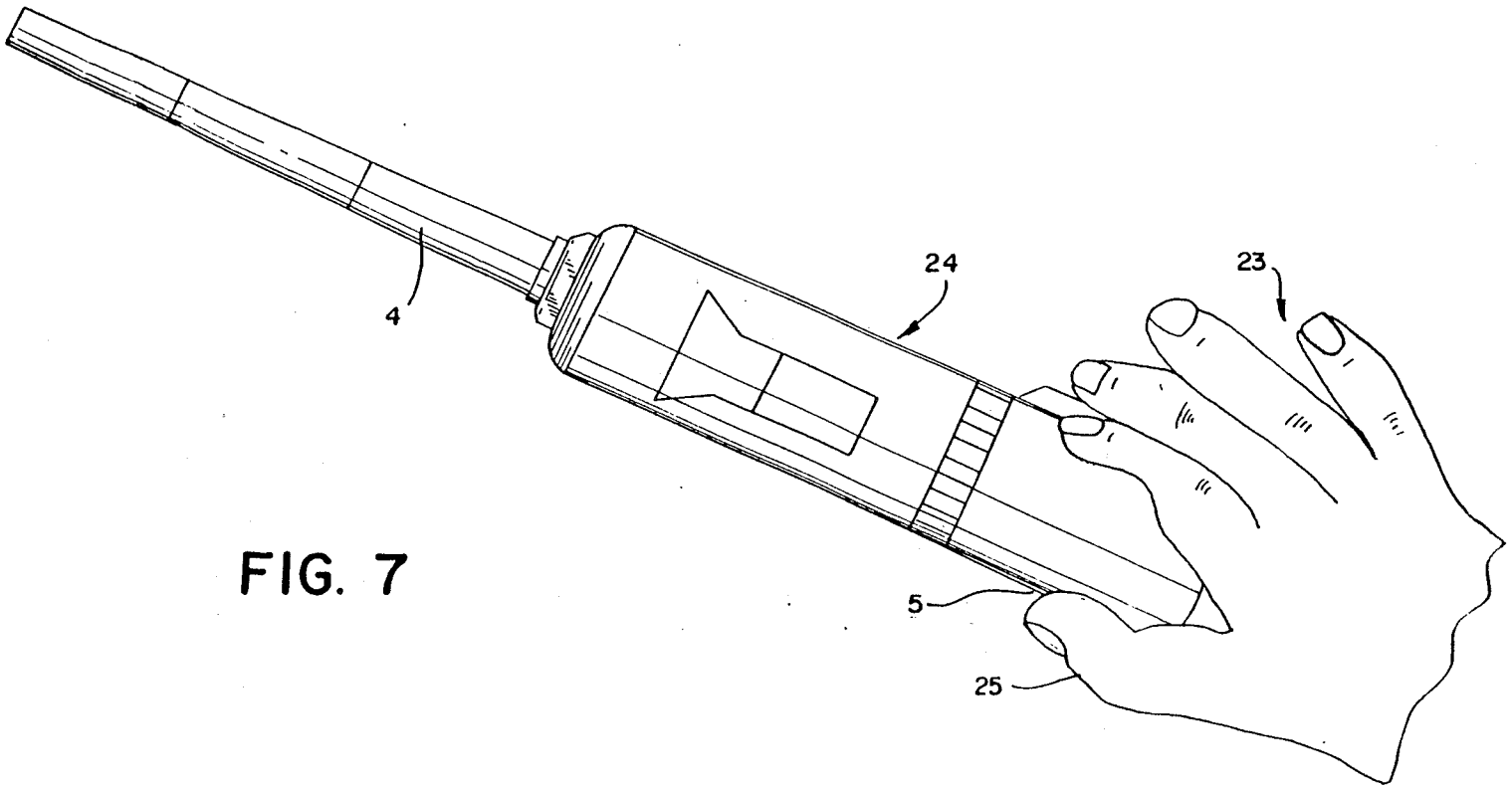
FIG. 7 is a pictorial description disclosing an angular perspective view of said transector device held by the user and positioned for firing.

FIGS. 1, 2 and 6 are pictorial representations of three perspective views of the transector device's exterior illustrating the front portion, aft section and side elevation of the aforesaid device. Numerals 1, 2, and 3 of said figures are assigned to three separate perspective views of the device's aft section, a side elevation defining a portion of the unit and a pictorial view of the front section. Numbers 4, 5, and 6 describe the telescopic barrel means, the firing mechanism and a rotatable selector means circumferentially disposed around the body of the device and utilized to program the numerous functions embodied with the transector unit. The laser emissive channel, number 7, is situated above barrel means 4; whereas the piezoelectric acoustical generator unit described by element 8 is disposed directly below the said barrel means, as indicated in FIG. 1. FIGS. 3, 4 and 5 are disclose two side elevations and a front view of the barrel mechanism embodied within said device which consists of a number of interlocking self sealing sections, not shown, and may either be extended or retracted, as described numeric values 9,9*a* respectively. The entire transector unit is hermetically sealed, having the capability to function in a submerged state being encased in water proof materials well known by those skilled in the art. Located on the circular face of the aft section, numeral 3 is a series of indicator diodes, a alpha numeric display and a single element key pad means. The single element pad defined by element 10 consists of twenty four separate and distinct multifunctioned keys and two single function key elements. The number of key elements varies with the number of programmable functions. The key pad means serves as a code specific locking or unlocking mechanism to either actuate or deactivate the transector device. The key pad, number 10, mechanism may at the discretion of the user act as a redundant feature programming the type of projectile fired, the number of projectiles fired, their range and dispersal pattern or the type, number and properties of the emission generated by the transector unit such as, the intensity, frequency and duration of one or more emissive sources embodied within the operative framework of the said device. Element 11 designates an LCD/LED alphanumeric display means, wherein keyed, programmed or automated functions are displayed to the user. A short term memory imprinted on a microchip, not shown, can be utilized to recall what had been previously displayed on the LCD/LED unit providing a record of events. Functions and properties of the said functions therein or qualitatively presented to the user acoustically by a piezoelectric wafer means is described by number 12, or visually in an analog manner through the sequential actuation of diode means, defined by elements 16 through 21, respectively. Manually programmed functions, target designation or automated operations can be conveyed either by a series of tones or verbal announcements through the piezoelectric means when deployed conventionally with a series of microchips encoded with tones or imprinted with digitized electronic equivalents of voice patterns. Diodes 16*a*, 17*a* and 18*a* are assigned different colors and pulsation rates in order to describe the laser designation, the automated mode or manual override processes. Diode elements 16 through 21 denote the type of function elicited, the strength or intensity of a generated signal, the frequency of a signal and its duration. The function type is indicated by a flashing of a given colored diode initially which is then preceded by the sequential light of diodes 16 through 21, which are lighted in a linear fashion to disclose the intensity of a given function for which there are six arbitrary values. The frequency of the function is set by the pulsation rate of the diode representing the given function and the duration or time in which the specific function is to be administered by the length of time the function diode remains lit. The colors of the diode are red, orange, yellow, green, blue and white. The red emitting diode disposes the lowest intensity level and each other progressive color emitted, orange, yellow signifies a progressively higher intensity, until the maximum value is attained when the white light emitting diode is actuated. As previously noted, each of the linear diodes numbered 16 through 21 are initially lighted to disclose to the user a specific function. The order or color of the diodes actuated initially are arbitrary and are illustrated by the following arrangement, red signifies the use of volitiles, orange represents the deployment of projectiles, yellow indicates the use of acoustical transmissions, green indicates the deployment of thermoconvective emissions, blue denotes the actuation of electric shock elements and white indicates the implementation of an intense non-lethal laser emission. Numeral 22 defines the piezoelectric means referred to previously, located aft of the device.

The transector device adapts to a cylindrical configuration which is considered to be the optimium design for purposes of manipulation by the user, but may be constructed in other numerous different sizes and shapes depending upon the units intended use. Here the device is depicted in the form of a hand held cylinder with a manual trigger means, that is actuated by pressing the button like projection, numeral 5, with either the thumb, index finger or palm. A rotating selector means numeral 6 or a key pad means can manually set the type, number, intensity, frequency and duration of functions administered by the said device; either through the user rotating the selector means using their fingers or palm or by pressing the keys manually until the desired functions are executed by the device. FIG. 7 is a angular perspective view of the transector device held by the user and positioned for firing. Here the user's hand, number 23, is placed over the transector device, number 24, with the user's thumb, number 25, triggering the firing mechanism, number 5. Numerals 13, 14, and 15 disclose the portion where a power module is inserted, and enclosed charging port/power jack adapter means and a heat exhaust port.

Figure 8:
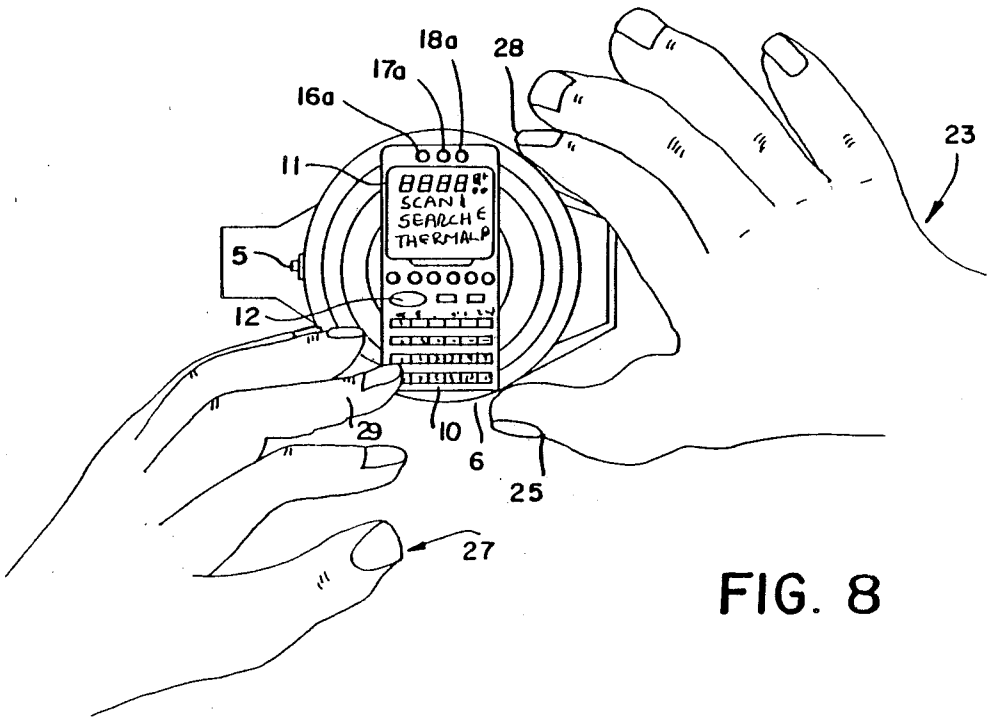
FIG. 8 is a pictorial description disclosing the aft control mechanism being programmed by the user.

FIG. 8 is a pictorial representation of the transector device being set by the user. The transector means, number 24, is held by hand 27, wherein selector means, number 6, is rotated into position by the thumb, numeral 25, and index finger, numeral 28 of hand 23. The device can be similarly set or programmed for one or more function by the keying of one or more separate key elements of pad 10, by anyone of the users fingers, or a stylus. Here the third finger of hand 27, designated by numeral 29 engages a single button element of the said pad, described previously by numeral 10.

Figure 11B:
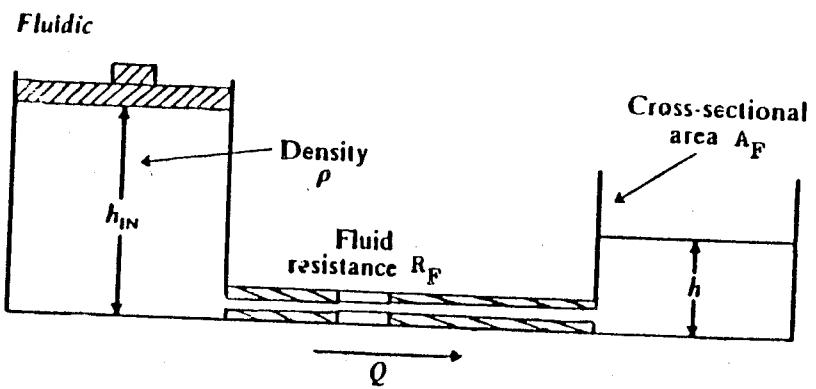
Figure 11A:
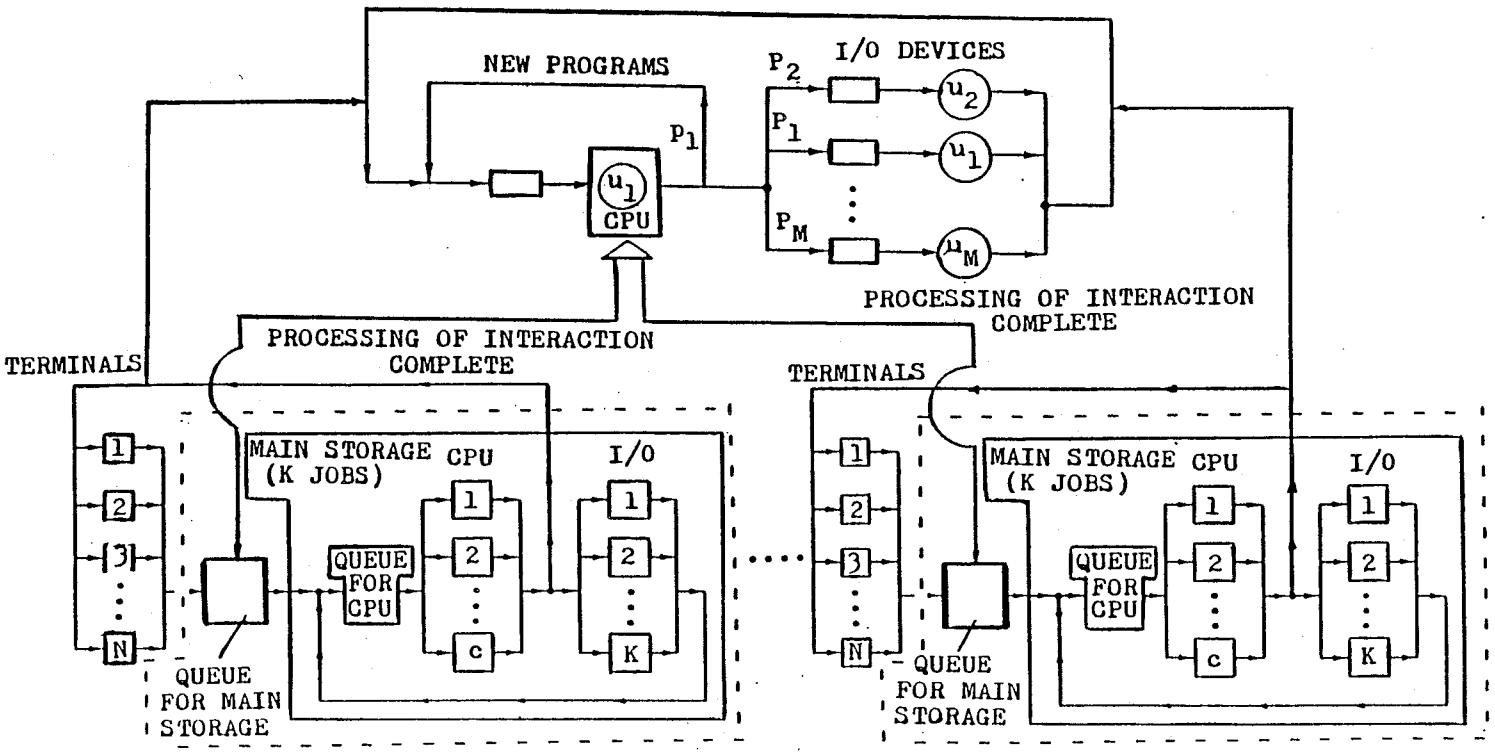
Figure 11D:
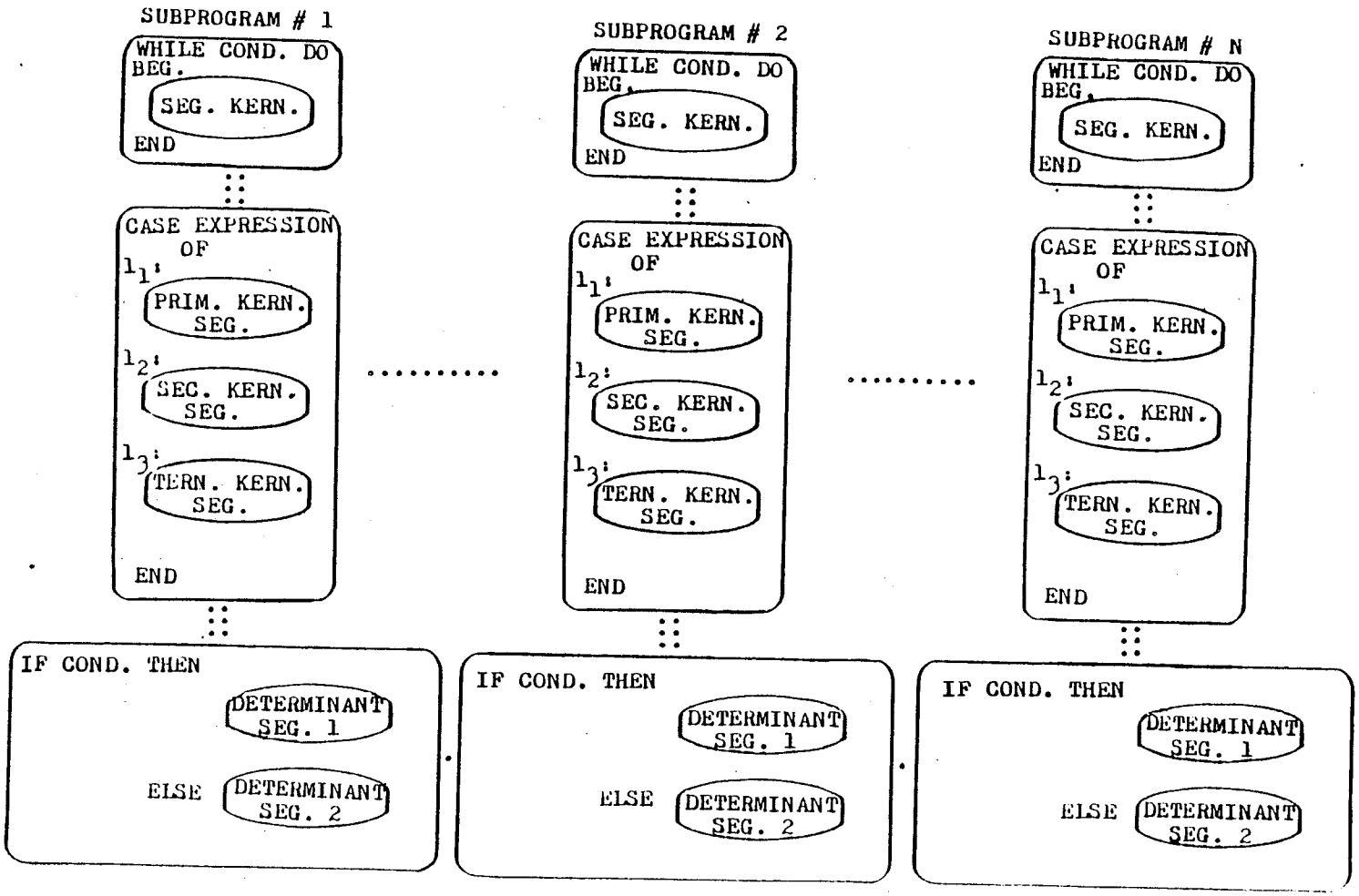

FIGS. 9, 10 and 11 are angular perspectives of the transector device which is presented in an illustrative manner to define the loading features for the projectile and volitile cassette means. Numerals 30*a*, 30*b* and 30*c* of FIG. 1*c* designates the region wherein projectiles cartridges are side loaded into a chamber of a revolving cylinder, which is then inserted into a chamber and the auto-magazine disengaged ready to lock into position by means 30*d*. Each magazine contains eighteen or more projectile cartridges, which are motivated into position by conventional spring action, functioning in a fashion consistant with the operation of conventional automatic or semi-automatic weapons. The said magazine, number 30, provides an additional means wherein projectile cartridges are replenished in either a single mode operation or rapid sequence firing mode. Number 30 describes a loading panel wherein a magazine or cassette of cylindrical cartridges containing volatiles and penetrator chemical substances, not shown, are side loaded into the transector device. Numerals 31, 32, 33 and 34 designate the radial locking means for unit 6, the power module means, heat exchanger elements and aspiration units delivering an electrical conducting spray to the aforementioned barrel.

Figure 12:
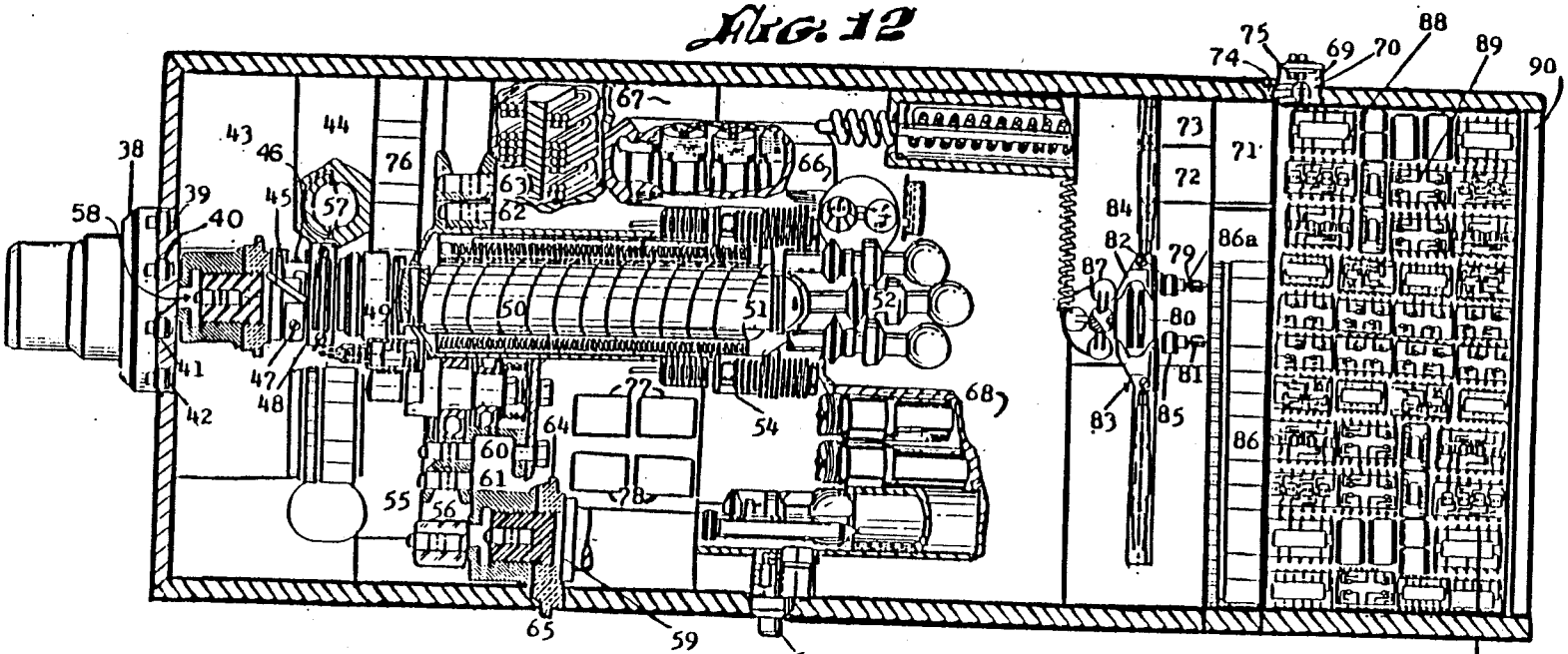
FIGS. 12 and 14 entails detailed sectioned views of the transector device revealing in part the internal disposition of operative systems.
Figure 13:
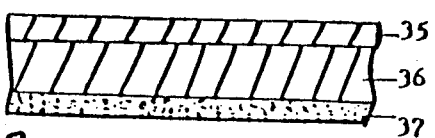
FIG. 13 is a section of the outer casing of the transector device.
Figure 14:
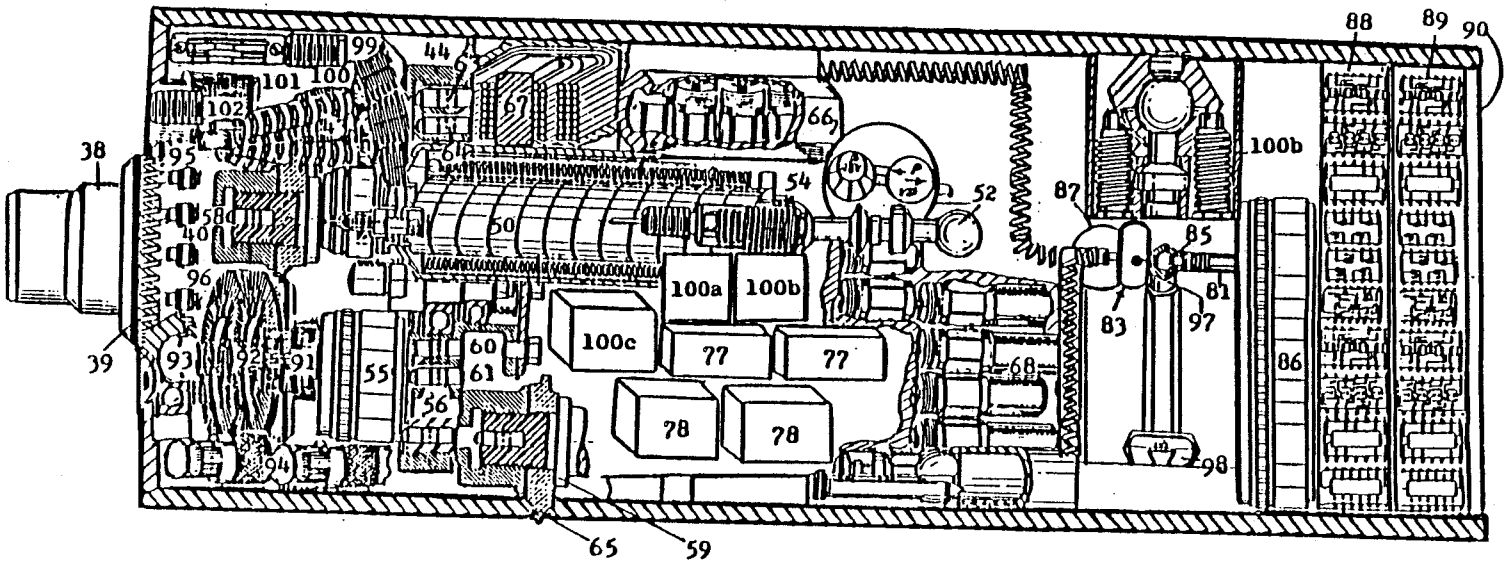

FIGS. 12 through 14 entail partially sectioned perspectives of the transector device revealing in part the internal disposition and/or compartmentalization of operative systems embodied within the said device.

FIG. 12 is a partial sectioned topographical view disclosing the internal configurational units encased in the upper most portion of the transector means. FIG. 13 discloses in part a cross-section of the casing for said device, as indicated by elements 35 36 and 37 said figure. Numerals 35 to 37 represents a case consisting of precision machined structural material which forms the inner hull preferably constructed from an alloy of chromium, titanium carbide stainless steel, a middle layer of an insulatory material preferable formed from a epoxylated composite material containing elastically bonded annealed layers, silicon nitride, and an outer layer of impact resistant water proof polyethylene, eurthane or some other suitable material. The transector device is hermetically sealed by a series of soft self sealing gasket means, not shown, which line, interlocks or compartments where cartridges, cassettes, or magazines are inserted or side loaded and cover or coat entire surface areas of electronic circuits, voltage generating means and other electronic structures disposed towards short circuit in the presence of water or other aqueous conducting mediums. The projecting barrel means, consisting of graduated insertable segments or tubular structures, number 38, is retracted. Numeric values 39, 40, 41 and 42 are assigned to the tubular coupling channel which is excluded from the central bore and circumferentially disposed around the barrel, two of four conducting channels acting as conduit means 40, 41, to transfer volitile complexes* from the mixing chamber, number 86, to the coupling means 39 and solenoid regulator unit 42, which governs the flow of volitiles from element 40, 41 into unit 39. Numerals 43, 44 designates portions of radiofrequency generator means providing ultra-high frequency voltage to the peripheral conducting portion of the segmented tubular structure elements, collectively assigned the value of barrel means 38. Numerals 45, 46, and 47 collectively form the folded optics, complex 48 consisting of three equivalent selectively emissive prismatic beam splitter means, respectively. Elements 49, 50, 51 and 52 describe, semi-emissive partially reflective mirror, a flash coil, a pulse ruby or plasma container means and gasifier means which automatically recharges expended plasma when needed to initiate lasing. Elements 49 through 52 form the resonant cavity, whereas radiofrequency exciters denoted by units 53, 54 provide the necessary excitation to increase the duration and power of the laser emission. Numeric values 55, 56 and 57 define a rotating chamber means in which projectile cartridges are selected from an automated selector means, which rotates the chamber means into position and an automated injector unit which loads the specified projectile cartridges into a separate firing chamber. The firing chamber, number 58 is a single explosive resistant cylindrical structure wherein each projectile means is dispersed. The operation and structure of the projectile system will be discussed in detail later on in the specifications. An external side loading chamber, number 59, allows the user to manually replace expended projectile cartridges into their respective orifices located in rotating means 55. Numeric values 60 through 63 define in part four of ten orifices or slots into which cartridges are placed into the said rotating means. Male prongs 64, 65 insert into their respective female slots of the magazine means, not shown, which locks into position, when the said magazine is inserted into position. Elements 66, 67 denotes a capacitor bank and transformer means which is utilized to generate high voltages. Numeral 68 is collectively assigned to a battery module means optimally consisting of a number of low voltage high amperage batteries connected in a series of preferably molten lithium types. The battery module unit, number 68, is rechargable from an automated jack means, number 69, which has incorporated within its structure a blocking diode, sensory device, spring loaded sealant means and deactivator element disclosed by elements 70 through 73. The blocking diode 70 prevents leakage of voltage or discharge. The sensor device, number 71 actuates the jack receptacle means, number 69. The spring loaded sealant means consists of a simple spring loaded plunger, elements 74, 75 which effectively seal off the said jack means, 69, from moisture, or pressurized water until an ancillary power plug, not shown, in inserted into means 69. Units 76, 77 and 78 are ascribed to circuitry and switching elements associated with the laser target designation means. Elements 79, 81 and 82 of autoselector means 83 consist of two equivalent solenoid operated means utilized to engage reservoirs of volatiles and meditators located in cylindrical cartridges contained within cassette means 86, and a mixing chamber means 87, wherein the contents obtained from the cylindrical cartridges are combined within numeral 80 exiting from conduits 84, 85. The aforementioned cassette means, number 86, inserts into channel 86*a* and remains static, until removed from the said channel when the contents contained within the cylindrical cartridges is expended. The autoselector means 83 is automated to translate up and down, vertically and from side to side horizontally, to simultaneously engage or disengage cartridge pairs. A detailed description of the autoselectors structure and operation will be provided in FIG. 10 of the specifications. Numerals 88, 89 are assigned to two equivalent microcomputer means utilized to control, sequence and program functions of the transector device. The circuitry of each microcomputer unit is etched onto two equivalent insertable cards. One of the microcomputer means serves to operate the transector device; whereas the second microcomputer means functions as a back up system in the event the first microcomputer suffers a systems failure. Element 90 of FIG. 12 is assigned to the entire panel means aft of the transector device, whereas element 90*a* is assigned to the manual user based electronic circuitry means.

* Carrier mediated volitiles consist of concentrated liquified volatile gases formed under extreme pressure and coupled to penetrators such as, DMSO and chemical enhancers or actuator means.

FIG. 14 discloses a partially sectioned side elevation of the transector device. Numeric values 35 through 90 are equivalent to those numbers assigned to operative elements in the preceding FIG. 12. Number 91 is collectively assigned to the acoustical generator means which consists of a piezoelectric resonator, number 92, a parabolic focusing dish, element 93 is a complex of exciters and ancillary element, number 94. Three of four conducting channel elements 40, 95 and 96 are illustrated in FIG. 14 delivering substances from unit 87 to coupler means 39. Additional motivator means, 97, 98 assist the vertical and horizontal translation of means 83. The laser designator system is defined by numeral 100. Elements 99, 101 and 102 describe an array of fiber optics elements utilized for transmitting and receiving laser emissions, an array of sensors and a tunable laser source generator, respectively. Modular units 100*a*, 100*b*, and 100*c* denote ancillary electronics means, secondary backup systems and additional energizer elements.

Figures 15, 16, 17, 18, 19, 20:
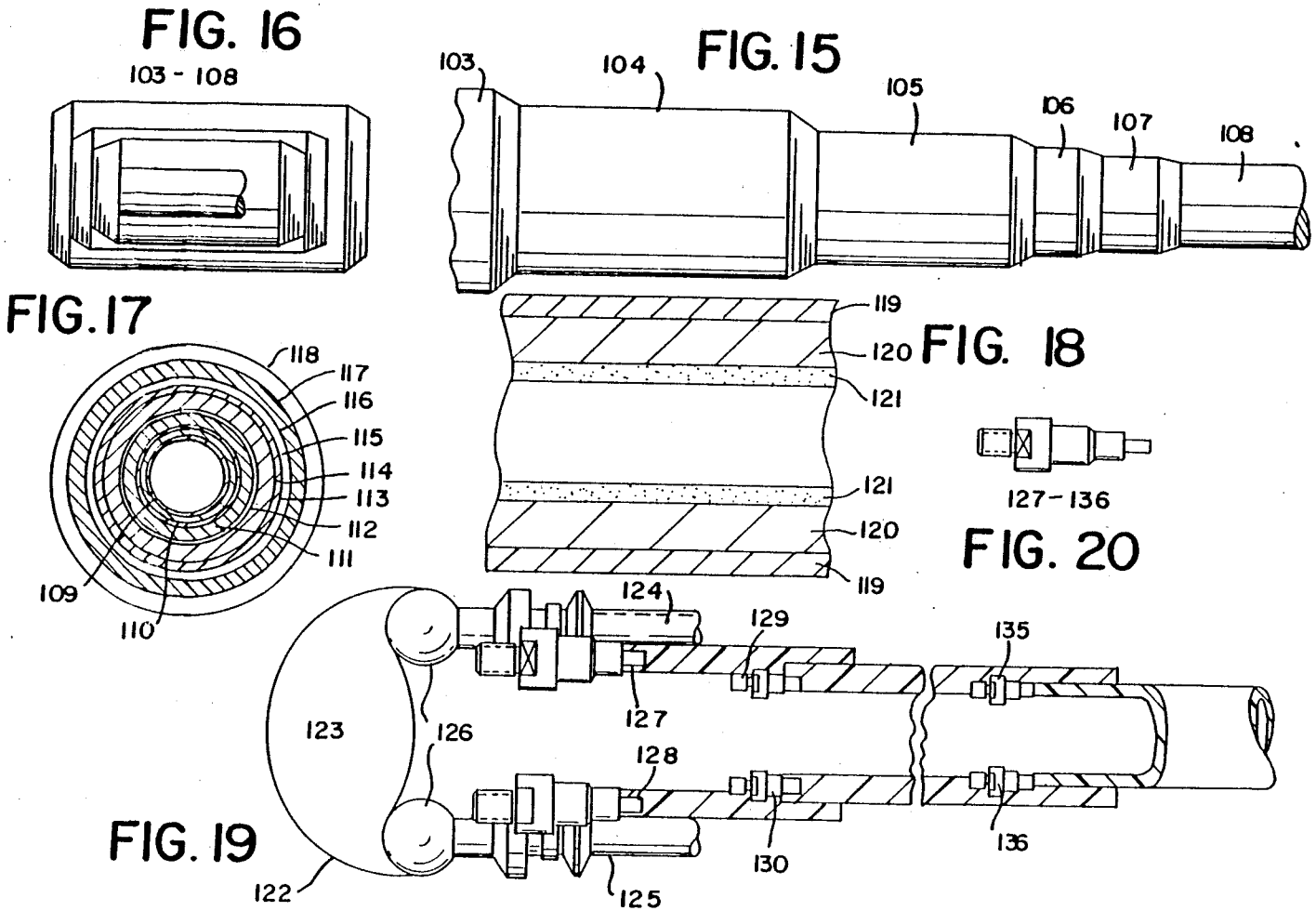
FIG. 15 is a side elevation of the segmented barrel structure of said device extended.
FIG. 16 is a side elevation of the aforesaid barrel means in the retracted position.
FIG. 17 is a partially sectioned perspective view of the front portion of the aforesaid barrel structure.
FIG. 18 is a partially sectioned portion of the tubular segment structure of said barrel means disclosing the trilayer configuration of said segment.
FIG. 19 is a detailed cross-sectioned view of the aforesaid barrel structure describing in part motivator means and ancillary elements.
FIG. 20 is a side elevation of a single motivator element.

FIG. 15 describes detailed sectioned views of the retractable barrel means embodied within the transector device. The barrel of the transector unit is designed to execute four operative functions. The first operative function of the barrel structure is to conduct high frequency variable electric impulses down the tubular shaft of the said barrel. The conducted impulses have the capacity to either shock, stun, or induce localized paralysis in a specified assailant. A second operative function is to conduct and deliver ultra high frequency and radiofrequency impulses to an assailant, locally inducing small clusters of intense heat by means of thermoconvective agitation into specified surface regions of the said assailant temporarily causing intense pain. The heat generated within localized regions of the assailant is calculated to be noninjurious to the human organism. The third operative function of the barrel means is to project carrier mediated volatiles which are dispersed peripherally from the sintered portion of the said barrel structure. The fourth operative function of the barrel means is to provide an effective delivery means for a variety of projectiles when large numbers of assailants must be neutralized and subdued.

FIGS. 15, 16 disclose six side elevations describing six separate and distinct interlocking segments of the barrel structure for said transector device. FIG. 15 discloses said barrel extended; whereas the said barrel is retracted in FIG. 16. Tubular elements 103 through 108 designate six composite structures which are tapered or progressively graduated interlocking segments which collectively form the barrel means, number 4. The optimum length of the barrel unit is recommended to vary between one and one and a half meters and the thickness of each segment which ranges from 10.0 to 5.0 millimeters. Larger single element barrels were originally deployed, but were found to lack the utility and compactability of an equivalent barrel means which have a multiple segment configuration.

FIG. 17 discloses a partially sectioned view of the front portion of said barrel, as described by elements 109 through 118. Circular self sealing gaskets are circumferentially disposed around each tubular insert, 103 through 108, as indicated by numbers 109 through 118 with the exception of the terminal end of the barrel means 4, in order to prevent premature seepage of volatiles. Each sealing gasket structure is self lubricating and made of a suitable commercially available material which is resistant to corrosives, or cracking produced by fatigue and or wide variances in temperature.

FIG. 18 is a cross-section of a segment. Numerals 119, 120 and 121 of an enlarged section, number 120, obtained from one of the six equivalent structures, numbers 109 to 116, gives a detailed description of the trilayer configuration of each said tubular segment. Numeral 119 consists of a hardened but resilient alloy of chromium, titanium stainless steel. Numeral 120 is indicative of a middle layer of sintered material rendered porous to the volatiles by etching and/or atomic bombardment processes, which are well known by those skilled in the art. Numeral 121 consists of a fracture and heat resistant non-conducting composite material preferably formed from a silicon nitride epoxylated ceramic material. Layers 119, 120 and 121 are bonded to one another in a conventional manner. FIG. 19 is a sectioned view of the barrel and ancillary means. Mechanism 122 is a serviceable reservoir means which is filled with a conducting non-viscous lubricant, number 123, which coats the segments when they are projected from a retracted state. The circular flow 124, 125 channels are provided with a circular release mechanism 126, which aspirates the contents of the reservoir onto the outer surface of the tubular structure means, as described previously by numbers 103 through 108. The projection of the aforementioned tubular barrel means defined by segments 103 to 108 is provided by either one of three mechanisms. The first mechanism initiating projection of the segments is provided by the initial pressure build up caused as the mixture of volitiles expands through the sintered material. The second mechanism for projection of the barrel means consists of the trigger release of a tension spring means which provides the necessary force to kick the segments of the barrel forward. A third release mechanism providing forward motion of the barrel structure as disclosed by FIG. 20 consists of the programmed actuation of solenoid means 127 to 136 by sliding each segment forward and ahead of the preceding segment. The tubular array has tubular interlocking means disclosed by elements 137 through 146, which under prescribed conditions locks each of the said barrel segments into position until disengaged by the user. The barrel means can also be extended or retracted manually by the user, under prescribed conditions.* Numeral 147 is assigned to the headon barrel means, 21.

* The barrel is preferably maintained in the uncharged condition unless specified otherwise.

Figure 21:
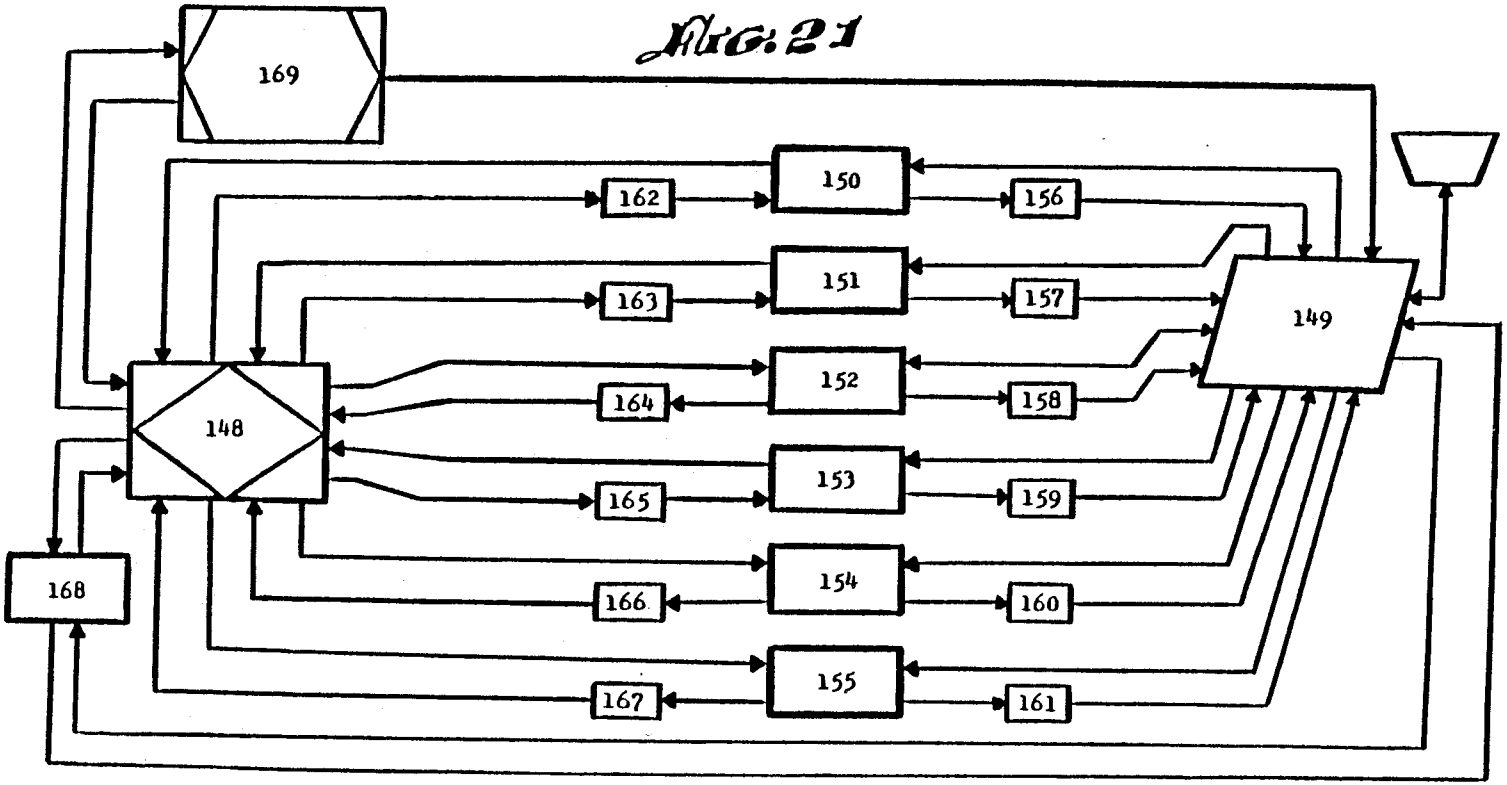
FIGS. 21 through 25 are simplified block diagrams with the number and types of operative systems embodied within the transector device and the way in which each said system interacts with every other system.

FIG. 21 is a simplified block diagram with the number and types of operative systems embodied within the transector device and the way in which each said system interacts with everyother system. Schematically illustrated the transector device has two control centers the microcomputer means as defined by number 148 and the user manually keying means, number 149, which consists of the keyboard pad and rotating selector switch means. Numerals 150, 151 and 152 designates the high voltage delivery means, the radiofrequency generator means and acoustical generator unit. Numbers 153, 154 and 155 are assigned to the laser emission means, the volitile dispersal system and projectile delivery means. Each operative system elements 150 through 155 have embodied within its operative framework a sensor based feedback loop which is represented by numeric values 156 through 167, respectively. Elements 156 through 161 are equivalent to elements 162 through 167 with the exception that the former sensory feedback loops feed into the microcomputer element 148; whereas the later sensory feedback loop means exclusively serves the users based secondary electronics level, as defined by unit 149. The laser target designating system provided identification, ranging and tracking of targets is indicated by unit 168. Element 168 provides digitized computable data to path the microcomputer, 148, and the users electronic subsystem, 149, the array of diodes and LCD/LED means incorporated within the panel of the transector device. The vital signs of one or more given assailants are measured by an array of sensory contained within a feedback loop, element 169, and the said values are sent to the microcomputer, 148, for comparisons and analysis and to the users based electronic system, 149, for display. The microcomputer 148 will automatically and continuously reset the operative parameters ranging from the voltage and/or current delivered to an individual, or the concentration of volitiles dispersed to one or more individuals over a specified interval of time so that the maximum tolerance levels of the targeted individuals are not exceeded, preventing excessive injury or death to the said targeted individuals.

Figure 22:
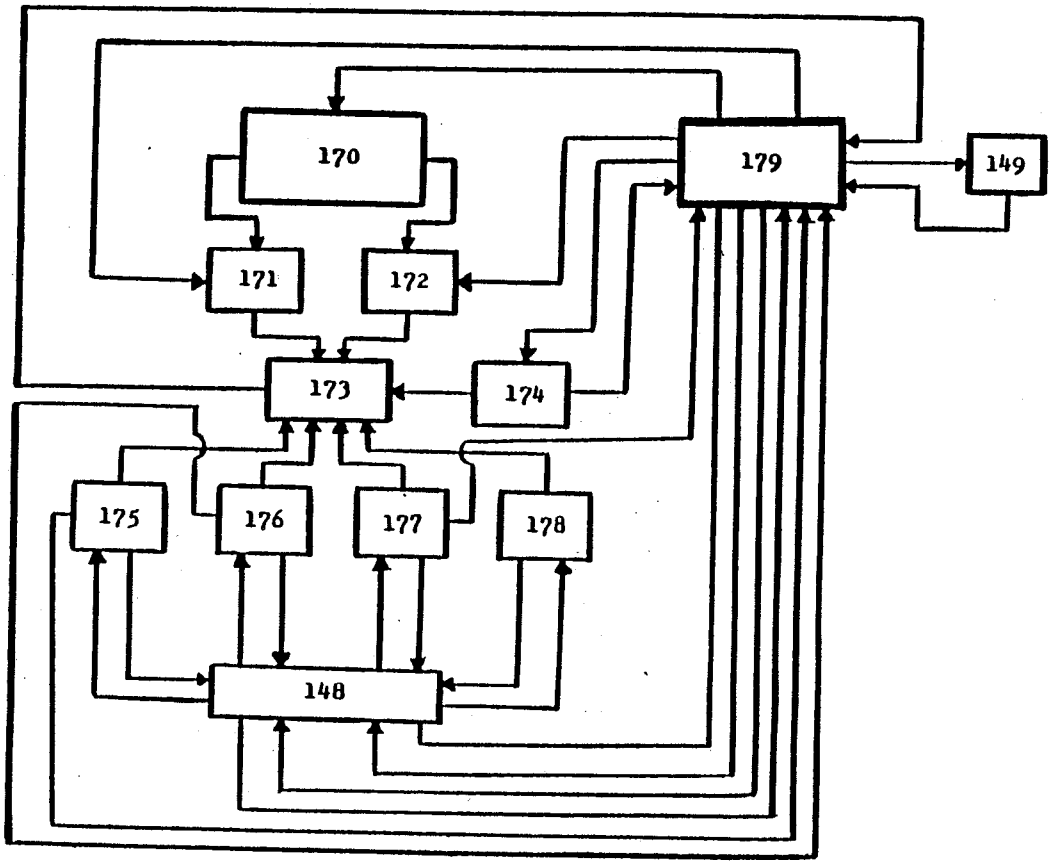

FIG. 22 schematically describes in a more detailed block diagram the operation of the electrical radiofrequency generating system. The power, pulse characteristics, frequency and duration of the electrical discharge and or radiofrequency emissions are set automatically by the microcomputer, number 148 or bypassed by the user, 149. The voltage and ampers are regulated by generator means 170, which adjusts the current delivered to radiofrequency generator 171, and the high frequency voltage generator means 172, respectively. The radiofrequency emissions and/or the high voltage signals are conducted to the barrel means 173, in which they are propagated from in order to engage the targeted individual. Additionally provided is a mechanism, number 174, which delivers an aerosol spray circumferentially along the length of barrel 173, which it coats with a self lubricating electrical conducting medium. An array of sensory apparatuses consisting of laser diodes, piezoelectric means, electronic capacitance system and fiber optics coupled electronic devices which are disclosed by numeric values 175, 176, 177 and 178, respectively; monitors vital signs of the targeted individual. User based data in the form of priority signals are conveyed from means 148 to an electronic substation means 179; wherein the appropriate electronic signals are conveyed to units 170, 171 and 172, respectively.

Figure 23:
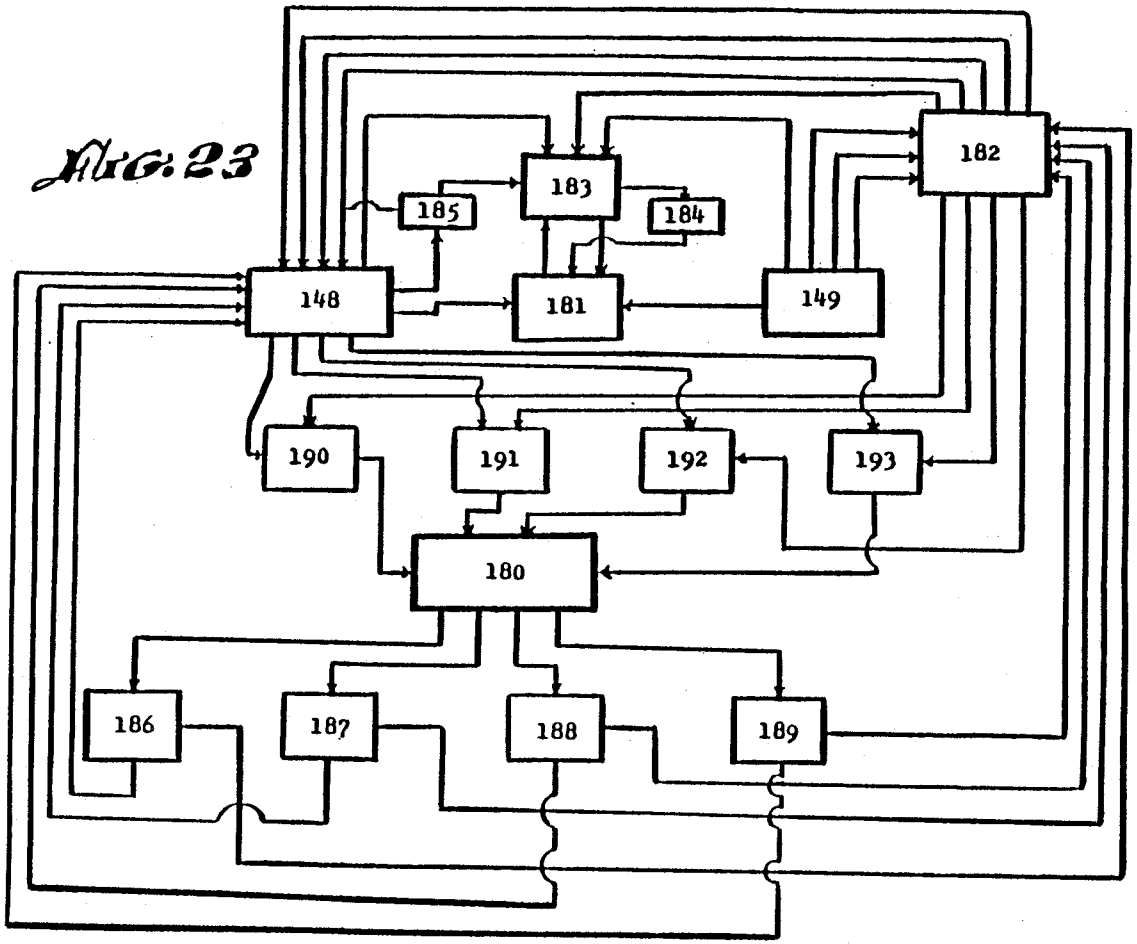

FIG. 23 is a more detailed block diagram indicating schematically the operative subsystems of the laser emission source. The intensity, frequency and duration of the laser pulse is regulated from two command sources, a microcomputer means number 148 and a user keying means defined by number 149. Laser means, 180, may be either a synthetic ruby crystal type, a plasma tube type or a chemical laser, or some other suitable laser beam generator, or some other combination of laser means. The laser source is non-lethal, generating a temporary blinding light, momentarily immobilizing one or more targeted individuals. The laser is powered by energy source 181 and is controlled manually through electronic subsystem 182 and pulse generating means 183, which engages the governor or controller means 184 of said power source 181. The power source can be automatically regulated by electronic signals conveyed from microcomputer unit 148 to power source 181 through means 185. The internal operative status of the laser source generator means 180 is monitored by an array of internally based sensors, described by units 186 through 189. Thermal conditions of the laser are monitored by sensor means 186. Power output is assessed by sensor means 187. The internal pressure of plasma or chemicals when such laser units are employed and are indicated by element 188. The internal charge within the resonant cavity is calibrated by unit 189. The information generated by sensor means 186 through 189 are conveyed to electronic subsystem, 182 which relays the data for display to unit 149 and or to the microcomputer means 148. Compensatory command signals from microcomputer 148 are based on the information retrieved from sensors 186 through 189 or unit 182. If the laser means is overheating, then signals are sent to the closed system coolant means, 190. If the plasma pressure level in the plasma jacket is appreciably low or the chemicals needed to produce lasing in a chemical laser are deficient, then the appropriate signals are generated by microcomputer means 148 to release the contents of one or more recharging reservoirs designated by element 191. Output of the laser means can be adjusted by appropriate signals sent from means 148 to radiofrequency generators 192 and/or voltage regulator unit 193, which would power a flash coil and/or other means if a synthetic ruby element, or other suitable means to increase lasing were deployed in the transector device. The microcomputer means 148 may be replaced by the sequence of keyed commands initiated by the user from element 149.

Figure 24:
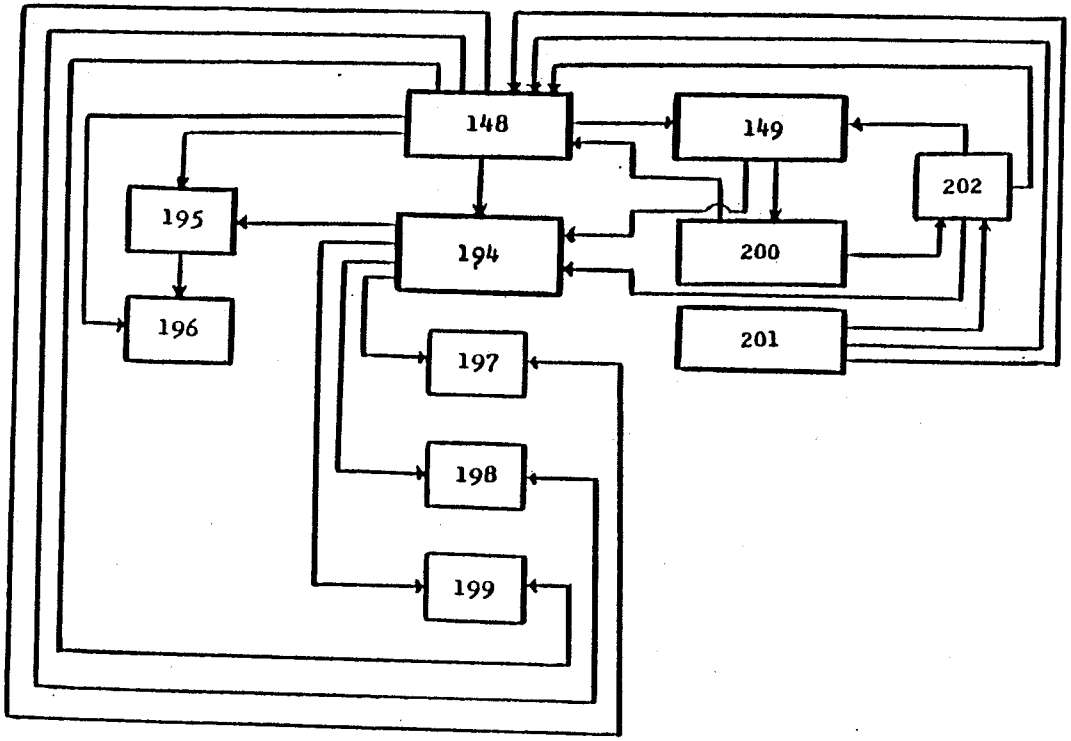

FIG. 24 is a detailed block diagram schematically describing the interaction of subsystems contained within the operative framework of the volatile dispersal unit. The operation of the volatile dispersal unit can be ideally keyed from microcomputer means 148 or manually keyed from unit 149. Cartridges containing volatiles and chemical mediators are contained in a magazine means, not shown, which are selected from by position selector means 194; which is motivated to engage a pair of cylindrical cartridges and to convey the content therein to a mixing chamber 195, which delivers the said contents to a dispersal coupler means 196. The location of the position selector unit, 194, is controlled by vertical translator means, 197, horizontal translator means 198 and solenoid injector/retractor means 199. Feedback from position sensors 200 and pressure sensors 201 provide the user 149 and the microcomputer 148 with data concerning the types of volatiles delivered or to undergo dispersal and the volume to be dispersed or the amount of volatiles and mediators, which are being dispersed from each cylindrical cartridge pairs. Numeral 202, an automated manual override means provides a fail-safe mechanism in the event of a systems failure, wherein damage to circuitry is incurred, or if the position selector jams, or if the cylindrical cartridges rupture.

Figure 25:
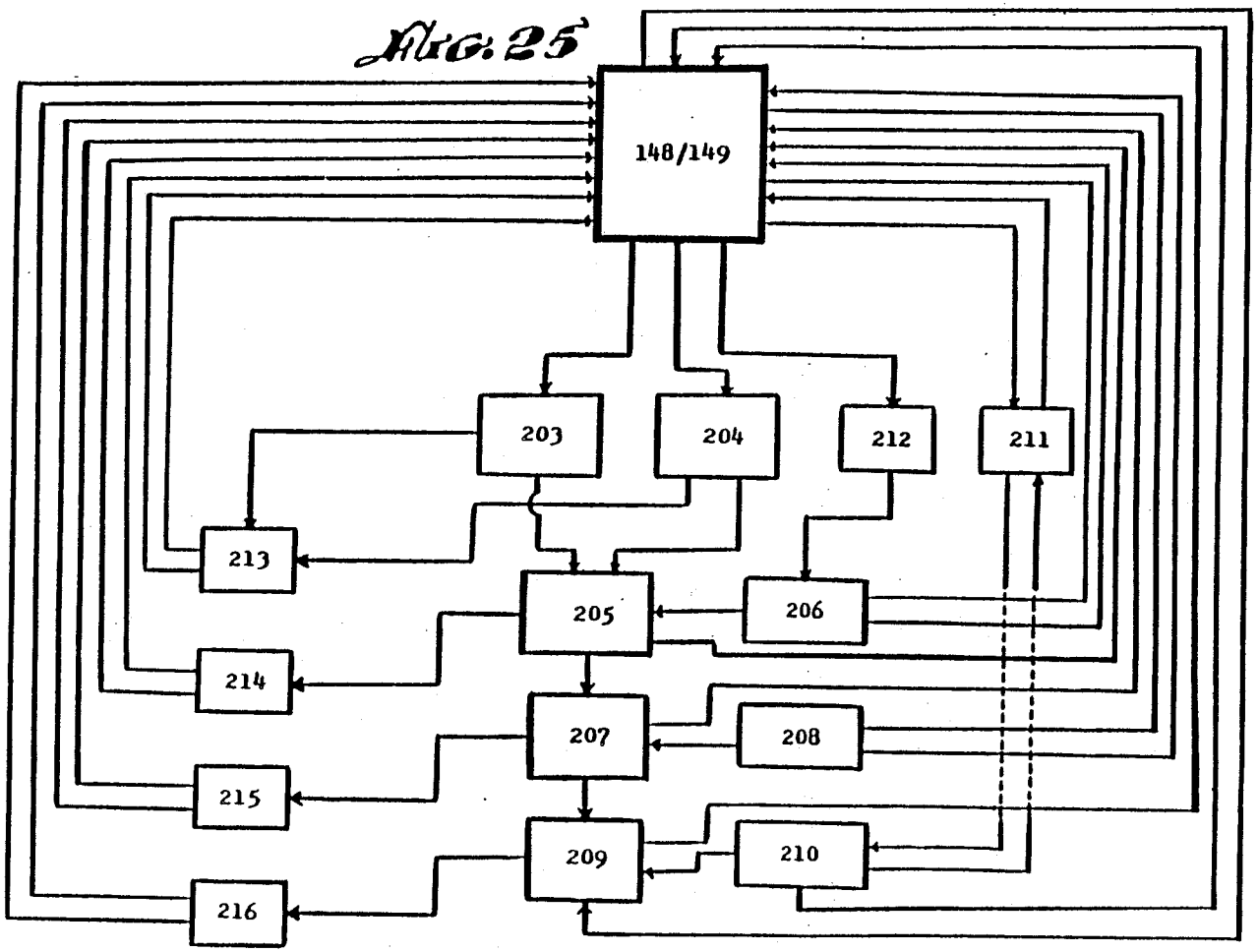

FIG. 25 is a detailed block diagram schematically illustrating the operation of the projectile firing system. The operation of systems operative systems contained within the projectile firing system is controlled and/or mediated by either microcomputer 148 or the user via element 149. Projectiles are loaded in the form of cartridges which are supplied either in relatively large numbers by a magazine, described by element 203, or side loaded individually by placing individual cartridges into the transector device designated by element 204. Projectile cartridges are inserted into a revolving chamber, number 205, wherein ten or more cartridges are positioned in a circular array. Each type of projectile is selected for or based on what is programmed by either the microcomputer means 148 and/or the user defined by number 149. Each different projectile cartridge type is coded with a specific diffraction holograph wherein laser sensor means 212 reads the holograph and provides data signals to motivate autoposition selector, number 206, to rotate the revolving chamber means 205 into position. The position of cartridges being loaded into the chamber from elements 203, 204 is monitored sensor means 213 and the position of the revolving chamber is provided by sensor means 214. Numeral 208 defines the autoinjector means which inserts the selected cartridge means into the autoload projectile slot, means 207. Sensor element 215 indicates whether or not a projectile cartridge has been dropped into an appropriate slot. The specified projectile cartridge drops from slot means 207 into firing chamber 209. Sensor means 216 monitors whether or not a projectile cartridge has been loaded into firing chamber 209, wherein the projectile is eventually propelled. The chamber, 205, is rotated prior to firing of the said projectile means, by element 210. Element 210 is an electronic ignition means which when actuated delivers an electronic signal to the projectile cartridge, allowing it to be discharged from the firing chamber element 209 into the central bore of barrel means 4; whereby the said projectile exits the transector device. The operation of the electronic ignition is monitored by circuit sensor means 211. The array of sensory elements 211 through 216 provides information both to the microcomputer means 148 and to the user 149 in the form of an LCD/LED display and/or a voice synthesizer means.

Figure 26:
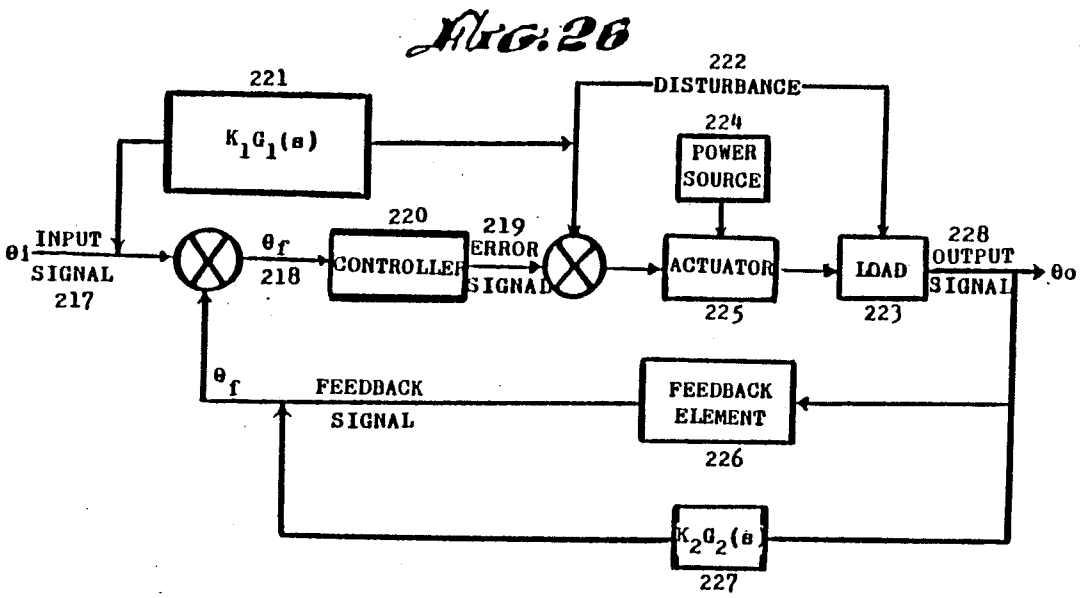
FIG. 26 is a diagrammatic representation of one of several equivalent feedback loops utilized to monitor and adjust the frequency, intensity and duration of functions as not to exceed the biological tolerence levels of the designated individual.

FIG. 26 is a diagrammatic representation of one of several equivalent feedback loops utilized to monitor, and adjust the frequency, intensity and duration of functions in a specific manner so that the biological tolerance levels of a given targeted individual are not exceeded in order to avoid undue injury or death to the said individual. Physiological readings are obtained from the designated individuals by systolic measurements taken by laser doppler means, acoustical measurements of cardiac and respiratory output, electrical measurements of GSR and ECG which are conducted back through the barrel of the transector device and other ancillary operations utilized to assess the designated individuals vital signs. Further, embodied within the operative framework of the feedback loop are a number of automated compensatory mechanism which alter the operative function of the transector unit continuously over the course of the said devices operation. Said function consists of, for example, a electrical charge administered to a designated individual, the intensity of the electrical current conducted by the charge, the frequency and duration of the charge delivered by the transector device. Electrical charge, radiofrequency emission and the dispersal of carrier mediated volitiles are operative functions of the transector device. The intensity, frequency, duration and other parameters of operative functions such as, chemical concentration or activity in the case of dispersed volatiles are continuously regulated based on date retrieved from sensors. Sensors are located in the most forward position of the transector device. Vital signs which are electrophysiologically based and are conducted through the barrel means of the said device during a non-electrical or radiofrequency emitting mode are frequently monitored and continuously updated.

The input signal $\theta$, is received by sensory means, 217, which conveys the signal to error detector element 218 for comparison. The error detection element 218 consists of an array of comparator and interrogator circuits, not shown, which compares the incoming signals $\theta$; with digitized values stored in the units memory. If the values of the incoming signals exceed those physiological norms construed to be the targeted individuals maximum, then an error signal is generated, as defined by number 219 and the symbol $\theta E$; wherein the generated signal is sent to the controller means 220, as is the forward transfer function defined by numeral 221. The controller means is associated with various internal operations which act in a prescribed compensatory manner to offset any discrepancies with an appropriate action, that occurs within the operative framework of the given feedback loop. Values are adjusted whether the action is to lower or raise the intensity of an electrical discharge, radiofrequency emission, or the concentration of volitiles dispersed, the duration of time each of which is administered and/or the frequency or sequence of each counter measure which is delivered to the designated or targeted individual. The effects of the output is being continuously monitored and the output undergoes frequent readjustment based on the influx of data. Disturbances, numeral 222, are registered and effect the load element, 223. A power source, element 224 effects actuator means, number 225, which also acts as a forcing function on load means 223. Current status retrieved from other sensory means, as defined collectively by feedback element 226 and a secondary transfer function, number 227, jointly provide a feedback signal which is reassessed against error detector means 219, as it re-enters the loop as either a negative or positive transfer function. The intensity, frequency, duration, concentration and the like are all parameters which may be immediately modified, numerous times, by the operation of the feedback loop. The output signal $\theta o$, 228, modifies and regulates the aforementioned parameters. Further contained herein below are a series of standard simplifed equations which describe the feedback loop for a control system having transferred functions which are listed in part herein below:

The forward transfer function is defined by the expression:

$$\frac{\theta o\,(s)}{O\epsilon(s)} = K_1\,G_1(s)$$

The forward transfer function $K_2G_2(s)$ is defined by the equation:

$$\frac{\theta f(s)}{\theta e\,(s)} = K_2G_2(s)$$

The open loop transfer function, the product of the forward and feedback transfer function is defined by the expression:

$$\frac{\theta f(s)}{\theta\epsilon(s)} = K_1K_2G_1(s)\,G_2(s).$$

The error transfer function is designated by the expression:

$$\frac{\theta\epsilon(s)}{\theta f(s)} = \frac{1}{1 + K_1K_2G_1(s)\,G_2(s)}.$$

Figure 27:
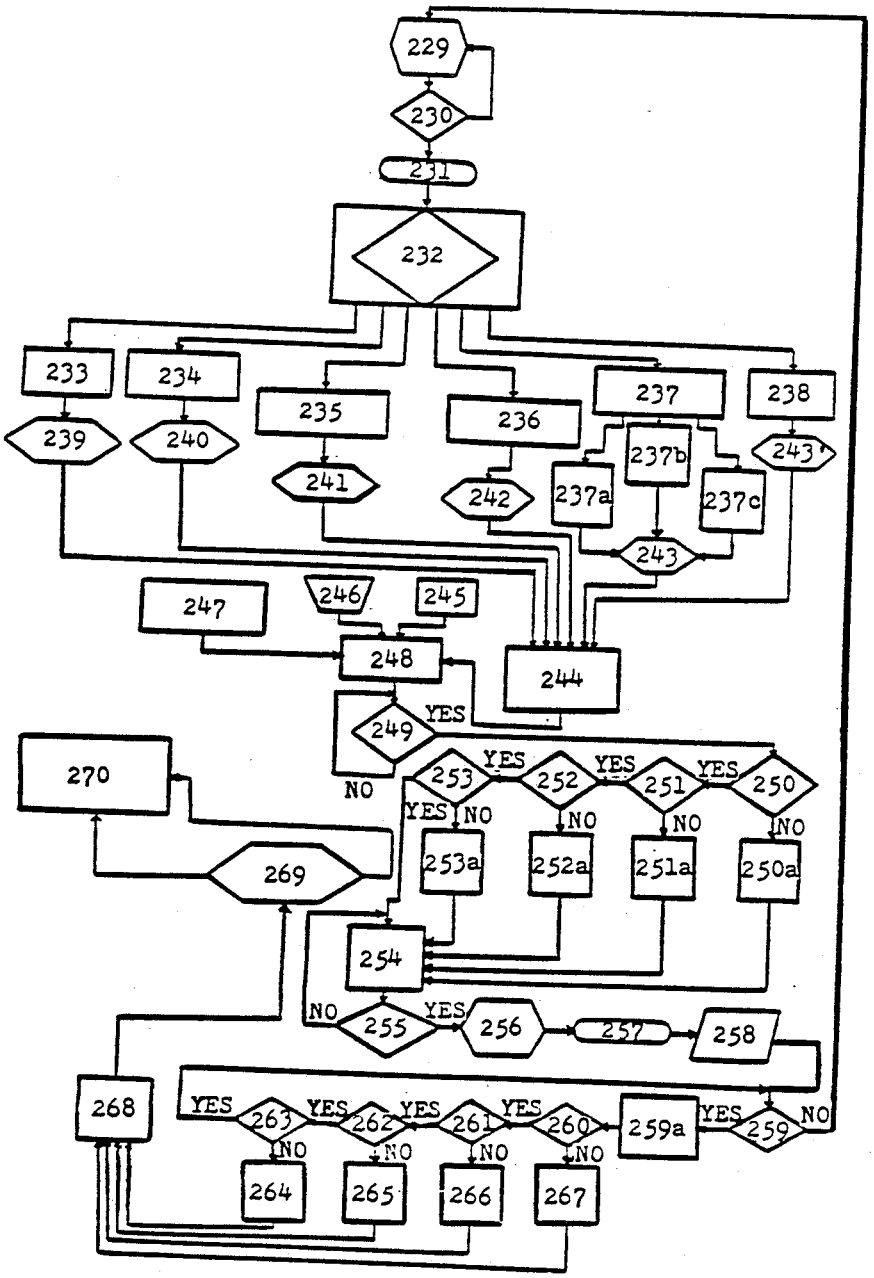
FIG. 27 is a flow chart for a program for processing input information derived from sensors to alter emissive parameters of the transector device so that the designated individuals biological limits are not exceeded.

FIG. 27 is a flow chart for a program for processing input information derived from sensors to alter the emissive parameters of the transector device in such a manner that the output of the said device does not exceed the biological limits of the designated individual. The biological norms are established based on a statistical analysis of established human values obtained in a population. The variance due to size, weight and sex are adjusted for in the program as well as variances in emotional conditions alluding to agitation of the designated individual. The programs are additionally constructed as to make certain allowances in the process of subduing dangerous individuals who for some reason are under the influence of alcohol or medications, or psychometrics (amphetamines, barbiturate, hypnotics, P.C.T., and/or other pharmacologicals) do to the incorporation of an expert system within the programming of the transector device. The targeted individuals are initally identified and tracked, as indicated by process 229, prior to being engaged as indicated by numeral 230. If the targeted individuals have or are being engaged, 230, then the program is actuated, as indicated by start sequence 231, or else the system will return to identify and further track the designated individuals, number 229. Usually when the target designate moves beyond the effective range of the device, or is obscurred from sensory process 229, which must be re-enlisted. Once the program has been actuated, 231, program selection is enlisted from a repetorie of appropriate counter measures consisting essentially of six catagories identified numerically by 001, 010, 011, 100, 101, 110 and the classes contained within each of the said catagories are collectively designated by number 232. The catagories of programmed functions are identified by elements 233 through 238. Numeral 233 identified a subprogram catagory which delivers high voltage electrical shocks locally discharged are implemented to temporarily induce partial local muscular contraction and/or paralysis, or to effect other means in order to neutralize a designated individual. The subprogram governing the projection of radiofrequency emissions in order to induce localized hyperthermia in specific regions of an individual is expressed by element 234. Numeral 235 defines a subprogram catagory involving the projection of narrow beam acoustical emissions producing a temporary deafening sound inhibiting verbal or auditory cues in designated individuals. Numeral 236 is indicative of a subprogram controlling the parameter of an intense flash of laser light temporarily blinding one or more deisgnated individuals depriving them of visual cues. Element 237 illustrates a subprogram specifying the dispersal of carrier mediated volitiles. Elements 237*a*, 237*b* and 237*c* define subcatagories or subprograms governing different classes of volitiles to be dispersed to carrier mediated volitiles producing states of anesthesia leading to drowsiness or sleep, which is described by number 237*a*. Number 237*b* designates a class of volitile antabuses inducing states of nausea and confusion in targeted individuals. Numeral 237*c* denotes a subprogram governing the dispersal of cryogenic agents utilized to induce rapid chilling or freezing in localized regions inducing a form of hypothermia in the said specified regions of the designated individuals. Numeral 238 is assigned to a subprogram specifying the launching of projectiles when the number target designates are greater than 10 and range from 50 to in excess of 200 meters from the body of the transector device. The initial parameters of a single function such as intensity, frequency, duration, concentration and/or dispersal patterns are regulated by scanning circuitry; which additionally provides sequencing and timing of one or more given functions generated by the transector device, as indicated by six equivalent processes assigned the values 239 through 243, respectively. Additional circuitry to monitor the output of each function, calibration and internal operations conducted within each operative system are provided by operative means 244. After the first counter measure is instituted, an array of sensors effectively calculate the designated individuals physiological parameters currently updating status regarding vital signs, as indicated by number 245. Information is additionally provided concerning data retrieved from sensory apparatuses which had measured physiological parameters of designated individuals prior to administration of one or more functions of the transector device to the said individuals, which is illustrated by number 246. Data entering from system 245, 246 are compiled, collated and compared with digitized signals retrieved from memory chips contained within the global memory system of the device, as indicated by the statistical format contained within element 247. The statistical values are based on physiological norms taken from mean averages of population studies. The deployment of a global memory system within the contexts of one or more expert systems will be discussed further in the specifications. The programming of element 247 allows the device to assess the average weight, sex, and physiological condition of designated individuals. Various traces of drug residue can be monitored by means of laser spectrostrophy of chemical species formed in the perspiration which will be disclosed in reference material and later on in the specifications. The values compared against statistical norms by interrogator circuits indicated by element 248 and if the value does not exceed those construed to be life threatening, then the program is channeled for display and eventually termination, provided the designated individual or individuals are neutralized. Elements 249 through 253 define values such as, systolic output provided by laser means, measurements of respiratory function conveyed by piezoelectric sensors, body temperature derived from infrared sensors and spectrophotometric analyses of chemical species in the perspiration of the targeted individuals, respectively.* The values which deviate from the norm are displayed as are those which correspond to various established norms. The data from elements 250*a* through 253*a* are conveyed collectively to compiler means 254; wherein the overall status of designated individuals are determined. A decision upon whether or not designated individuals are neutralized is conducted by element 255. If the designated individuals are neutralized, then the program procedes towards termination as indicated by the process describd by number 256. The internal systems and functions residing in the systems therein are placed on standby, as illustrated by number 258, until one or more targeted individuals are assigned by the user, 257. If however, the targeted or designated individuals are not neutralized an additional numeric cycle is provided, as indicated by number 259, which automatically re-engages process 229. If values of systolic respiratory function, basal metabolism, body temperature or other vital functions sufficiently disturbed are indicated by decision processes 260 through 263. The values pertaining to the disturbance of vital signs are assessed on a priority basis by elements 264 through 267, which collectively input into means 268; wherein the program acts in a compensatory manner to effect alterations in the parameters of various programmable functions of the transector device. Means 268 initiates a series of reduction processes which alters or reduces the output of such parameters as, intensity, frequency and duration of generated emissions and/or the concentration or chemical composition of volitiles and the like in the form of signals; which directly effect element 232 and the properties of 001 to 110 contained therein. Numeral 268 contains within its embodiment a multivariant feedback loop which asserts the capacity of the program to undergo program modification in order to make the necessary adjustments in given parameters of specific functions, an exemplary form in which a program is modified and is illustrated by number 269. Additionally, you have programs acting on programs during the operation of transector device, whoich is indicated in part by number 270. Numerals 269, 270 are only simplified generalizations of a number of processes taking place and therefore should only be taken in an illustrative manner rather than in a restrictive or limited sense.

*Rosenberg laser spectrophotometric analyses patent Ser. No. 4,589,078.

Figure 28:
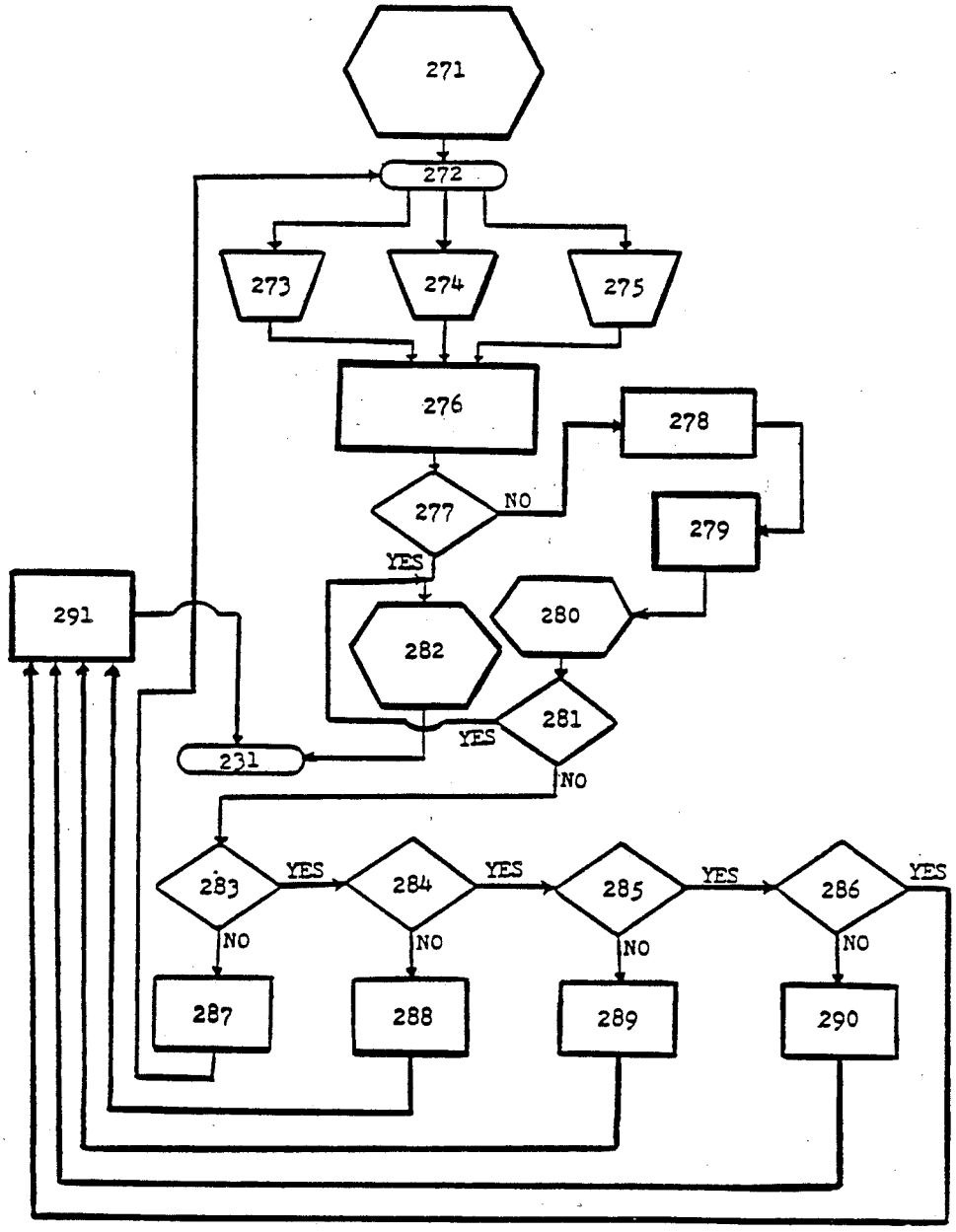
FIG. 28 is a flow chart for a program for processing data received from sensors providing for target designation, target pursuit or tracking and engagement of the designated target.

FIG. 28 is a flow chart for a program for processing data received for target deisgnation, target pursuit or tracking and engagement of the designated target. The user first sites targeted individuals and points the transector device at the said individuals and then actuates an autokeying sequence, which is indicated by numeral 271. The autokey sequence actuates the laser designator means, disclosed by numeral 272. Once the laser designator is activated an array of sensors and circuitry computes the range, speed and movement or motion pattern of the targeted individuals, as described by numerals 273, 274 and 275, respectively. Data derived from sensors is accumulated, collated and transferred to higher order computational circuits, as indicated by numeral 276. Decision process 277 determines whether or not a target is illuminated. If the targeted or designated individual is not illuminated by the laser emissive source then a process wherein the return laser beam source is scanned for power, wavelength and effects are instituted whereby the wavelength is tuned appropriately, as indicated by numbers 279, 280. If the target is illuminated by a laser signal monitored by sensors, as defined by number 281, then the range, speed and pattern of flight is computed by process 282 to the exclusion of other individuals and targets and each of the designated targets are assigned the appropriate matrix number and motion vectors. Once process 286 has identified the target the transector means is locked onto the said target and ready to begin the neutralization process, as defined initially by start sequence 231. If however, the target is not verifiable, then data which is returned to sensors are interrogated by elements 283 through 286. If the target is illuminated, then the decision element 283 moves to 284; and if not the data is returned via means 287 to the start number 272 for reprocessing of data. Element 284 determines whether or not the range is computable and if it is then the process is advanced to element 285; if not the data is recalibrated against the targets last known position, as indicated by number 288. Element 285 determines whether or not the pattern of movement is generated by the designated inidividuals. If the pattern of motion of the targeted individuals are computable, then decision process 286 is engaged; wherein a measure of the targeted individuals vital sign are measured. If the pattern of motion of the targeted individual can not be determined, then the pursuit trajectory is recalculated based on last known position or probalistic patterns of evasive action, as determined by numeric means 289. If the vital signs of the targeted individuals are computable, as indicated by decision element 286, then the confirmed data is transferred from elements 283 to 286 to compiler means 291; wherein new values of range, speed and pattern bahavior is computed, evaluated and confirmed. If the vital signs of said individuals can not be determined by element 286, then ancillary sensors are actuated, as indicated by number 290. The data derived from elements 288, 289 and 290 are collectively sent to means 291 for collation, cross-referencing and conformation of the targeted individuals range, speed and pattern of motion. The data from 291 is like that of 282 channeled to actuate the start sequence 231, wherein appropriate behavior to neutralizd designated targets is computed and then inacted by the laser based transector device.

FIGS. 29 through 45 are partially sectioned perspective views of the loading assembly rotating cylinder unit and selector injector means. The types, quantities and effective range of projectiles loaded and fired from the barrel of the transector device which is ultimately controlled by the operation of the selector injection means in conjunction with the rotating element and loading assembly means.

Figure 31:
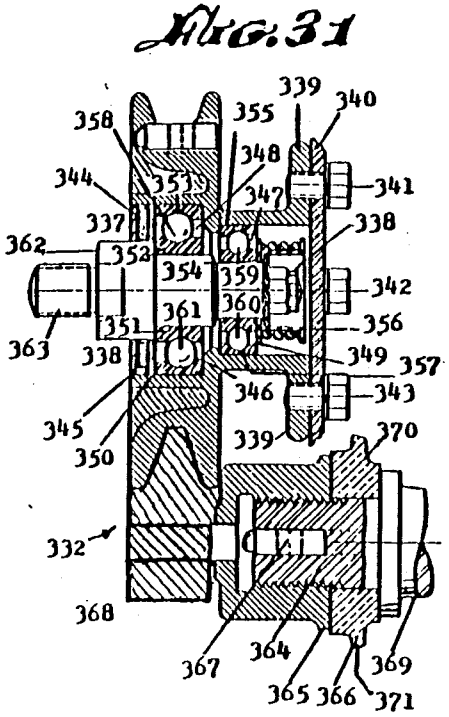
Figure 30:
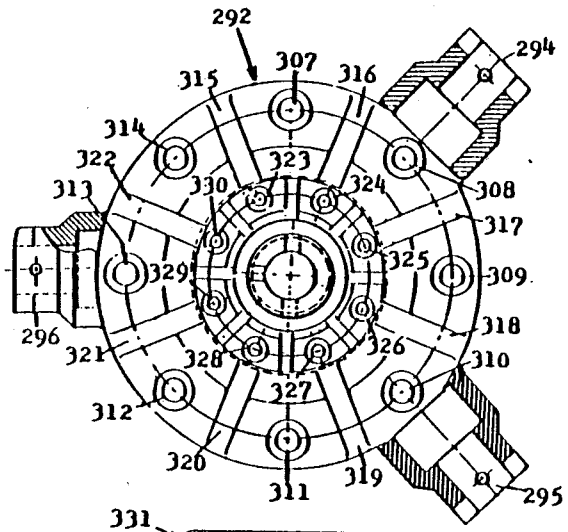
Figure 32:
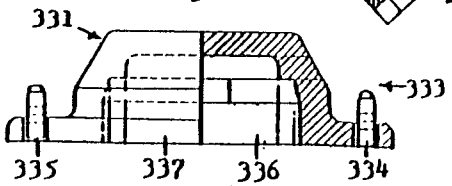
Figure 29:
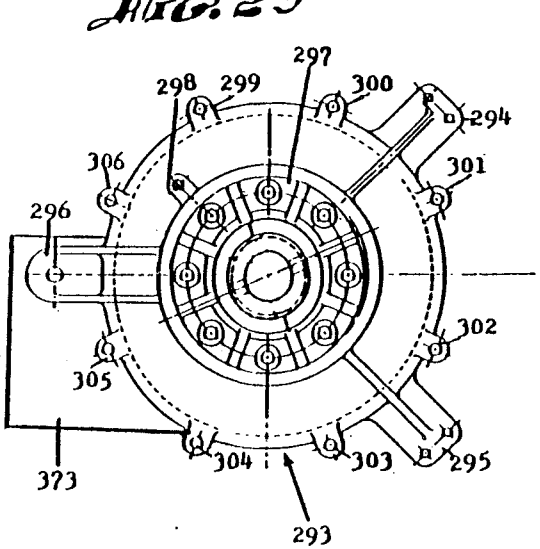

FIG. 29 through 48 entail four partially sectioned views of the rotating or revolving cylindrical means. Numeral 292 is assigned to the entire cylindrical means, which is encased by unit 293. Elements 294, 295 and 296 of FIG. 29 describe the housing of two equivalent injector means for loading projectile cartridges from revolving cylinder means 292 into the firing chamber, not shown, and a selector element for rotating cylindrical means 292. Numerals 297, 298 denote the housing for a laser sensor means to detect the position of the cylindrical means 292. Case means 293 is secured by precision insert and matching screw means 299 through 306 to the mainframe of the transector device, not shown. The revolving cylindrical chamber means, as described by numbr 292 of FIG. 30 is schematically shown with eight cartridges receptacles loaded with projectile cartridges, described by elements 307 through 314 and their respective slide channels, which is described by grooved means 315 through 322. Information regarding position is provided by electro-optical sensor means 323 through 330. Essentially when the cylindrical chamber means 292 rotates into position by selector means 294, 295 it stops and injector means 296 thrusts a single specified projectile forward and down into the firing chamber, 373. In FIG. 32 numerals 331, 332 are assignd to the side elevation of the rotating chamber means. Numerals 333, 334 and 335 are ascribed to the outer casing, peripheral loading channel for projectile cartridges, and the internal casing emboding the rotating shaft, ball bearing complement and other ancillary structures. In FIG. 31 numerals 336, 337 and 338 define the static brace into which the inner and outer race means of unit 292 are mounted, an internal reservoir containing a silicon based synthetic lubricant for the ball bearing system and an inlet means to service the said reservoir. Numeral 339 describes a mounting bracket for static means 337 and is secured to the mainframe of the device, 340, by four bolts, three of which are indicated by numerals 341, 342 and 343. Internal sealing gaskets 344, 345 provide effective seals for the ball bearing system and the lubricant reservoir. Numerals 346, 347, 348 and 349 are conduit channels conducting synthetic lubricant from the reservoir means to the complement of the ball bearing system. The inner and outer races of the ball bearing system are defined by elements 350 through 357 and the ball bearing means are described in part by means 358 through 361. Element 362, 363 describe locking means for cylindrical chamber 292. The loading means is defined by casing means 364, 365 and 366, with the inner case 364 formed from a soft silicon composite which is threaded and inserts into casing 365, 366. A single projectile, numeral 367, is illustrated traveling towards a receptacle, number 368, which is contained within cylindrical chamber means 292. Coupling 369 leads to the outside of the transector device where the user may insert or side load one or more projectiles. Elements 370, 371 denote male insert elements, wherein the female portions of an autoloading magazine which engages and locks said magazine, not shown, into position for rapid replacement of expended projectile cartridges.

Figures 33, 34, 35:
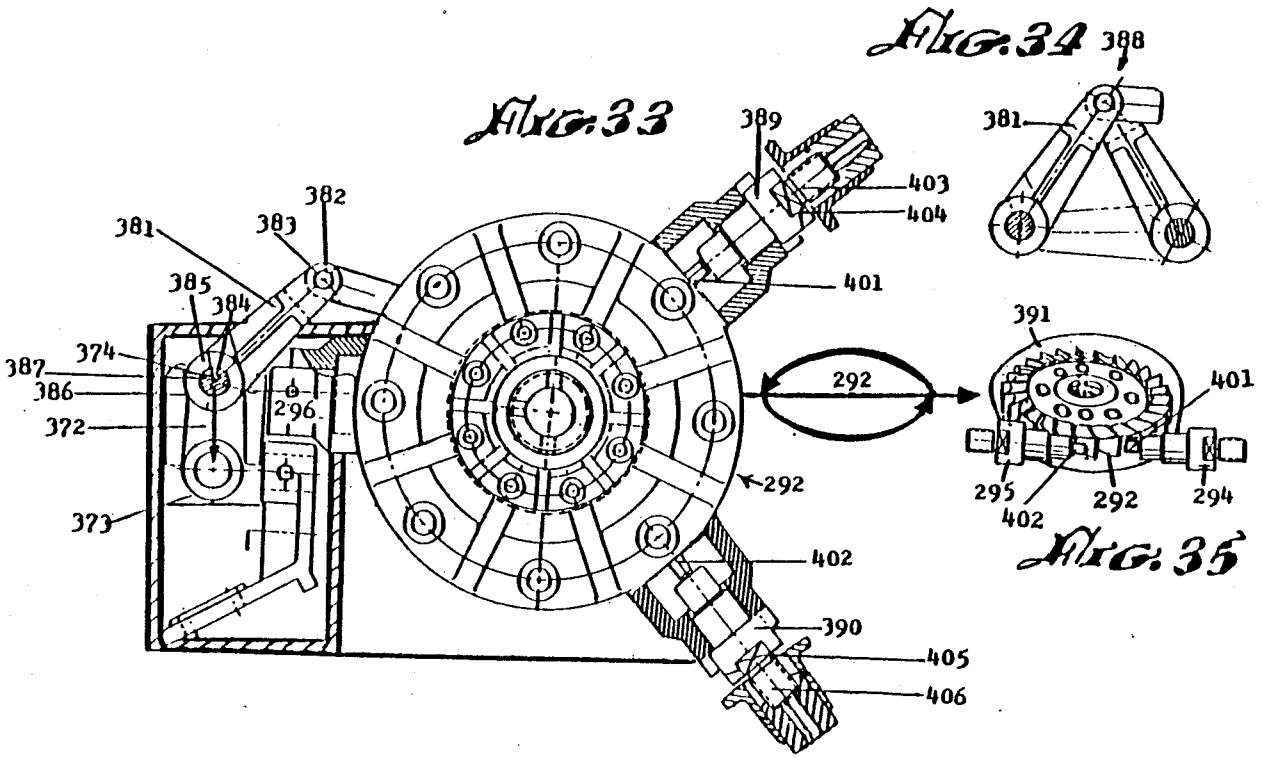

FIG. 33 is a partially sectioned view of the injector selector means and autoloading mechanism for firing either single or sequences of projectiles in or near designated regions where targeted individuals reside. Projectiles are injected from the cylinder means 292, along slotted channels or slide 372, into the firing chamber 373 by injector means 296. Once a given projectile is loaded into the firing chamber 373 through port 374 the cylindrical chamber means is advanced in such a manner as to seal the said port with the non-slotted portion of means 292, wherein the chamber means is closed or sealed from the rest of the transector device. The outer case of injector means 296 is defined by numerals 375, 375*a* and the inner lubricating channel is defined by means 376. Numerals 377, 378, 379 and 380 describe collectively the solenoid means, an inner casing, a miniature electromagnetic coil, a composite return spring and a plunger means, respectively. The operation of injector means 296 by the angular action of gearless slide means 381, which articulates with 382, 383, gearless discs 384, 385 and holding receptacle 386. Unit 381 temporarily encases the specified projectile cartridge number 387 by receptacle 386 as the said projectile cartridge travels linearly along slide 372 until the port, number 374, is reached at which point the projectile cartridge is released dropping into the firing chamber, number 373. Each selector means 294, 295 advances the entire revolving cylindrical chamber means 292 either forward in clockwise motion or in a backward counter-clockwise rotation, until the receptacle containing the desired projectile cartridge is rotated into the loading position adjacent to the injector means 296. The operation of slide means 381 is schematically indicated by number 388 of FIG. 34. Each equivalent selector means 294, 295 consists of a interactive solenoid complex collectively assigned to numerals 389, 390. Each selector unit 389, 390 are angularly disposed abutting against channeled grooves listed in part by numerals 391 through 400 which are circumferentially disposed around the peripheral edge of chamber means 292. In FIG. 35, forward movements by plunger means 401, 402 advances element 292 either in a forward or backward direction, clockwise or counter-clockwise motion. The motion of the cylindrical chamber is set by either or both solenoid means 289, 390 which disengage one the chamber is put into motion re-engaging the grooves, which act like teeth of a gear once a desired loading position is achieved the solenoids are locked into position preventing further rotation by the said chamber means, number 292. Each solenoid means may operate independently of the other solenoid and at any given time unit 389 remains in a standby mode, while unit 390 is actuated or visa versa. A spring loaded secondary solenoid pivot system is described by means 401 through element 406 which angularily move units 389, 390 towards or away from the groove means of the cylindrical chamber unit.

Figure 36:
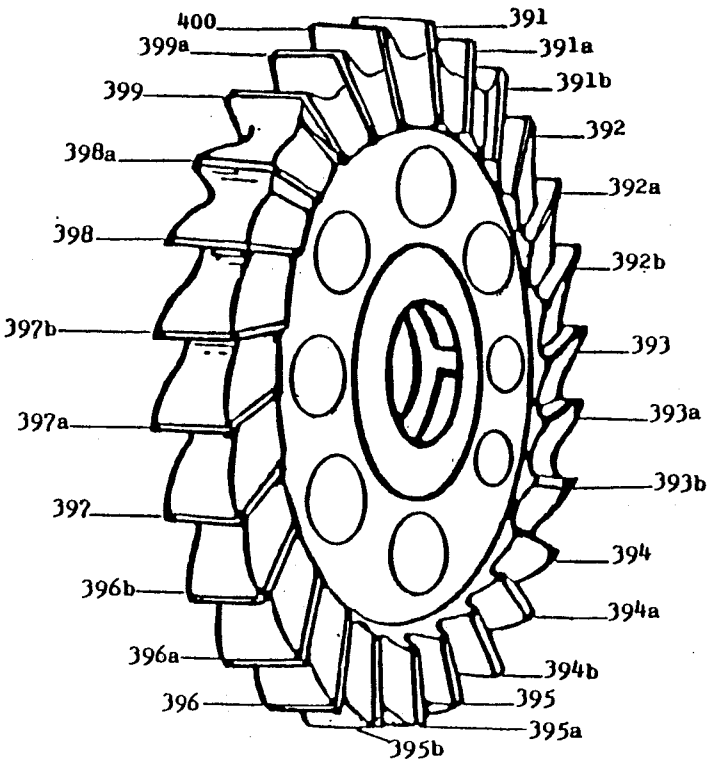

FIG. 36 entails a pictorial description of unit 292 and elements 391 through 400, respectively.

Figure 37:
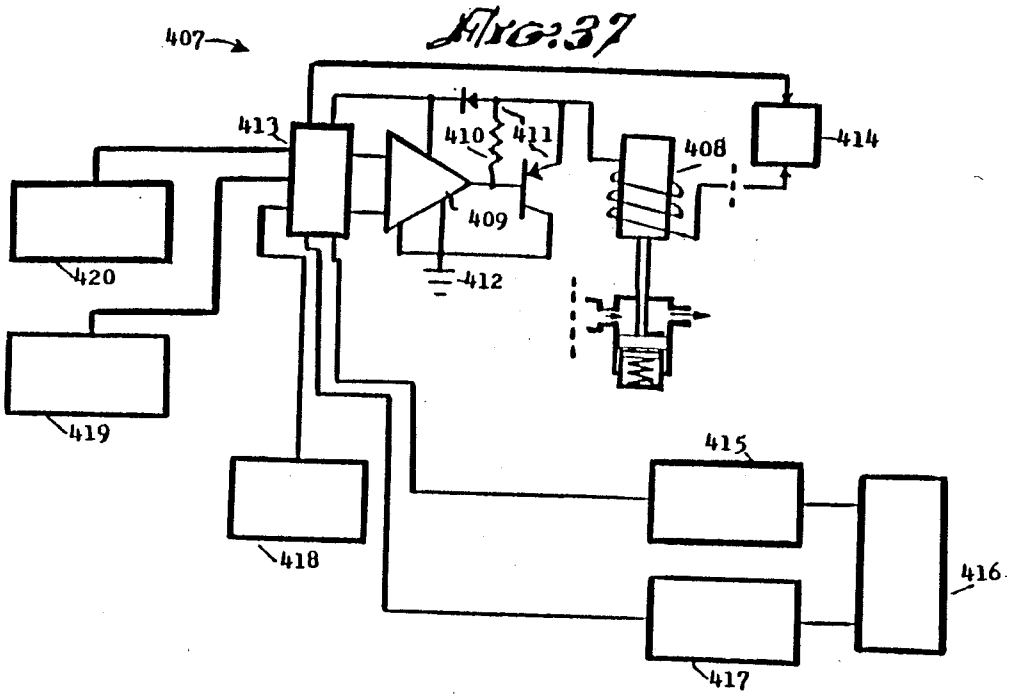

A brief circuit schematic block diagram describes the elementary operation of the solenoid driving means of FIG. 37 is collectively assigned the numeric value 407. Numerals 408, 409, 410, 411 and 412 define one of several solenoid means, an integrated circuit means, typical diode and resistive elements and a suitable ground means, respectively. A control and sequencer means, numeral 413 controls the input delivered to the solenoid circuit, the output delivered by the said circuit and the sequence in which one or more solenoids are actuatd in order to perform a specific function. Other equivalent solenoid means of the sequence are illustrate by element 414. The position of the chamber 292 is indicated by elements 415, as specified by, laser diode, sensors and electrical contact means 416. The position of specified projectiles are provided by means 417 which also receives data from elements 416, 418. Element 418 is defined as a single mode static scan electro-optical array which verifies the type of projectile by identifying the holographic encrypton pattern or code etched on the surface of the said projectile. Numeral 419 designates a counter latch and decoder unit for signal processing and locking mode. The internal scale factors alluding to logistics, range, disperal patterns and other parameters are set by user based automode element 420.

Figure 38:
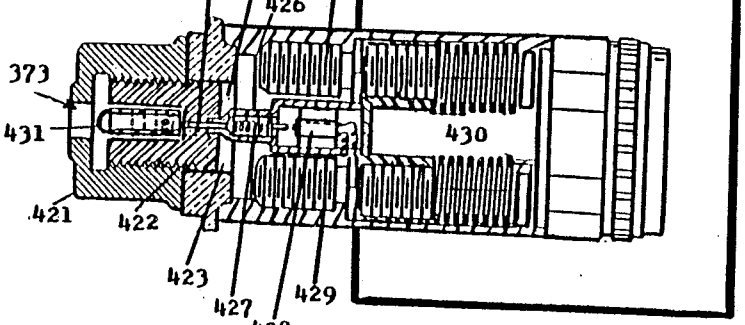

FIG. 38 defines in part the ignition system and firing chamber. Once the specified projectile 431 is loading into the firing chamber 373 the proper ignition sequence is provided by elements 421 through 425. The outer and inner casing of the firing chamber means is defined by elements 421, 422. Numeral 421 consists of a synthetic epoxylated metallic element composed of tungston, titanium stainless alloy embedded in a synthetic carbon fiber matrix. Numeral 422 describes the inner housing of chamber means 373 which is composed of a flexible ceramic composite of polymorphic silicon nitride embedded in a synthetic carbon fiber matrix. Numerals 423, 424 and 425 describes two equivalent positive carrier means and a negative biased discharge means for producing an electric arc. Enclosed element 426 contains a ignition coil means 427, 428. A miniature capacitance bank for charging ignition coil means 427, 428 is defined collectively by element 429. Numeral 430 designates a secondary transformer means utilized to charge capacitance bank 429.

Figure 39:
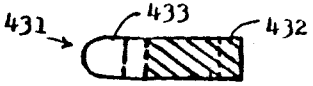
Figure 40:
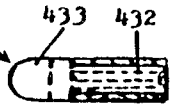
Figure 42:
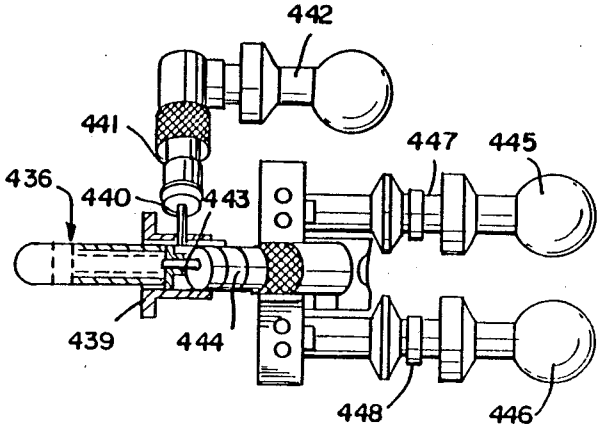
Figure 44:
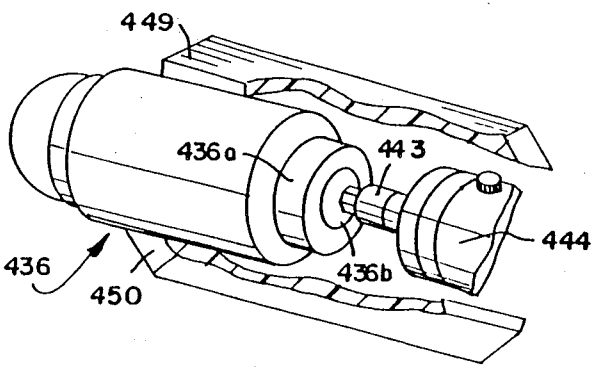
Figure 41:
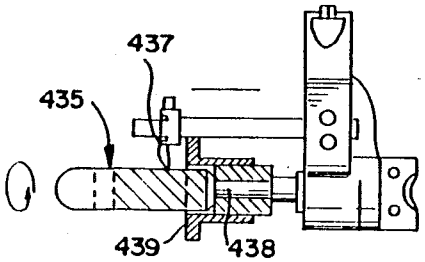
Figure 43:
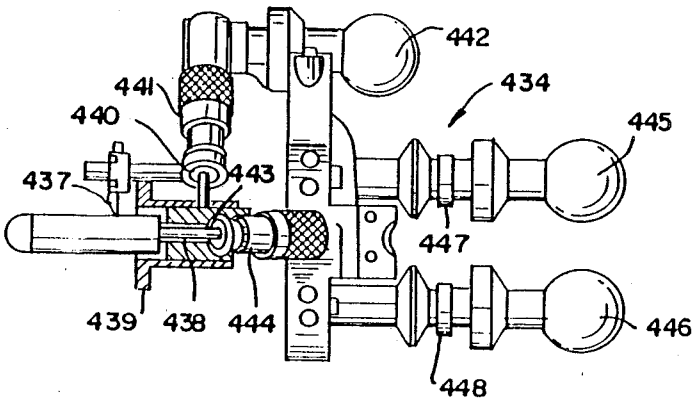

FIGS. 39, 40 are cross-sections of two equivalent ant projectile types. Projectile cartridge means 431 is sectioned to reveal a primary explosive charge, numeral 432, which upon ignition provides propulsion and a warhead assembly defined by means 433, which upon dispersal either ignites, detonates or reduces to a highly volitile vapor depending upon the type of projectile exiting through the barrel of the transector device.

The range and dispersal pattern of projectiles is contingent on the type of projectile cartridges selected, the composition of the porpellant system employed and the type of charge applied to the coil. The propulsion system consisted of either a solid propellant, liquid propellant or charge of compressed air, for more limited ranges. The concentration of the propellant as well as its quantity can be regulated prior to packaging, a bleeding off process in the case of liquid propellant, or the process of structural deletion for solid propellant means, wherein a prescribed section of the explosive charge is removed prior to the projectile cartridge being loaded into the firing chamber. It is obvious that the range of a specified projection can vary directly with the amount or quantity of propulsive charge expended. Packaging of contents varying the charge of a solid propellant or the bleeding of fuel in liquid propellant are conventional means of regulating range in the ranging of missiles, rockets and certain variable mortar means.

FIGS. 41 through 48 designate partially sectioned views denoting the structural configuration of the range selector means. The range selector means, number 434 operates on the propulsive portion of the projectile cartridge. There are basically six types of propulsion mediums available; however only two types of propulsion means will be disclosed by projectile cartridges 435, 436. The other four types of propulsion means vary in chemical composition from those illustrated by elements 435, 436, both have the same structural configuration and operational paramaters of the said disclosed projectile cartridges. Projectile cartridge means 435 discloses a solid propellant means. The range of solid propellant powered projectile cartridges are diminished by simply excising and removing an appropriate portion of solid propellant calculated by sensors to reduce the range of a projectile by a given specified measure of distance. A carbide blade means, number 437, scores and cuts a predetermined length circumscribed and specified by a programmed based on the range of targets monitored by the laser designation means, not shown. A portion of the cartridge containing solid propellant is cleaved by means 437 and ejected by solenoid means 438 into a holding chamber 439. If the propellant is liquid or compressed gas then the range is diminished by bleeding a measured portion of the propellant away from the cartridge reducing the range of the said cartridge, number 436, so that the expended projectile travels an exact distance coinciding with an exact distance determined by laser designation and sensors. Numerals 440 to 442 and **436*a*, 436*b* define a solder junction, bleeding nozzle, solder/flux unit, a self sealing gasket and casing for the propellant embodied by projectile means 436. Numeral 443 designates a solenoid injector retractable needle means by which elements 436*a*, 436*b* are pierced and the contents of 436 are bleed off. The solenoid element which advances and retracts the fine bore needle means 443 is described by element 444. The flow into and out of reservoir means 445, 446 are controlled by bidirectional solenoid means 447 and flow channel governor 448. Reservoir 445 receives contents bleed off from the propulsive element of projectile cartridge 436; whereas reservoir 446 is charged with either high pressure gas or liquid propellant for increasing the fuel and/or propulsive force generated by projectile means 446. Numerals 449, 450 are autostays which grasp onto projectile means 436, while it is undergoing further charging from reservoir 446, or being discharged by passing propellant into reservoir 445. The autostays 449, 450 are automatically retracted when the operation of ranging the projectile is completed; wherein the modified porjectile cartridge is inserted into an ancillary loading chamber, 451 which is adjacent to the loading chamber of the selector means 454. A solenoid motivated cylindrical shell, 452, moves either modified projectile cartridges 435, 436 into the loading chamber of selector means 434. Solenoids 452*a*, 452*b* move cylindrical plate means 453**, laterally back and forth, so that projectile cartridges are conveyed to and from the loading chamber of the selector when either modification are initiated and/or completed. As for the miniature warhead assemblies which vary upon the type of function designated which range from blinding chemical flares to encapsulated cylinders of volatile charges and the dispersal patterns of each can be programmed by mechanism embodied within the said assemblies (i.e. programmable timing or logic circuits understood by those skilled in the art.

Figure 49:
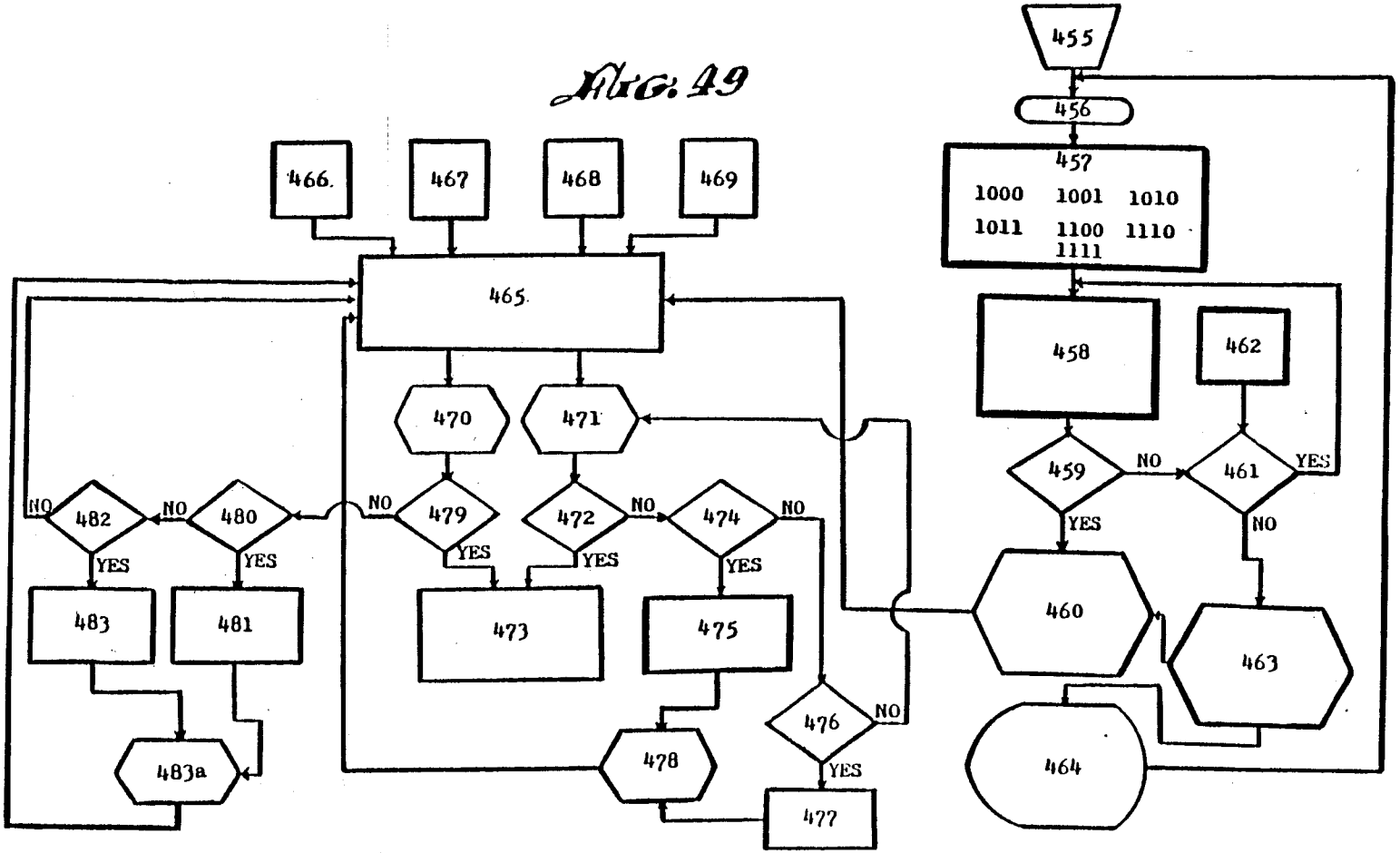
FIG. 49 is a flow chart for a program for determining dispersal pattern, selecting projectile types, quantity and the range of the same said projectiles.

FIG. 49 discloses a flow chart for a program for selecting projectiles, types, quantities, dispersal patterns and the range of the said projectiles. The program governing the type quantities, dispersal patterns range and other parameters are essentially keyed by the user in conjunction with various onboard system embodied within the transector device. The user can at any given time manually override the operation of any system simply by keying modifications in a prescribed manner. The start sequence 456, is initially actuated by the user, as disclosed by number 455. The user keyed/instructions provides the basis wherein projectile types ar defined by numeral 457. The types of projectile types are as follows, value 1000 specifies the use of carrier mediated volatiles in the form of anesthetics, 1001, noxious or irritating antabuses,* 1010, and/or neural inhibitors, 1011. Fast evaporating aerosols dissipate surface heat rapidly inducing a chill factor to groups of targeted individuals, as described by programmed value 1100. The selection of concussive projectile cartridges 1110, which upon detonation above targets produce a deafening sound and concussive forces. Value 1111 specifies for the selection projectile cartridges containing miniature flares, which when ignited above a specified target region produces heat and intense blinding light. The programmed selection further actuates a scanning circuit which scans for the specified projectile, provides timing and sequencing for dispersal of the said projectiles, as indicated by element 458. Decision process 459 determines whether or not an appropriate target has been selected; and if so then a subprogram numeral 460 is actuated; and if not then the data is channeled to element 461. Element 461 determines whether or not a given specified projectile is contained within the present inventory of load projectiles. Information describing the entire disposition of projectile cartridges loaded in cylindrical chamber 492 is qued by, or otherwise by scanning the holographic patterns or codes imprinted on each projectile cartridge means, as determined by process 462. If certain specified projectile, cartridges are not contained within the inventory than new alternative projectile cartridges are reassigned to their respective targets, as illustrated by process 463. The information obtained from process 463 is relayed to element 464; wherein the data is displayed and the system immediately returns to element 457 for new instructions.

However, if it is determined by element 459 that the target can be selected for by one or more specified projectiles, subprogram, number 460 is enlisted. Element 460 automatically selects parameters alluding to but not limited to those values of chemical concentration force range and dispersal patterns, as previously indicated and relays its data to unit 465 for further processing. Unit 465 is additionally implemented with data received from processes 466, 467, 468 and 469, respectively. The position of one or more projectile cartridge in relation to the load assembly is indicated by elements 466, 467. Information concerning the current range of targets and their patterns of motion or movement is currently provided by means 468, 469. The aforementioned parameters selected by subprogram 460 are computed by unit 465. The information derived by unit 465 is channeled to two equivalent, but separate and distinct processes described by numerals 470, 471. Process 470 is deployed when the propulsion system of a given cartridge is specified by holographic pattern code to be either liquid or compressed gas. Process 471 is deployed if the given cartridge means is specified by said holograhic code to be a solid (i.e. hard solid, paste or fused powder). In the event the propellant is determined to be a solid, then it is established by decision process 472 whether or not the amount of propellant contained is exact to reach a targeted region. If the propellant contained within a cartridge is deemed sufficient to reach a designated targeted region, then element 473 is elicited; and if not, then decision element 474 is enlisted. Element 474 determines whether or not the distance of the target will be greatly surpassed by the propellant contained within the said cartridge. If it is affirmed that the target will be surpassed by the projectile, then a portion of the cartridge with the length defined by X is removed or subtracted from the circumferential length of the solid propellant element defined by Y, so that some optimum value N is reached, as indicated by element 475. If however, it is determined by process 476 that the required distance to engage a target is beyond the capacity of a given specified projectile, than element 477 is engaged wherein the length of the propellant Y is extended by some specified value Z (i.e. a cylindrical section of a specific length containing propellant Z and is added to length Y from a storehouse of reserve propellant elements). Both processes 475, 477 are upon completion verified by means 478 which re-enlists element 465 for confirmation of data. If it has been determined by element 479 that the range of the targets match those parameters provided by the propulsion means of a specified projectile cartridge containing compressed gases, liquid propellant or some other suitable media, then unit 473 is enlisted to determine the optimium values firing sequence and the like needed to survive one or more targeted regions. If the range of the targets do not match those of the propellant system, then decision process 480 which determines whether or not the targets are out of range is inacted. If the targets are beyond the propulsive capabilities of the specified projectile cartridge, then means 481 is engaged; wherein the contents of the liquid or gas propellant are recompressed and added to the propellant, such that propellant Y is added to proportion to propellant X1 which is compatable with Y and produces a new quantity Z. Quantity Z is calculated to provide the projectile means with sufficient thrust to reach the specified targets. If however, the thrust provided by the propellant system is in excess of that needed to reach designated targets, which are determined by decision process 482, then process 483 is engaged wherein excess propellant is bleed off. The amount of propellant bleed off from the initial amount of propellant contained within the specified projectile cartridge Y is that amount or volume X2, removed or subtracted from Y, Z which allows the projectile means to avoid overshooting the said targets. As in the case of the solid propellant system once a programmed modification has been instituted the new value X2 must be verified and confirmation requires a return to system 465. Process **483*a* verifies the new parameters and returns to unit 465** for further confirmation.

*a non-injurious noxious substance which induces vomiting when administered in concentrated form i.e. tetraethylthiuram disulfide, etc.

FIGS. 50 through 63 are detailed sectioned views illustrating the loading assembly, selector means, mixing chamber and dispersal means for the carrier mediated volitiles. The operation of the above mentioned system requires a minimium of maintance for normal operation. A cassette loaded with eighteen separate and distinct cylindrical cartridges are arranged in rows of six and disposed in pairs. Each cartridge charged with a volitile substance is situated adjacent to a cylindrical cartridge containing some carrier mediated chemical complex such as DMSO or other suitable substances. An automated servo means described as a selector means consists of a pair of fine bore needle means mounted on a translating bore means, which acts as a two dimensional variable stage motivating the said needle process either vertically or horizontally along the complement or array of cartridges. A solenoid complex thrusts the fine bore needles forward, when actuated into a prescribed pair of cylindrical cartridges, which automatically retracts from the programmed cartridges when the solenoid complex is deactivated. The needle means project into each respective cartridge means piercing a self sealing gasket complex and the pressurized content of each cylindrical means is conveyed by a pair of miniature corrugated conduits to a miniature phase mixing chamber means. The pressurized content delivered from the conduit means intermixes in the mixing chamber and is conducted to the peripherally located sintered material which is embodied within the barrel structure by an array of miniature corrugated pipes. A series of equivalent solenoid values emit the flow of pressurized carrier mediated volitiles into and out of the said mixing chamber.

Figures 50, 51, 52, 53, 54, 55, 56:
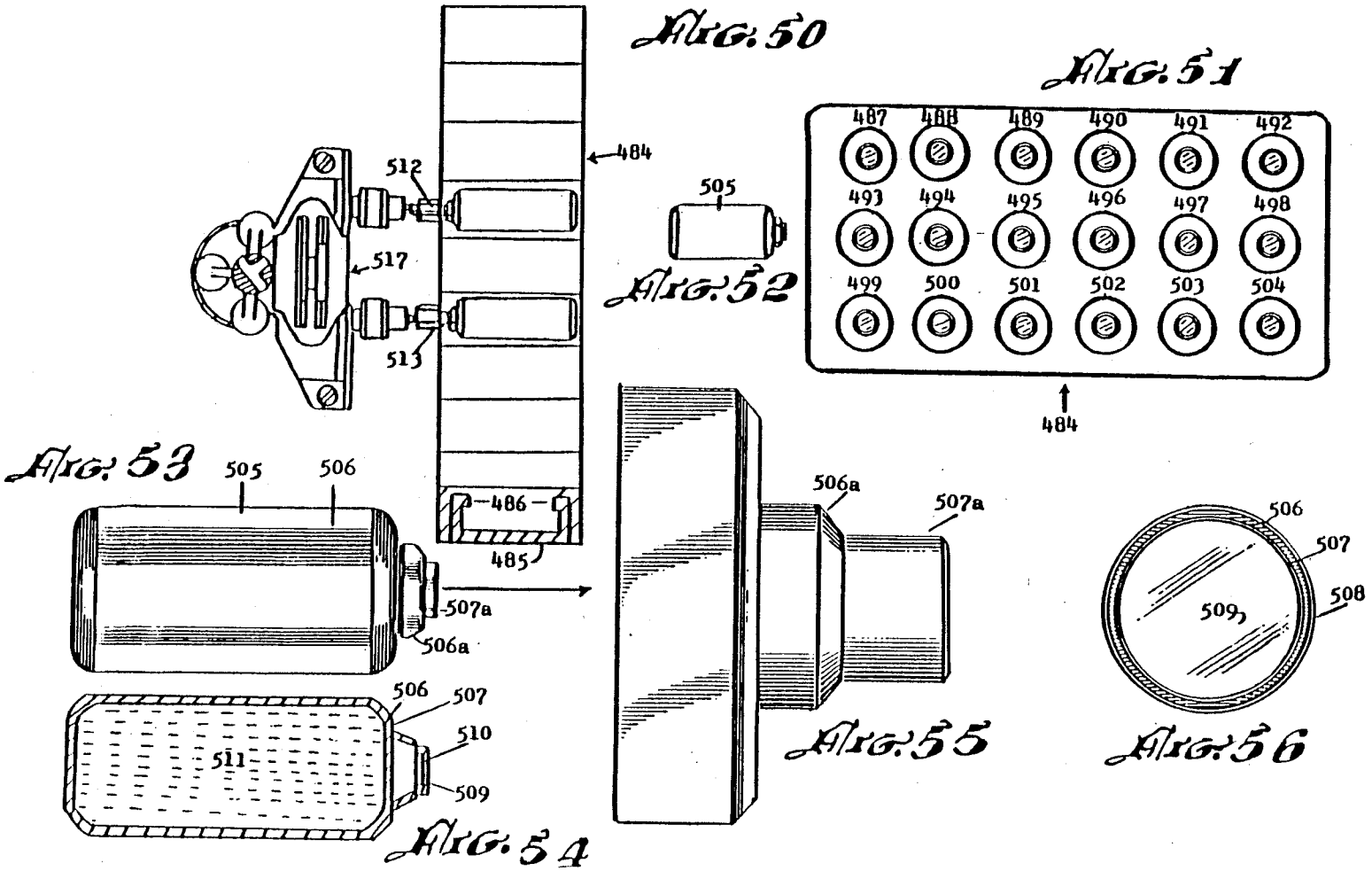
FIGS. 50 through 63 are detailed sectioned views illustrating the loading assembly, selector means, mixing chamber and dispersal means for the volatiles.

Numerals 484, 485 and 486 of FIG. 50 designate the loading cassette containing eighteen separate liquidfied gas cylindrical cartridges, the load ramp or slide and carriage means in which cassette 484 is accepted and a crimpped or beveled portion of the said cassette means 486 which inserts into carriage 485. In FIG. 51 numerals 484 through 504 define eighteen separate and distinct cylindrical cartridges loaded into their respective receptacles of cassette means 485. A sectioned view of a single cylindrical cartridge, as described by numeral 505, in FIG. 52, is equivalent in structure and design to anyone of the eighteen said cylindrical cartridges of the complement containing volatiles, or penetrators, or other suitable pressurized liquified gas mediums. In FIG. 54 the outer wall, 506, consists of a layer of aluminum which is epoxylated to a thin insulatory layer, number 507, coating the interior of cylindrical means 505. The front portion of the cartridge, 505 is slightly elongated forming a neck which is gradually tappered as indicated by numbers **506*a*, 507*a* in FIGS. 53, 55**.

Covering the central bore of the neck, 508 is a thin sheet of aluminum which is fused circumferentially to the flat surface face, as described by number 509 of FIG. 56. A cylindrical plug means described by numeral 510, which is composed of a suitable soft self sealing synthetic plastic gel. Upon penetration by a fine hollow bore needle means, number 512 the plug means 510 seals around the said needle means in a fashion as to prevent leakage of the cylinder, 505, contents, 511, from the peripheral portion of the needle means 512. Upon retraction of needle means 512 from the bore 508, of the neck cylinder means 505 the hole made by the penetration of the needle means immediately seals itself preventing seepage of pressurized contents 511 from exiting the aforesaid cylinder. A pair of fine bore needle means 512, 513 are mounted on a translatable stage, 517. Aft of each needle means are two spring loaded recoilable solenoid flow governors, numbers 514, 515 which control the flow of pressurized fluids or gases from nedle means 512, 513 respectively, as disclosed in FIG. 57.

Figures 57, 58, 59:
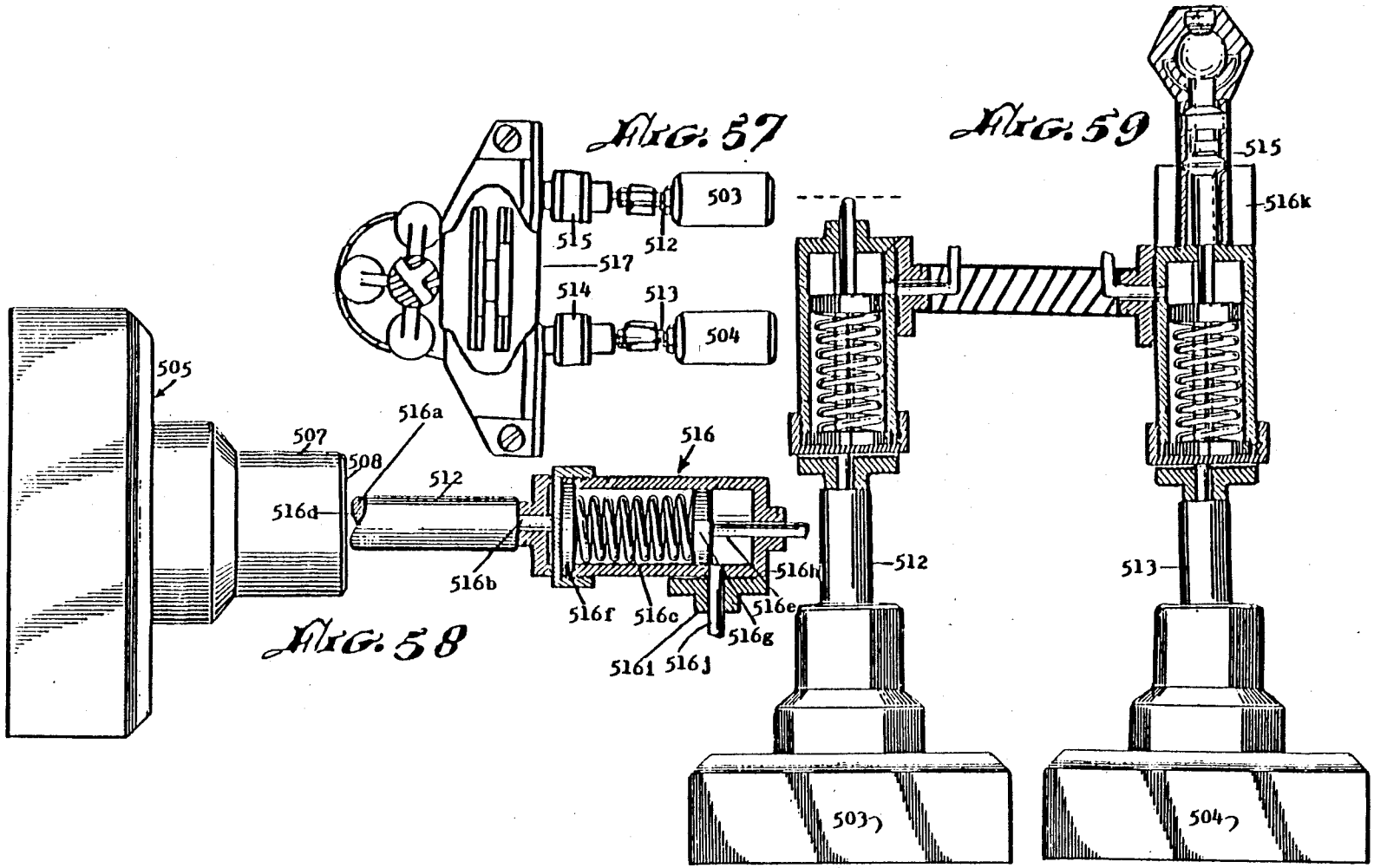

FIGS. 57 to 59 disclose detailed perspectives of the selector means. Numeral 516 is assigned collectively to a sectioned perspective of needle means 512, 513 and flow governors 514, 515 to schematically reveal the operation of the needle governor inlet system. In FIG. 58 elements **516*a*, 516*b* and 516*c* define the outer casing of the needle means which is composed of a suitable stainless synthetic composite material, a solid rod composed of a suitable non-reactive composite material which prevents a portion of plug means 510 from falling back down hollow bore 516*d* of the said needle and a coiled stablization spring means. The base of rod 516*b* is a plunger means 516*e* which abutts against a self sealing washer means 516*f*, 516*g* front and aft of the said plunger means. This seals washers 516*f*, 516*g* operating inconjunction with a tension spring, 516*c* which abutts up against projections 516*h*, 516*i* to effectively close the channel of bore 516*j* until solenoid means 516*k* as seen in FIG. 59 is actuated, opening the said channel so the pressurized contents, 511**, can back up and exit the outlet of the governor means.

Figures 60, 61, 62, 63:
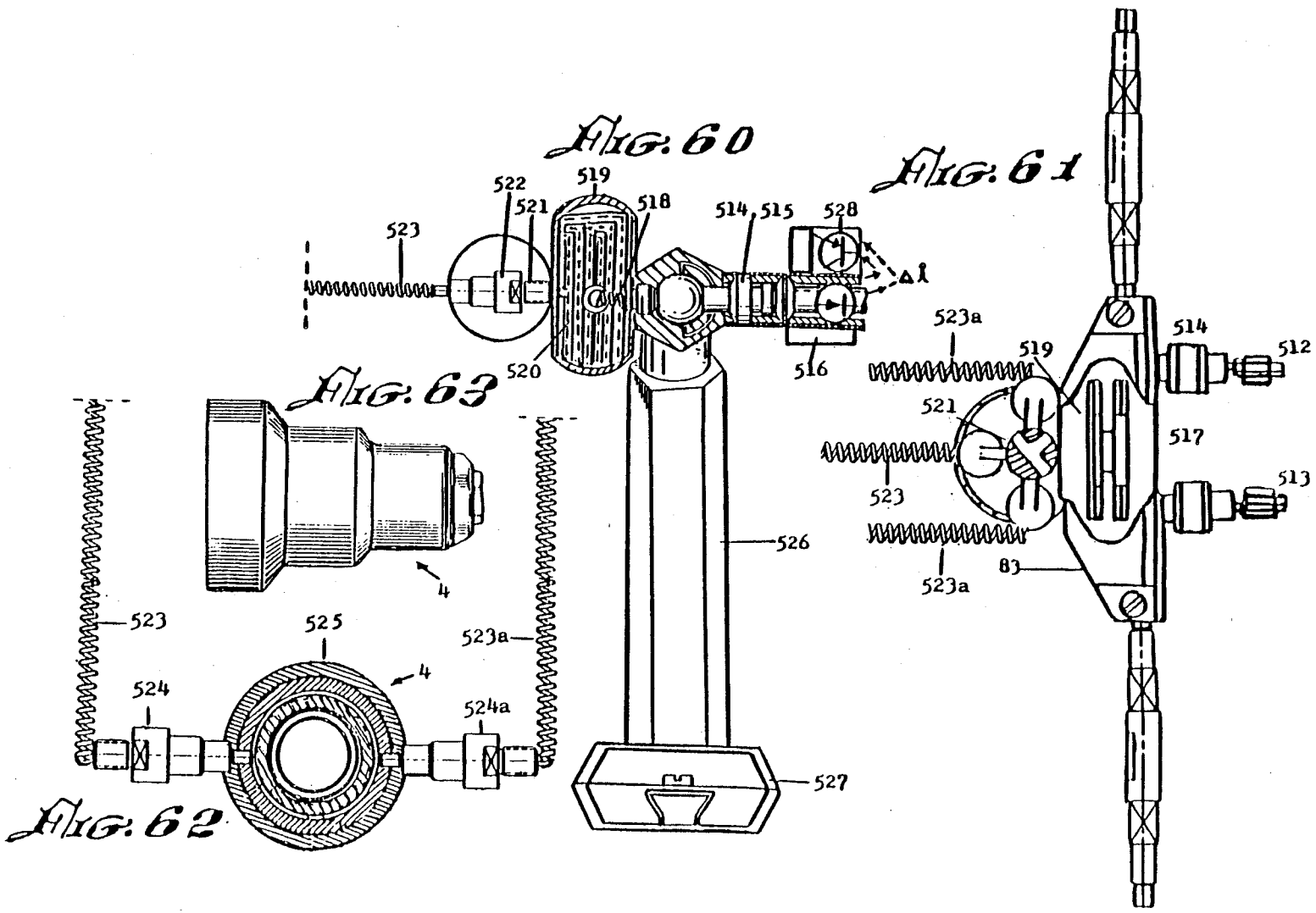

FIGS. 61, 61 are partially sectioned views of said selector means. The contents of each governor means 514, 515 exit into mixing chamber 519. It is within the aforesaid mixing chamber 519 wherein the aforementioned volatile and penetrator means are intermixed. A thin film baffle system described by element 520 provides an extended surface area wherein chemical interactions or complexing can readily occur. A coupler outlet numeral 521 entailing a solenoid governor means 522 controls the exit of pressurized carrier mediated volatile complexes out of mixing chamber means 519. Elements 518, 523 are corrugated exit pipe or conduit means, numeral 523, inserts into coupler outlet means 521 and functions to convey the carrier mediated complexes to a secondary coupler element described by element 522. Said corrugated pipe means 523 diverges into two or more sections, as indicated by FIGS. 61, 62, respectively.

FIG. 63 is a partial side elevation describing the exterior of barrel means, number 4; whereas FIG. 62 describes a partially sectioned schematic view of the aforesaid barrel structure and ancillary means for the release of volatiles. As indicated in FIG. 62 conduit means 523 diverges into two conduit structures **523, 523*a* and said structures enter secondary govenor elements 524, 524*a*. Elements 524, 524*a* are fused to structure 525, which forms the peripheral sintered casing component of said barrel means. The pressurized contents conveyed by conduit means 523 is distributed to the sintered material of barrel means 4, wherein it filters forward through the poreous sintered portion of the said barrel exiting out peripheral from the aforementioned barrel means, as previously disclosed. The translational stage or support bar 517 is mounted on vertical support 526, which is mutually disposed on XYZ translational stage, 527, which operates in a specific manner to move the mixing chamber and needle governor complex precisely in in either one of three directions, as described in FIG. 60. The XYZ translational stage means 527 is automated by either solenoids or miniature motorized units and operates in a manner consistant with conventional systems. Numeral 528 consists of a series of miniature laser based sensory means which assist in positioning the needle means, so it can accurately pierce a given specified pair of cylindrical cartridges at any time. The aforementioned laser based sensor system and translational stage means operate within the contexts of an automated feedback loop readily understood by those skilled in the art and will be elucidated further by the flow chart described in FIG. 64**.

Figure 64:
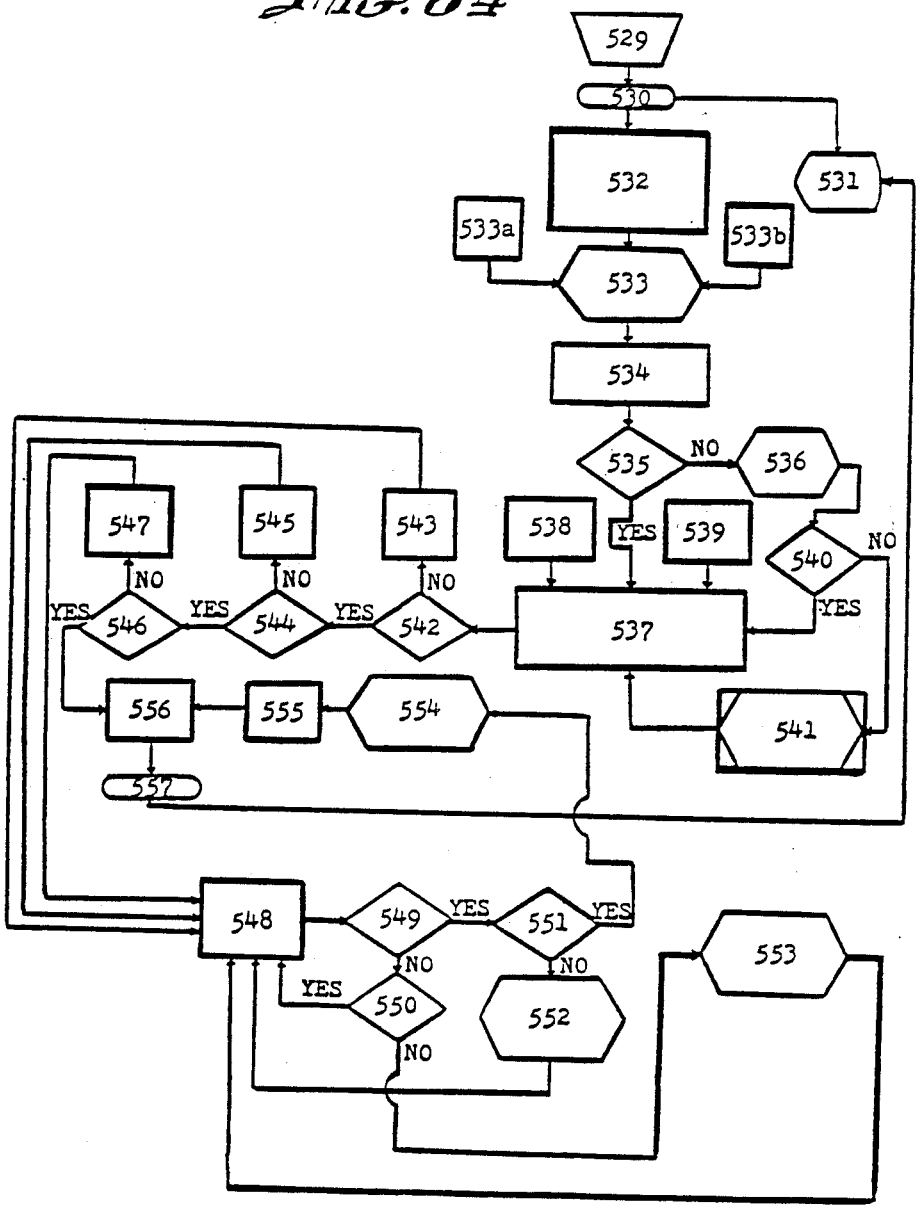
FIG. 64 is a flow chart for the program governing the concentration, type and range of the volatiles to be dispersed.

FIG. 64 is a flow chart for the program governing the concentration, type and range of volitiles to be dispersed by the user actuated transector device. The user initially keys the start sequence number 529 and makes the initial selection described by element 530. The current status of the cylindrical cartridge means, the types, quantity, charge capacity and viability of each which is displayed to the user by ancillary means 531, denoting status of the volatile delivery system. The user upon receiving the information concerning the operative readiness of the volitile system by hearing and/or viewing the status as per means 531, which actuates a keyed selection, as indicated by number 532. The alphanumeric code is keyed by the user, specifying the type of volatile to be delivered, the duration of the delivery period, the sequence and concentration of the carrier mediated volatile dispatched is determined by means 532. Once a set of instructions is initiated by the user, number 532, then a scanning procedure is instituted by process 533. Data received from internal intersystem based laser sensory means identifies specified cartridges and their subsequent positions, as denoted by elements **533*a*, 533*b*. Once the scanning procedure, number 533 has been completed, then data is channeled into an accumulator means 534; wherein positional data based on a three dimensional axial grid is identified, locates and verifies the position of the selector means 194 in relation to a given pair of specified cartridges contained within the cassette means, number 486. Determinant process 535 is redundant and functions to match and verify the digital signals retrieved by the reflected holographic code, which is etched or imprinted on the specified cylindrical cartridges. If the code match is verified, then data is channeled to means 537; whereas if verification is not substantiated or confirmed, then a search subprogram is initiated and the results are deployed, as indicated by number 536. Online data derived from means 535, 538 and 539 is conveyed to element 537 for processing. The data from element 536 is channeled to deterministic process 540, which assesses whether or not a second scan provides a verification of an exact match or not. If the second scan is verified, then data from element 540** is sent to the aforementioned element 537 to be acted upon. If the second scan is still not verified by the said process 540, then the information obtained from element 540 is conveyed to process 541, wherein an alternative selection is made and the choice generated is displayed to the user. The data from the subprogram described by element 541 is conveyed to element 537 to be acted upon. Process 542 determines whether or not the coordinates for the X axis match those designated coordinates affirmed by the sensors. If conformation of the X coordinates are exacted, then data from 542 is transferred to 544; and if the said X coordinates are not verified, then element data from 542 is conveyed to 543. If the data derived from process 542 is verified, then the coordinates are reset and the necessary corrections are exacted in a specific manner as to have the X coordinates match those of the specified coordinates. In a equivalent fashion decision processes 544, 545, 546 and 547 act on data concerning the coordinates of the Y and Z access as paired elements 542, 543 act. The data exchanged and processed by elements 542 through 547 are collectively sent to unit means 548; wherein the selected pairs of cylindrical cartridges are engaged by selector means 194. Decision process 549 determines whether or not a given specified cylindrical pair is engaged or not. If it is determined by element 549 that indeed the proper cylinders are engaged, then the data is channeled from 549 to 551. If however, the selected pair of cartridges are not engaged, then the data is transferred from determinant process 549 to determinant process 550; wherein it is determined if the X,Y,Z motivators, solenoids, motors and/or the like are operative. If the said motivators and like are all operational, then data from 550 is sent back to unit 548 for reprocessing; wherein if 550 exacts a negative decision the data is channeled to subprogram 553. It is in element 553 wherein a subprogram is enlisted to institute an alternative program and resets all coordinate values, returning the modified data to process element 548 by way of determinant process 550. Data concerning determinant process 551, wherein it is determined whether or not sufficient volume is presented in cylindrical cartridge means 552, is conveyed to either process means 554 or process 552. If a negative response is elicited from 551, then the data is sent to means 552, wherein a search for an equivalent cylinder or pair of cylinders to those which had been initially specified, each of the substituded cartridges now are selected and monitored by pressure sensors and the like in order to confirm that they are sufficiently charged. The data derived from process 552 after completion is conveyed to unit 548 to be further acted upon. If the specified cartridges are sufficiently charged, that is the said cartridges contain a sufficient quantity of substnace to deliver a prescribed dosage, then process 554 is enlisted. Process 554 determines the length of time or duration of delivery and the sequence of the said delivery controlling signals to solenoid release mechanisms and the like. Data from 554 is conveyed to subprogram 555 which controls solenoids governing the release and mixing the volatile penetrators and the like. Information acted upon by subprogram 555 is conveyed to means 556, which actuates the governor means controlling the release of carrier mediated volatiles. Data is transferred from element 556 to process 557 wherein the resultant release is displayed forcing a return to process 531; wherein the systems readiness to complete another function is signaled by means 532 for the next cycle. Originally, eighteen separate and independent solenoids were assigned to each of the separate eighteen cartridge means, but difficulties were incurred in a loading cassette with expended cartridges and replacing the said cassette with one which contained fully charged cartridges. Therefore, it was determined that the selector means operated to function in a more reliable manner than selection provided entirely by a complement of solenoid apparatuses.

Figure 65:
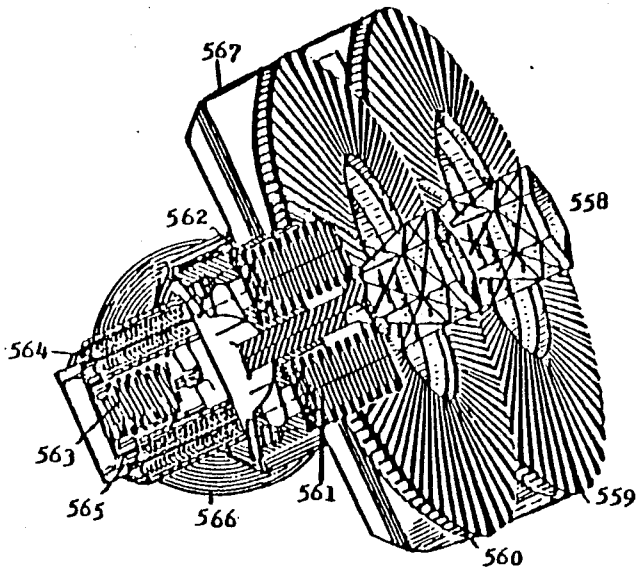
FIG. 65 is a detailed partially sectioned perspective view of the acoustical piezoelectric generator means.

FIG. 65 is a detailed partially sectioned perspective view of the acoustical piezoelectric generator means illustrating in part the operative structure of the said unit. Numeral 558 designates a metallic quartz crystalline piezoelectric generating means which initiates the sonic transmission. Elements 559, 560 denote two separate and distinct charging plates. The charging coils for plates 559, 560 are defined by elements 561, 562, respectively. A pulse generator means is described by unit 563. Commerical pulse generators like the one described by numeral 563 can either be otained locally or readily manufactured from conventional components. Numerals 564, 565 designate sectioned view of electro-optical transducers and proportional coolant elements. Numeral 566 defines an articulating joint and socket means which enables the unit when automated by motivator means, not shown, to rotate 360 degrees of arc in any one of three directions. Numeral 567 designates an outer peripheral parabolic dish means for concentrating or focusing the acoustical transmission towards a specified targeted region of the designated targeted individual.

Figure 66:
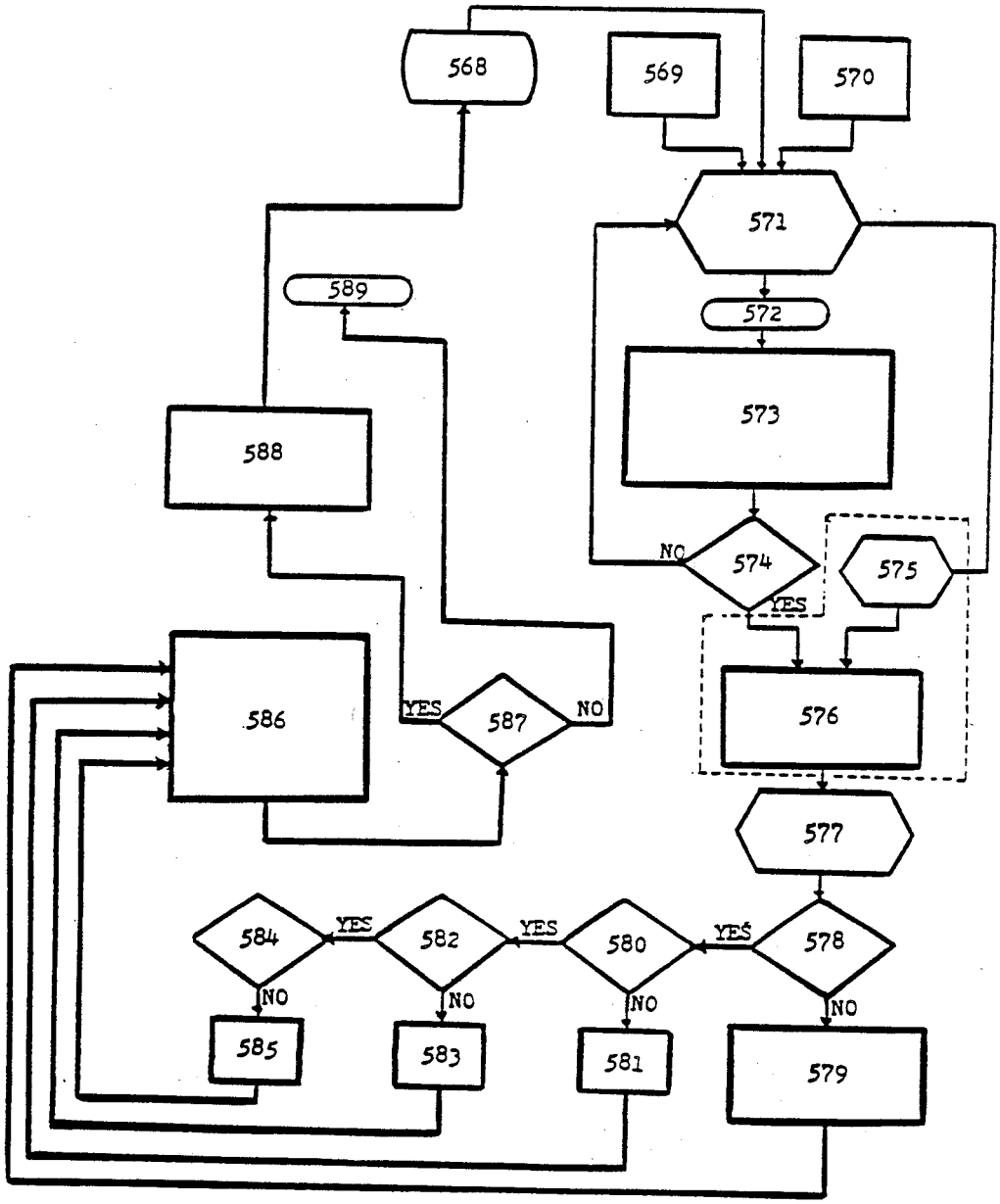
FIG. 66 is a flow chart for the program governing the frequency, duration, intensity and other characteristics of the sonic emissions produced by the acoustical generator means.

FIG. 66 is a flow chart for the program governing the frequency, duration, intensity and other characteristics of the sonic emissions produced by the acousatical generator means. The user initiates process 568 wherein the transector device is aimed or pointed at a target along the axis of sight; while the user actuates or keys the laser designator means, which is described by process 569 and acoustical locator means 570. The data processed by elements 569, 570 are channeled to process 571, which entails a subprogram wherein the process of target acquisition is instituted on the said data. The start sequence, number 572 is actuated upon the completion of numeral 571. The user selects a set of instructions which define parameters such as, power level or intensity, pulse shape and the duration of the acoustical emission, as indicated by programming process 573. Once element 573 is keyed then verification process 574 determines whether or not the primary targets are illuminated. If the primary targets are not illuminated (i.e. identified, tracked and locked onto) then the data from 574 is reconveyed to element 571 for reprocessing. If however, conformation of illuminated targets are exacted by determinant process 574, then process 576 is actuated. The information supplied from 574 is supplemented by a subprogram 575, which provides an informational update on primary targets. It is in process 575, wherein acoustical transmissions are deployed to engage primary target designations 1, 2, 3 . . . N. The first emission sequence is immediately followed by the administration of a second sequental sonic burst which is delivered to primary targets, as indicated by numeral 577. The data from 577 is sent to a number of determinant processes, as described by elements 578 through 585. Process 578 determines if all the parameters are operational. If the parameters ae all actuated, then data from process 578 is conveyed to element 580, if not then the data from 578 is conveyed to process 579. It is in 579 where circuits are electronically scanned to verify power parameters and to recalibrate systems. Elements 580, 583 and 584 ascertains the status of the intensity, pulse shape and duration of the acoustical emission; whereas if negative values are elicited by the aforementioned processes then means 581, 582 and 585 operate to reset and correct deviations in the established norms of intensity, pulse, shape and the duration of the acoustical emissions. Elements 578 through 585 collectively input into system 586. It is in element 586 wherein the proper execution of instructions is displayed to the user. If no secondary targets are available then the program is terminated, element 587 and the start sequence 572 is once more reinstituted. If secondary target are specified then reinterative processes, collectively assigned the value 588 are enlisted. The processes contained within subprogream 588 are equivalent to those 574 through 586. Once the keyed instructions are completed in means 588 the program is terminated and the system is placed in a standby state numeral 589.

Figures 67, 68, 69, 70:
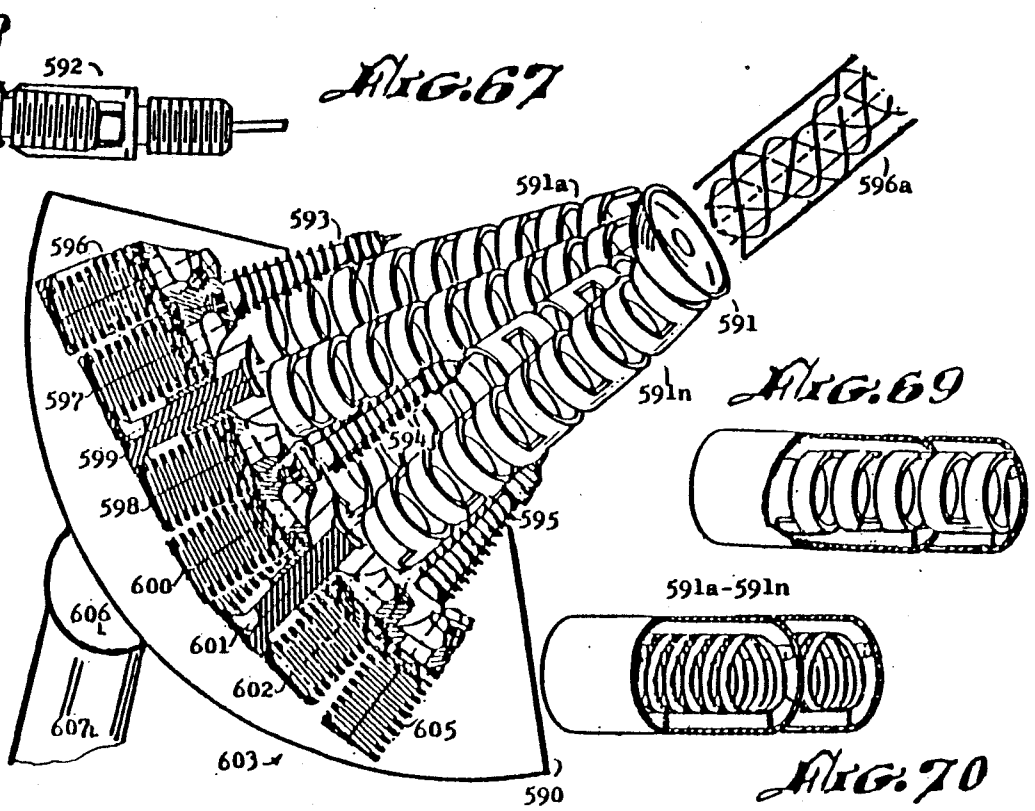
FIGS. 67 to 70 are detailed partially sectioned views of one of several radiofrequency means generating high frequency electrical charges and/or localized thermal gradients.

FIG. 67 is a detailed partially sectioned perspective of one of several radiofrequency means generating high frequency electrical charges and or localized thermal gradients circumferentially along the transector barrel means. An emission schematically defined by number 596*a*, the centroid dish by element 590 which assist to collimate the source emissions generated and channeled through a series of wave guides which are described collectively by numeral 591. Numerals 591*a* through 591*n* are equivalent wave guide means arranged in a specific geometric manner as to project a tight beam emission. Elements 593, 594 and 595 designate separate and distinct r.f. coils each of which having distinct termine located along the central axis of each separate and distinct waveguide.

FIG. 68 discloses a detailed partially sectioned view of a single radiofrequency coil, numeral 592 with an extended terminus. Element 592 is equivalent to radiofrequency elements 593, 594 and 595 previously dislosed in FIG. 14. Numerals 599, 601 of FIG. 14 denote internal guide or internal support structure means for parabolic dish 603. Elements 596, 597, 598, 600, 602 and 605 denotes separate charging coils for the radiofrequency coil means. Numeral 606 describes a single articulating socket joint means which is located inbetween support column 607 and dish means 603 giving a configuration which allows a 360 degree rotational frame in three dimension when motivated by solenoid means or some other automated means, not shown.

FIGS. 69, 70 describe in detail wave guide means 591*a* through 591*n* previously disclosed in FIG. 67.

Figure 71:
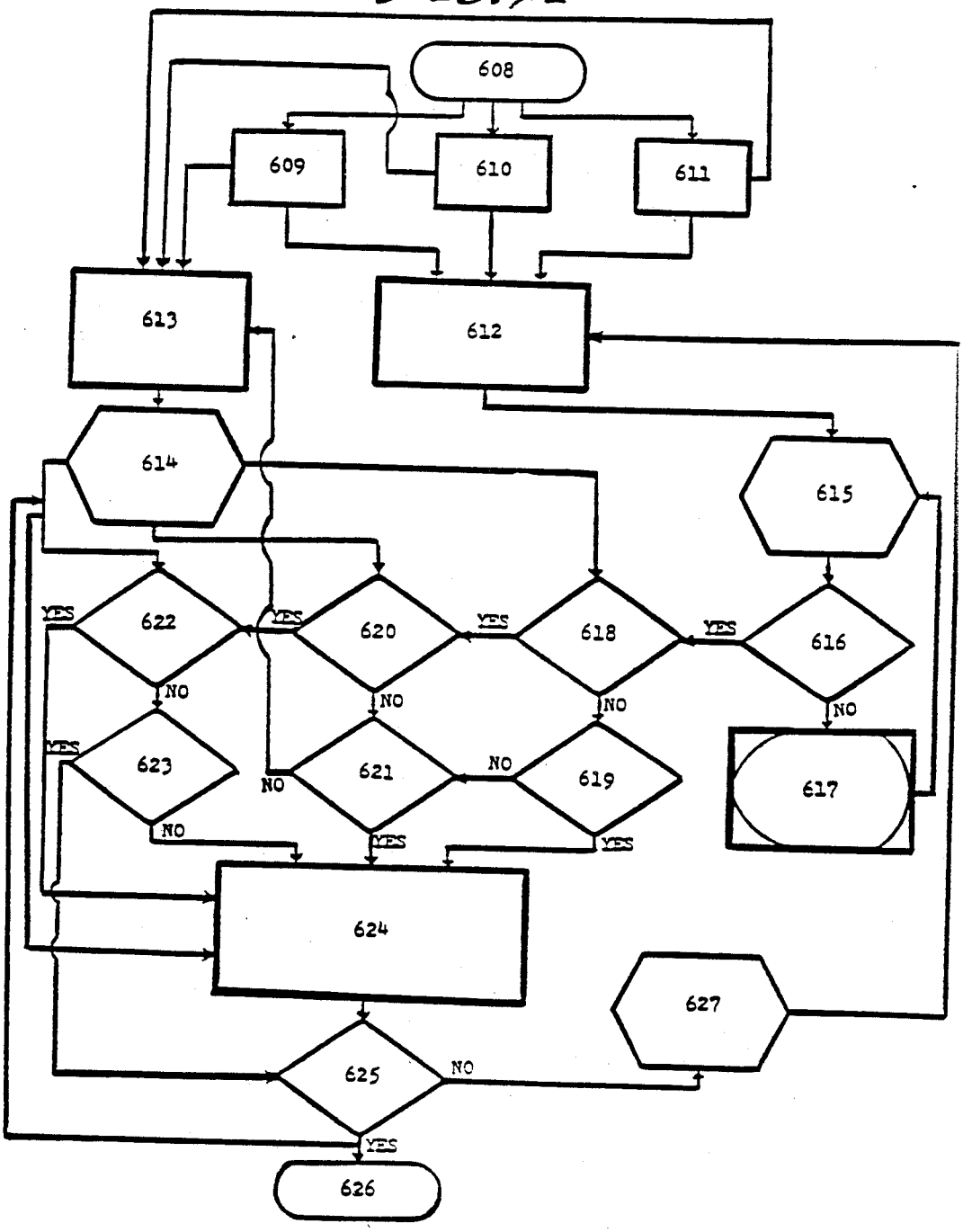
FIG. 71 is a flow chart for the programming of the radiofrequency means described in FIG. 67.

FIG. 71 is a concise flow chart for the programming of the radiofrequency means described in FIG. 67. The numeric value 608 defines the user actuated start sequence which re-enlists the laser designator means, an acoustical piezoelectric contact element and GSR/temperature contact sensors reassigned values 609, 610 and 611. Data provided by means 609, 610 and 611 is channeled to both elements 612, 613, respectively. Numeral 613 denotes an accumulator means wherein the designated individuals cardiac output, respiration, galvanic skin response, body temperature and the like are compiled to be acted upon by subprogram 614. The power discharge level, frequency, pulse shape, duration and other parameters are selected for by the user, as indicated by element 612. The administration of radiofrequency emissions and subsequent engagement of specified target areas is exacted by process 615. Decision process 616 determines whether or not given target areas or regions are engaged. If a target region is engaged, then decision process 618 is enlisted; and if a negative response is elicited, then a search process is instituted; wherein the current status is displayed by subprogram 617, which acts to return to process 615 wherein new parameters are selected by the user via number 612. Numeral 618 establishes whether or not the cardiac parameters correspond with those norms construed to be either equal to or less than the maximum tolerance level. If the cardiac output is either equal to or less than the established physiological maximums then decision process 620 is enlisted, if not decision process 619 is engaged. Decision process 619 determines whether or not the maximum limit for cardiac output has indeed been exceeded and if so subprogram 624 is engaged, if not decision 621 is enlisted. Element 620 determines whether or not respiratory parameters are obtained from the designated individuals and are either equal to or less than preprogrammed values construed to be the maximum tolerance levels for respiratory output. If the aforementioned respiratory values correspond to the said preprogrammed values then decision process 622 is engaged; if the said values do not correspond, then decision process 621 is enlisted. If it is determined that the respiratory output exceeds the maximum tolerance values then process 624 is engaged. Process 622 determines whether or not the maximum tolerance values for body temperature, galvanic skin response and the like correspond to the established values. If an affirmative answer is enlisted by element 622 then process 625 is enlisted; if however a negative response is indicated, then decision process 623 is engaged. Decision process 623 determines whether or not the maximum tolerance parameters of process 622 are exceeded or not if the said values are exceeded; then process 624 is enlisted, if not process 625 is enlisted. It is in process 624 whereby a subprogram recalibrates, resets if needed all values and temporarily terminates the on running program to display the current status to the user and to return to the user for further instructions, unless specified not to, as indicated by element 615. Decision process 625 ascertains whether or not all instructions have been executed by the system. If it is established that all instructions have been executed by process 625 then the program is terminated, as described by process 626. If however, all instructions have not been executed as determined by element 625, then system enters a subroutine wherein the information is displayed to the user, as indicated by element 627 and then is readied for receiving new instructions from the user.

Figure 72:
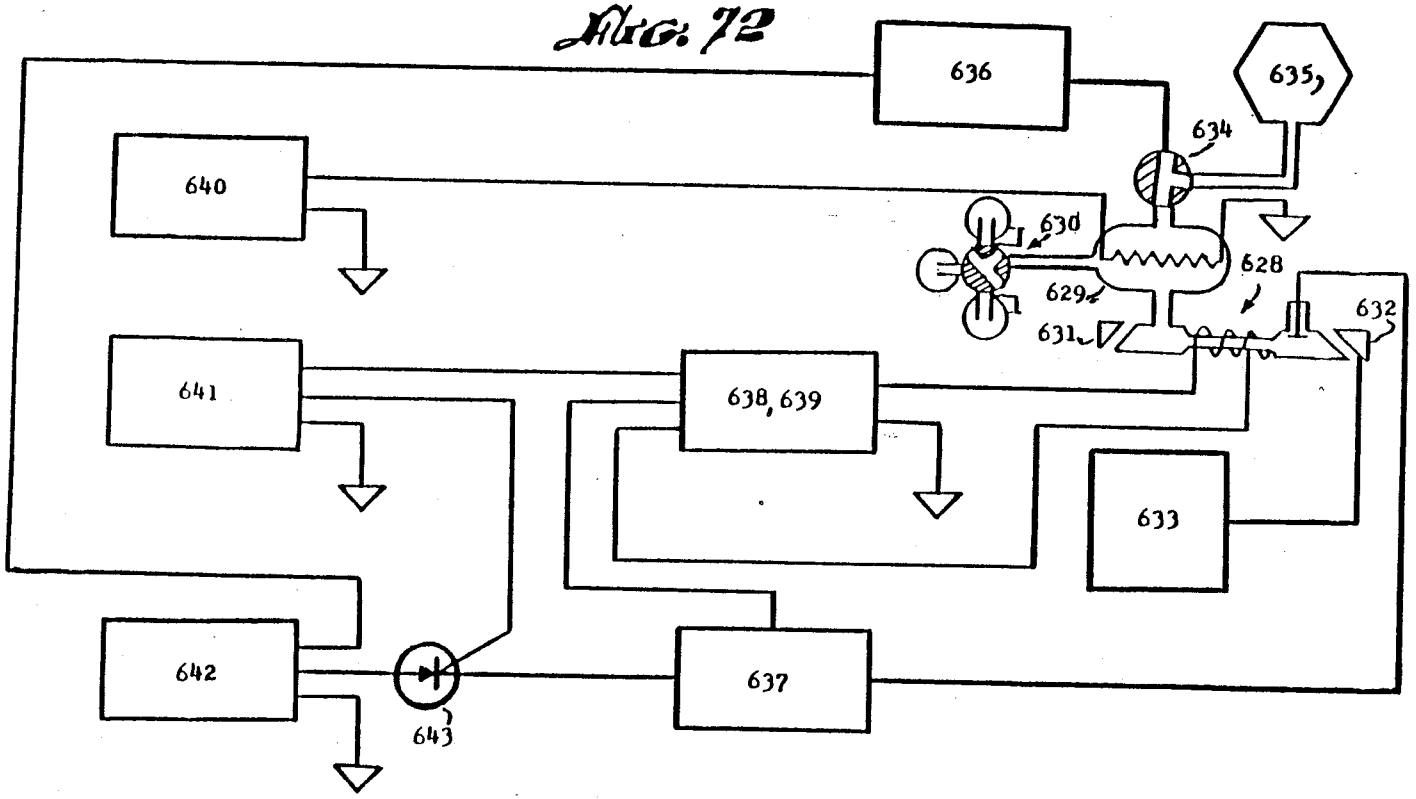
FIG. 72 is a simplified block diagram describing in part the basic operative subsystem of the laser emission means.

FIG. 72 is a simplified block diagram describing in part the basic operative subsystem of the laser emission means. A simple plasma laser generator means is indicated in FIG. 16 rather than a ruby type, chemical laser, or other suitable coherent light generating means. Numerals 628, 629 and 630 disclose the resonant cavity, the fracture resistant quartz plasma containment jacket and discharge vessel. Numerals 631, 632 and 633 represent a totally reflective prismatic mirror, a selectively emissive automated mirror and the control circuit for the same said automated mirror means. Elements 634, 635 and 636 designates an automated inlet valve or governor means for controlling the flow of plasma during the recharging cycle, a plasma reservoir containing a suitable lasing medium under pressure and a controller element utilized to regulate the release of the lasing medium and its pressure within the plasma jacket. Numerals 637, 638 and 639 are delegated to a radiofrequency element to provide additional excitation for enhanced lasing and additionally an ancillary circuitry concerned with pulse shaping formation. Units 640, 641 and 642 are assigned to the filament supply, timing circuits and power supply, respectively. Element 643 signifies a SCR means.

Figure 73:
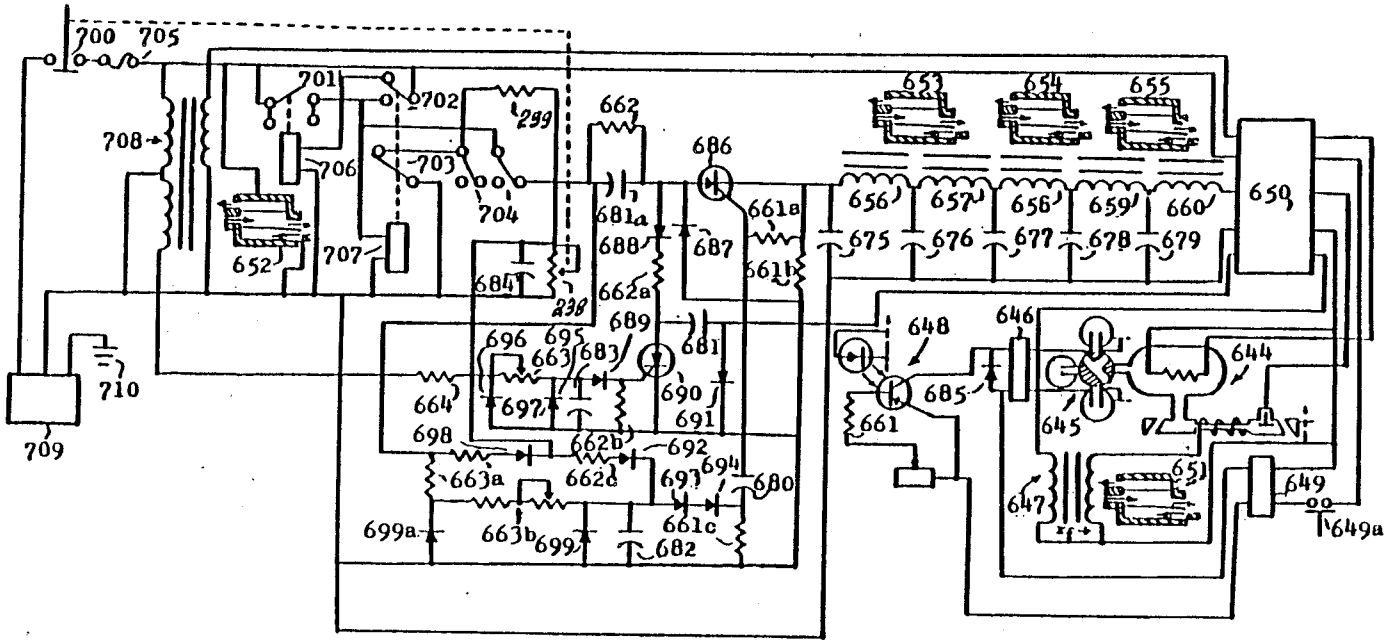
FIG. 73 is a simplified electronic circuit schematic and block diagram of the emissive laser means.

FIG. 73 is a simplified electrical schematic of a single plasma laser source generator unit. Numerals 644, 645 and 646, 647 of FIG. 73 designates the plasma ion laser generator, a valvular control governor, solenoid gas pressure valve and radiofrequency excitor means. Number 648 is collectively assigned a light emitting sensor complex utilized to detect and respond to the concentration of gaseous plasma which is contained in a given reservoir. Elements 649, 649*a* define an automated control mechanism governing the release of gas plasma from the reservoir and a manual release switch gasifier means. The central control microcomputer 650 is utilized for timing electrical impulses, sequencings of electrical impulses and the delivery or distribution of impulses to various points of junctures. Heat exchanger means are utilized to conduct thermal energy away from circuits, inductive elements and the like and are designated by values 651 to 655, inclusive. Numerals 656 through 660 are assigned to inductive elements taken in series. The resistive elements of the circuit are defined by numerals 661 through 664; whereas the capacitance elements are defined by element 675 through 684. The diode elements of the circuit diagram are indicated by numerals 685 through 699. Numerals 700, 701, 702, 703 and 704 designate switching elements for the standby and operative modes, inclusive. Numerals 705, 706 and 707 defines a fuse element and two guardian elements utilized to protect or shield the circuit. Elements 708, 709 and 710 are assigned to a transformer means, a power source and ground means.

Figures 74, 75:
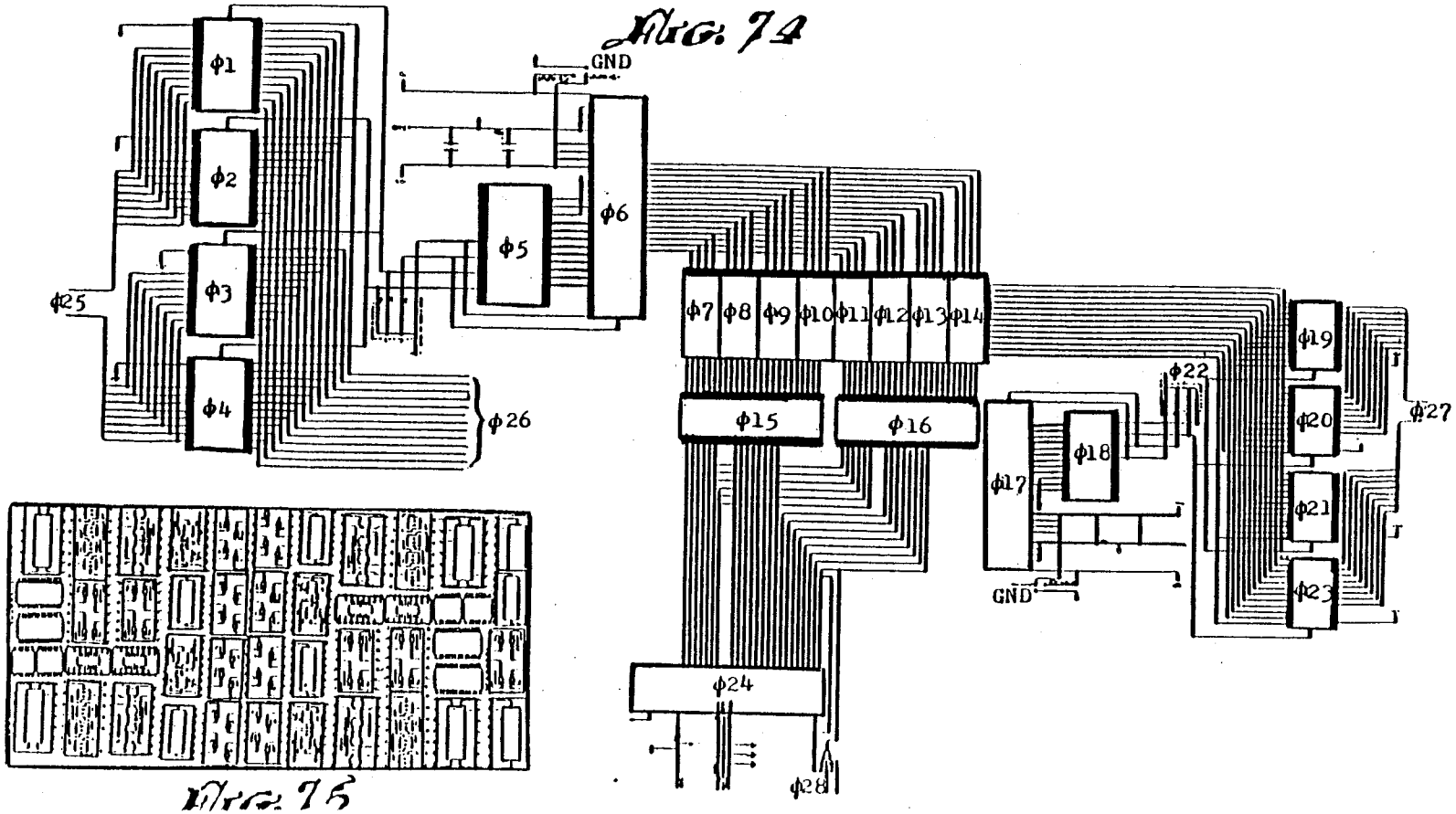
FIGS. 74, 75 discloses a portion of the repetitive logic circuit forming the basis of the microcomputer means imprinted on the insertable VHSIC card.

FIGS. 74, 75 discloses a portion of the repetitive logic circuit forming the basis of the microcomputer means which is etched or imprinted on one of several equivalent insertable VHSI cards. Here the vital portion of the circuit which is shown is equivalent to a multitude of similar such circuitry utilizing VLSI/VHSIC technology. The separate I.C. elements are so constructed as to be repetitive providing a reliable microcomputer with an increased ability to calculate and implement information, acquisition, the dissimination of data, the calculations of pursuit vectors, the administration of various aforementioned functions and their related parameters. The I.C.'s are disposed on a single portion of the VLSI card which is replaceable in and of itself as well as each of the microminiature integrated circuit means or modules. Each integrated circuit is designated by its own alphanumeric value and there are twenty-four I.C.'s depicted in the figure herein. The I.C.'s are listed by element Ø1 through Ø 6 acting as interrogator means for logic elements Ø7 through Ø14. Comparator means for data are indicated in part by elements Ø1 through Ø4 and elements Ø19 through Ø23. Alphanumeric values Ø25, Ø26, Ø27 and Ø28 are indicative of origins of embarkation wherein data either enters from other circuits or leaves from portions of the circuit, as depicted in FIG. 74 and is for other circuits. The other portions of the partial circuit diagram depicting capacitors, grid means, resistive elements and the like are straight forward to one skilled in the art and therefore are not assigned any alphanumeric value.

Figure 76:
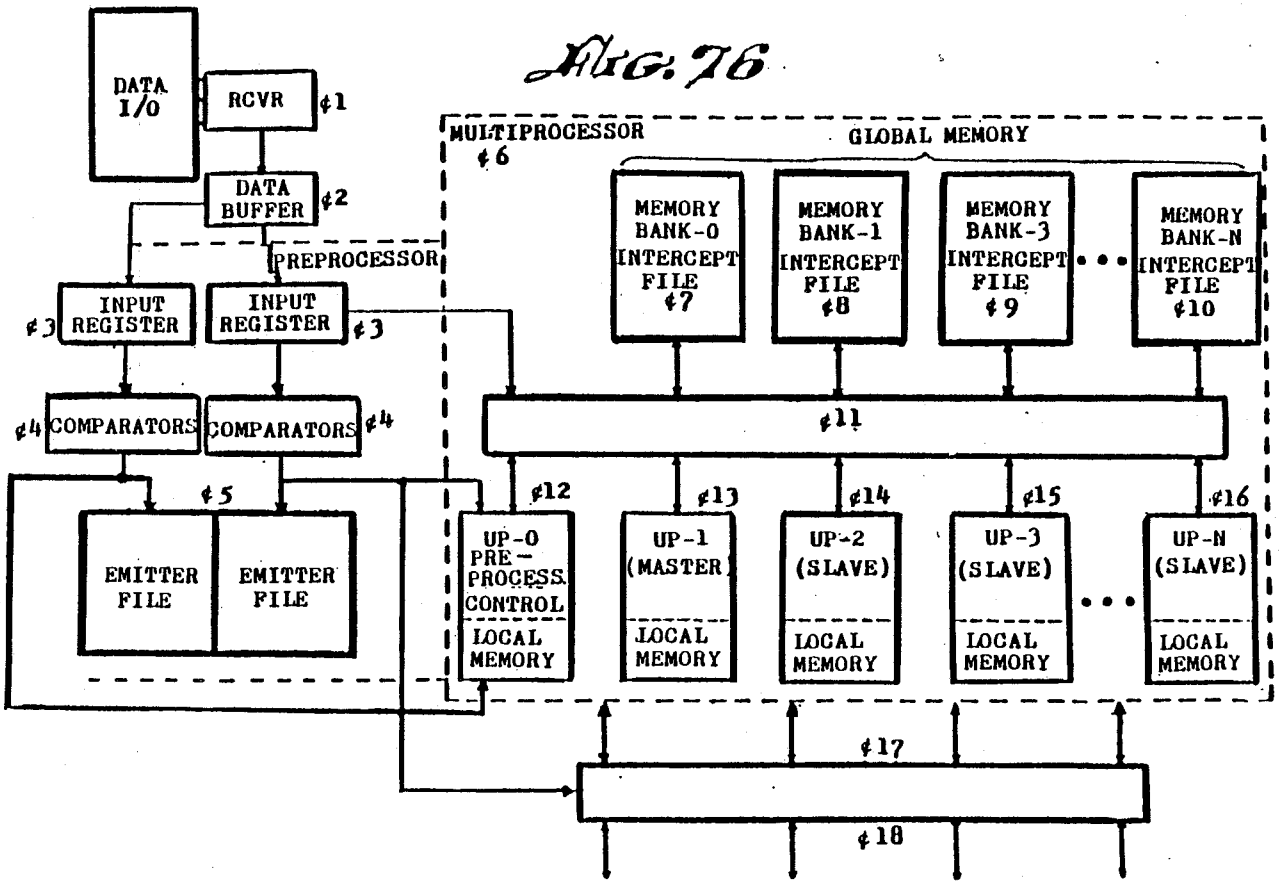
FIG. 76 entails a block diagram schematically illustrating in brief the operations of a global memory system.
Figure 76A:
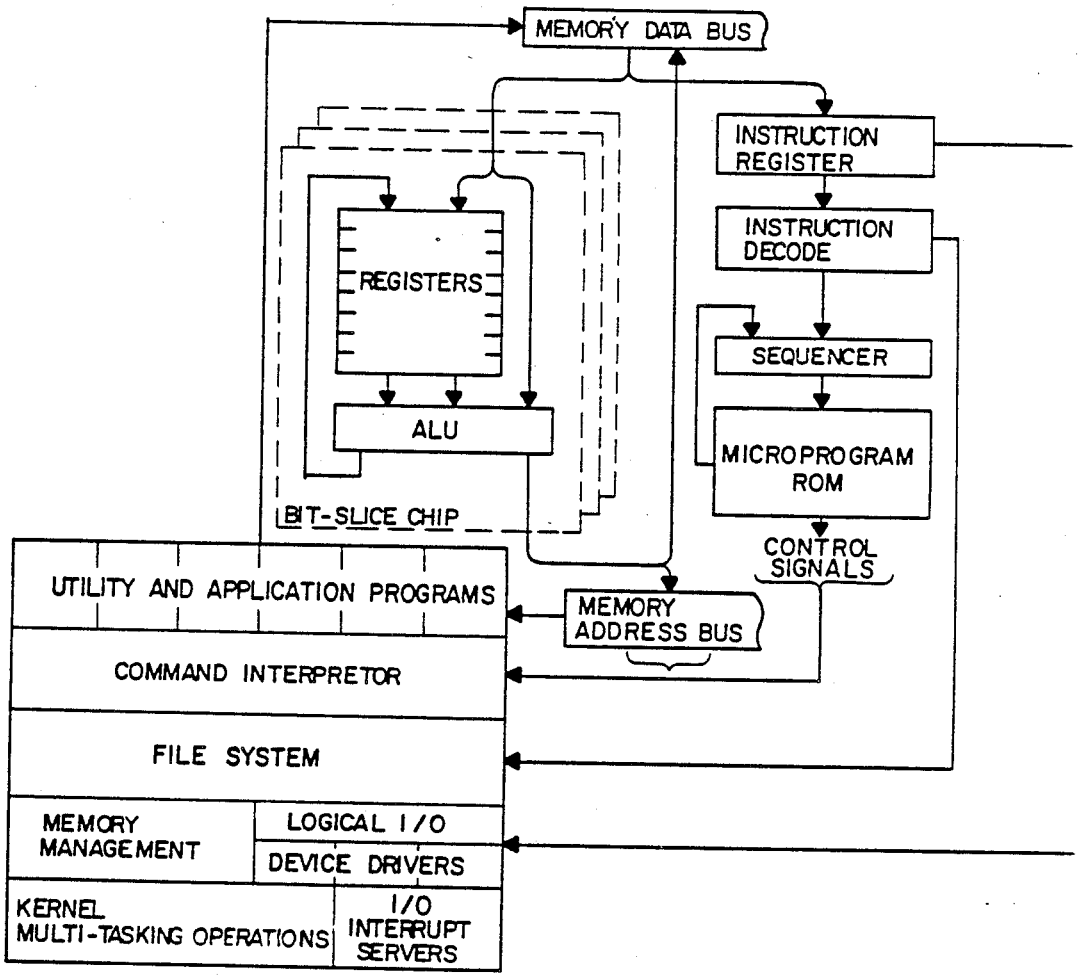
FIGS. 76*a*, 76*b* are indicative of extended operations and processes consistant with the global memory system.
Figure 76B:
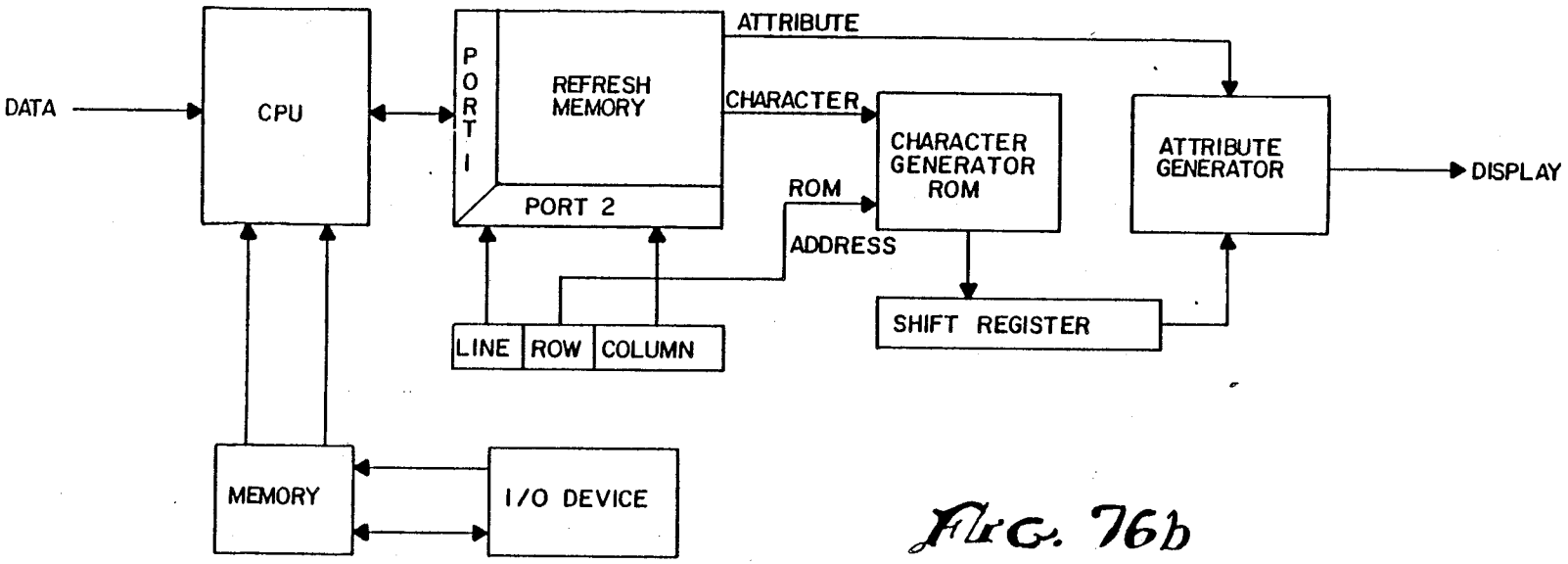

FIG. 76 entails a simplified schematic block diagram illustrating in brief the operations of a global memory system. The simplified block diagram described in FIG. 76 illustrates in an exemplary fashion a microcomputer array processor element disposited on a single VHSIC card. Information is received and encoded by element ¢1, which sends the data to be buffered by ¢2. The data obtained from ¢2 is then conveyed to a series of serial input registers, as denoted by element ¢3. The data from ¢3 is sent to a comparator bank described by ¢4 which either processes the data by sending it to an emitter file ¢5, or to a series of interrogator circuits. The microcomputer array processor means is designated by value ¢6, which is contained within the embodiment of elements that are defined by a series of memory bank elements and intercept files, denoted by elements ¢7 through ¢10; wherein element ¢10 is a memory bank consisting of a number of subelements carried out to some desired element and all of the elements, ¢7 through ¢10 form what is losely known as a global memory. Element ¢11 forms a typical memory request logic interrogator means and elements ¢12 through ¢16 form a preprocessor control local memory interrogator, a master control local memory and a series of slave memories with EEPROM capabilities. The processed data and preprocessed data are both entered directly into the systems computer controller means, as defined by embarkation point ¢17 and ¢18.

Embodied within the structure of the global memory system are integrated circuits or microprocessors which are responsible for manipulating the data fed into the microcomputer, in accordance with the operative set of instructions provided here by the user. The instructions are keyed by the user and are provided within the operative framework of a digitized list or sequence, forming a program which is encoded and stored into the memory elements of the microcomputer. Each instructional element of a sequence of instructions consists of a specified number of bits averaging 256 bits of information, which is stored in one or more registers collectively called a memory address. The number of addresses of instruction sequences to be employed by the system is stored in order to form the proper sequence in a program counter. A controller means usually receives the address of the new set of instructions from the program counter which obtains the digitized data stored in the aforementioned memory address and transfers the said data to the instruction register. The way by which data is conveyed is by three separate and distinct communication channels as designated by the, address bus, the control bus and the data bus, respectively. The instructional address placed in the program counter is entered in the address bus, which readies the storage means to yield or transmit the instructional data. A digitized signal or electrical impulse on the control bus enables the data to be transferred to the data bus means. An additional control signal conveyed to the instruction register is held while the controller means decodes it and issues further digitized control signals to perform the given set of instructions. The instructions pertain to data stored in the data buffer and may be initiated by either some input device or in and from the memory. If the instructions perform a given operation the results of the said operation may be stored temporarily in the accumulator means; wherein upon completion of the same said operation the results are sent back to the specified memory address. The ALO and accumulator means are associated with a set of condition codes also known as flags, which function as single bit registers with each unit indicating something about the results about a given operation held in the accumulator means. When subprograms and frequent subroutines are embodied within a given program, which requires several instructions in the same sequence that are conveyed to adjacent memory addresses, collectively defined as a stack means. Said stack enhances the speeds in a given operation. The memory addresses forming the stack are separately addressed as if only a single memory location and the address accessed is stored in a means defined as the stack pointer. The stack pointer functions in a specific fashion as to allow the controller to use only a single address to call for the entire stack.

A series of other ancillary registers known as general purpose registers, which are used as required. The ancillary registors have or consist of a exact finite number of register elements n, begining with an accumulator and ending with a high order byte register and a lower order byte register means. Other means are disposed in the form of external connections including, a clock, power supply, data input/output means, analog/digital converters and other means. The CPU is implemented with secondary memory devices, which are defined by such means as read only memories (ROM's). Random access memories (RAM), charged coupled devices (CCD's) or other equivalent means embodied within such means as I.C.'s are etched or imprinted on a card along with the microprocessor. The above aforementioned operations of the central processing unit CPU and how the CPU transfers data are illustrated schematically by FIGS. *76a, 76b*. Numeric values are not assigned to the elements in the figures because each element is clearly defined and staight forward, consistant with the operation of conventional computer systems.

Figure 77:
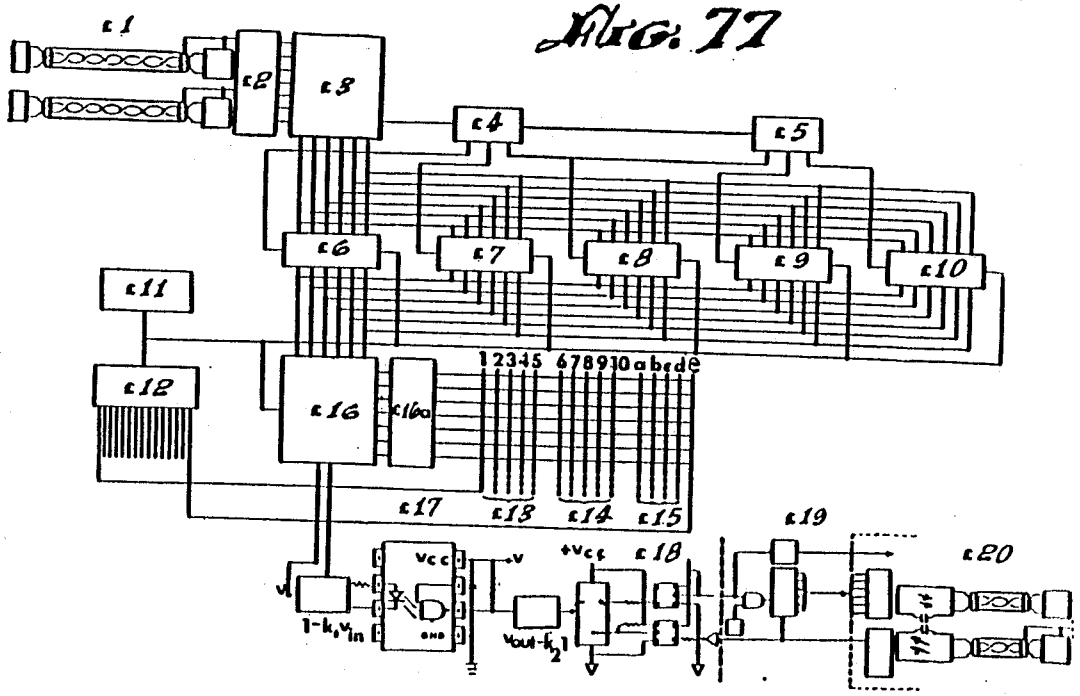
FIG. 77 describes in part a combination circuit and block diagram schematically illustrating the operation of one of several equivalent electro-optical systems embodied within the transector device.

FIG. 77 describes in part a combination circuit and block diagram schematically illustrating the operation of one of several equivalent electro-optical systems embodied within the transector device. Optical electronic analog/digital converter feedback units are typically employed by the transector means for sensory updates, scans, target pursuit and other processes. Alphanumeric values are assigned to each subsystem in order to more clearly define a few basic component systems of an array. Elements £ 1, £ 2 and £ 3 are indicative of the optical electronic sensory array, optical electronic encoder and analog/digital interfacing and keying means. Alphanumeric values £ 4, £ 5 and £ 6 through £ 10 designates an array selectors and a full complement of input storage buffers. Elements £ 11, £ 12 and £ 13 through £ 15 denotes a clock/timing means, column drivers and display terminals. Element £ 16 collectively describes a VLSI chip containing data input transfer means, a column selector, comparator encoder/decoder signal out flow means, respectively. Element £ 17, £ 18, £ 19 and £ 20 designate a voltage to frequency converter, a monopulse multivibrator drive means and a line driver receiver bidirectional means.

Figure 78:
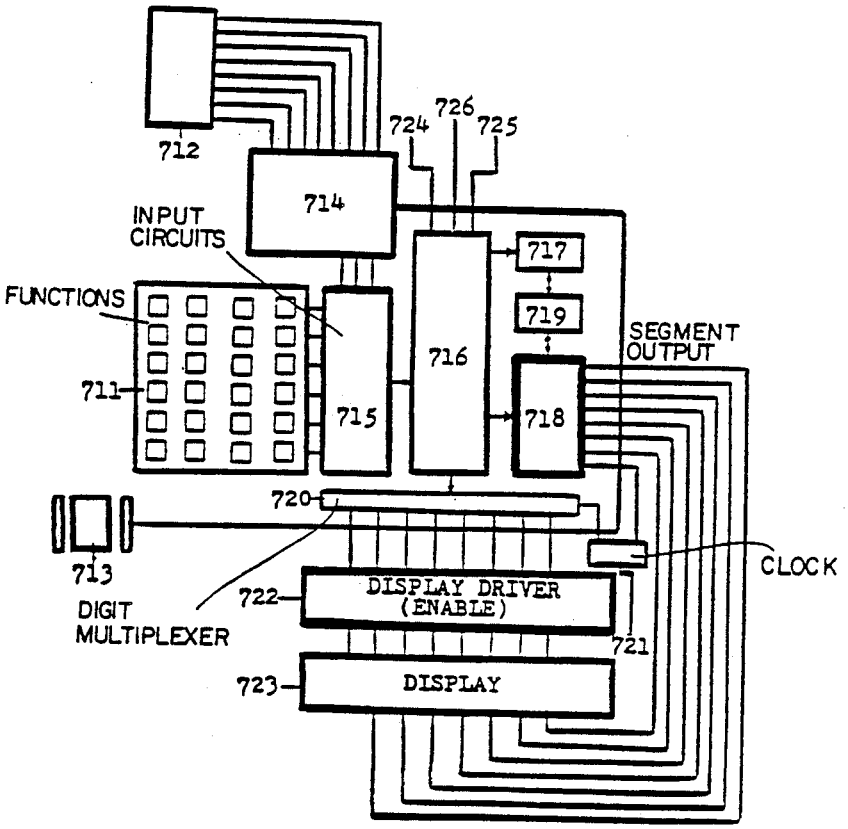
FIG. 78 illustrates in a simplified schematic fashion in part the mechanism by which the user keys the various functions of the transector device.

FIG. 78 illustrates in a simplified schematic fashion imparts the mechanism by which the user keys the various functions of the transector device. Numerals 711, 712 and 173 of FIG. 78 define interfacing elements such as, a single element multiple function key pad, a bidirectional piezoelectric system and a rotating selector means. Numerals 714, 715 designates input circuits for manual manipulator means 711, 712 and acoustical piezoelectric means 713. Element 716 is collectively assigned to the CPU means, CPU element 716 inputs directly onto elements 717, 718 and 720. Element 720 is a digit multiplexer means. Element 718 entails an IC means governing the display of data. Element 717 defines a speech synthesizer means with bidirectional capacity. Element 719 denotes a bidirectional relay circuit providing input/output flow or accessibility between element 717 and 718. Numerals 721, 722 and 723 are assigned to an ancillary clock means, the display driver (enable) and display means. Numerals 724, 725 and 726 are indicative of embarkation points; wherein data is exchanged between the CPU and other systems, a bidirectional point whereby data is conveyed from means 717, 719 for analysis and processed by speech recognition systems and ouput lines leading to the alphanumeric display means 723.

Figure 79:
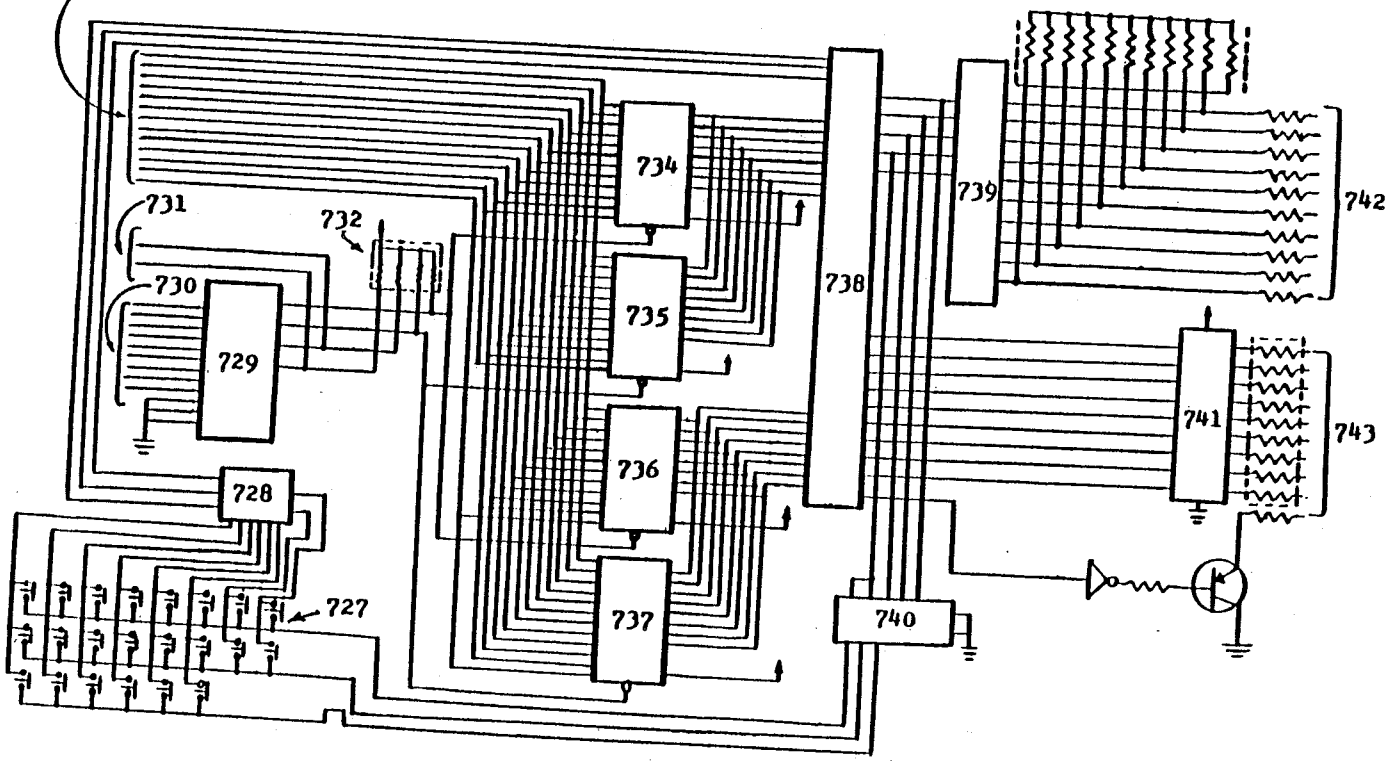
FIG. 79 defines a simplified electrical schematic designating a portion of the circuitry involved in keying the interactive screen, holographic, acoustical elements and the like systems associated with the devices operation.

FIG. 79 defines a simplified electrical schematic designating a portion of the circuitry involved in keying the interactive screen, holographic, acoustical elements and the like systems associated with the devices operation. Numerals 727 of FIG. 22 is collectively assigned to manual keying elements which are manipulated by the user to insert, recall, or modify data. All signals retrieved from duel or tri-function keying elements are essentually processed by a signal digitizer and encoder means defined by element 728. Numerals 729 designates a signal encoder/processing means to relay data derived from a radial selector knob mechanism and/or a light want means. Numbers 730, 731 and 732 are points of entry for data generated by interactive systems such as, an electro-optical video, a radial selector means and supplemental LCD touch unit. The entry and exit point defined by value 733 corresponds to circuitry concerned with voice recognition and synthesis. Integrated circuits 734, 735, 736 and 737 act as comparators and interrogators for LSI circuit 738. Other integrated circuits 739, 740 and 741 serve higher order functions and additional data signals are exchanged at points 742, 743. Resistive element, grounds and the like are straight forward and are unnumbered for the sake of simplicity.

A military version of the transector unit was similarily constructed with the same basic structural and operative functions of the said devices, but differing in the intensity of parameters and the type of projectiles delivered to designated targets. Multistage armor piercing kinetic energy projectile and miniature projectiles delivering explosive clusters where constructed for the transector unit. The multistage armor piercing projectiles are initially launched from the barrel of the transector device by compressed gases or an equivalent low velocity propellant. Once the armor piercing projectile exits the barrel of the device, a secondary high velocity propulsion system is actuated when the projectile is in flight. The secondary or second stage propellant system is calculated to cut in or be actuated a safe distance away from the user and the initial launch site in order to eliminate the near crushing recoil or danger of incineration caused upon actuating the high velocity propellant system. The secondary propulsive means consists of but is not limited to, the ignition of liquid oxygen and hydrogen to form water vapor, various military grade glycernated plastic explosives and liquified hydrazine in the presences of a suitable reactant. Completed herein below is a partial list of materials presented in a tabular form, assessed to be either an explosive means, propellant means, or precursor of each thereof and the mechanism by which said means and the like undergoes modification therein.

TABULAR FORMAT (P) ITAL AS PER U.S. GOVERNMENT ASSIGMENT

Military explosives, propellants, and pyrotechnics, and constituents and precursors thereof, as follows:

1. Guanidine nitrate
2. 2,4,6 trinitroresorcinol (styphnic acid)
3. 1,3,5 trichlorobenzene
4. 1,2,4-butanetriol (1,2,4 trihydroxybutane)
5. Bis(chloromethyl)oxetane for bis(azidomethyl)oxetane
6. Polynitroorthocarbonates Military explosives, propellants, and pyrotechnics, and constituents and precursors which are substances and mixtures that contain more than 2%, alone or in combination, of the following:

1. Nitrocellulose with nitrogen content of over 12.2%
2. Spherical aluminum powder with uniform particle size and an aluminum content of 9.7% or more
3. Metal fuels in particle sizes less than 500 microns, whether spherical, atomized, spheroidal, flaked, or ground, consisting of 97% or more of any of the following: lithium, magnesium, zirconium (ECCN 3604A), titanium, uranium, tungsten, boron, magnesium, zinc, and alloys of these; misch metal; fine iron powder (1–3 microns) produced by reduction of iron oxide by hydrogen
4. Triethylaluminum (TEA), trimethylaluminum (TMA), and other pyrophoric metal alkyls and aryls of lithium, sodium, magnesium, zinc, and boron
5. Potassium nitrate or other oxidizers (such as perchlorates, chlorates, and chromates) composited with powdered metal or other high energy fuel components
6. Nitroguanidine (NQ)
7. Compounds composed of fluorine and one or more of the following: other halogens, oxygen, nitrogen
8. Hydrazine in concentrations of 70% or more; hydrazine nitrate; hydrazine perchlorates; unsymmetrical dimethylhydrazine; monmethylhydrazine; and symmetrical dimethylhydrazine
9. Carboranes; decarborane; pentaborane and derivatives
10. Ammonium perchlorate
11. Cyclotetramethylenetetranitramine (HMX); octahydro-1,3,5,7-tetranitro-1,3,5,7-tetrazacycloctane; oktogen; octogene
12. Cyclotrimethylenetrinitramine (RDX); cyclonite; hexahydro-1,3,5-trinitrol-1,3,5,-triazine; 1,3,5-trinitro-1,3,5-triazacyclohexane; hexogen; hexogene
13. Nitroglycerin (or glyceroltrinitrate, trinitroglycerin) (NG)
14. 2,4,6-trinitrotoluene (TNT)
15. Hexanitrostilbene (HNS)
16. Diaminotrinitrobenzene (DATB)
17. Triaminotrinitrobenzene (TATB)
18. Triaminoguanidinenitrate (TAGN)
19. Any explosive with a crystal density greater than 1.8 g/ml an composed of compounds of carbon hydrogen, nitrogen, and oxygen or fluorine
20. Any explosive with a detonation velocity greater than 8,700 m/s or a detonation pressure greater than 340 kilobars
21. Ethylenediaminedinitrate (EDDN)
22. Pentaerythritoltetranitrate (PETN)
23. Lead azide, normal and basic lead styphnate, and primary explosives or priming compositions containing azides or azide complexes
24. Other organic high explosives yielding detonation pressure of 250 kilobars or greater that will remain stable at temperatures of 250° C. or higher for periods of 5 minutes or longer
25. Boron hydrides (ECCN 1715A); titanium subhydride of stoichiometry $TiH_{0.65-1.68}$
26. Hydroxylammonium nitrate (HAN); hydroxylammonium perchlorate (HAP)

Military explosive, propellant, and pyrotechnic constituent and precursor additives, such as:

1. Glycidylazide polymer (GAP)
2. Polycyanoidifluoraminoethyloxide (PCD)
3. Trimethylolethanetrinitrate (TMETM); metrioltrinitrate (MTN)
4. Triethyleneglycoldinitrate (TEGDN)
5. Butanetrioltrinitrate (BTTN)
6. Bis-2-fluoro-2,2-dinitroethylformal (FEFO)
7. Butadienenitrileoxide (BNO)
8. 1-vinyl-2-pyrrolidinone; 1-methyl-2-pyrrolidinone
9. Dioctylmaleate
10. Ethylhexylacrylate
11. Catocene
12. 2,2-dinitropropanol
13. Bis (2,2-dinitropropyl) formal and acetal
14. 3-nitraza-1,5-pentane diisocyanate
15. Basic copper salicylate; lead salicylate
16. Lead beta-resorcylate
17. Lead stannate; lead maleate; lead citrate
18. Monomers and polymers containing energetic nitro, azido, nitrato, or nitrazo groups Military explosive, propellant, and pyrotechnic constituent and precursor stabilizers, including:

1. Ethyl and methyl centralites
2. N,N-diphenylurea (unsymmetrical diphenylurea)
3. Methyl-N,n-diphenylurea (methyl unsymmetrical diphenylurea)
4. Ethyl-N,N-diphenylurea (ethyl unsymmetrical diphenylurea
5. 2-Nitrodiphenylamine 2NDPA
6. p-Nitromethylaniline; N-methylparanitroaniline.
7. 4-Nitrodiphenylamine (4NDPA)

The armor piercing projectile itself is formed from a variety of materials including but not limited to synthetic diamond based composites, expended fissiles materials such as U238, silicon nitride based ceramics. At a limited range of between 300 and 600 meters such projectiles have developed sufficient velocity to penetrate four to six inches of hardened alloy steel. The portion of armored material upon penetration by a kinetic energy projectile is converted into an energetic molten metal, which exits the obverse of the point of initial penetration as a high velocity plasma like spray. The armor piercing projectiles is especially effective against tanks, armored vehicles or other reinforced, or fortified structures. Projectiles containing miniature clusters of explosives, fragments and/or incindraries are effective against anti-personel devices in the open field at a range of 500 meters. Therefore, the only differences between the military version of the transector device and the form of the transector device deployed in civilian operation are restricted to the types of projectile dispersed from the said device and the operative parameters contained within the said devices programmable functions.

Figure 80:
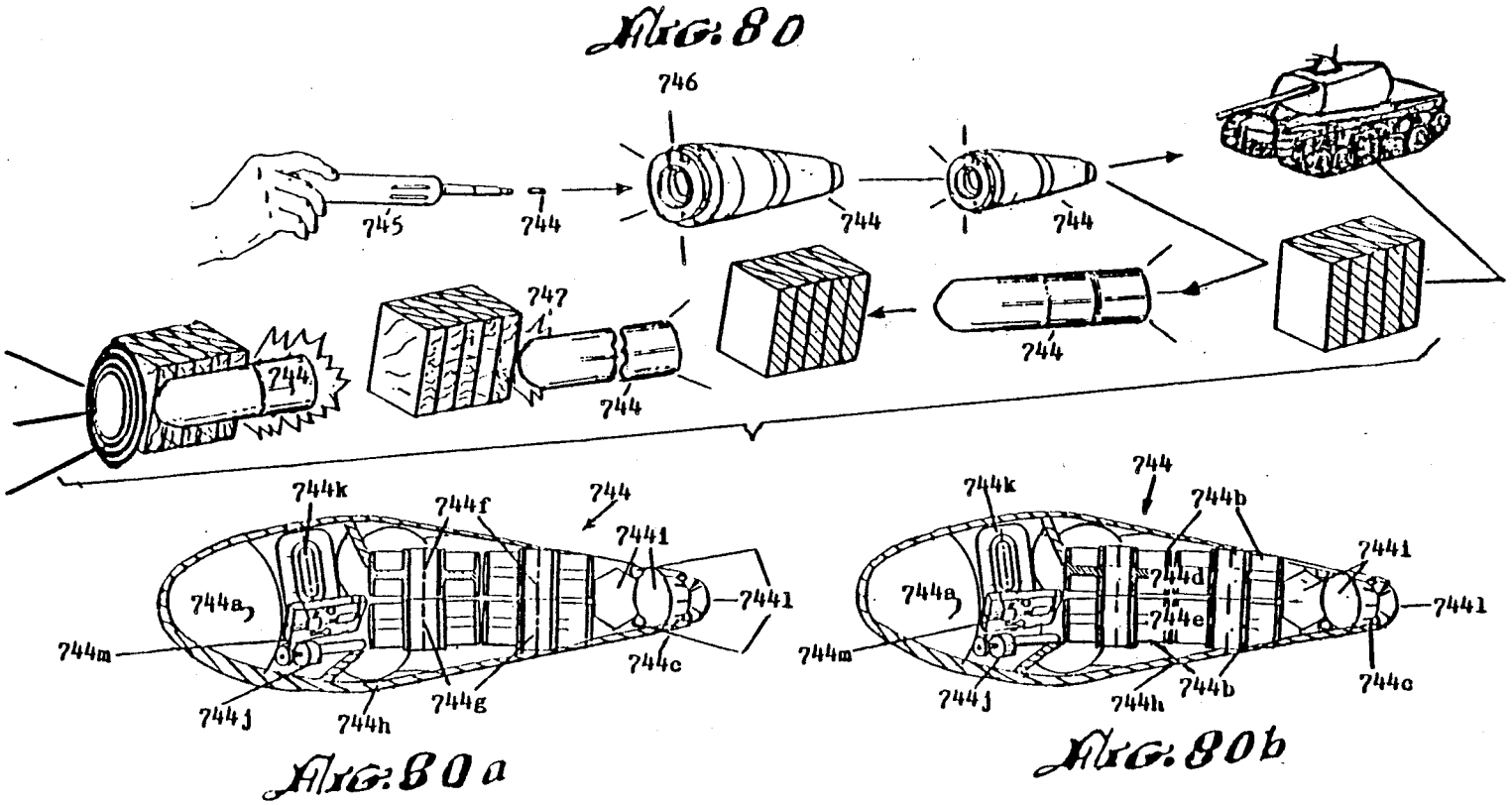
FIG. 80 is a pictorial representation illustrating in a concise manner the delivery of a kinetic energy projectile dispersed from the user based transector device.

FIG. 80 is a pictorial representation briefly illustrating the delivery of a kinetic energy projectile dispersed from the user based transector device. The kinetic energy projectile, number 744, is dispatched from the transector device, number 745, by programming initiated by the user. The said projectile 744 is dispatched initially from the aforementioned transector device by the thrust supplied by the release of compressed air or the detonation of a liquid or solid propellant charge. Once the kinetic energy projectile has traveled a specified distance from its initial launch point, usually four to ten meters, the secondary propulsion system is actuated, as indicated by numeral 746. Maximum velocity is usually achieved within about one hundredth of a second after the initial launch of the kinetic energy projectile. As mentioned previously, the secondary propulsive means is actuated a distance from the user based transector device because of the enormous recoil and intense heat generated by the secondary propulsion system. Special formulations of liquid hydrogen, oxygen hydrazine, explosive plastic gels are suitable propulsive means. The impact of kinetic energy projectile 744 onto a specified portion of a hardened structure is indicated by numeral 747. Reinforced concrete will be reduced to powder, occasionally fragmetize and produces sparks due to friction throughout a linear section wherein impact occurs. Metallic structures upon impact with said kinetic energy projectiles are reduced to a pressurized stream or spray of molten white hot metal. The effects on reinforced structures or armor plating of kinetic energy type projectile is well documented by classified and unclassified reports received from the DOD, American military and various member nations of NATO (specifically the Frensh and British governments). A partially sectioned perspective of two types of kinetic energy projectiles are depicted in the forgoing.

FIGS. 80*a*, 80*b* disclose sectioned views of unit 744 a precision guided munition equivalent to a SMART system. Numerals 744*a*, 744*b* and 744*c* designate the armor piercing tip, a cartridge containing a suitable hypervelocity propellant and a secondary automated ignition system. The armor piercing projectile are composed of materials containing but not limited to silicon carbide, silicon nitride expended uranium or other suitable materials. The solid propellant means consists but is not limited to a shock resistant explosive glycerated gel, a class of exergonic chemical powders, chemical reactants/oxidants, or any suitable propulsive mediums. The liquified reactant and oxidant means are indicated by numerals 744*d*, 744*e*. Numerals 744*f*, 744*g*, 744*h* and 744*i* designate separate housing chambers for the reactant and oxidant means, the outer casing structure and a reaction vessel for the combustion of the reactant in the presences of the said oxidant. Numeral 744*c* defines a secondary electronic ignition system providing the initial means; whereby a spark ruptures a portion of 744*d* and 744*e* allows contents of each to enter reaction vessel 744*i* and subsequently igniting the reactant oxidant mixture therein. Once an armored or fortified structures are penetrated by one or more kinetic energy projectiles, then designated targets may be reached with additional projectiles carrying volatiles or other suitable materials. Said projectiles carry one or more miniature explosives or elements which undergo fragmentation upon impact, such means were constructed, implemented and delivered by a modified transector unit. The said explosive or fragmentation projectiles conformed to the design and operation of similar such means already in use by the military and therefore have not been discussed to any large extent. The subsequent implementation of the transector device's projectile system with an autonomous miniature precision guided means necessitated the incorporation of a subminiature internal guidance system, steering means and a VLSI, CPU; briefly indicated by elements 744*j*, 744*k* and 744*l*, 744*m* respectively, allowing the aforementioned projectile means to function autonomously once it is in the launch mode. Unit 744 is a precision guided munition corresponding to a SMART system.

MATHEMATICAL EQUATIONS AND FORMULAS RELATED TO THE OPERATION OF THE INVENTION

The complexing of volatiles and penetrator substances to form a carrier mediated volatile mixture. Complexing occurs in the mixing chamber as stated earlier in the specifications. Let the volatile substance consists of a mixture of stable chemical species A, B, C and D and the penetrator substance be composed of chemical species L, M and N which are initially in a state of chemical equilibrium at temperature T and pressure P, such that all species are related by two independent reactions as described in brief herein below:

$$^{v}A_1A+v_BB\rightleftharpoons v_CC+v_DD$$

$$^{v}A_2A+v_LL\rightleftharpoons v_MM+v_NN$$

wherein species A takes parts both of the said reaction. The stoichiometric coefficients differs from the number of moles present in the mixing chamber, the coefficients $V_A$, does not necessarily equal the coefficient VAZ and that species A contibution in each of the above reaction differs. Here A, B and L decrease in the number of moles; whereas there is a increase in the number of moles of species for C, D, M and N. The degrees of reaction for both reactions is described by $P_1$, $P_2$, respectively and once intermixed the changes in the number of moles are defined by nfinitesimal shifts from equilibrium composition as follows:

$$dn_A=-v_{A1}dp_1-v_{A2}dp_2$$

$$dn_B=-v_Bdp_1$$

$$dn_B=-v_Ldp_2$$

$$dn_C=+v_Cdp_1$$

$$dn_D=+v_Ddp_1$$

$$dn_M=+v_Mdp_2$$

$$dn_N=+v_Ndp_2.$$

The changes in the Gibbs function for the mixture in the mixing at a constant temperature and pressure is:

$$dG_{T,P}=\bar{G}_Ad\text{-}n_A+\bar{G}_Bdn_B+\bar{G}_Cdn_C+\bar{G}_Ddn_D+\bar{G}_Ldn_L+\bar{G}_Mdn\text{-}M+\bar{G}_Ndn_N$$

and upon substitution yeilds terms $$dG_{T,P}=(v_C\bar{G}_C+v_D\bar{G}_D-v_{A1}\bar{G}_A-v_B\bar{G}_B)dp_1+(v_M\bar{G}_M-v_N\bar{G}_N-v_{A2}\bar{G}_A-v_LG_L)\,dp_2.$$

It is considerably more convenient to express each of the partial molal Gibbs functions in terms of the relation $$\bar{G}_i = g_i^{\circ} + RT \ln\left(\frac{y_i P}{p^o}\right)$$

which yields $$dG_{T,P} =$$

$$\left[\Delta G_1^o + RT \ln \frac{y_C^{\nu C} y_D^{\nu D}}{y_A^{\nu A} 1 y_B^{\nu B}} \left(\frac{p}{p^o}\right)^{\nu C + \nu D - \nu A1 - \nu B}\right] dp_1 +$$

$$\left[\Delta G_2^o + RT \ln \frac{y_M^{\nu M} y_N^{\nu N}}{y_A^{\nu A} 2 y_L^{\nu L}} \left(\frac{p}{p^o}\right)^{\nu M + \nu N - \nu A2 - \nu L}\right] dp_2$$

the standard state change in the Gibbs function for each reaction is defined by $$\Delta G_1^{\circ} = \nu_C g_C^{\circ} + \nu_D g_D^{\circ} - \nu_{A1} g_A^{\circ} - \nu_B g_B^{\circ}$$

$$\Delta G_2^{\circ} = \nu_M g_M^{\circ} + \nu_N g_N^{\circ} - \nu_{A2} g_A^{\circ} - \nu_L g_L^{\circ}$$

The equilibrium constants for the two reactions can be defined by the expressions $$\ln K_1 = -\frac{\Delta G_1^o}{RT}$$

and $$\ln K_2 = -\frac{\Delta G_2^o}{RT}$$

with equilibrium achieved at some point in time described by the equations $$K_1 = \frac{y_C^{\nu C} y_D^{\nu D}}{y_A^{\nu A} 1 y_B^{\nu B}} \left(\frac{p}{p^o}\right)^{V_C + V_D - \nu_{A2} - \nu_B}$$

and $$K_2 = \frac{y_M^{\nu M} y_N^{\nu N}}{y_A^{\nu A2} y_L^{\nu L}} \left(\frac{p}{p^o}\right)^{\nu_M + \nu_N - \nu_{A2} - \nu_L}$$

wherein the equilibrium constants $k_1$ and $k_2$ are functions of temperature and the equilibrium equations must be solved simultaneously for the equilibrium composition of the said mixtures. Upon exiting the transector devices the carrier mediated volitile will eventually be administered to a designated target wherein disassociation will occur. Consider the disassociation of the diatomic species AB into a monoatomic species A,B as an oversimplification of two or more chemical species, a volatile and penetrator is complexed or temporarily combined to form a carrier mediated volatile. This is described now by the expression defined by equation $AB \rightleftharpoons A + B$ where it is assumed the mixture behaves statistically as an ideal gas mixture composed of three components AB, A and B with the most probable distribution being described as follows: Each spieces has its own set of energy levels $$\epsilon AB_1, \epsilon AB_2, \ldots, \epsilon AB_j$$

$$\epsilon A_1, \epsilon A_2, \ldots, \epsilon A_j$$

$$\epsilon B_1, \epsilon B_2, \ldots, \epsilon B_j$$

the values of each are fixed for a given system with volume V and having the corresponding degeneracy $$gAB_1, gAB_2, \ldots, gAB_j, gAB_1, gA_2, \ldots, gA_j, gB_1, gB_2, \ldots gB_j.$$

A mixture composed of a definitive finite number of particles of each species $N_{AB}$, $N_A$, $N_B$ which are not necessarily in a single state of chemical equilibrium, but in a state of dynamic flux contained in some cohesive volume at temperature, T. The said particles are destributed across various energy levels with the distributor being specified by the number of particles of each species in each of the following energy levels.

$$N_{AB1}, N_{AB2}, \ldots, N_{ABj}$$

$$N_{A1}, N_{A2}, \ldots, N_{Aj}$$

$$N_{B1}, N_{B2}, \ldots, N_{Bj}$$

with restriction $$N_{AB} = \sum_{ABj} N_{ABj}$$

$$N_A = \sum_{Aj} N_{Aj}$$

$$N_B = \sum_{Bj} N_{Bj}$$

The thermodynamic probability u for the mixture for any given distribution of particles among the said energy level is defined by the expression $$w = (w_{AB})(w_A)(w_B) =$$

$$\left(\prod_{ABj} \frac{g^{N_{ABj}}}{N_{ABj}}\right)\left(\prod_{Aj} \frac{g^{N_{Aj}}}{N_{Aj}}\right)\left(\prod_{Bj} \frac{g^{N_{Bj}}}{N_{Bj}}\right)$$

Since each state for a component A can either be associated with any state B or AB the statistical value u for the mixture is simply the product of those of the individual constituents, as in the preceding expression with the energy distribution expressed as $$U = \sum_{ABj} N_{ABj} \epsilon_{ABj} + \sum_{Aj} N_{Aj} \epsilon_{Aj} + \sum_{Bj} N_{Bj} \epsilon_{Bj} \epsilon_{Bj}$$

with the most probable distribution for the system with a finite number of particles or species of each time and fixed energy of the system is more conveniently expressed in its logarithmic form $$\ln w = \sum_{ABj} N_{ABj} \ln \frac{gABj}{N_{ABj}} + \sum_{Aj} N_{Aj} \ln \frac{gAj}{N_{Aj}} + \sum_{Bj} N_{Bj} + \ln \frac{gBj}{N_{Bj}} + N_{AB} + N_A + N_B$$

with the most probable distribution having the maximum value u. Differentially the preceding equation and seting the result equal to zero one obtains.

$$d \ln w = -\sum_{ABj} \ln \frac{N_{ABj}}{g_{ABj}} dN_{ABj} - \sum_{Aj} \ln \frac{N_{Aj}}{g_{Aj}} dN_{Aj} - \sum_{Bj} \ln \frac{N_{Bj}}{g_{Bj}} dN_{Bj} = 0$$

which is subject to the constraints $$dN_{AB} = \sum_{ABj} dN_{ABj} = 0,\ dN_A = \sum_{Aj} dN_{Aj} = 0,\ dN_B = \sum_{Bj} dN_{Bj} = 0$$

$$dU = \sum_{ABj} \epsilon_{ABj}\, dN_{ABj} + \sum_{Aj} \epsilon_{Aj}\, dN_{Aj} + \sum_{Bj} \epsilon_{Bj}\, dN_{Bj} = 0$$

However, if one utilizes the method of undetermined multipliers to find the most probable distribution the above aforementioned constraints can be muliplied by $\alpha_{AB}$, $\alpha_A$, $\alpha_B$ and $\beta$ respectively and upon summation and collecting terms the most probable distribution becomes $$\ln \frac{N_{ABj}}{g_{ABj}} + \alpha_{AB} + \beta\epsilon_{ABj} = 0 \text{ for all } AB_j$$

$$\ln \frac{N_{Aj}}{g_{Aj}} + \alpha_A + \beta\epsilon_{Aj} = 0 \text{ for all } A_j$$

$$\ln \frac{N_{Bj}}{g_{Bj}} + \alpha_B + \beta\epsilon_{Bj} = 0 \text{ for all } B_j$$

If the expression $\beta = 1/kT$ is substituted into expression $$\ln \frac{N_{ABj}}{g_{ABj}} + \alpha_{AB} + \beta\epsilon_{ABj} = 0 \text{ for all } AB_j$$

it can now be written in the form $$N_{ABj} = g_{ABj} e^{-\alpha_{AB}} e^{-\epsilon_{ABj}/kT}.$$

Summing overall ABj the expression below is obtained $$N_{AB} = \sum_{ABj} N_{ABj} = e^{-\alpha_{AB}} \sum_{ABj} e^{-\epsilon_{ABj}/kT} = e^{-\alpha_{AB}} Z$$

wherein the partition function $Z_{AB}$ for the said substance AB is defined in the usual manner and the most probable distribution for $$N_{ABj} = \frac{N_{AB}}{Z_{AB}} g_{ABj} e^{-\epsilon_{ABj}/kT}$$

and by a equivalent procedure $$N_{Aj} = \frac{N_A}{Z_A} g_{Aj} e^{-\epsilon_{Aj}/kT}$$

$$N_{Bj} = \frac{N_B}{Z_B} g_{Bj} e^{-\epsilon_{Bj}/kT}$$

which expresses the most probable distribution of particles of various species among their respective energy levels for given $N_{AB}$, $N_A$, $N_B$ and U. By substituting the above aforementioned expressions into the equation $$\ln w = \sum_{ABj} N_{ABj} \ln \frac{g_{ABj}}{N_{ABj}} + \sum_{Aj} N_{Aj} \ln \frac{g_{Aj}}{N_{Aj}} + \sum_{Bj} N_{Bj} \ln \frac{g_{Bj}}{N_{Bj}} + N_{AB} + N_A + N_B$$

the thermodynamic probability for the so called most probable distribution is obtained by the following expression $$\ln wmp = N_{AB}\left[\ln\left(\frac{Z_{AB}}{N_{AB}}\right) + 1\right] + N_A\left[\ln\left(\frac{Z_A}{N_A}\right) + 1\right] + N_B\left[\ln\left(\frac{Z_B}{N_B}\right) + 1\right] + \frac{U}{kT}$$

The mixing process, distribution and the like for mixtures of carrier mediated volatiles is general and intentionally over simplified in a effort to give the user a good but incomplete operational definition of some of the processes.

Three separate and distinct classes or types of cryogenic carrier mediated volatiles were delivered by the transector device. The first class, type I, consisted of but was not limited to pressurized, liquified alcohols, ethers, or other suitable substances with low boiling points and rendered relatively inflammable by certain additives well known by those skilled in the art. Type I cryogenics readily absorb thermal energy from a specified region of a targeted individual, which subsequently undergoes immediate evaporation or vaporzation; wherein said absorbed heat is dissipated or evolved in the vaporization process. A second class of carrier mediated volatiles of cryogenics, type II, consists of but are not limited to liquified natural gases, freon ($CBr\ F_3$, $CC12F_2$), condensed carbon dioxide or other suitable substances. Type II cryogenic substances readily absorb energy and dissipates said energy by undergoing phase change expansion to increase the entropy and decrease the enthalpy of an effected region, lowering the temperature of the said region. Carbon dioxide undergoes sublimation expanding five to seven orders of magnitude upon its subsequent release; whereas liquified natural and/or synthetic gases undergo expansion from a liquified state to a gaseous state. Type III carrier mediated volatiles consist of but are not limited synthetic byproducts of liquid nitrogen and related superconducting, supercold, or refrigerated substances which are liquified in special deware containers, or require complex maintance procedures. The operation of Type III cryogens are typical and well understood by those skilled in the art. The drawbacks of said type III cryogens are obvious, a high maintence factor, the requirement of special refriguration support apparatuses with a limited servicable life and the limited shelf life (10 minutes to six hours) of said cryogens. Entailed herein below are a series of equation depicting in brief the thermodynamical aspects of three classes of carrier mediated cryogenic volatiles. Typically the enthalpy, H, or heat content of any given substance is disclosed by the internal energy E and the sum of the product of pressure P and volume V such that, $$H = E + PV$$

$$\Delta H = \Delta E + P\Delta V = q$$

and the change in enthalpy, H, is equivalent to the heat absorbed by a given system q in which the work performed is mechanical pressure volume, as described by the term (P Δ V) wherein, the change in internal energy is defined by ΔE, and the expression of (q−P Δ V), which is the heat absorbed by a given substance minus the work done. The heat absorbed by a given substance wherein pressure volume work is done under conditions whereby no chemical reaction or state transitions transpire and temperature T, rises such that, the ratio of heat absorbed over the differential temperature increases, the heat capacity C, and at a constant pressure Cp, which is most often computed in calories/degree mole such that $$\left(\frac{\partial H}{\partial T}\right)_p = C_p$$

A substance undergoing a phase transition or transformation from one physical state to another, such as evaporation or vapaorization of a liquid, fusion or sublimation of a solid into a gas, or some polymorphic transition; the heat absorbed by the said substance during the transformation is defined as latent heat or transformation. The aforementioned transformation process whether it be evaporation, fusion, sublimation vaporization or the like, is equal to the enthalpy difference of the said process between the said states. The values L or of H with subscripts t, f, m, s and v are employed to indicate said states at equilibrium, at standard conditions of temperture and pressure (760 mm, 298.15° K. ) and the units of said substances are calculated as a molar quantity (calories or kilocalories per mole or gram formula weight). A substance undergoing a single phase transition with the latent heat at temperature Tt the enthalpy change between temperatures $T_1$ and $T_2$ with $T_1 < T_t < T_2$ is expressed by the equation $$H_\tau - H_\tau = \int_{\tau_1}^{\tau_t} C_p dT + \Delta h_f + \int_{\tau_t}^{\tau_2} C'_p dT$$

wherein C'p, C''p are the heat capacities of said substance in two separate and distinct physical states.

The process of evaporation is basically a process wherein a phase change is induced by subjecting a substance to an increment in temperature which remains constant at the temperature of vaporization Tv, until said substance a liquid is converted into a vapor. Initially the said liquid substance is confined within a container which adjusts its volume V and said liquid exerts a pressure P. Once released said fluid substance, a liquid, expands at a constant rate of expansion at p, unless acted upon by another force. The said liquid remains in a fluid state until sufficient heat is supplied; wherein Tv(P) is attained and the fluid is converted into a gas, g. The temperture of vaporization defined by TV(P) is related to the pressure by the Clausius-Clapeyron equation herein below.

$$dT_v/dP = (T_v/nL_v)(V_g - V_l)$$

wherein Lv is the latent heat of evaporation per mole of material at pressure p, $V_1$ is the volume of the material as a liquid prior to evaporation the volume of gas, Vg is significantly greater than $V_1$, $T_v$ and changes far more rapidly with P, than does $T_m$. The reciprocal of the aforementioned Clauius-Claperyron equation described herein below.

$$dP_v/dT = [nL_v/T(V_g - V_l)]$$

defines a condition equilibrium is attained between a given substance either a liquid or fluid which does not completely fill a container; wherein some of the substance evaporates into the free space above said substance such that, equilibrium is established between evaporation and condensation therein. The vapor pressure Pv is a function of temperature T. The pressure of some foreign gas in the free space above the surface of said liquid or fluid has an indirect effect on the quantity of vapor present wherein the total pressure P exerted on said liquid is the sum of partial pressures Pf of said foreign gas and Pv of said vapor. The addition of more foreign gas to increase the total pressure P by dP, at a constant T will increase the Gibbs function of said liquid by $dG_l = V_l dP$, however the same quantity of material present in gaseous form is not affected by said foreign gas and $dG_g = V_g dP_v$. The relationship between vapor pressure PV (P,T) and presence of said foreign gas on the total pressure is given by the expression, $$dP_v/dP = V_l/V_g$$

and may be integrated from the initial state wherein no foreign gas is present and $P = p_u$ and $P_u$ solving the previous equation to the final state, whereas $P = P_f + P_w$. Vg is significantly greater than $V_1$, $P_v$ and changes negligibly when said foreign gas is added. The subsequent addition of a foreign gas forces a small but significant amount of vapor out of said liquid rather than forcing same said vapor back into the said liquid.

A special case of sublimation wherein a solid S sublimes at a low relative pressure to that of its confinment in a container at a sublimation temperature Ts, which is large compared to some arbritrary $\theta$ with linear expansion properties. The equation relating the sublimation temperature Ts, and sublimation pressure Ps for some specified quantity N molecules of mass at Volume V is approximately $$\begin{aligned} G_1 &= V_0 P_s + \frac{3}{2} Nk\theta + 3\, NkT_s \ln(\theta/T_s) - NkT_s \\ &= G_s \simeq NkT_s \ln(P_s V_0 T_s^{7/2}/N_0 k\theta^{5/2}) - NkT_s \end{aligned}$$

where No is defined by $$N_O = V_O(4\pi Iek\theta/h^2)(2\pi mk\theta/h^2)^{3/2}$$

where No defines a constant as are volumes k and h respectively and $$\theta_{rot} << T_s << \theta_{vib})$$

and $$V_O << V_g = NkT_s P_s \text{ and } \theta << T_s.$$

which reduces to $$P_s \simeq N_0 k \sqrt{T\theta}\ /V_0$$

The latent heat of sublimation is described by the equation herein below $$L_s = T_s(S_g - S_s) \approx \tfrac{1}{2}NkT_s$$

wherein Ls is the latent heat of sublimation, Ts is the sublimation temperature, the gas consists of ½N molecules of mass, k is a constant and the difference (Sg−Ss) relates to the entropy change between states.

In principle the interaction of systems in regards to energy can be expressed by the following well known general energy principle equation $$\frac{D}{Dt}\int_{\gamma_m(t)} \rho\left(e + \frac{1}{2}v^2\right)dV = -\int_{\phi_m(t)} q \cdot ndA + \int_{\phi_m(t)} t_{(m)} \cdot vdA + \int_{\gamma_m(t)} \rho g \cdot vdA + \int_{\gamma_m(t)} \Phi dV$$

wherein the following terms are defined as, $$\frac{D}{Dt}\int_{\gamma_m(t)} \rho\left(e + \frac{1}{2}v^2\right)dV =$$

time rate of change of internal and kinetic energy of the body

| | |
|---|---|
| $-\int q \cdot ndA$ | rate of heat transfer to the body |
| $+\int_{\phi_m(t)} t_{(m)} \cdot vdA$ | rate of surface work done on the body |
| $+\int_{\gamma_m(t)} \rho g \cdot vdV$ | rate of work owing to body forces |
| $+\int_{\gamma_m(t)} \Phi dV$ | rate of energy absorbed or emitted owing to electromagnetic radiation |

Incorporated within the above equation are the principles of local equilibrium and the first law of thermodynamics and the internal energy per unit mass i.e., is assumed to be a function of space and time specified in terms of a localized thermodynamic state and the total energy referred to as total energy in a differential form, which is indicated by the expression $$\rho\frac{D}{Dt}\left(e + \frac{1}{2}v^2\right) = -\nabla \cdot q + \nabla \cdot (T \cdot v) + \rho g \cdot v + \Phi$$

The application of the Reynolds transport theorem working with terms left to right yields $$\frac{D}{Dt}\int_{\gamma_m(t)} \rho\left(e + \frac{1}{2}v^2\right)dV = \int_{\gamma_m(t)} \rho\frac{D}{Dt}\left(e + \frac{1}{2}v^2\right)dV$$

incorporating the divergence theorem on the first term on the right hand side of the said energy principle giving the following expression $$-\int_{\phi_m(t)} q \cdot ndA = -\int_{\gamma_m(t)} \nabla \cdot qdV$$

applying a stress vector as $t(n) = T \cdot n$ along with divergence theorem to obtain the following expression $$\int_{\phi_m(t)} t_{(n)} \cdot vdA = \int_{\gamma_m(t)} \nabla \cdot (T \cdot v)dV$$

and upon substitution $$\int_{\gamma_m(t)} \left[\rho\frac{D}{Dt}(e + \tfrac{1}{2}v^2) + \nabla \cdot q - \nabla \cdot (T \cdot v) - \rho g \cdot v - \Phi\right]dV = 0$$

The limits of integration are arbitrary, the integrand is assumed to be continuous and the integrand is necessarily identically equal to zero. Then governing differential equations for fluid motion and the transport of energy are defined by the following expressions contained herein below, which when compiled with thermodynamical data and constitutive equations for q, previously defined, are sufficient to specify temperature velocity fields by which the desired interphase heat transfer is computed and determined.

$$\rho\frac{D}{Dt}\left(e + \frac{1}{2}v^2\right) = -\nabla \cdot q + \nabla \cdot (T \cdot v) + \rho g \cdot v + \Phi, \text{ energy}$$

$$\rho\frac{Dv}{Dt} = \rho g + \nabla \cdot T, \text{ momentum}$$

$$\frac{\partial \rho}{\partial t} + \nabla \cdot (\rho v) = 0, \text{ mass}$$

Figure 81:
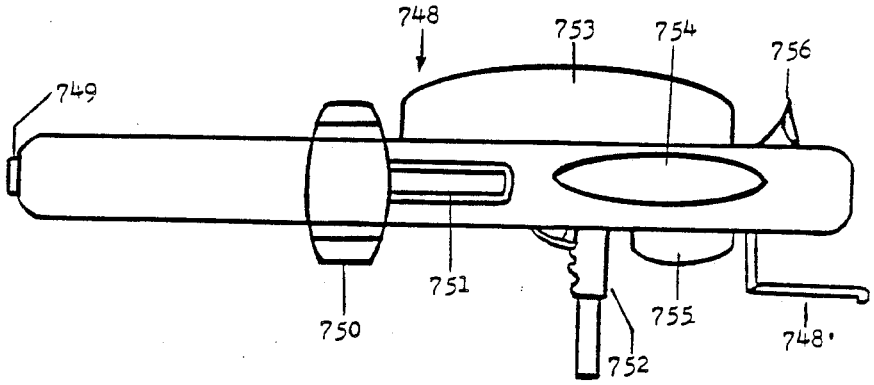
FIGS. 81 to 82*b* are perspective views of a military version of the transector device entailing front, side elevation and plan views.
Figure 81A:
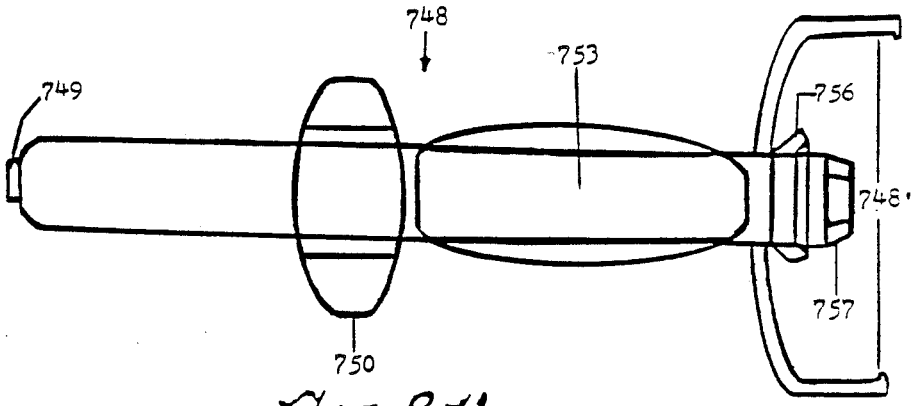
Figure 81B:
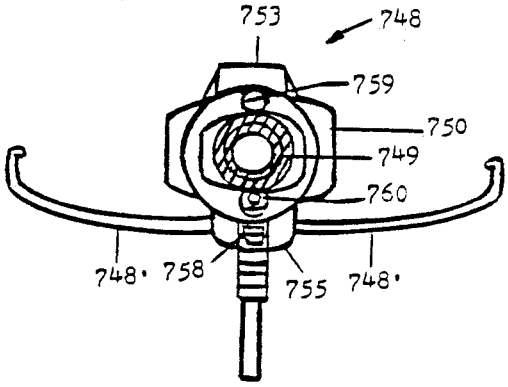
Figure 82:
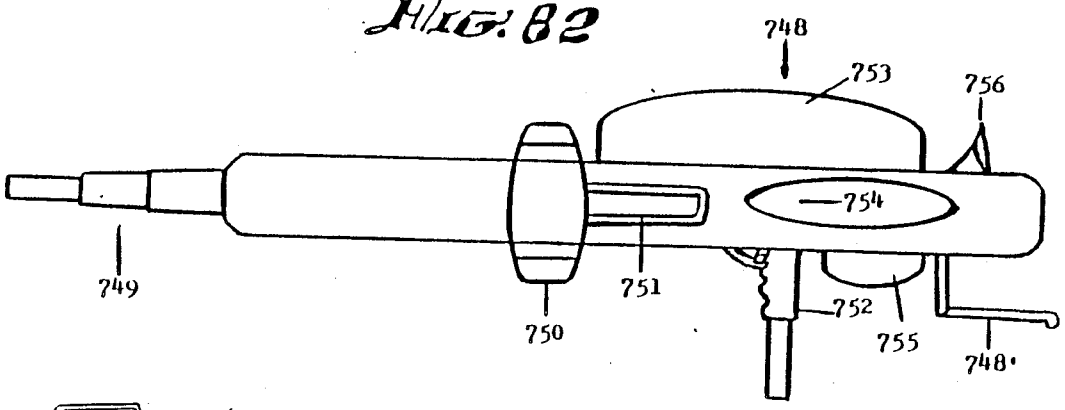
Figure 82B:
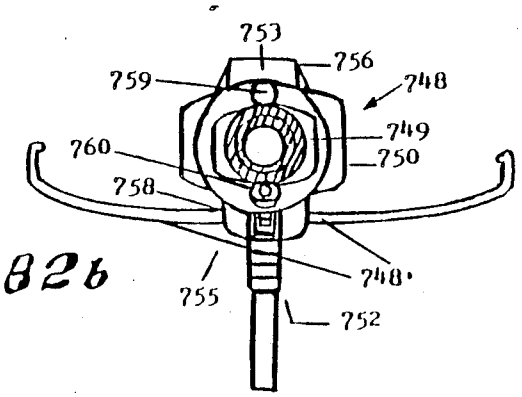
Figure 82A:
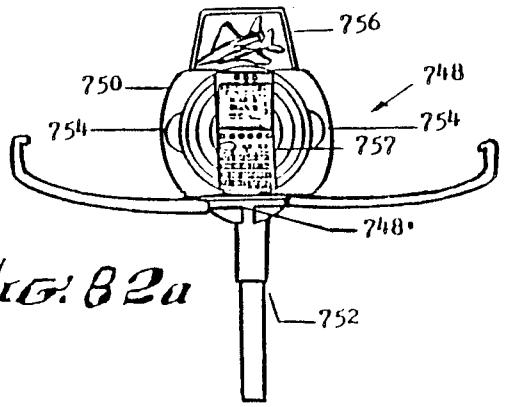

FIGS. 81 through 142 exclusively specify the operations and systems embodied within the military grade version of the transector device. The size or physical dimensions, design and functions of said transector device may vary from the parameters described in the foregoing specifications; whereas the operational parameters of the aforesaid device will remain essentially the same. Therefore, the foregoing disclosure is to be considered in its representative form of the invention and the processes are to be interpreted in an illustrative rather than in a limiting sense.

FIGS. 81 through **82*b* are perspective views of a military version of the transector device entailing the front, side elevation, plan and aft perspectives of said device. Numerals 749, 750 and 751 of Transector means 748 define the segmented barrel, munitions autoload element and manual projectile insertion user access means, respectively. Numerals 752, 753 and 754 designate collectively small caliber automatic dispersal element containing a clip of 40 rounds of dumb projectiles, an automated magazine containing in excess of six intermediate range miniature missiles, emboding either single or multiple warheads and a pair of high voltage, high amp charging capacitor means. Elements 755, 756, 757 and 748' describe a high voltage, high-amp power source, a holographic LCD/LED imaging system, an interactive user input panel and retractable shoulder gaurds to absorb and diffuse the force of recoil. The duel trigger element laser and acoustic emitter elements are illustrated by numbers 758, 759 and 760**.

Figure 83:
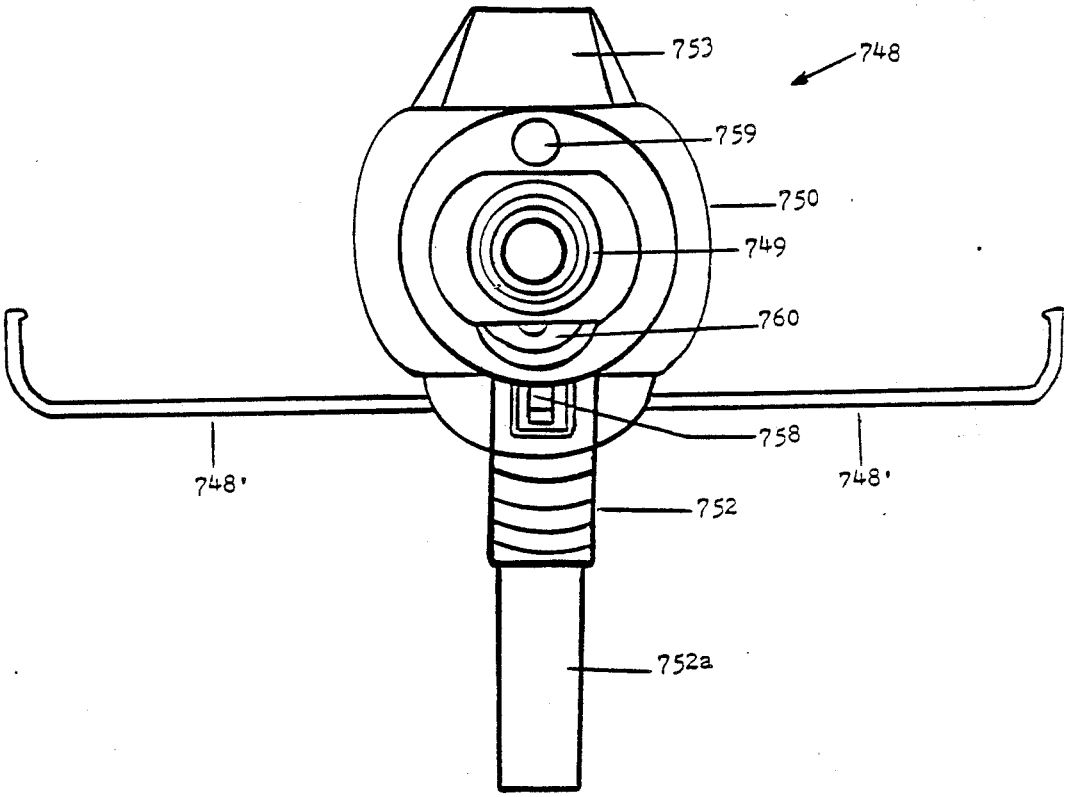
FIGS. 83, 84 are detailed pictorial perspectives of the front and aft views of said military transector device.
Figure 84:
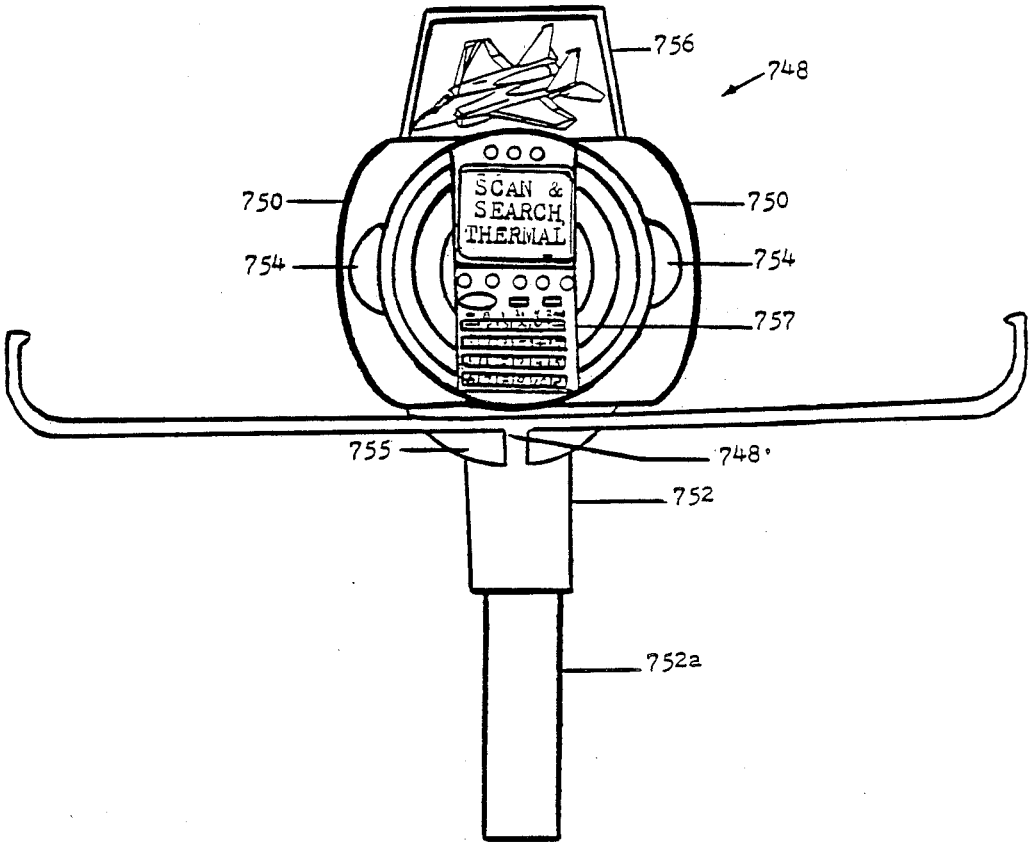

FIGS. 83, 84 are detailed pictorial perspectives of the front and aft view of the military transector device. All numerical values entailed within FIGS. 26, 27 correspond to the figures proceding said figure.

Figure 85:
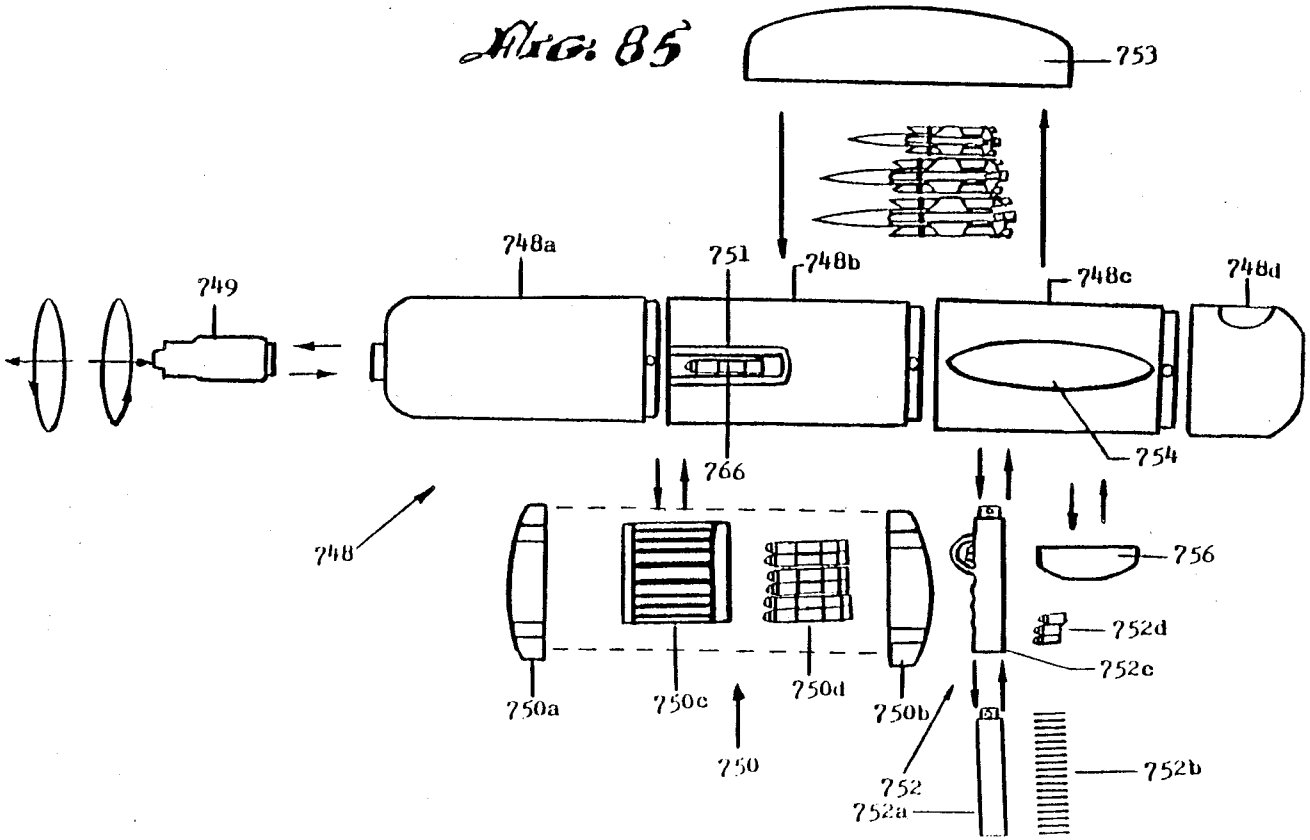
FIG. 85 entails a partial exploded view of the military grade type of transector unit.

FIG. 85 entails a partially exploded view of the military grade type of transector unit. The transector unit, number 748 is subdivided into four interlocking sections described collectively by numeral 748*a* through 748*d* which can be rapidly assembled or disassembled by the user during transport in less than thirty seconds. Equivalent portions of one transector unit are interchangeable with other equivalent portions from the same type of transector unit, therefore a section containing defective elements can easily be replaced by an equivalent operative section from another equivalent transector unit. A clockwise rotation is sufficient to lock each section into the next section including barrel means 749, whereas a counter clockwise rotation is sufficient to disengage each said section from the next provided the aforesaid individual transector is in a deactivated state. Locking solenoid means, not shown in the said figure prevents counter clockwise rotation when the transector unit is actuated. The munitions autoload elements consist of an outer containment cylinder described by numerals 750*a*, 750*b*, which embodies a rotating magazine, numeral 750*c*, which houses a full complement of precision graded munitions and/or SMART projectiles designated by numeral 750*d*. As magazine 750*c* rotates element 750*d* embodied within are loaded into the firing chamber of the aforesaid device, not shown, and fired either in single burst or in rapid succession. Means 750 when assembled fits into section 748*b*. Magazine 752 inserts into section 648*c*. Means 752 consists of clip 752*a*, magazine housing and trigger means 750*c* and forty or more rounds of dumb munitions described collectively by munitions 752*c*, 752*d*, respectively. Automated magazine 753 consists of an interlocking cylinder element, an autofeed element, not shown here, and a full complement of intermediate range miniature missiles collectively described by numeral 753*a*, inclusive.

Figure 86:
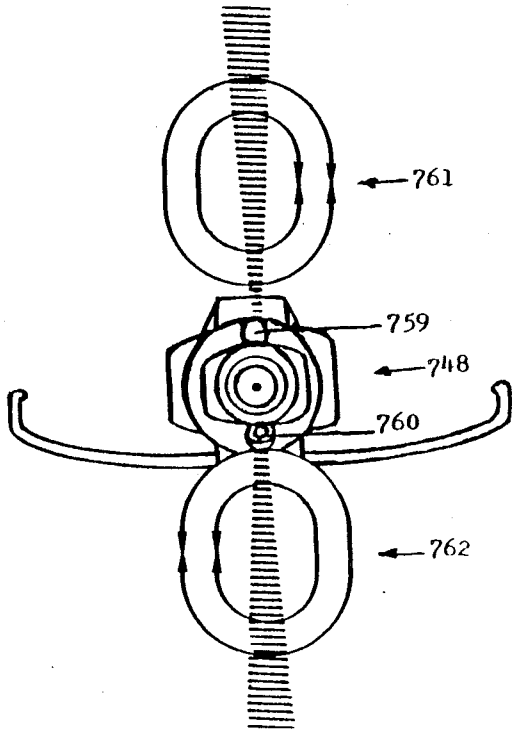
FIGS. 86, 87 are pictorial representation of the three dimensional duel scanning/emitting elements and a target acquisition profile.
Figure 87:
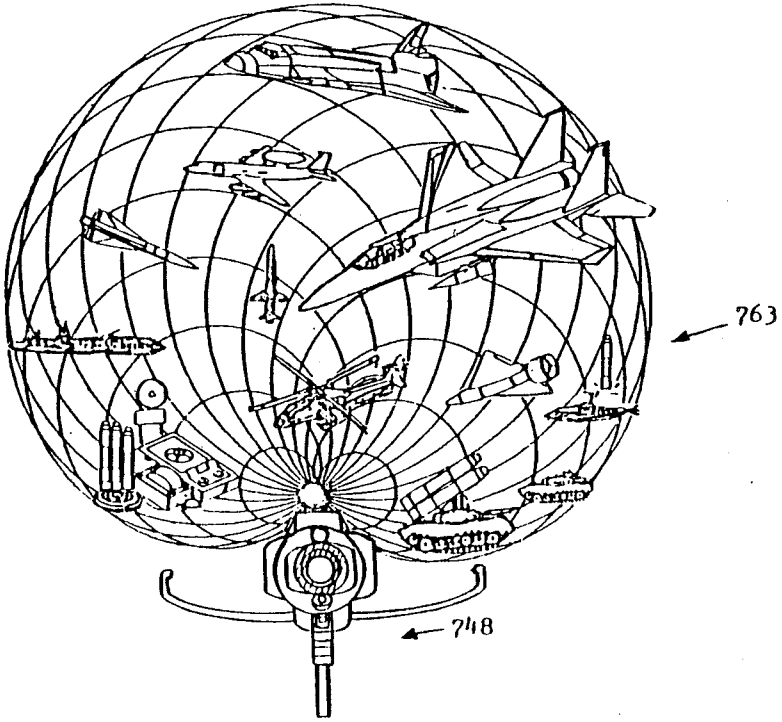
Figure 88:
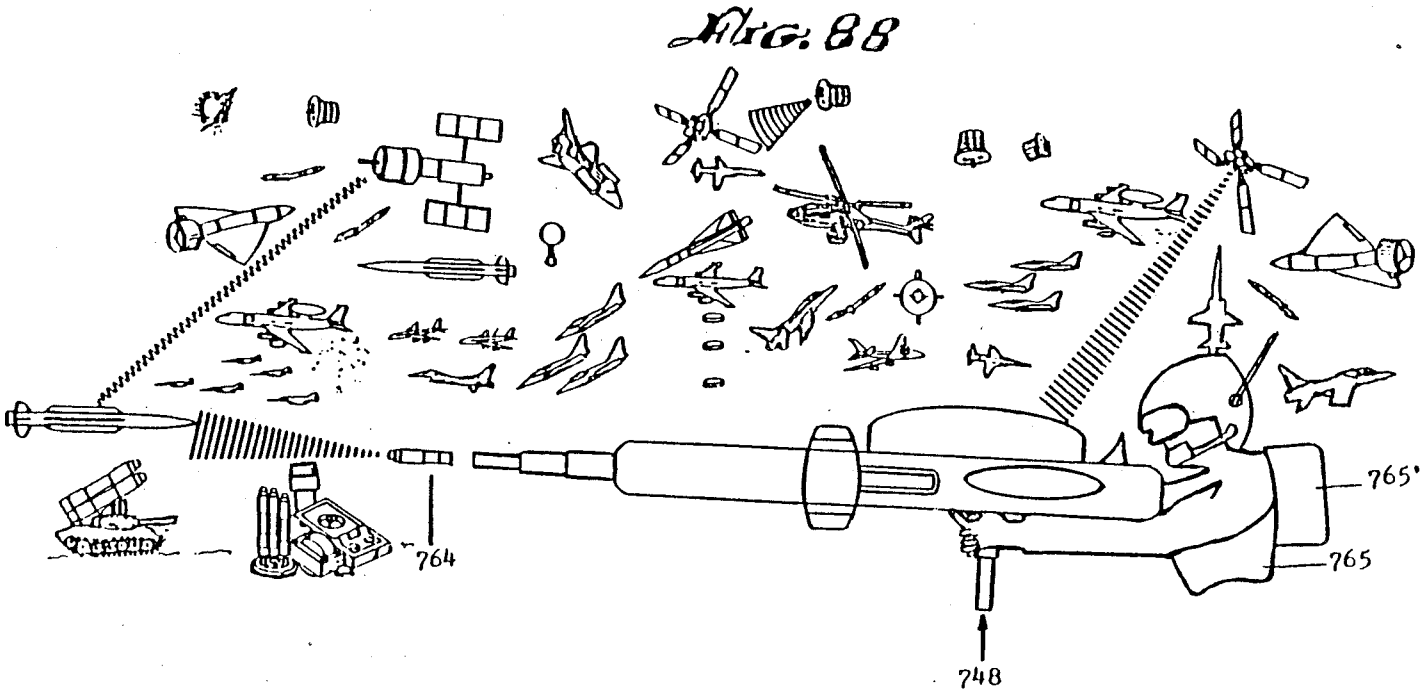
FIGS. 88, 89 are pictorial representations exemplifing a battle scenario and simple phase projectile launch mode.

FIGS. 86, 87 are pictorial representations of the duel function, 360 degree, three dimensional, scanning and emitter elements embodied within said transector device and an exemplary array of targets which fall in range of said transector device. Numerals 761, 762 and 763 of FIGS. 86, 87 describe the aforesaid scanning/emitter elements and the aforementioned type of targets, which fall in range of the transector unit; whereas numeral 764 of FIG. 88 is indicative of a SMART munition dispersed from the transector device, number 748 by the user, number 765 under a full battle scenario. Numeral 765 designates an ancillary power which supplements element 757 during the continuous operation of a high energy laser, EMP projectiles, or other systems embodied within said transector device.

Figure 87A:
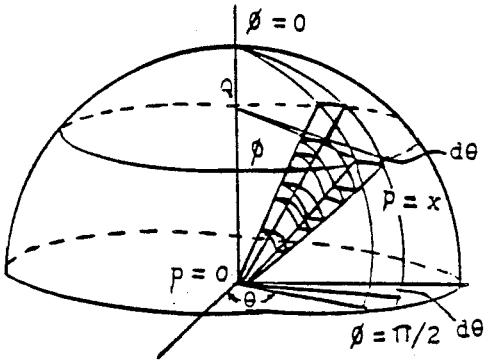
FIGS. 87*a*, 87*b* describes the separation of a three dimensional hemispherical scanning region into smaller subregions utilizing spheres, cones and half plane, forming the typical region known as a spherical coordinate box.
Figure 87B:
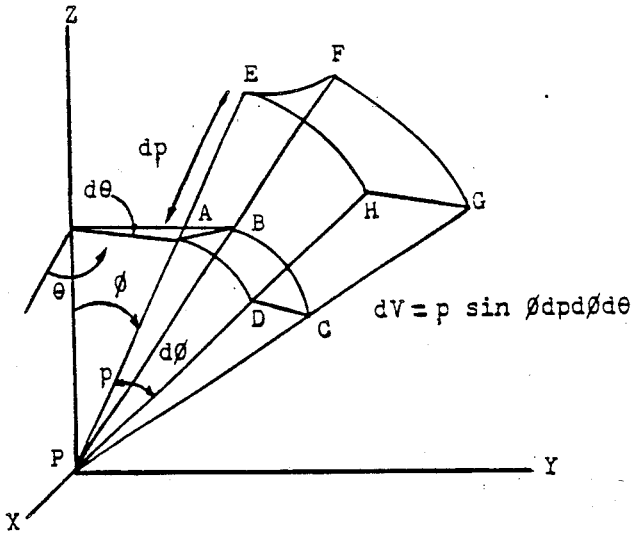

FIGS. 87*a*, 87*b* describe in part the separation of a single three dimensional hemispherical scanning region into smaller spherical regions subtending said hemispherical region. Portions of a single given hemispherical region must be scanned sequentially by an array of sensors to determine whether or not designated targets are present and whether or not said targets are within range. The allocation of sensors, logic circuits, the CPU and microprossor elements will be described in detail later on in the specifications in regards to queueing of said system. The utilization of triple integrals over the spherical and conical regions and the derivates associated with said regions are easier to handle by automated systems when determining spherical coordinates. Given $RZ^2dV$ where R is the upper hemispherical region with radius x. The method of integration is achieved by evaluating triple integral by separating said triple integral into three single integral elements which add from back segement to front of a vertical strip such that f(x,y,z) dV i . . . n $f(x_n, y_n, z_n)\, dV_n$ add subtotals from left to right. The process of integration for spherical coordinates consists of dividing the region into a number of smaller subregions assuming the configuration of spheres, cones and half planes face ABFE lies on a cone with angle $\phi$, whereas face DCGH lies on a cone with angle $\phi+d\phi$ forming a subregion known as a spherical coordinate box. Face ADCB lies on a sphere of radius $p_i$ whereas face EHGF lies on a sphere with radius P+dP. Face ADHE lies on a half plane adjacent to the z-axis at angle $\theta$; whereas BCGF lies on a half plane with angle $\theta+d\theta$. Said faces intersect perpendicularly such that volume dV is essentially the product of three edges $\widehat{AB}$, $\widehat{AD}$ and $\overline{AE}$. By summating all $z^2Vd$'s on the typical radial strip utilizing the entire complement of equations exemplary to the equations herein below $$dV = d\rho \times \rho d\phi \times \rho \sin \phi d\theta = \rho^2 \sin \phi d\rho d\phi d\theta.$$

$$z^2dV = (\rho \cos \phi)^2\rho^2 \sin \phi d\rho d\phi d\theta = \rho^4 \cos^2\phi \sin \phi d\rho d\phi$$

$$z = \rho \cos \phi$$

then add or summate the strip of sums down the great circle from $\phi=0$ to $\phi=\pi/2$ and to add subtotals around from $\theta=0$ to $\theta=2\pi$ such that the addition is achieved by three single integrals illustrated by the following expression $$\int_R Z^2dV = \int_{\theta=0}^{\theta=2\pi} \int_{\phi=0}^{\phi=\pi} \int_{\rho=0}^{\rho=x} \rho^4 \cos^2\phi \sin \phi d\rho d\phi d\theta.$$

Additionally, a triple integral over a solid region R may be evaluated with three single integrals by changing x, y, z and dV to spherical coordinates, as indicated by the expression contained herein below $$x = \rho \sin \phi \cos \theta, \quad y = \rho \sin \phi \sin \theta, \quad z = \rho \cos \phi,$$

$$\rho^2 = x^2 + y^2 + z^2, \quad dV = \rho^2 \sin \phi d\rho d\phi d\theta.$$

Figure 89:
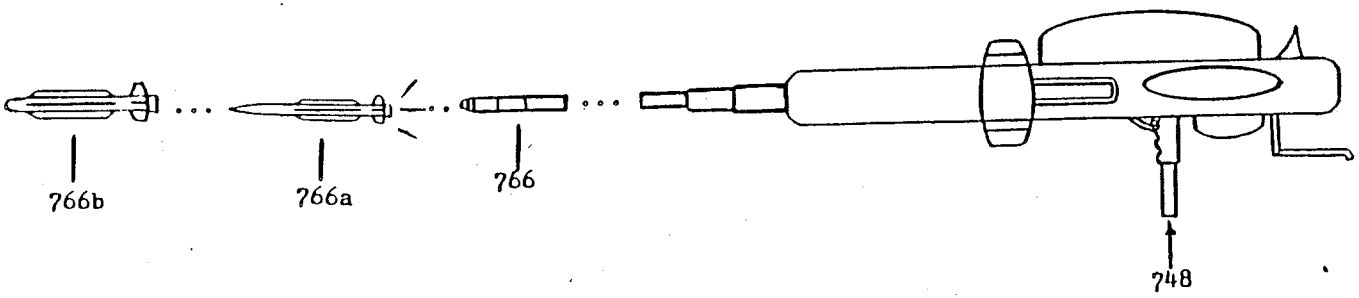

FIG. 89 is a pictorial perspective of evolution of a miniature missile element upon exiting from the segmented barrel of the aforesaid transector device. There are essentially three stages by which the aforesaid missile numeral 766 attains maximum velocity. Initially missile element 766 is expelled from barrel means 749 by a discharge of compressed gas such as $CO_2$, pressurized air or other compressed gases, until the approximated distance of one meter is attained from the initial point of dispersal. Compressed gases are discharged initially by projectile 766 to avoid subjecting the transector device to intense heat, pressure and wear and the user to the same with an additional recoil sufficient to either spin the user around or propel said user backwards. Once a distance of one meter from the barrel portion of said device is attained by projectile 746, the aforesaid missile, 766, engine undergoes ignition as disclosed by numeral 766a. The steering ruders, elevators and the like are ejected upon achieving engine ignition, as described by numeral 766a. Numeral 766b illustrates the overall structural configuration of said missile designated by number 766 once maximum velocity is attained at a distance of approximately ten meters from the initial point of dispersal.

FIGS. 90 through 104 consist of detailed structural perspectives of projectile delivery systems emboding single and multiple warhead configurations. Projectiles delivering multiple warheads to specified targets differ from projectile delivering only a single warhead in three parameters. The first parameter in which multiple warhead delivery systems deviate from single warhead delivery systems or projectile means is in the warhead assembly; wherein a dozen or more separate and distinct independently targeted warheads may be embodied in a vehicular device opposed to a single delivery means. A second parameter is that a single projectile warhead delivery means may be precision guided or SMART, but will not contain a CPU structure encoded with an expert program even though both systems may function independently from the transectors CPU after being dispersed from the transector device in the launch mode. The third parameter which distinguishes multiple warhead delivery systems from single warhead delivery systems is the complexity and number of inertial guidance systems embodied within said means. The inertial guidance system, array and types of sensory elements and response times for multiple warhead configurations are several orders of magnitude more complicated and faster than projectiles delivering a single warhead. The size or caliber of said projectiles vary with the size and type of target designated by the user, as are other parameters not mentioned, such as, speed and range of the aforesaid designated targets effect onthe structural design of the aforesaid projectiles delivery systems. Additionally, the structural configuration of a multiple warhead delivery means may embody a variety of warheads ranging from armor piercing projectiles to those carrying carrier mediated volatiles.

Figure 90B:
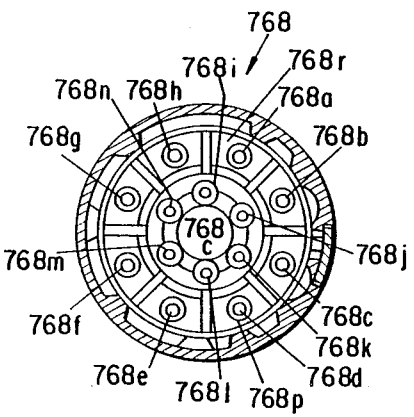
FIGS. 90 to 90*d* denote the external disposition and internal structural configuration of the multiple warhead deliver system.
Figure 90C:
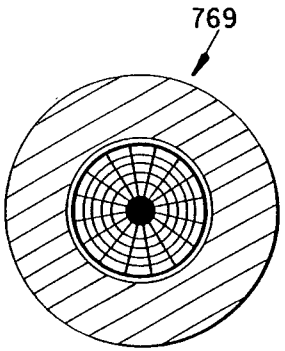
Figure 90D:
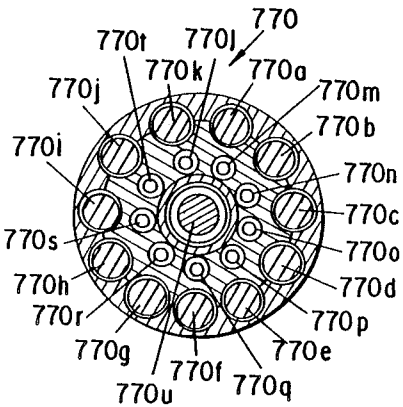
Figure 90:
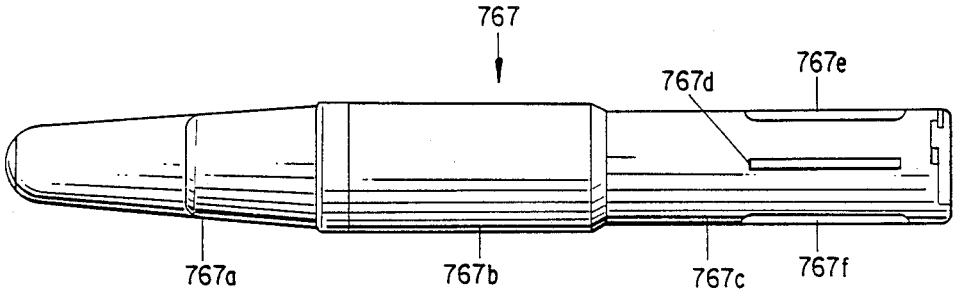
Figure 90A:
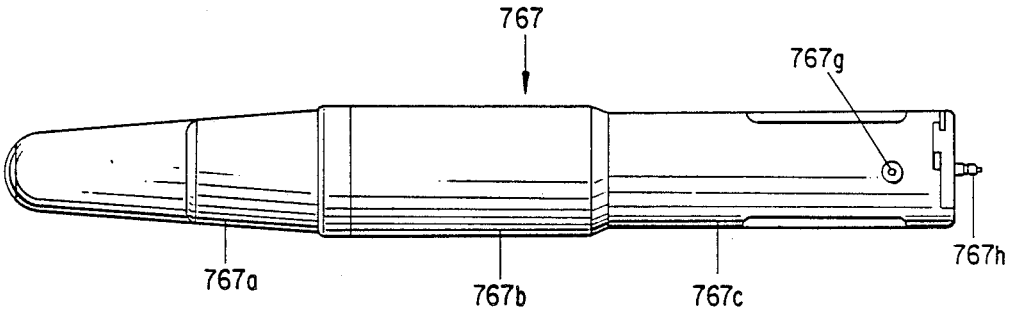

FIGS. 90, 90a and 90b denote the external disposition and internal structural configuration of a multiple warhead delivery system. Numeral 767 of FIGS. 90, 90a are collectively assigned to the entire projectile; whereas numerals 767a, 767b and 767c are assigned to external portions of the projectile denoting the warhead assembly and vehicular means, the inertial guidance system emboding an array of sensors, the CPU, power elements and other ancillary systems and the propulsion system emboding fuel, a rocket engine and ancillary servomechanism which are associated with said projectile. Three of four elevator and rudder elements in their retracted mode are described by elements 767d, 767e and 767f, respectively. Elements 767g, 767h disclose a conducting fiber optics terminal, wherein optical digitized impulses are conveyed from the transecor CPU via a fiber optics cable to the microprocessor or CPU of the aforementioned projectile and a pressurized gas terminea, whereby pressurized or compressed gas or air is initially released from the projectile means in the initial launch mode prior to ignition. The internal warhead configuration denotes the structural disposition of warheads within the warhead assembly. Numerals 769 to 770 of FIGS. 90 to 90b are assigned to cross-sectioned perspectives of said warhead assembly. Numerals 768a through 768o designate the actual warheads located within the warhead assembly. Elements 768p, 768q and 768r designate the warhead casing, the assembly support structures or stays and propulsive packing utilized during the dispersion of warheads. Numeral 769 is assigned to a warhead assembly with a single concentrated warhead system. Numeral 770 is assigned to the entire warhead assembly. Separate warheads with warhead assembly 770 are designated by elements 770a through 770 u; whereas the internal support structures are assigned values 770v, 770w and internal propulsive packing means are described by elements 770y, 770z, respectively.

Figure 92A:
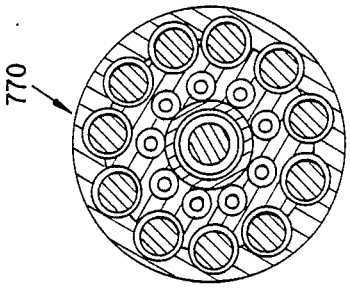
Figure 92C:
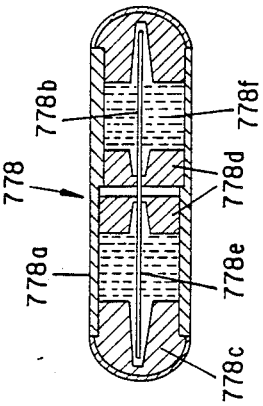
Figure 92:
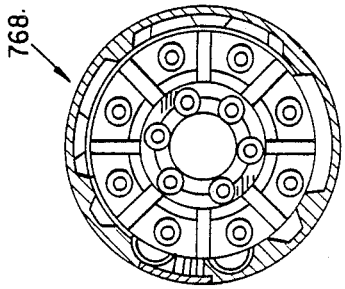
Figure 92B:
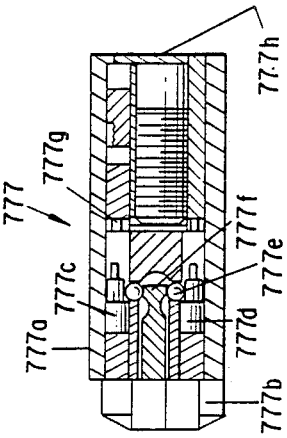
Figure 92E:
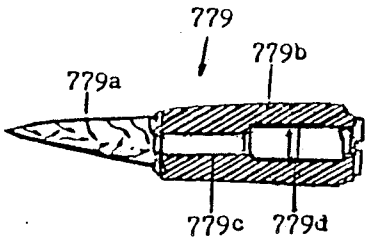
Figure 92G:
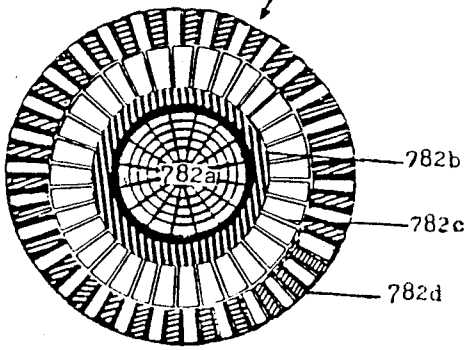
Figure 92D:
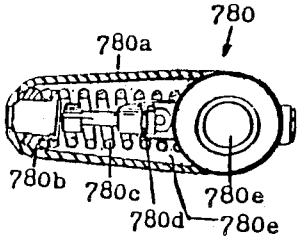
Figure 92F:
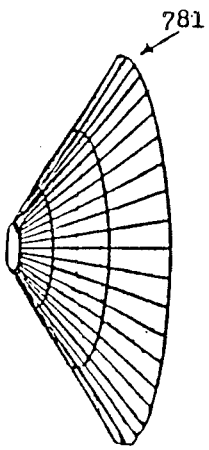

FIGS. 91 through 92g are detailed cross-sectioned descriptions of warhead types embodied either within multiple warhead assemblies or implemented by projectiles with single warhead systems. Numerals 768, 770 detail sectioned views of multiple warhead assemblies; whereas numerals designate warhead payloads and warhead types. Numeral 771 is a cross-sectioned view of a armor piercing projectile consisting of a composite jacket of high density material such as, expended uranium described by numeral 771a, surrounding or encasing a centrally located core of a radioactive substance, such as polonium. Numeral 772 is collectively assigned to a warhead assembly of armor piercing projectiles equivalent to the type defined by unit 771. Numeral 773 details an exploded assembly of high velocity scrapnel. Numeral 773a designates the initial casing means housing basket elements 773b, 773c, which separate, releasing small caliber linear rods of said scrapnel collectively described by element 773d. Element 774 designates a single linear rod element equivalent to those same said units depicted by numeral 773d. Numeral 775, 776 described pictorial two variations of chaffing means utilized to confuse enemy radar and hostile infrared sensory means. Element 775a embodies a broad spectrum of infra-red emitter means; whereas coiled element 775b designates a gyrating descent element, which decreases the rate of descent and intrinsic pattern of motion exhibited by each element. Numerals 768, 770 of FIGS. 91, 91a describes the same multiple warhead configuration which is described in the preceding figure. Numerals 777 thorugh 780 designate cross-sections of four different types of projectiles; whereas numerals 781, 782 discose two partial views of projectile means capable of pre-ejecting a progressively expanding net consisting of numerous coiling tendrils or filament structures. Numeral 777 is a cross-sectioned precision guided munition, entailing the shell, a charge and a focusing cap. The detonator means, power source and two component parts of a plastic explosive which remain inert until combined and detonated are collectively described by elements 777a to 777h, of FIG. 92b. Projectile 778 is a sectioned view of a capsule unit emboding carrier mediated volitile. In FIG. 92c elements through 778f designate the outer shell element, the initiator pin explosive, plastic explosive means, activator gel, penetrator complex and a solution of carrier mediated volitiles, respectively. Numeral 779 of FIG. 92d is a detailed cross-section of a modified armor piercing projectile element 779a, which denotes a composite synthetic cone formed from silicon carbide or other suitable substances, a jacket of molecular dense material such as expended uranium, which envelopes a rod of reactive material composed of radioactive material and an additional payload module consisting of a plastic explosive. Carrier mediated volitiles consist of a penetrator element, actuator means and some suitable volatile substance consisting of but not limited to anesthetics, corrosives, cryogens, toxins and related chemical compounds. Numeral 780 of FIG. 92*e* is a detailed sectioned view of an EMP projectile initiating point fields of intense localized electromagnetic fields by the radial discharge of high voltage, high amperage current. Elements 780*a*, 780*b* and 780*c* define the outer casing of the projectile, an electrical distributor cap element, which conducts the electrical discharge conveyed by electrical discharge coil means. Elements 780*d*, 780*e* and 780*f* of projectile means 780 are assigned to a miniature ceramic tranformer element discharge capacitor mechanism and electrical accumulating gel and an electric charge accumulator means, whereby electric current is conveyed through internal charging lines embodied within the transector device, not shown. Numerals 781, 782 of FIGS. 92*f*, 92*g* are two perspective views of an expending projectile, which upon detonation projects a net of filaments which entangles or ensnares a given specified target. The aforesaid net can consist of but is not limited to nylon, metallic elastic polymers or composite materials and/or any suitable substance. Numeral 781 reveals the net structure projected radially from the projectile; whereas numeral 782 is indicative of a view predisposing radial expansion. Elements 782*a*, 782*b*, 782*c* and 782*d* describe the explosive core of the projectile, condensed neting material and two levels or stages of progressively more tenuous expanding netting structures.

Figure 93:
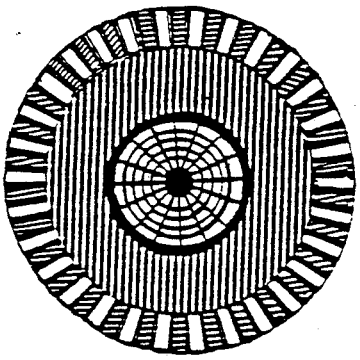
FIGS. 93 to 93*e* denotes pictorial representations of several types of shell casing enveloping the aforesaid projectiles.
Figure 93A:
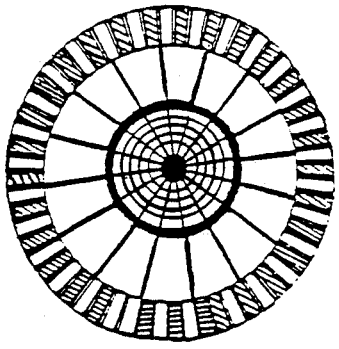
Figure 93B:
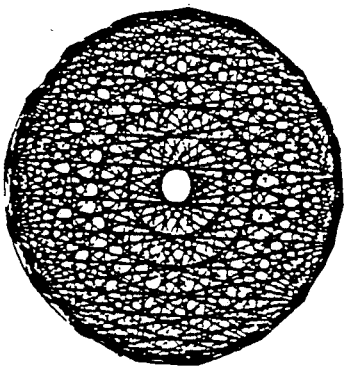
Figure 93C:
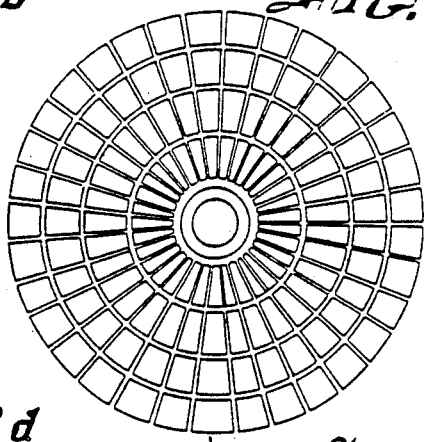
Figure 93D:
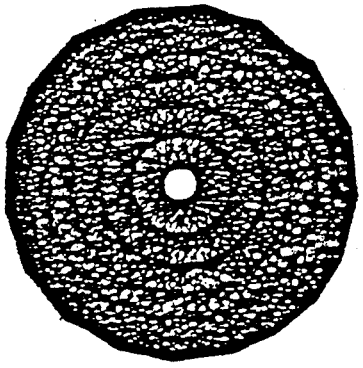
Figure 93E:
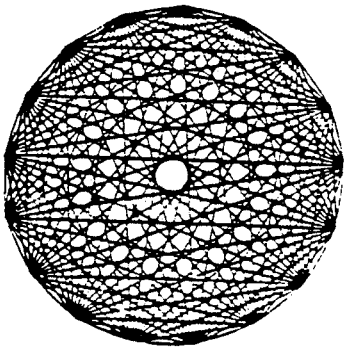

FIGS. 93 to 93*e* illustrate the structural formation of several types of shell casing enveloping the aforementioned projectiles. Numerals 783, 784 and 785 of FIG. 35 disclose projectiles encased by pressurized composite materials with the later numeral 785 consisting of rolled of material which fragmitize* upon either impact or detonation. Numerals 786, 787 and 788 consist of woven filaments of fused or epoxylated synthetic fibers which is extruded from a mechanism and spun from a rotating spindle means until components of the projectile are encased and hermetically sealed. Threads of synthetic carbon material similar to kevlar, or silicon and/or any suitable substitute of polymers varying in density are illustrated by pictorial representation 786, 787 and 788, respectively.

* Materials which when subjected to intense heat form shaped white hot fragments.

Figures 94, 94A, 94B:
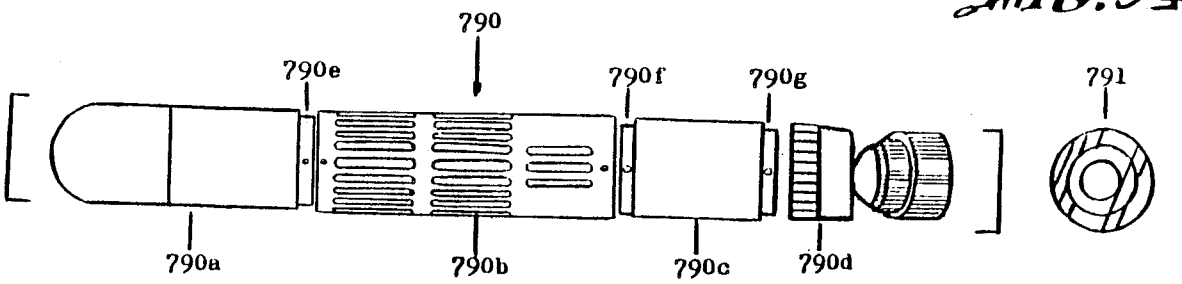
FIGS. 94 to 94*b* is a detailed description of the external assemblage of component sections which form a projectile.

FIGS. 94 through 94*b* describe in detail the external assemblage of component sections which form a projectile. The front and aft views of said projectile are disclosed by numerals 789, 791; whereas both plan and side elevation perspectives are satisfied by illustrations of projectile 790. Element 790*a* of projectile 790 discloses the warhead assembly section, which inserts into and interlocks into section 790*b*, which contains the CPU, the inertial guidance system, sensory means and full tanks. Section 790*b*, inserts into and interlocks into section 790*c*, which contains additional fuel tanks and section 790*c* inserts and interlocks into section 790*d* which contains directional elements, motivator means and the rocket engine assembly providing thrust or propulsion and directional control for said projectile. The interlocking elements for sections 790*a*, 790*b* and 790*c* are denoted by elements 790*e*, 790*f*, and 790*g*, respectively. A forward thrust and clockwise rotation is sufficient to lock all sections together; whereas a retractory force and counter-clockwise rotation of said segments is sufficient to disengage said sections from one another unless said sections are fused. The coupling and decoupling of projectile sections will be discussed later on in the specifications.

Figures 95, 95A, 95B:
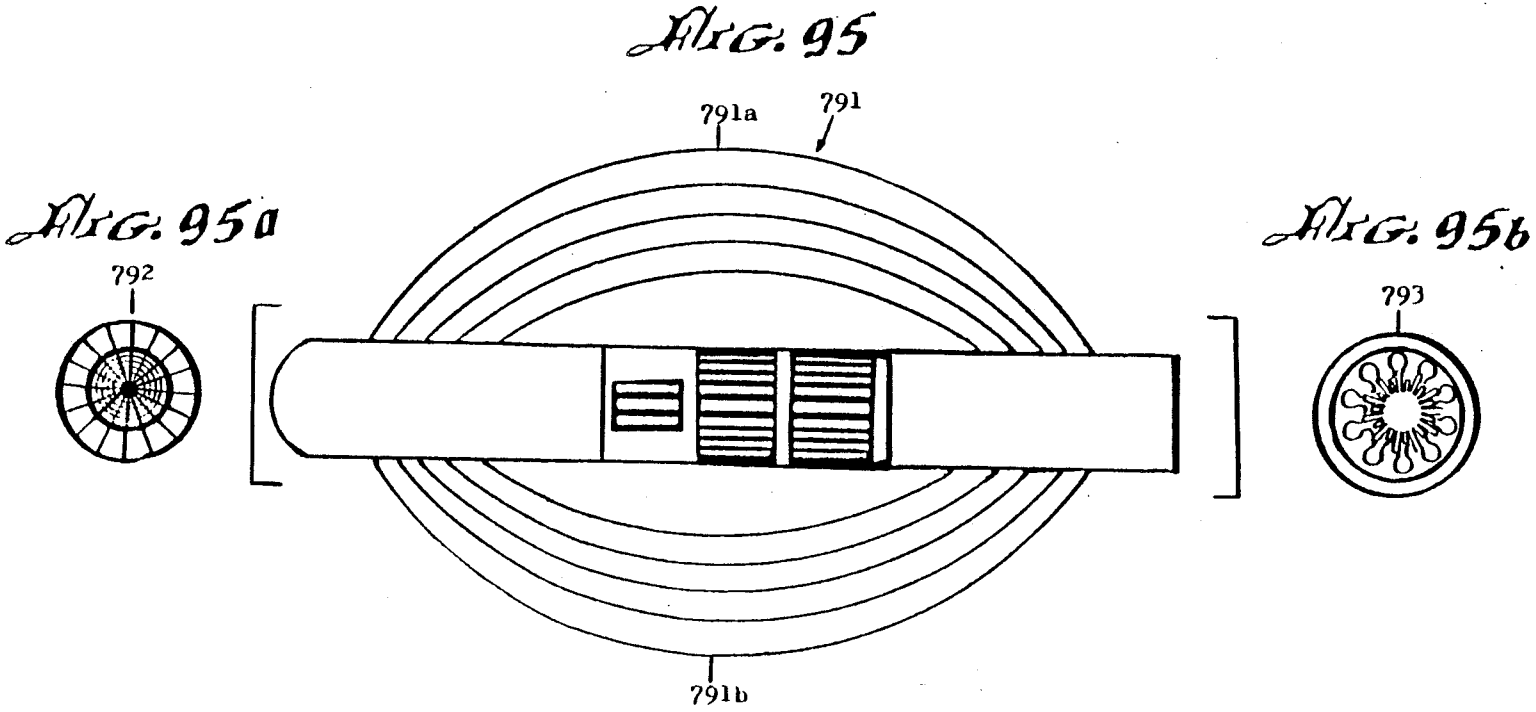
FIGS. 95 to 96*b* are pictorial perspectives of a fully assembled projectile.

FIGS. 95 to 95*b* are pictorial perspectives of a fully assembled projectile with radial expanding elevator means. Forward and aft perspectives of said projectile described collectively by numeral 791 with elevators 791*a*, 791*b* retracted are described by numerals 792, 793, respectively.

Figures 96, 96A, 96B, 96C, 96D, 96E, 96F:
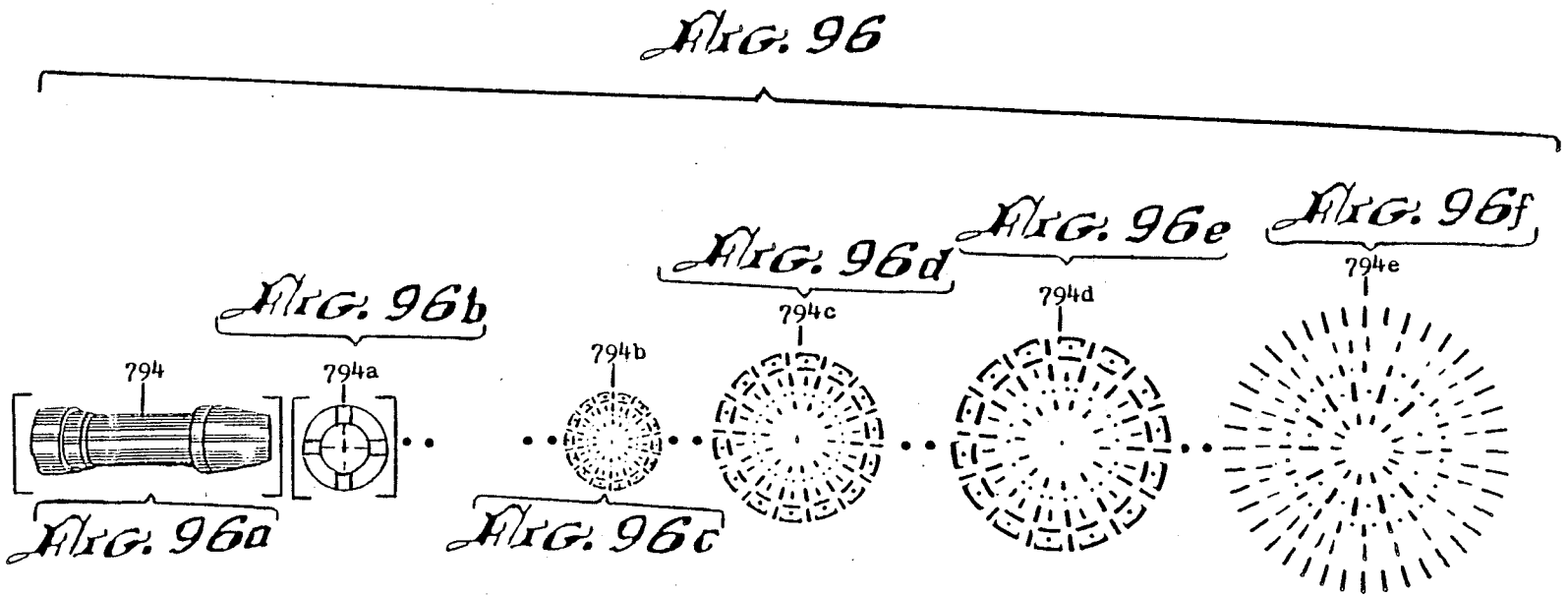
Figures 96, 96G, 96H, 96I, 96J, 96K, 96L:
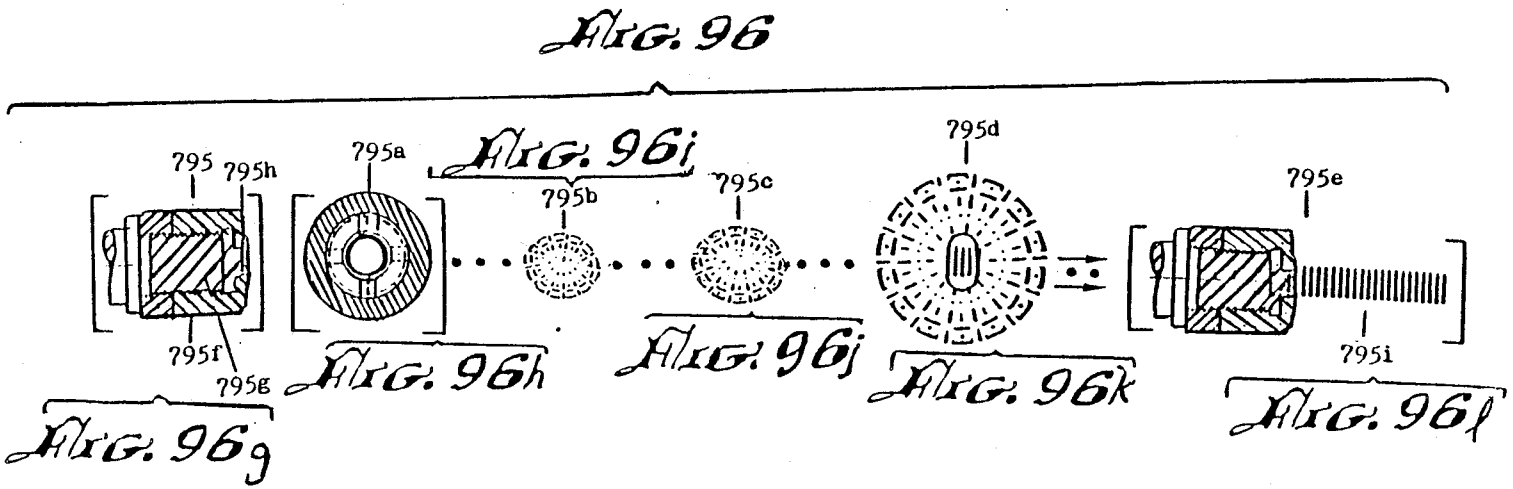

FIGS. 96 to 96*l* are pictorial representations of two types of exploding projectiles undergoing detonation. The first sequence of events illustrated by FIG. 96 to 96*l* describe a radially symmetric explosion; whereas the second sequence of events describes a shaped explosion. Projectile 794 is illustrated by numerals 794, 794*a* which denotes the side elevation and forward perspectives of said projectile. Numeric values 794*b* through 794*e* describe the evolution of an explosion upon detonation and such materials, as scrapnel are dispersed upon detonation in the same pattern. Numerals 795 through 795*e* describe cross-sectioned views of the warhead assembly for a shaped blast or shaped explosion. Element 795*f* denotes a metallic or synthetic composite case composed of suitable materials capable of withstanding and temporarily containing the tremendous forces generated by explosive element 795*g* which may be composed of nitrated gels or other pyrotechnies; whereas element 795*h* consists of a lower density, less tensile material, which readily allows the explosive force and material to exit upon detonation. Numeric values 795*b* through 795*d* describe the evolution of the explosion from a shaped charge upon detonation. Numeral 795*i* schematically illustrates the optimal shape of said explosion as perceived from the side of said projectile.

FIGS. 97 through 97*e* are detailed discriptions of the external and internal structural disposition of an automated SMART emitting decoy equipted with a CPU, encoded and implemented with expert programming. Numerals 796*a*, 796*b* and 796*c* designate the forward containment cap the mid-section emboding the CPU inertial guidance system, sensory apparatus power rotor means and fuel elements and the rocket engine assembly. Numeral 796*h* represents a coiled rotating means which at a high rpm rate tilts in one or more of several directions implementing the thrust parameters provided by engine means 796*c*. Numeral 796*e* is collectively assigned to a detailed cross-sectioned perspective of projectile 796. The shell or casing of projectile 796 is defined by element 796*e*. Numeric values 796*f*, 796*g* and 796*h* designate the external and internal rotor shaft and the differential rotating engine. Elements 796*i*, 796*j*, 796*k* are assigned to the CPU sensory inertial guidance and controller elements for fuel tank elements 796*p*, 796*r* and 796*s*, respectively. Numeric values 796*l*, 796*m* and 796*n* of projectile 796 denote the electronic ignition system and rotating solenoid means; whereas inlet mechanisms for the directional rocket engine element 796 are described by elemetns 796*t*, 796*u*, and 796*v*. Element 796 illustrates the CPU card embodied within modular unit 796*i*.

Figures 98, 98A, 98B, 98C, 98D, 98E:
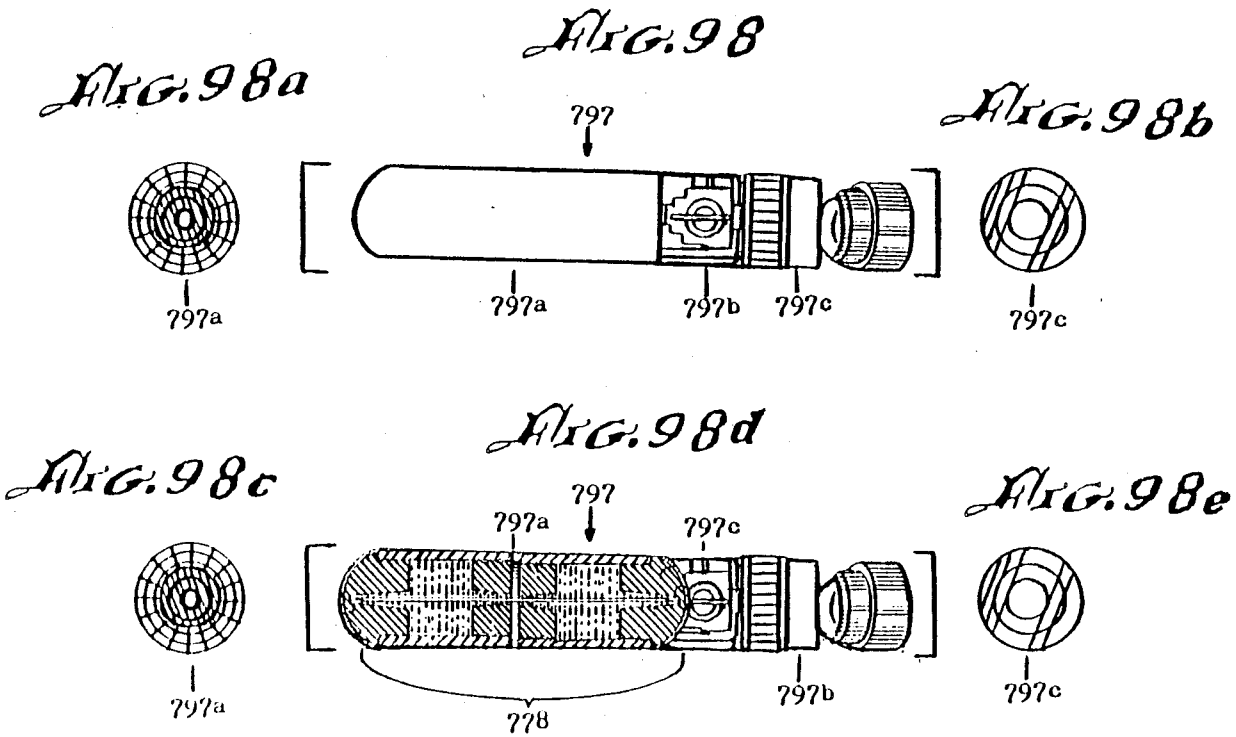
FIGS. 98 to 98*e* illustrates in part the structural disposition of a precision guided projectile carring a payload of carrier mediated volatiles.

FIGS. 98 to 98*e* illustrate in part the structural disposition of a short range precision guided projectile carrying a payload of carrier mediated volatiles. Numeral 797 of FIG. 98 is assigned to the entire projectile; whereas elements 797*a*, 797*b* and 797*c* are assigned to sections containing the carrier mediated volatiles, the pressurization valve and the rocket engine assembly. The payload of carrier mediated volatiles are assigned a single numeric value 778 as described in FIG. 98*d*.

Figure 99:
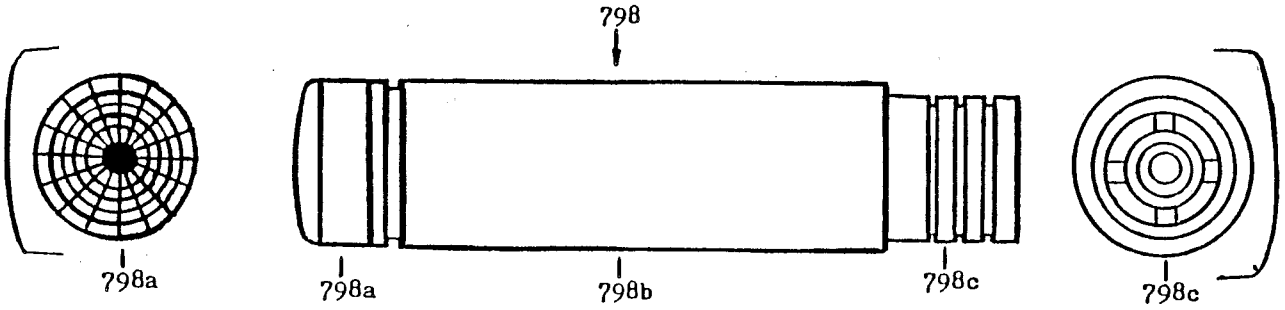
FIGS. 99 to 99*b* in a pictorial description briefly illustrating projectile dispersal system.
Figure 99A:
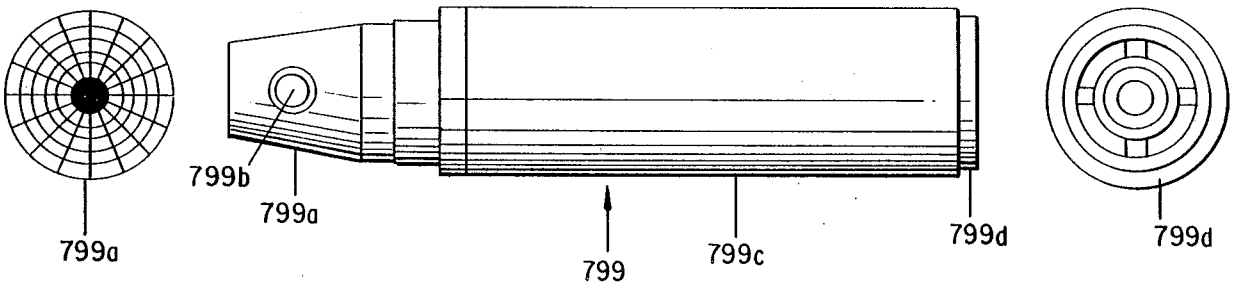
Figure 99B:
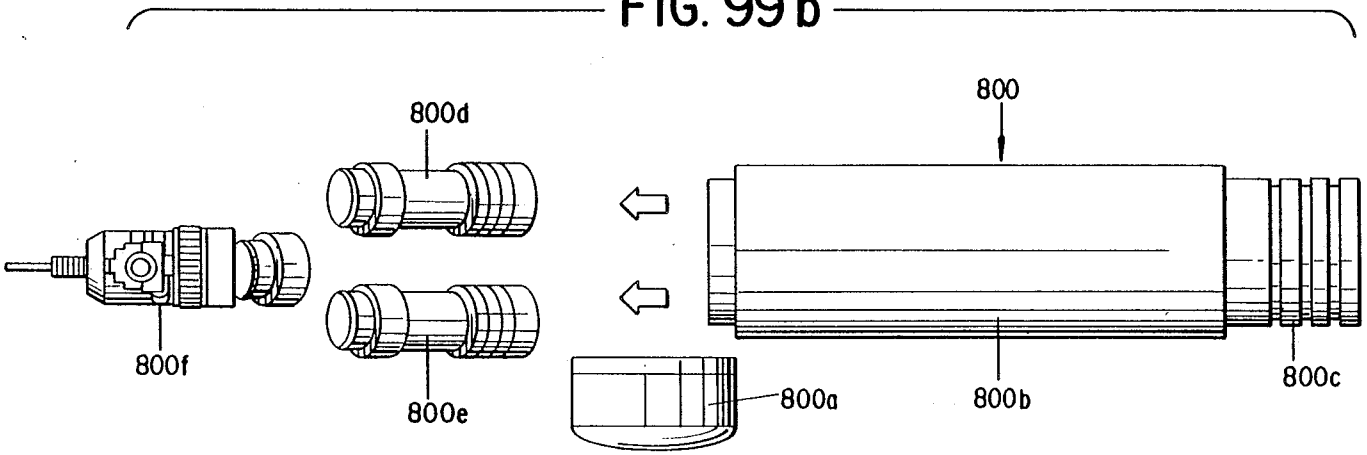

FIGS. 99, 99*a* and 99*b* are concise pictorial desciptions illustrating projectile dispersal from a multiple warhead projectile system. Numerals 798, 799 are assigned to two externally different types of projectile delivery systems. Elements 798*a*, 798*b* and 798*c* disclose in order, the warhead nose cone assembly, the section containing systems concerned with targeting, navigation and propulsion and the rocket engine assembly. Elements 799*a* through 799*d* of projectile 799 designate the warhead nose cone assembly, a fiber optic synthetic sapphire coupling window, the section housing systems concerned with targeting, navigation and propulsion and the terminal section housing the rocket engine assembly. When the multiple warhead system achieves optimum distance from designated targets small charges detonate disengaging and blowing the external nose cone section free of the multiple warhead projectile system in accordance with signals conveyed by the projectiles CPU, releasing the warhead assembly. The aforementioned process described in the previous sentence is anecdoted by numeral 800 of FIG. 43 wherein said external nose cone structure, numeral 800*a* separates and is blown free of sections 800*b*, 800*c* releasing the warhead assembly consisting of three separate and distinct projectiles, described by elements 800*d*, 800*e* and 800*f*, respectively. Elements 800*d*, 800*e* for the sake of simplicity are munitions carring explosives; whereas element 800*f* designates a multiple or multifunction projectile containing carrier mediated volitiles. The aforementioned projectiles released from the warhead assemble will engage and neutralize separate and distinct targets some distance away from one another. The trajectory pattern and detonation time interval projectiles 800*d*, 800*e* has been computed and implemented by the CPU embodied within multiple projectile system 800 prior to the release of projectiles from the warhead assembly. Projectile 800 will be described in greater detail in the next figure.

Figures 100, 100A, 100B:
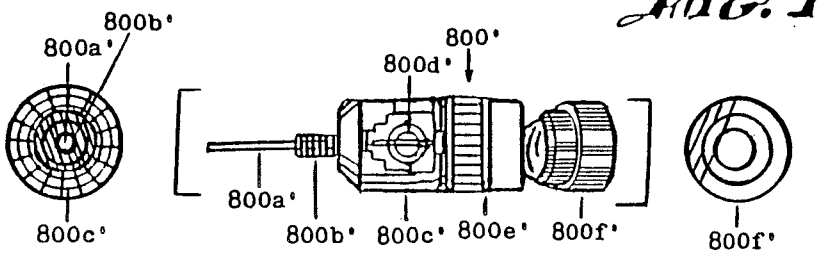
FIGS. 100 to 100*e* describes in detail the external disposition and internal structure of multiple function projectiles conveying carrier mediated volitiles.

FIGS. 100 to 100*e* describe in detail the external disposition and internal structure of multiple function projectiles conveying carrier mediated volitiles. Ideally each multiple function projectile is reuseable, servicing a number of specified targets within a single operation or mission. Two types of multple function carrier mediated projectiles are disclosed in FIGS. 100 to 100*e*. Numerals 800, 801 and 802 are assigned to one external perspective and three sectioned views of the multiple function carrier mediated volatile delivery means or projectile. The launch scenario for the multiple function carrier mediated volatile projectile means is consistent with a number of intermediate inaccessible specified targets, such as, terrorist, snipers, escaped convicts and the like which must be first isolated from hostages, or bystanders, or elminated from key position and then captured for purposes of interrogation. Said projectile means is automated, keyed onto specified targets via laser designation or some other method of acquisition and maneuvers into position, then engages targets by firing a high velocity stream of carrier mediated volitiles, which immediately penetrate the aforesaid targets and saturate the bloodstream of said targets. The initial penetration speed and diameter of said high velocity spray is so fine that designated or targeted individuals do not feel the initial injections of the carrier mediated volatile substance. The force of penetration, speed and concentration of said substance and the composition of the substance is preprogrammed by the transectors CPU onto the volatile memory of the projectiles CPU. Three perspective exterior views of projectile 800 are described in FIGS. 100 through 100*b*, which describe the front view, side elevation and aft section of the aforesaid projectile. The external perspective view for projectile 800 is consistant with that of projectiles described by numerals 801, 802. Elements 800*a*', 800*b*' and 800*c*' designate the hydraulic injection needle element, which conveys said spray, a secondary compressor and operture element to regulate the diameter of the high velocity and the cylindrical portion of projectile 800' housing the pressurized carrier mediated volatile substances. Elements 800*d*', 800*e*' and 800*f*' describe a combination charging port and manual regulatory switch for said volitile substances, the section containing the CPU module, sensors, infrared sensors, laser designators, inertial guidance means and propulsion elements and an external rocket engine with a directional nozzle means.

Figure 100C:
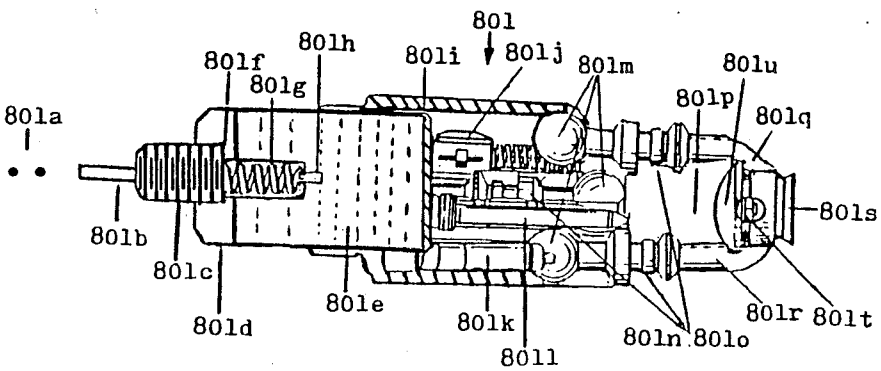

In FIG. 100*c*, element 801*a* of projectile 800 discloses a pressurized spray or stream of carrier mediated volatile substance exiting the hydraulic injection needle element 801*b*, and the secondary compressor operture means, numeral 801*c* regulating the size or diameter of said volatile stream. The external case of the dispensor means 801*d*, housing carrier mediated volatiles a composite spring loaded recoiling solenoid mechanism. 801*g* motivates slotted tubular access element forward and backwards or aft to release a metered dosage of said volatile, 801*e*. Aforesaid tubular element 801*h* is slotted in order to allow substance 801*e* to flow as seen in numeral 801' of FIG. 100*d*. A forward linear slide of element 801*h* into sealent gasket 801*i* disengages 801*h* which prevents the release of a metered dosage of said volatile substance. The outer case of the projectile 801, is defined by element 801*i*. The module containing the CPU inertial guidance and navigational elements is assigned the numeric value 801*j*. Elements 801*k*, 801*l* describes a combination designator element and seeker means which initiates, assists and implements target acquisition. Secondary fuel tanks and pump mechanism containing automated regulatory valves or means are designated by elements 801*m*, 801*n*, 801*o*, respectively. The primary fuel tank containing propellant is described by element 801*p*. Release mechanisms 801*q*, 801*r* conveys propellant or fuel to rocket engine means 801*s*. The fuel is ignited within the said engine 801*s* by electronic ignition element 801*t*. The entire rocket engine assembly can be rotated within three dimensional planes by rocker element 801*u* in order to control or alter the course of projectile once said projectiles are in flight, solenoids, not shown here, act as motivators for said rocker elements. Projectiles 801, 801' are equivalent to one another in all respects with the minor exception that projectile 801 has just completed firing of the aforementioned high velocity stream, 801*a*, and projectile 801' has just begun to fire or emit said stream from needle element 801*a*. Projectile 802 is equivalent to projectiles 801, 801' with the exception of the dispensor and carrier mediated delivery stystem, which will briefly be described in the foregoing. In FIG. 100*e* elements 802*a*, 802*b* are equivalent to 801*a*, 801*b* and the dispensor case housing said carrier mediated volatiles as defined by element 802*d*. Elements 802*e*, 802*f* and 802*g* are assigned to a variable solenoid release mechanism, a variable slide ramp and a composite recoil spring which terminates firing a stream 802*a*, once solenoid means 802*f* has disengged and an automated variable sampler element. The actuator, penetrator and volatile component portion of the carrier mediated volatile are defined by condensed pressurized materials 802*h*, 802*i*, and 802*j*, respectively. The carrier mediated volatiles here are so unstable that the component parts must be intermixed and utilized immediately.

Figure 101B:
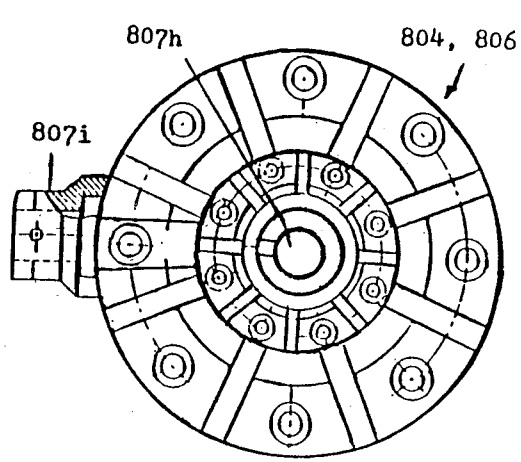
FIG. 101 to 101*e* describes in a concise fashion the mechanism by which warhead assembles are altered prior to the launch mode.
Figure 101A:
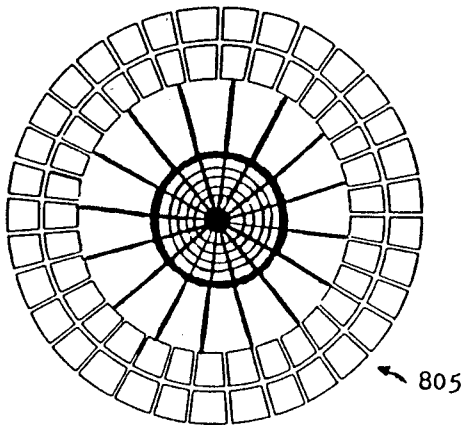
Figure 101:
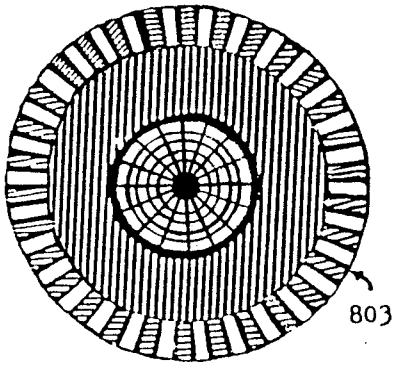
Figure 101C:
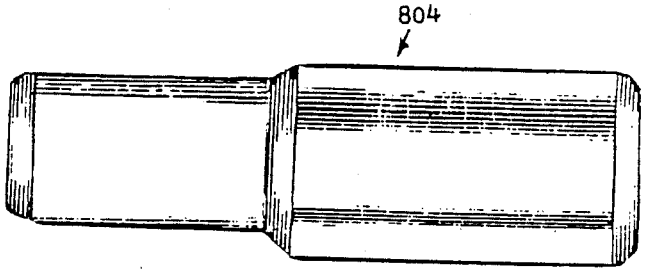
Figure 101D:
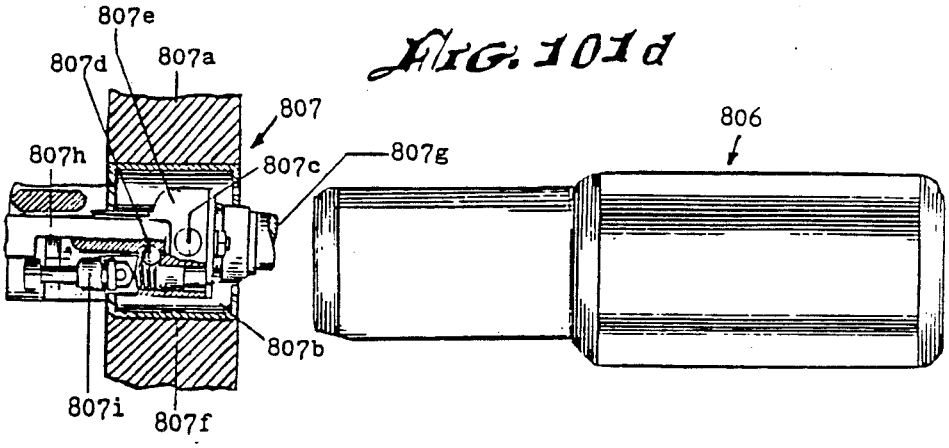
Figure 101E:
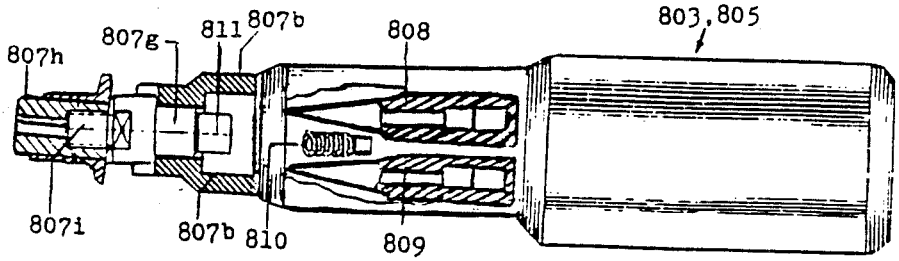

FIGS. 101 to 101*e* are concise representations of the mechanism by which warhead assemblies are altered or modified prior to the launch mode of projectiles delivering multiple warheads. Numerals 803, 804 describe the front portion and side elevation of a multiple warhead delivery means, excluding the propulsion system and rocket assembly. Numerals 805, 806 are equivalent to numerals 803, 804, however a portion of the warhead cap or nose has been engaged forward and rotated clockwise by specially crossed gripers of autoload mechanism 807. Element 807*a* denotes a sectioned segment of the autoload x, y axial translator bar, which conveys said autoload means vertically up and down and/or horizontally from side to side relative to a given projectile element which is to leave its warhead assembly changed or modified. The size, shape and pattern of said grippers exclude the possibility that the warhead cap or nose cone would be prematurely disengaged by wind forces rotating said projectile in clockwise fashion when said projectile is in flight, or by inadvertent tampering prior to loading said projectile into the transector device. The gripper element occurs in pairs, one of which is in its retracted state and is defined by element 807*b*. Said grippers extend forward once a laser designator and sensor means 807*c* has lined said gripper elements up with depression on the warhead cap or nose cone. Once the extended grippers have entered the shaft of each respective slot located on said nose cone, not shown here, the entire gripper means of the autoload mechanism rotates on ball baring race 807*d*, 807*e* in a clockwise fashion until said nose cone is completely unscrewed. The said cap is then removed and placed in a recovery or holding area within said transector device, not shown, the autoload mechanism finds the component warhead projection by moving linearly along slide 807*f* which is on a track 802*h*, wherein tubular element 807*g* graps said projectile warhead types, projectile types and other items which are specified by a holographic digitized code illuminated by a laser diode element and scanned by an array of sensor elements. The internal projectiles within the warhead assembly are identified by an equivalent process which is well understood and practiced by those skilled in the art. The unwanted warhead is essentially scooped out of the cylindrical housing in the warhead assembly by tubular element 807*g*, which constricts as said unwanted projectile is withdrawn from the aforementioned warhead assembly. The aforesaid unwanted projectiles are repositioned in the space or slot previously occupied by the projectile type, which will ultimately replace said unwanted projectile to be retrieved and/or modified at a later date. A much more detailed explination of the above process will be given in algorithms controlling said process. Tubular element 807*g* ejects the specified projectile containing the desired warhead into the warhead assembly and then is retracted. Tubular element 807*g* is expanded to release projectiles by circumferential ring 807*h*, which is actuated by solenoid means 807*i*. Solenoid element 802, consists of two separate and distinct opposing solenoid mechanisms. The entire autoload mechanism can be rotated on a circular slide and ball baring race assembly in a circumferential fashion to service projectiles, peripherally located in the warhead assembly. Said autoload mechanism 807 is translated linearly in either a vertical or horizontal direction. A parially sectioned multiple warhead projectile is assigned the values 803, 804, 805, and 806, respectively. Here the warhead cap or nose cone element is reassembled by any of the aforesaid gripper elements, extending projectiles within the warhead assembly 811, which is briefly indicated by elements 808, 809 and 810, respectively.

Target recognition, sensor vector analyses, target preference and orientation between the position of said missiles and their respective targets is essential for independent target pursuit after launch of said missiles. The initial programming of systems aboard said missiles occurs through a fiber optic link fused to an optical window of said missiles at one end and an electro-optical encoder at the other end. Instructions from the CPU aboard the transector regarding target specification is transmitted to said electro-optical encoder prior and during the launch phase of said missile*

* A microprocessor or δ element aboard the said missiles with a short term volatile memory allows the aforesaid missile to function independently or autonomously after launch providing what is known as a dedicated system.

FIGS. 102 to 102*b* disclose the basic design and structural disposition of systems embodied within a single miniature missile element of the military transector unit or device. FIG. 45 is a sectioned view of missile 812, which is indicative of the type of missile incorporated within operational scale models of said vehicular device. Numerals 813, 814 and 815 of missile 812 disclosing rear clamping means, a pair of aerolons, or rudders and rear elevator elements, respectively. Number 816 reveals a sectioned portion of the outerhull of the missile, which is formed from an elastic ceramic composite material reinforced with metallic fibers. Elements 817, 818, 819 and 820 designate a combination pressurization chamber/structional nozzle element, automated liquid fuel rocket engine and internal fuel tanks containing liquified oxidants and suitable reactants, respectively. Pressurized fluid or compressed gases are contained within a hermetically sealed chamber of nozzular element 821. Said hermetic seal is broken when clamp means 822, 823 are desingaged by release solenoids, not shown, contained within said vehicular device. Forward momentum or thrust generated by the release of pressurized fluid or compressed gases as the aforesaid seal, not shown, is ruptured propels said missile away from the vehicular device prior to the ignition of engine element 824. Although solid propellants are within the scope of missiles embodied within the device liquid propellants presently generated greater thust, proved to be more reliable and efficient than solid state propellants occupying the space and having the same mass, as said liquid propulsion systems. Elements 825, 826 and 827 denote automated flow governors, which regulate the quantity of oxidants and reactants supplied to conduit leading to engine 824. The circuit containing internal targeting menas, sensors, a single CPU card and inertial guidance systmes are collectively designated by numerals 828 through 831. Directional control is implemented by motivator elements 832 to 835, which controls the position and angle of elevators, aerolons or other such means. The actuation of motivator elements 832 through 835 in conjunction with the differential operation of engine 824 allows continuous corrections in the course of said missile, number 812; from its initial launch point to engagements of specified targets. Numeral 836 defines the electro-optical umbilical port or juncture; wherein digitized signals are optically conveyed through aforesaid fiber optics cable from the vehicular device specifying the target profile, spatial and directional vector of said target and other parameters of said target. Since the only interface between the umbilical port, number 836, and the fiber optics cable, not shown, is fused to the surface of a transparent synthetic sapphire window element described by number 837. The aforesaid fiber optics cable is fragmetized by force initially generated, as engine means 824 delivers its primary thrust. The payload, numeral 838, is contained within nose cone element 839. If the fuel is completely expended prior to target engagement then explosive bolts, 840, 841 detonate disengaging nose cone element 839 from the main body of missile 812. Nose cone elements may contain a single high grade plastic explosive, a small quantity of smart projectiles, as indicated by numeral 770, or any other suitable payload. The subsequent disengagement of the nose cone element may occur either prior to or after the initial impact of said missile means. It is preferred to have detachment of said cone element to occur after impact and some distance after penetration if a specific portion of a vessel is to be disabled or neutralized. In some instances it is preferable to disperse smart types munitions within close proximity of said targets. Smart munitions generally consist of a hommer or seeker means, a detonator element and a comparatively large payload. Said payloads range from carrier mediated anesthetics or toxins to miniature anti-personel devices. Estimates based on tests conducted upon working scale models of said missiles (1/10 scale) indicates a fuel scale version of the same said missile, which would have an effective range of between ten to eighteen kilometers and a mean cruise speed (out of water or air speed) of six thousand kilometers per hour for a payload in excess of one hundred grams.

Figure 103:
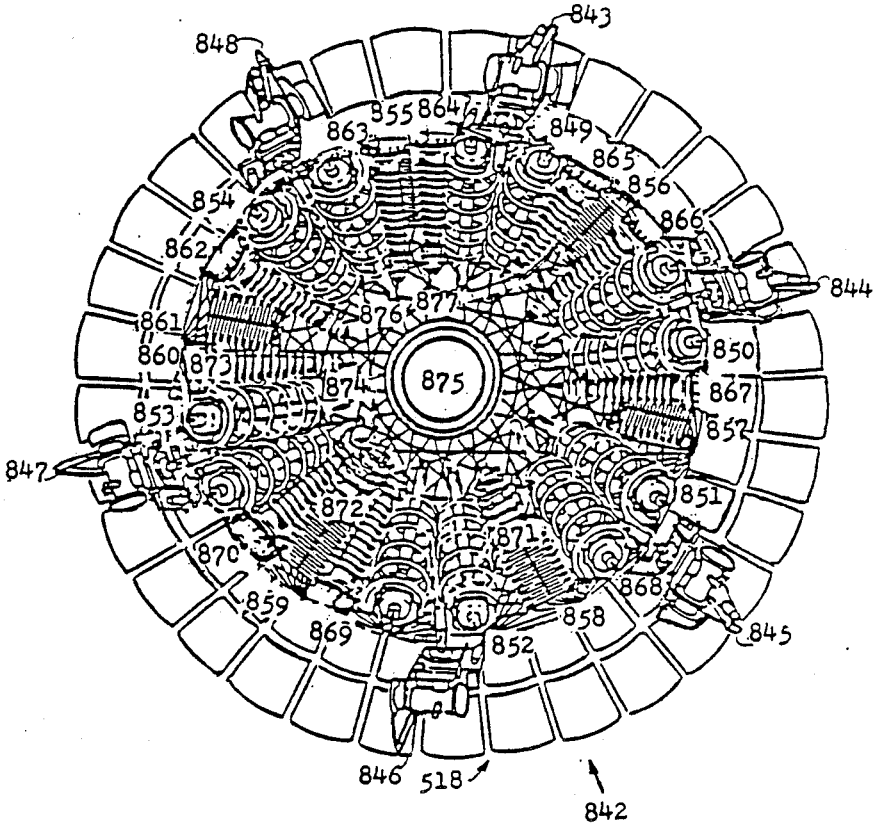
FIGS. 103 to 104*b* are concise detailed descriptions of a hyperatomic explosive capable of being delivered by the aforesaid miniature missile.

FIG. 103 is a detailed sectioned view of the internal structural components of a proposed hyperatomic mechanism. Single element versions of the explosive means were constructed utilizing a special commerically available two element impact plastic explosive gelatin instead of fissionible* material, wherein an impacter is accelerated at extreme velocity instead of an initiator and or high velocity neutron emitting sources. Element 842 is a partial view of the outer shell casing of the explosive means consisting of numerous plates of impact absorptive ceramic material mentioned earlier in the disclosure. Numerals 843 through 848 are indicative of high voltage source generators with exiting filaments or charging inlets associated with external energizers. Numerals 849 through 855 denote the miniature mass action driver means utilized to accelerate projectiles into the explosive centroid designated by numeral 875. The combination of charging coils and capacitor banks is illustrated by elements 856 through 862. Additional high voltage generators are depicted by electrostatic generator or voltage acceleration coils 863 through 871 of which only ten of twelve elements are shown. Structures 872, 874 are a partial representation of only two of six radiofrequency units deployed to irradiate the central explosive mass important in devices involving nuclear charges. The radiofrequency devices are believed to increase the mass density pressure of the non-critical nuclear mass by a slight but significant degree of 2.5 to 5.0 percent prior to engagement of said mass by a fast moving neutron source. Numerals 876, 877 are an electro-optical/electronic timing sequencer and a partial visual perspective of the woven synthetic support strut structures, respectively. The woven synthetic support matrix 877 consists of a spun fiber polymorphic polycrystalline silicon and or a high carbon fiber polyester of a commerically available type, wherein all structural component systems are embedded and stablized prior to and after the initial impact.

* fissile

Figures 104, 104A, 104B:
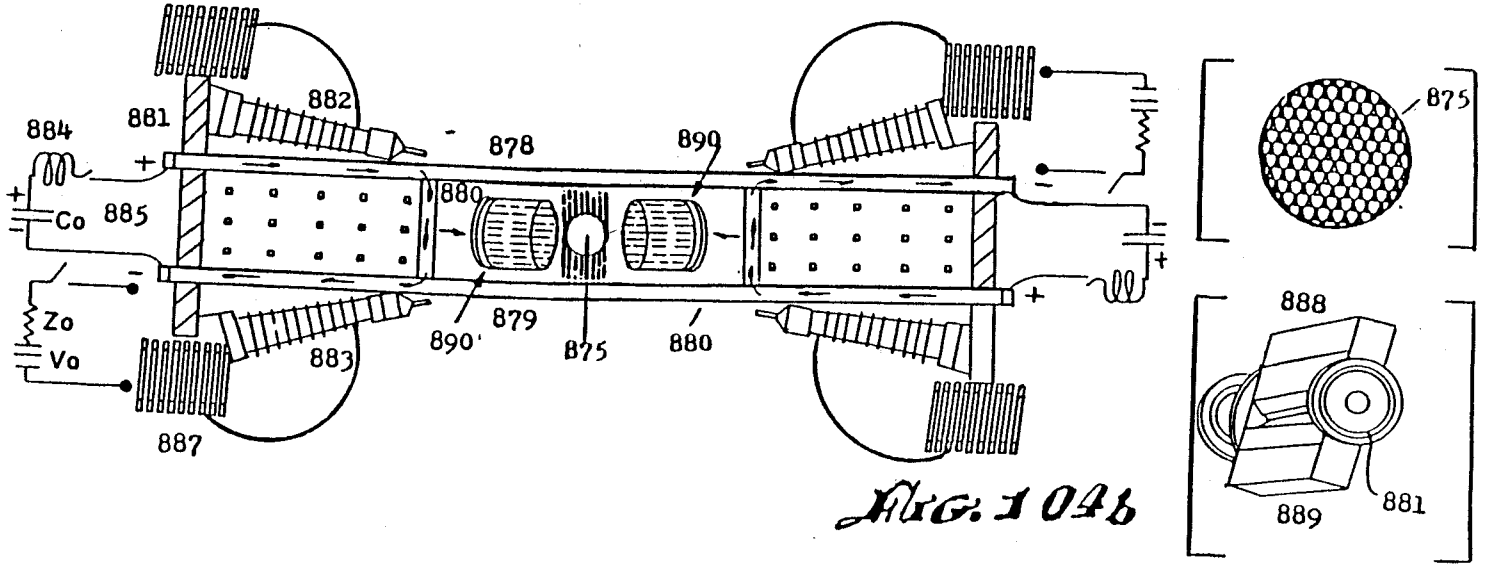

FIG. 104 to **104*b* are concise pictorial descriptions of a sectioned view of the initiator/alpha emitter capsule heading for its intended target centroid. The mass action unit consists of a modified d.c. rail gun type of assembly. The d.c. rail assembly is described herein by numerals 878, 879 and 880, which consists of a positive rail structure, a conducting plasmoid disc which upon ionization provides the forward thrust and a negative d.c. rail completing the circuit. The support bar number 881 is flanked on either side of the assembly by two voltage acceleration coils depicted by numerals 882 and 883. Numerals 884, 885, 886 and 887 are indicative of the charging capacitance bank, switching elements and ancillary charging coils. The forward thrust occurs as the plasmoid disc 880 undergoes ionization driving either an initiator and/or alpha emitting source 875 into a linear trajectory pattern. Additional rails are provided, numerals 888 and 889. The ultra high velocity projectile 890 exits the rail gun element through orifice 891 towards its intended target centroid element 875** which contains either a conventional explosive or a fissionible mass. Hence two projectiles are fired head on from two equivalent rail gun devices; such that one impactant is composed of a suitable initiator such as beryllium and the other advancing projectile is a suitable alpha emitter. The subsequent impact occurs in the center of the fissionible mass releasing copious quanities of fast moving neutrons which bring about the formation of a critical mass from a non-critical mass value conducive for the initiation of a chain reaction process. The primary reactants, a suitable initiator, an alpha emitter, Polonium, etc. is placed in close proximity with the aforementioned neutron source generator; such as beryllium in a manner indicative of the Chadwick reaction. Since the aforementioned reaction occurs at the centroid of the subcritical fissionible mass composed of U235, Pu239 or other suitable material wherein the critical factor $K<1$, becomes drastically altered to a state in which $K>>1$, at which point a chain reaction is elicited and subsequently propagated as the secondary reactants, the neutrons and the heavy isotope U235 or Pu239 reaching some critical or maximum density factor in accordance with reactants propelled into one another, which is in accordance with the scope of the invention and set forth herein below by several greatly simplified nuclear field equations:

$$_4Be^9 + 2He^4 \rightarrow {}_6C^{13} \rightarrow {}_6C^{12} + on^1$$

The Chadwick reaction provides one source of neutrons as the above equation indicates prior to initiating a chain reaction described by the equation herein below:

$$on^1 + {}_{92}U^{235} \rightarrow {}_{42}U^{236} \rightarrow {}_{56}Ba^{141} + {}_{36}Kr^{92} + 3_on^1$$

$$1.0087u + 235.0439u \rightarrow 140.9139u + 91.8973u + 3.0261u$$

-continued $$\Sigma_m \text{ reactants} \overset{\Delta}{\nearrow} \Sigma_m \text{ products}$$
$$236.0526u \qquad 235.8373u$$

$$\Sigma m \text{ reat.} - \Sigma m \text{ prod.} = 0.2153u$$

$$1 \text{ atomic mass unit} \approx 1.66 \times 10^{-24} \text{ gm}$$

$$\therefore \text{ mass converted} \approx 3.57 \times 10^{-25} \text{ gm}$$

$$\text{Energy released} \approx = \frac{3.21 \times 10^{-4} \text{ erg}}{1.60 \times 10^{-12} \text{ eV}}$$

$$\left\{ \begin{array}{l} 3.57 \times 10^{-25} \times (3 \times 10^{10})^2 \\ 3.21 \times 10^{-4} \text{ erg} \end{array} \right. = 2.01 \times 10^8 \text{ eV}$$

If fissionable material is encased by a shell of fussionible material such as, lithium deuteride, deuterium or any other suitable material, than the energy derived or released from the nuclear reaction will initiate a thermonuclear reaction or fussion process described in brief herein below:

$$\begin{array}{lll} {}_1H^2 + {}_1H^2 \rightarrow {}_1H^3 + {}_1H^1 + 4 \text{ MeV} & & \\ {}_1H^2 + {}_1H^2 \rightarrow {}_2H^3 + on^1 + 4 \text{ MeV} & \text{ionization energy of hydrogen} & \left\{ \begin{array}{l} = 2.18 \times 10^{-11} \text{ erg} \\ = \dfrac{2.18 \times 10^{-11}}{1.60 \times 10^{-12}} \end{array} \right\} \\ {}_1H^3 + {}_1H^2 \rightarrow {}_2He^4 + 2on^1 + 11 \text{ MeV} & & \\ {}_1H^3 + {}_1H^2 \rightarrow {}_2He^4 + on^1 + 18 \text{ MeV} & & \text{or } 13.6 \text{ eV} \end{array}$$

Alternate variations of fusion processes describng the thermal nuclear ignition are standard and indicated herein below:

$$D + T \rightarrow He^4(3.5 \text{ Mev}) + n(14.1 \text{ Mev})$$

The above reaction, once initiated will subsequently detonate secondary reactions:

$$D + D \rightarrow t(1.01 \text{ Mev}) + p(3.02 \text{ Mev})$$

$$D + D \rightarrow He^3(0.82 \text{ Mev}) + n(2.45 \text{ Mev})$$

The resulting tritium originating from said preceeding secondary reaction.

$$D + D \rightarrow T(1.01 \text{ Mev}) + p(3.02 \text{ Mev});$$

whereas a lower yield of $He^3$ from reaction $D + D \rightarrow He^3(0.82 \text{ Mev}) + n(2.45 \text{ Mev})$, will undergo fusion by reaction $$He^3 + D \rightarrow He^4(3.67 \text{ Mev}) + 0\ p(14.67 \text{ Mev}).$$

Other possible reactions can additionally formed by neutrons (n, 2n) generated by such nuclides as, D, $Be^7$, $Bi^{209}$, $Li^7$ and other nuclides. It is believed by Marwick and others, as cited in the prior art, that even though a majority of neutrons have a high probability of being absorbed by fissionible or fissile actinides such as $Pu^{239}$, $U^{233}$, or related materials such reactions as, $$n + Li^6 \rightarrow T(2.74 \text{ Mev}) + He^4(2.06 \text{ Mev})$$

and $$n + He^3 \rightarrow T(0.19 \text{ Mev}) + p(0.57 \text{ Mev}),$$

respectively.

$$\frac{1}{2} MVa^2 = \frac{3}{2} \text{ Kt}$$

$$\int_{KE \cdot Z_2}^{KEe_1} MVa^2 \rightarrow 3 \text{ Kt}$$

$$Z_1 + Z_2 \rightarrow \text{dist} \cdot R \text{ If } R = 10^{-12} \text{ cm}$$

$$Z_1 Z_2 e^2/R$$

$$3\ KT = \frac{Z_1 Z_2 e^2}{R}$$

$$T = \frac{Z_1 Z_2 e^2}{3\ KR}$$

$$T = \frac{Z_1 Z_2 (4.8 \times 10^{-10})^2}{(3 \times 1.38 \times 10^{-16})(10^{-12})}$$

$$T = 5.5 \times 10^6\ Z_1 Z_2 \cdot K$$

The size, shape and structural configuration of the atomic device is designed to stablize the explosion centroid and to prolong the interval of nuclear reactions prior to desintegration. The kinetic forces generated by collisions of neutron emitting materials into said centroid by the mass action driver elements are designed to temporarily contain the explosive consequences of a nuclear chain reaction by a small but significant interval of time. It is believed that the aforesaid containment of said chain reaction will significantly increase the yield of the nuclear explosion by as high as several fold to one order of magnitude, according to computer simulations.

Figure 105:
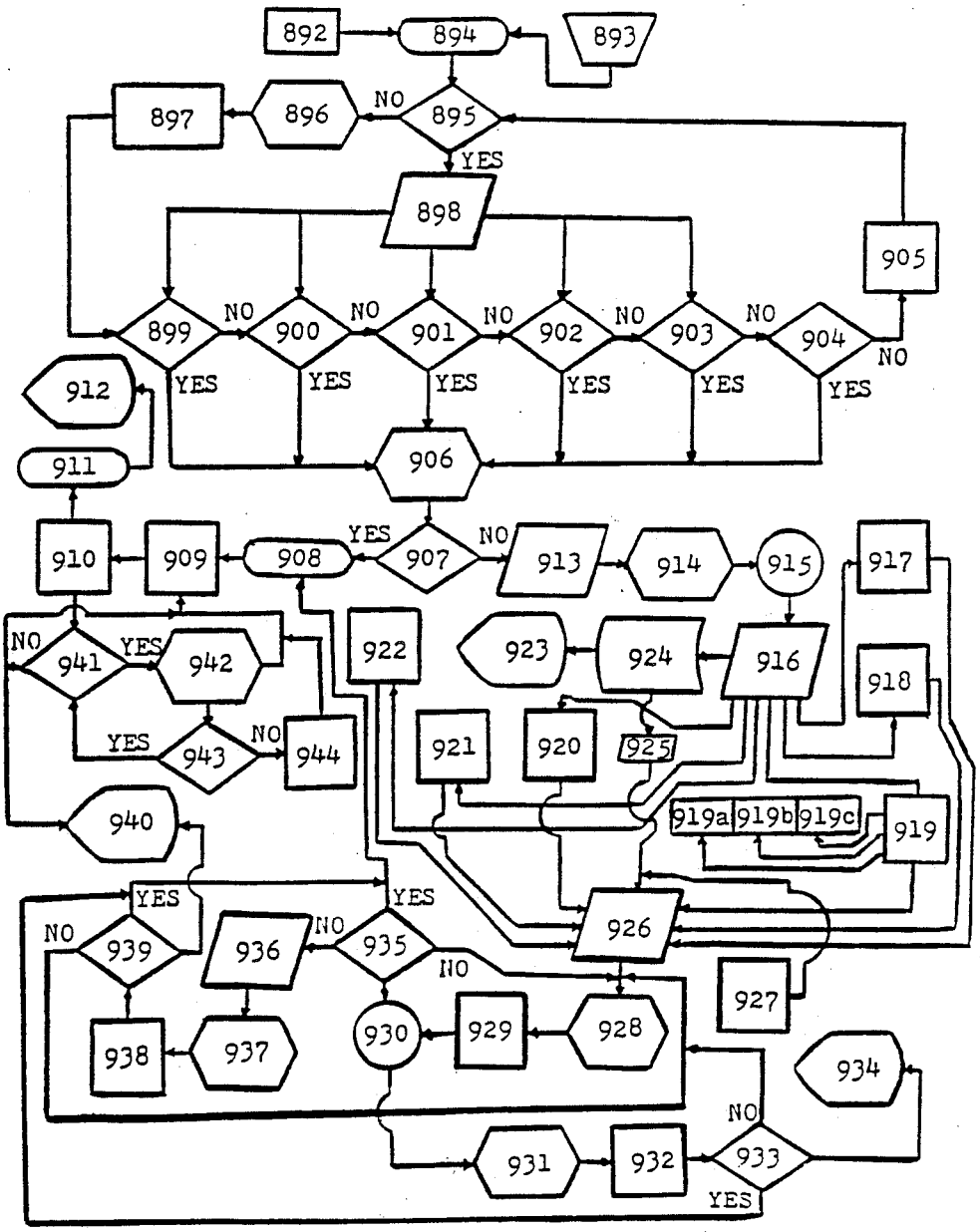
FIG. 105 is a concise algorithm describing the process of matching designated targets with specified types of projectiles.

FIG. 105 is a concise algorithm describing the process of matching designated targets with specified types of projectiles. Numerals 892, 893 and 894 of FIG. 48 describe processes responsible for automated target acquisition by the CPU, manual bypass for keying target acquisition and the initial acquisition codifying element. Data from codifying element 848 enters determinant process 895, which assesses whether or not target acquisition has occurred for specified targets. A negative assessment by process 895 enlists preparatory process 896, which digitally enhances data previously obtained and prepares to mix signals obtained from previous sensor scans with newly arriving signals, which are executed by process 897. A positive assessment from process 895 enlists element 898 which collates and lists data signals obtained from a variety of separate, distinct and fuctionally different sensory means. Process 897 engages decision process 899; whereas element 898 engages determinant processes 899 through 903, respectively. Decision process 899 determines whether or not target acquisition can be substantiated and a negative assessment by process 899 enlists determinant process 900. Process 900 assess whether or not the specified targets are illuminated by radar either on passive or active response frequencies. A negative assessment by process 900 engages decision process 901, which determines whether or not active or passive emissions are generated by said targets in the infra-red region of the spectrum. A negative assessment by process 901 enlists determinant process 902, which indicates whether or not the acquisition of a target can be provided on the bases of active or passive acoustic emissions. A negative assessment by decision process 902 enlists determinant process 903, wherein various other regions of the spectrum are accessed such as, ultraviolet or x-ray regions and the process is further implemented by laser acquisition means. A negative assessment by process 904 enlists preparatory process 905 which implements the data by supplementary data derived by a variable wavelength laser designation source. Prior to being conveyed back to determinant process 895 for further analysis. A positive assessment of target acquisition by processes 899 through 904 collectively engages preparatory element 906. Preparatory element 906 assimulates equivalent data obtained previously and the array of sensory elements, which cross-references and correlates said data conveys the results to determinant process 907. Determinant process 907 verifies whether or not the projectile types available to the transector device match those targets specified by the user/transector interface. A positive match by determinant process 907 enlists element 908 which institutes the load program described and collectively executed by subprogram 909. Upon satisfactory completion of subprogram 909, subprogram 910 is enlisted wherein a firing sequence is initiated, implemented and executed prior to entering termination phahse 911. Termination phase number 911, ends with the dispersal and subsequent discharge of projectiles from the transector device, the process of which is displayed to the user, as indicated by numeral 912. A negative evaluation by determinant process 907 enlists scanning process 913, which analyzes digitized signal return from holograms etched onto the nose cone or side elements of each projectile element embodied within the inventory of projectile elemnts which are either housed within the stores of transector device or available to the transector device through ancillary systems. Said holograms are illuminated by a array of laser diodes and sensory elements incorporated within the autoload means, mechanism and other mechanism embodied within the aforementioned transector unit. Preparatory process 914 indexes data from element 913 and readies ancillary systems to sort projectiles based on warhead types. Process 914 engages sorting element 915 wherein projectiles are sorted based on instructions prepared by preparatory process 914. Process 915 engages element 916 which lists the entire complement of projectiles with substitute warheads available within the transector inventory capable of neutralizing the designated targets. Numerals 917, 918 and 919 describe warhead tapes consisting of armor piercing kinetic energy projectiles, incindraries and projectiles carring payloads of volitiles. The warhead complement carring volitiles defined by numeral 919 is subdivided into three subclasses described by elements 919*a*, 919*b* and 919*c*. The designated subclasses of volatiles consisting of antibues, anesthetics, toxins and other substances. Numerals 920, 921 and 925 designate warhead types consisting of corrosives, radioactive emitters and high energy discharge units capable of instituting localized EMP. The initial effects of the sorting process 915 is to tabulate the list of accessible subtitute projectiles available are compilled by element 916, respectively. The updated list is committed to short term storage in an ancillary memory and momentarily displayed as indicated by processes 923, 924. Data obtained from storage process 924 is enhanced and conveyed by process 925 to process 926. The status of available projectiles carring warheads which can be substituted for projectiles emboding warheads specified for given designated targets is indicated by element 926. Process 926 additionally lists the location of warhead either detached from said projectiles or within warhead assembles, which match those warhead types directly specified but otherwise inaccessible to the initial sorting process, as obtained from the memory of the CPU, which is indicated by element 927. Information from process 926 is conveyed to preparatory process 928, wherein modified instructions are provided to match warhead types with designated targets. Process 928 enlists element 929 wherein said modified instructions are implemented and executed prior to engaging sorting process 930. Sorting process 930 engages determinant process 935 and preparatory process 931, sequentially. Preparatory process 931 enlists machinary within the transector device to reassemble warheads and projectile elements such that specified warheads located from other sources such as, deactivated projectiles can be mounted on projectiles which are activated and/or further locating said warheads from complements of projectiles or detached surplus warheads. Process 932 embodied a subprogram which assigns, implements and executes commands obtained from processes 929, 930 and 931. Determinant process 933 verifies whether or not subprogram 932 has executed its instructions. Positive affirmation by determinant process 933 enlists process 908; whereas a negative response re-enlists preparatory process 928. Determinant process 933 irregardless of its assessment engages display means 934 to inform the user of the present status of projectiles relative to the transector device. As indicated previously, element 930 enlists decision process 935 which determines whether or not substitutes can be found within the inventory of warhead and projectiles contained within the transector device and/or ancillary systems. Positive confirmation by determinant process 935 enlists process 908; whereas a negative assessment enlists process 936. Process 936 lists projectile assemblies which are available and which can upon being fired sequentially accomplish the necessary effects originally specified by the user and/or CPU in regards to certain specified or designated targets. The previous sentence portends a scenario, whereby a human target is inaccessible or protected by an armored structure, which otherwise prevents delivery of volitiles to neutralize said target. A combination of projectiles fired in sequence will obviate the difficulties arising from the previous scenario by immediately preceding the projectile carring volitiles with an armor piercing projectile fired in rapid succession eliminating the barrier between the target and neutralizing mist of volitiles. Other numerous scenarios, problems and solutions to said problems are corrected by sequential firings of projectiles taken in combination. Preparatory process 337 is enlisted by process 336 wherein the sequence of firing said projectiles are computed by said process. Process 937 engages subprogram 938, which executes the proper firing sequence and engages determinant process 939 then process 939 engages process 908; whereas a negative assessment by decision process 939 re-enlists preparatory process 928. Display process 940 is engaged irregardless of the determination specified by determinant process 940 in order to inform the user of the updated conditions within said transector device. In the unlikely event projectiles can not be fired from said transector device, such as an obstruction of the barrel structure number 749, a damaged or defective circuit, or jamming of said projectiles, determinant process 941 is enlisted by firing subprogram 910. There is almost a null probability that a rod, for example would be intentionally jammed within the barrel of the device, or a curcial circuit previously undetected and uncorrected will malfunction. The probability for the conditions alluded to in the previous sentence is approximately 0.0004±0.0001 according to simulations and the likelyhood of projectile jamming is determined to be 0.001±0.0005. Preparatory process 942 boosts signals to existing loading circuits engages alternate existing bypass circuits prior to engaging subprogram 909. Process 942 simultaneously engages determinant process 943, which assesses whether or not a malfunction in the system has suddenly developed due to jamming of a projectile. If a fault due to jamming of said projectiles occurs than determinant process 943 engages subprogram 944, which consists of a number of processes specifically designed to remove or eject the obstructing or jammed projectile from either the loading or firing chamber prior to re-engaging subprogram 909. If the fault which is preventing firing of the projectile is determined to be unrelated to jamming then decision process 943 re-enlists determinant process 941, which informs the user of the present condition existing within the transector device by reactivating display element 940.

Figure 106:
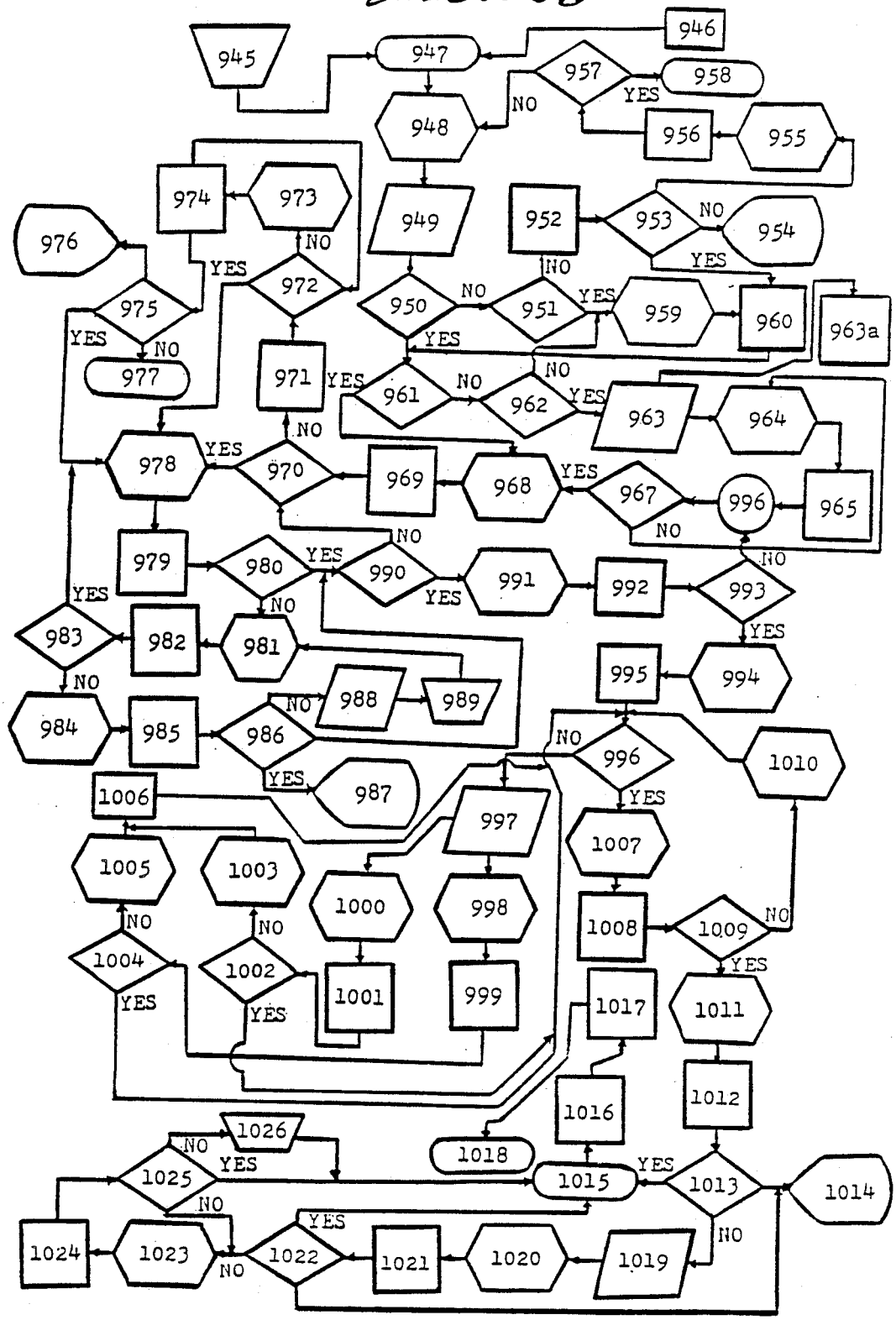
FIG. 106 is a concise detailed algorithm describing the process by which multiple warheads within a warhead assembly are altered or modified to match designated targets with projectiles carring substitute warheads.

FIG. 106 entails a concise algorithm which entails automated systems embodied within the transector device to modify the disposition or configuration of warheads with a given warhead assembly. Numerals 945, 946 and 947 of FIG. 49 designate the manual override element, the CPU automated override element and the sequence actuator means. Preparatory process 948 after being actuated by process 947 tentatively actuates target ranging elements within said transector device and enlists process 949 which, collates and lists the number, types and trajectory patterns of designated targets falling within range of the aforementioned transector device. Data from process 949 is conveyed to determinant process 950 which assess whether or not all designated targets are within range of the transector device. If all designated targets fall within range of said device than determinant process 961 is engaged; whereas a negative assessment by determinant process 950 enlists decision process 951. Decision process 951 determines whether or not designated target not within range of the transector device can be compensated for by extending the fuel parameter of the propulsion system by adding or concentrating fuel reserves. A negative assessment by determinant process 951 enlists a subprogram, number 952, to select an alternate trajectory pattern for said designated targets, which will allow said targets to fall within range. The alternate trajectory pattern is based on the present speed, direction and the complexity of the flight exhibited by the designated target in relation to atmospheric conditions such as wind velocity, barometric pressure or other parameters and the position of the transector device. The results from subprogram 952 are examined by determinant process 953, which based on data accumulated previously from simulations determines whether or not alternate trajectory patterns will engage said target. Irregardless, of the determination of decision process 953, display element 954 is actuated to up to date the user of the present status of the target. A positive assessment by decision proces 953 actuates processes which enlists subprogram 960; whereas a negative assessment by process 953 engages preparatory process 955. Preparatory process 955 selects the optimium trajectory paths in which to engage multiple targets, including paths anticipating necessary course corrections, which can implement the interception of designated targets. Process 955 actuates subprogram 956 which executes the programming that; alters trajectory paths and effects course corrections to allow projectiles to intercept designated targets. Determinant process 957 assess the effect of subprogram 956. A positive track indicating a high probability of target engagement initiates the actuation of the launch modes, as indicated by element 958; whereas a negative assessment by process 957 re-enlists preparatory element 948. A positive assessment by determinant process 951 enlists preparatory process 959, which acts on the program controlling warhead dispersal and actuates subprogram 960 which modifies the trajectory pattern of said dispersal and enlists determinant process 961, which is also enlisted by a positive assessment by decision process 950. Determinant process 961 verifies whether or not the number and types of warheads within the warhead assemblies correspond to those required to engage the full complement of specified targets. Process 962 interrogates other subservient systems embodied within the transector device through an internal array of sensory means in order to determine whether or not substitute warheads and projectiles are available to be requisitioned. If said projectiles and/or warheads are available requisition process 963 is directed to compile a list of said items and the method of access; whereas process 959 is engaged if said items are available but can not be requisitioned. Element 963 enlists preparatory process 964, which prepares the alternate warhead assembly from existing stocks and conveys instructions to internal servomechanisms which locate and load the aforementioned items. Process 963 also engages subprogram 963*a* in parallel with process 664. Subprogram 963*a* recapitulates the routines and subroutines and other processes embodied with the algorithms described in FIG. 48. Process 964 engages subprogram 965 which executes the instructions provided by element 964 and upon completion process 965 institutes a sorting procedure of said items, as indicated by element 966. Process 966 conveys the status of suitable warheads and projectiles to interrogation element 967 which discerns whether or not said items have undergone sorting. A negative response by process 967 re-engages preparatory process 964; whereas a positive assessment by process 967 actuates preparatory process 968. Preparatory process 968 actuates the autoload mechanism to detach the warhead assembly cap or nose cone element from the multiple warhead projectile, exposing the warhead assembly. Decision process 970 monitors the progress of subprogram 969 through an internal sensory feedback loop system. A negative determination by process 970 enlists element 971; whereas a positive confirmation engages preparatory process 978. Process 971 boosts the command signals to internal servomechanism embodied within the autoload mechanism and ancillary structures, decision process 972 which is equivalent to element 970; however a negative determination by decision process 972 enlists preparatory process 973; whereas a positive assessment by process 972 enlists preparatory process 975. Preparatory process 978 prepares to extract non-specified warheads and/or projectiles carrying non-specified warheads from the warhead assembly; whereas preparatory process 981 switches to alternate bypass circuits and systems if a gain or boost in signals to existing circuits does not motivate the autoload mechanism. Subprogram 974 executes the commands provided by process 973 and decision process 975 determines whether or not the autoload mechanism has detached the said nose cone structure, sufficiently exposing the warhead assembly. Irregardless of determinant process 975 assessment the fault is displayed to the user, as indicated by numeral 976. A negative assessment by process 975 enlists the termination of power to the autoload mechanism and the subsequent return to process 947 to restart a secondary equivalent autoload mechanism embodied within the aforesaid transector device. Process 978 initially orders the tubular structure of the auatoload mechanism to extend and ensnare non-specified warheads within the warhead assembly and then to retract from said assembly, extraction or withdrawing said non-specified warhead from said assembly. Remember all warheads and projectile types are specified by digitized holographic characters etched within the surfaces of said type structures or items, as previously indicated earlier in the specifications. Process 979 implements and executes the aforementioned extraction process. Decision process 980 determines whether or not the undesired or non-specified warhead has been extracted from the warhead complement. A positive confirmation of warhead ejection from said warhead assembly engages another determinant process described by numeral 990, which determines whether ejection of said warhead has also occurred; whereas a negative assessment by process 980 enlists preparatory process 981. Preparatory process 981 boosts and enhances the command signals to the respective circuits of said autoload means and process 982 executes said amplification and enhancement of the aforesaid signal, process 983 interrogates the system to determine whether or not process 982 has been effective. A positive assessment by process 983 re-engages process 973; whereas a negative assessment enlists preparatory process 984. Process 984 prepares to bypass previously existing circuits and actuates alternate circuits. Process 984 engages subprogram 985 to execute the instructions provided by preparatory process 984. Decision process 986 evaluates the effects of subprogram 985 and displays the fault and the course of correction to the user, as indicated by numeral 987. A positive response by determinant process 986 enlists process 990; whereas a negative response causes the data to be collated and the entire procedure to be implemented with a manual override, as indicated by numerals 988, 989, respectively. Determinant process 990 ascertains whether or not the unwanted or non-specified warhead has been ejected. A negative assessment by process 990 re-engages process 970; whereas a positive confirmation by process 990 enlists preparatory process 991. It is in preparatory process 991 wherein circuits are actuated controlling means to recover the specified warhead and/or projectile and warhead to be inserted into the warhead assembly and thereby modifying the structural configuration of the aforesaid assembly. Process 992 embodies a subprogram which sequentially actuates said systems responsible for recovering said substitute warheads and/or projectiles and warheads from the inventory of said items. Determinant process 993 asses-ses whether or not said substitute items have been retrieved or recovered by the aforesaid systems. A negative assessment by process 993 re-engages sorting element 966; whereas a positive confirmation that recovery of said substitutes has occurred enlists process 994. Preparatory process 944 prepares said substitute warheads and/or warheads attached to projectiles to be inserted into the vacant positions in the warhead assembly, previously occupied by said non-specified warhead elements. Process 994 engages subprogram 995, which actuates and implements systems responsible for executing the insertion procedure. Determinant process 996 verifies whether or not the insertion procedure has been properly executed by systems controlled and implemented by subprogram 995. Determinant element 996 through a series of sensors and feedback loops determines whether or not insertion of one or more required warheads and/or projectiles emboding specified warheads has taken place. A positive confirmation by determinant process 996 enlists preparatory process 1007; whereas a negative assessment by process 996 enlists clerical operation 997. Clerical operation 997 runs a systems check on all circuits and systems controlling insertion and release of substitute warheads or projectiles carrying the same. Process 997 enlists both processes 998 and 1000 for parellel operations. Preparatory processes 998, 1000 prepare elements within the program to boost and enhance command signals and to switch to alternate circuits. Processes 998, 1000 engage subprograms 999, 1001 which execute the instructions provided by elements 998, 1000, respectively. Determinant process 1002, 1004 interrogate the parellel systems to determine whether or not insertion and release of said substitute items has occurred. Positive confirmation by determinant processes 1002, 1004 re-enlists determinant process 996; whereas a negative assessment by processes 1002, 1004 engages preparatory processes 1003, 1005, respectively and processes 1003, 1005 both actuate subprogram 1006 for simultaneous parellel implementation. As indicated earlier, if determinant process 996 has established that insertion has been instituted then peparatory process 1007 is enlisted to effect a release of said warhead and/or projectile warhead type. Release of the aforesaid substituted items into the vacant chambers of the warhead assembly occurs automatically as the tubular insertion means is withdrawn or retracted from said warhead assembly. Preparatory process 1007 further instructs circuits of the autoload element to reinsert the warhead nose cone. Subprogram 1008 executes a sequence of instructions regarding the recaping. The recaping procedure involves replacing the warhead cap or nose cone back onto the warhead projectile assembly and rotating said nose cone clockwise into a threaded grove structure located within the inner rim of the warhead assembly. After a prescribed number of circumferential clockwise rotations the aforesaid nose cone locks into position via a pin latch mechanism, securing said nose cone element to the projectile warhead assembly. The autoload mechanism then retracts from the multiple warhead projectile unit upon completion of its task. Determinant process 1009 assess whether or not the aforementioned warhead has been recaped. A negative assessment by process 1009 enlists preparatory process 1010, which overrides and bypasses defective or inoperative circuits; whereas a positive assessment by process 1009 enlists preparatory process 1011. Preparatory process 1011 actuates rotating elements and releases autolocks of the autoload mechanism such that, a rapid forward thrust and clockwise rotation of the warhead cup can be implemented. Process 1011 engages subprogram 1012 which executes the forward thrust and clockwise rotation of the nose cone element by component systems embodied within the autorelease mechanism. The autoload mechanism disengages and retracts away from the multiple warhead projectile unit along an internal slide element embodied within the transector device. Determinant process 1013 assesses the effects of subprogram 1012 and display the status of the overload mechanism in relation to the aforesaid multiple warhead projectile unit, as indicated by element 1014. A negative assessment by determinant process 1013 enlists clerical operation 1019; whereas a positive assessment by decision process 1013 which engages element 1015. Element 1015 terminates the autoload mechanism operation and returns said mechanism into a neutral position, placing the said autoload elements and all other systems on standby; while the multiple warhead projectile is readed to be loaded. Process 1015 engages loading subprogram 1016, which upon completion actuates the firing subprogram element described by process 1017. Upon the successful firing of the multiple warhead projectile unit described by number 1014 by the execution of subprogram 1017 the entire program is terminated and the transector device is returned to the main program sequence clerical operation 1019 is enlisted by determinant process 1013 then a negative response is enlisted by said decision process. Clerical operation 1019 entails a complete search and listing of all component elements, including the warhead nose cap or warhead cap element which may have been jolted by a high g-impact, or acceleration, during the entire procedure. Clerical operation 1019 upon completion enlists preparatory process 1020, inclusively. Preparatory process 1020 engages subprogram 1021, which initiates routines and subroutines to compensate for discrepencies within the autoload mechanism and/or ancillary systems. The progress of subprogram 1021 is monitored then assessed by interrogator element 1022. Positive confirmation by element 1022 engages process 1015; whereas a negative assessment by process 1022 enlists preparatory process 1023. Command signals to alternate bypass circuits are actuated by preparatory process 1023, which engages subprogram 1024 actuating said circuits to perform the release procedure. The operations executed by subprogram 1024 is monitored and assessed by determinant element 1025, which engages a manual override process 1026 in the event a malfunction or systems failure prevents element 1024 from executing its instructions. A positive assessment by determinant process 1025 engages process 1015, which enlists subprograms 1016, 1017 and termination process 1018, respectively.

FIGS. 107, 107*a* to 107*g* entail concise description of an ancillary laser* element embodied within the transector element. The outer case of said ancillary laser means 1052 is described by element 1027. Numerals 1028, 1029 describes a heat exchanger and coolant means and thermal venting elements for said laser unit. Power cable 1030 conveys electrical energy to secondary transformer element 1031, which charges capacitory bank 1033. Numerals 1032, 1034 and 1035 designates a variable array of resistive elements, a solenoid actuator element and an oscillator means. Numbers 1036, 1042 of FIG. 107 discloses coiled heat exchanger elements embedded within a variable volatile coolant substance formed from a nylon phenolic quartz compound. Numeral 1043 defines a highly reflective circumferential surface. Numerals 1037, 1038 and 1039 designate the reflective interior of a high energy diode element encapsulated by a optically semi-emissive mirrored lense element. Element 1040 defines a phosphorescent impregnated material, which operates inconjunction with elements 1037 to 1040 and flash coil means 1044 to pump laser active material 1041, which previously consisted of Al-YAG, Nd-Al garnet, or Alexandrite doped material. Numerals 1045, 1046 and 1047 describes the most interior portion of case associated with variable compound lense element 1048, including slide and track element 1046, 1047. The aperture or size and focus of the laser beam are regulated by the circumferential rotation of lense element 1048 by a solenoid element, not shown in the figure. Numerals 1051, 1052 collectively designate the entire ancillary laser means and electrical schematics describing in part the circuitry of said laser means. Numeral 1049 defines a thermistor element which monitors the internal temperature with said laser device 1052. Numeral 1050 is collectively assigned to the separate circuit powering said thermister element 1049.

* U.S. Pat. No. 4,276,520 is incorporated by reference.

Figures 107, 107A:
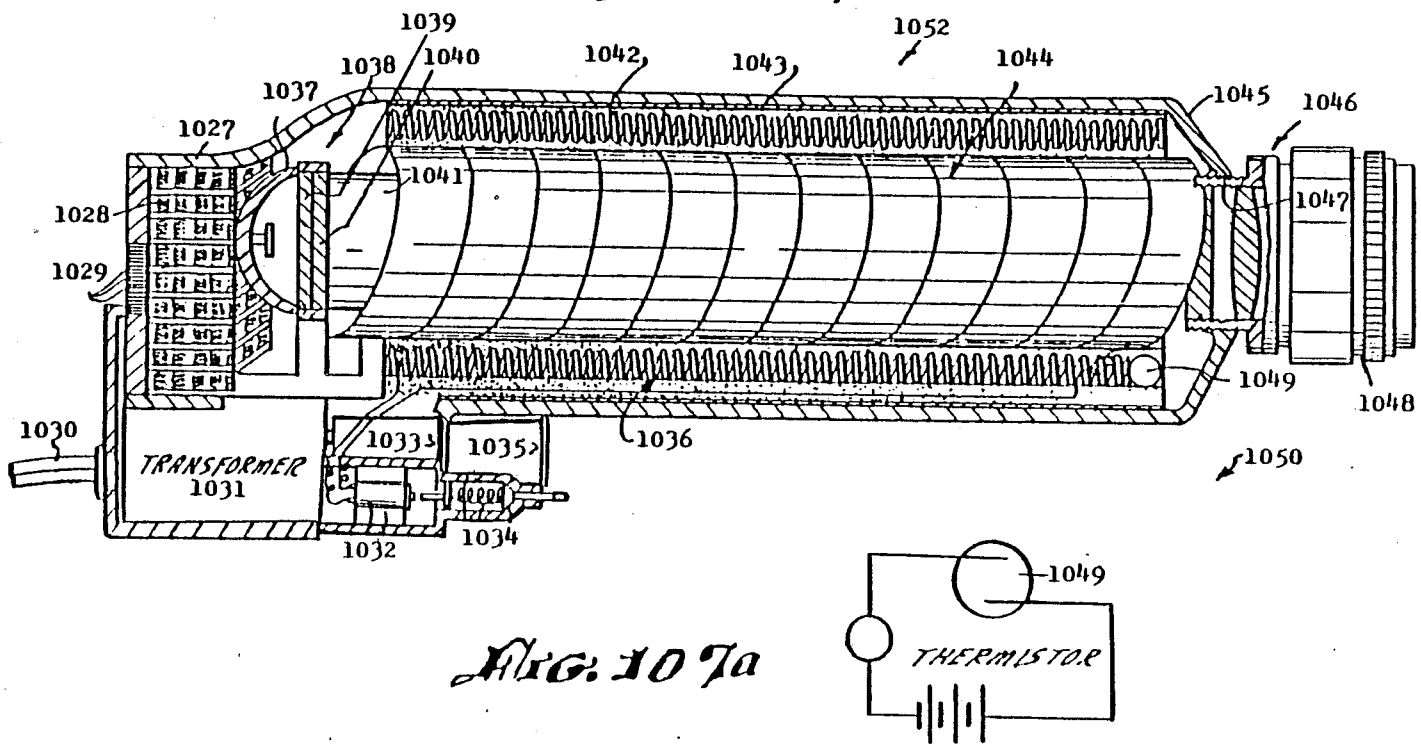
FIGS. 107 to 107*g* disclose detailed cross-sectioned perspectives of a high energy laser device, internal component systems and electrical schematics of said laser means embodied within the aforesaid military type or grade transector device.
Figure 107B:
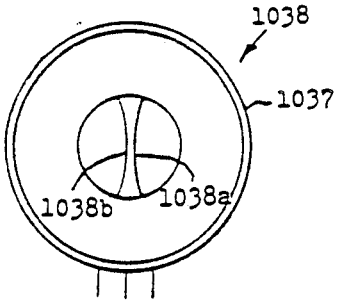
Figure 107C:
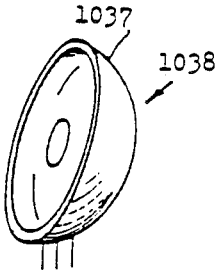
Figure 107D:
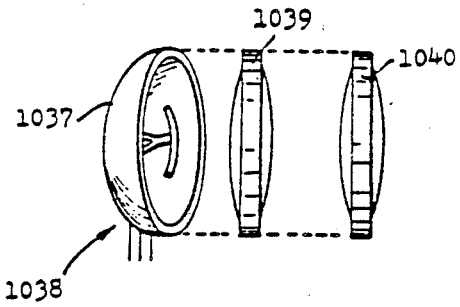

FIGS. 107*b*, 107*c* describe in detail the laser diode pumping source and coolant element positioned aft of laser device 1052. Elements 1038*a*, 1038*b* of diode 1038 designate separate anode and cathode elements providing the internal arcing source for diode means 1038.

Figure 107E:
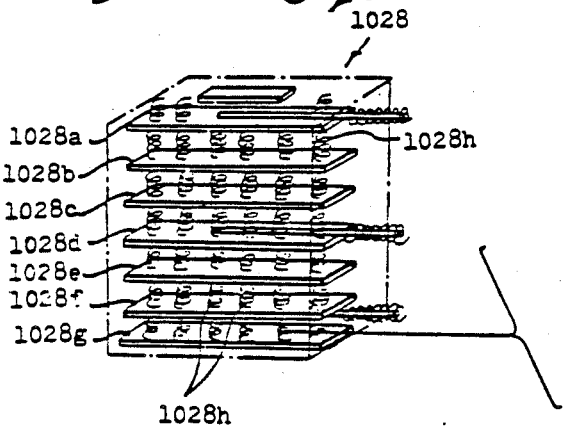
Figure 107F:
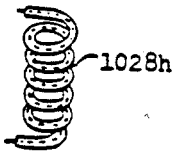

FIGS. 107*e*, 107*f* entail concise descriptions of the coolant cube and microcoiled heat exchanger element embodied within the coolant medium. The anterior coolant cube 1028, consists of an array of microcoiled heat elements described by element 1028*h* vertically disposed between an array of heat exchanger plates described collectively by numeric values 1028*a* through 1028*g*, inclusive. Said plates and microcoiled heat exchanger elements are embeded within an irregular matrix of a nylon phenolic acrylic coolant medium which slowly vaporizes when subjected to intense and continuous heat. Said heat being dissipate, as the vaporized coolant exits through vent 1029. The power source for laser 1052 is continuously powered from an ancillary power source provided by such power sources as external power means 765.

It is not unusual for said laser source to generate between two to four kilowatts of energy in ten to one hundred nanosecond bursts per second. At short distances of 1.0 to 50 meters such a coherent power source depending on atmospheric conditions and reflectivity it can be optimally used to drill, cut or fuse structures. The use of laser sources as an offensive weapon diminshes inversely with the density of atmospheric materials suspended in between a designated target and laser source and the position range, motion and composition of said designated target.

Figure 107G:
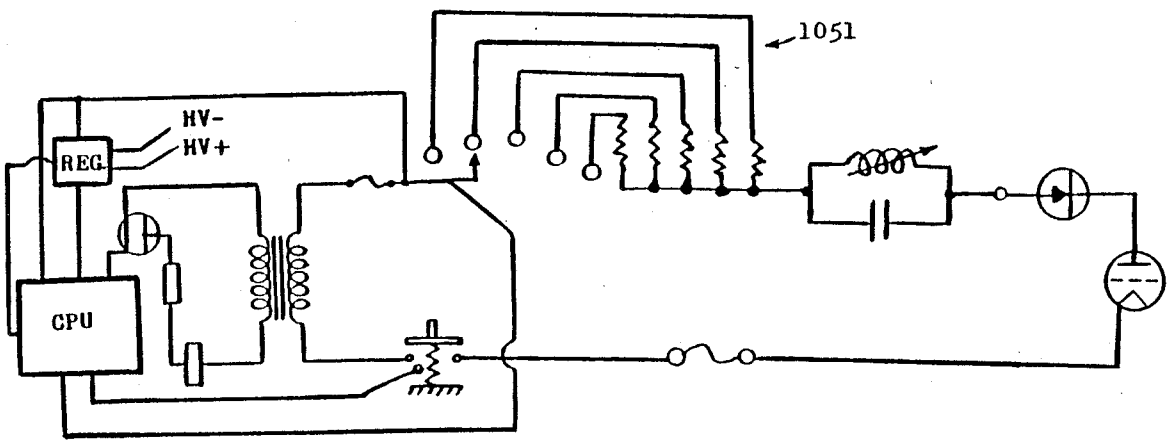

FIG. 107*g* entails a concise electrical schematic for the aforesaid laser unit described in the previous FIGS. 107 through 107*f*. The entire electrical schematic is assigned a single numeric value, number 1051. The internal disposition of internal electrical components and subsystems are straight forward and readily understandable to those skilled in the art, making a more detailed description unnecessary.

Figure 108:
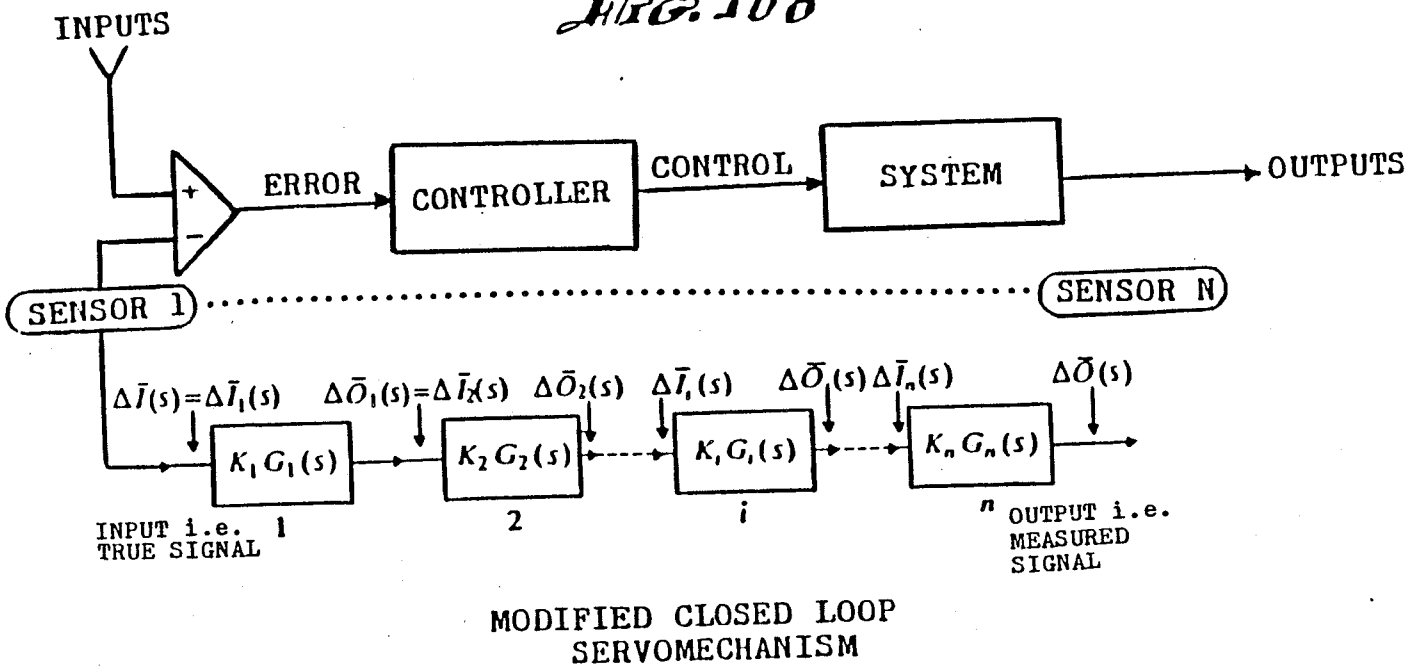
FIGS. 108 to 108*b* describe in block diagram fashion the operation of modified closed loop servomechanism, static and dynamic measuring systems embodied within said transector device.

FIG. 108 entails a simplified block diagram of a modified closed loop servomechanism contained within feedback systems embodied within the aforementioned transector device. The above mentioned block diagram is clearly marked and the accompanying descriptive equations are clearly defined and readily understood by those skilled in the art. Essentially input signals are monitored by an array of sensors and errors are detected between internal static values contained within the input structure of said signals.

The transfer function for a complete measurement system is described by the equation herein below $$\frac{\Delta\bar{O}(s)}{\Delta\bar{I}(s)} = G(s) = G_1(s)G_2(s) \ldots G_1(s) \ldots G_n(s)$$

Transfer function for complete measurement system where the system transfer function G(S) is the product of individual transfer functions, the output signal ΔO(t) corresponds_to a time varying input signal ΔI(t), for each element i having steady state and linear dynamic characteristics Ki. Substituting the Laplace transform of the output signal is defined by the expression $$\Delta\bar{O}(S)=G(S)\Delta\bar{I}(S),\ \Delta\bar{O}(S)$$

is expressed in partial fractions and ΔO(t) is designated by using standard Laplace transforms in a look up table. The dynamic error for signals generated can be described by the following expression $$\Delta O(t) = \sum_{n=1}^{n=\infty} \hat{I}_n |G(jn\omega_1)| \sin(n\omega_1 t + \phi_n)$$

whereas the dynamic error of a system with periodic input signals can be described by the expression $$\Delta E(t) = \sum_{n=1}^{n=\infty} \hat{I}_n \{|G(jn\omega_1)| \sin(n\omega_1 t + \phi_n) - \sin n\omega_1 t\}$$

where $\hat{I}_n = b_n$ is the amplitude of the nth harmonic at frequency $nw_1t$ and the nth harmonic $\hat{I}_n \sin nw_1 t$ is input to the system. The corresponding output signal is $\hat{I}_n G(jnw_1)|\sin(nw_1t+\phi_n)$ where $\phi_n = \arg G(jnw_1)$.

Figure 108A:
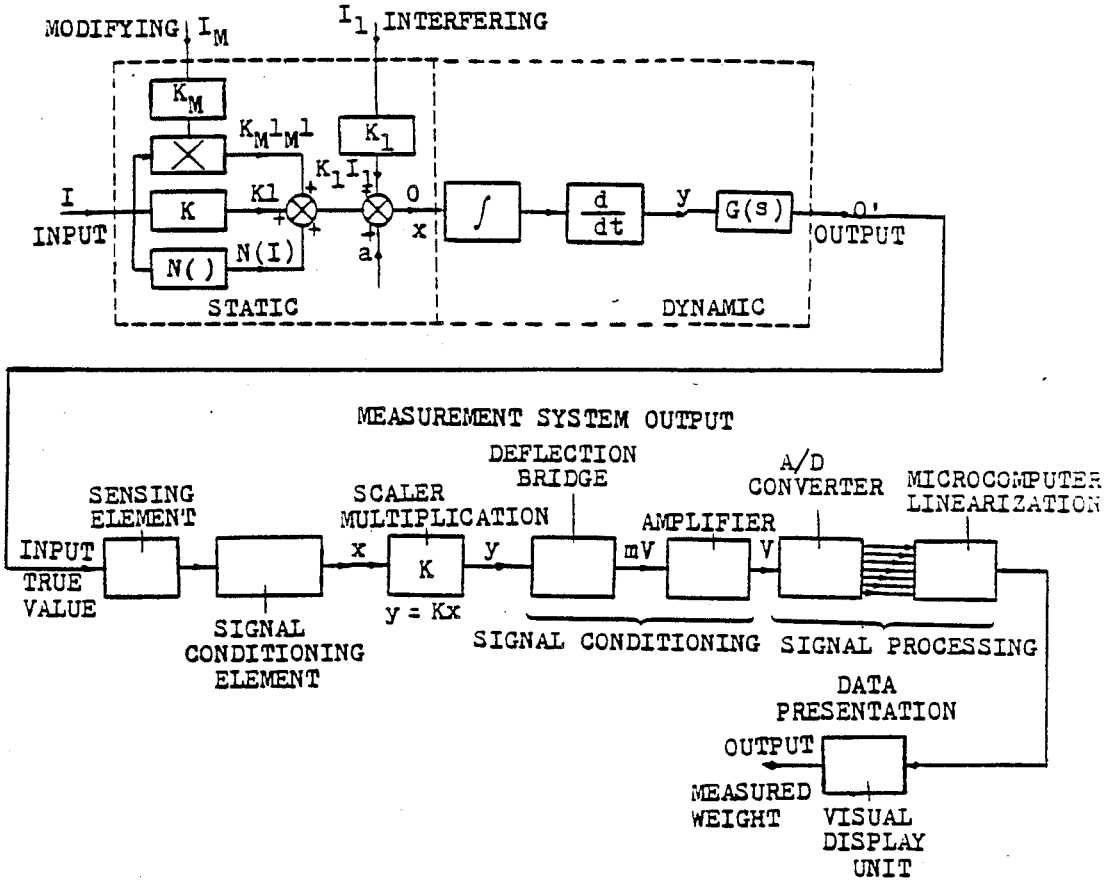

Once the signal is in its pure form enters an additional function element which performs a predetermined mathematical operation depending on what is required by the aforementioned system, such as additional summations, differencing logarithmic or exponential operations and/or other operations including scaler multiplication. Data treated by the aforesaid conditioning means which consists here of a deflection bridge and an amplifier element. The signals processes by the signal conditioning element is conveyed to the signal processing unit, which embodies an anolog to digital converter element and microcomputer linearization element. Information regarding the status of a given system and/or the signal generated by said system operated upon by the aforesaid signal processing means is made available to the user by a visual display element embodied within said device such as the LCD/LED display element, the holographic display means and an alternate ancillary means. The output is then remeasured and wieghted prior to re-entering the system such that the previous input and response can be compared against the incoming input and output signals. Numerical values are omitted in FIG. 108*a* because said figure is clearly labeled and well understood by those skilled in the art.

Figure 108B:
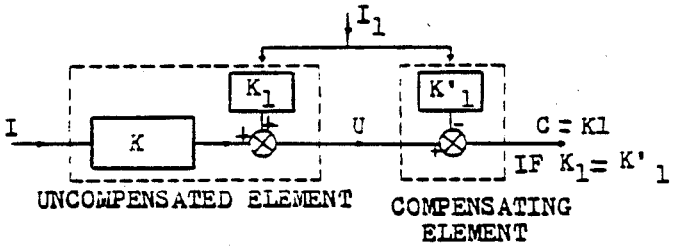

FIG. 108*b* is a concise block diagram wherein a system is compensated for by using enviromental inputs. The compensation of said systems by implementating the controller element embodied within said system with environmental inputs is of primary importance to such systems as those concerned with the dissemination of carrier mediated volitiles, the administration of electric shocks to targeted individuals or ancillary interactive systems. The block diagram is clearly labeled and readily understood by those skilled in the art.

Figure 109:
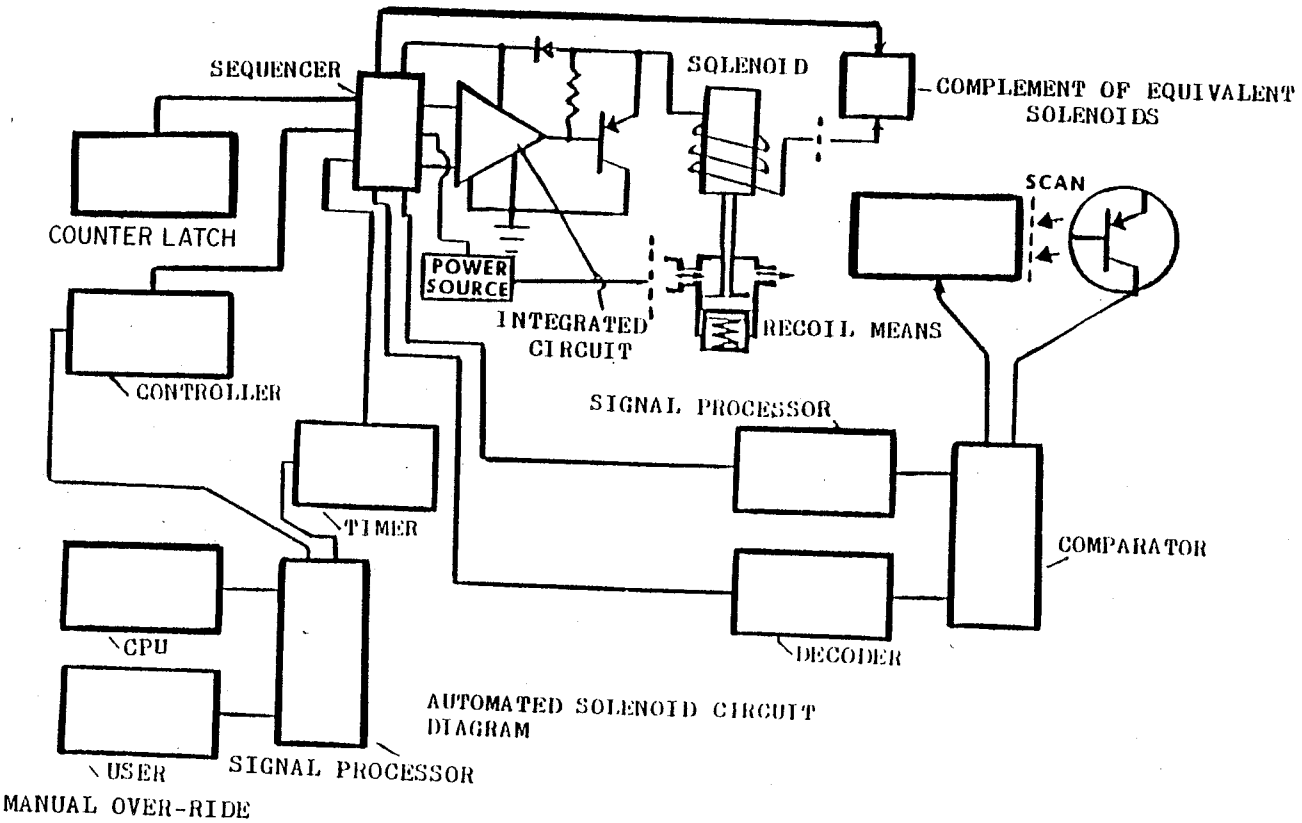
FIG. 109 is a concise block diagram illustrating the operation of automated solenoid means embodied within the transector device.

FIG. 109 is a concise block diagram describing the operation of automated solenoid elements contained within mechanical servomechanisms embodied within the aforementioned transector device. Numerical values are not assigned to elements described within FIG. 52 because said elements are clearly labeled to one skilled in the art. Solenoid elements are prevalent in such systems as the autoload mechanisms, the mechanism by which carrier mediated substances are assessed and the means by which projectiles are ejected and/or other ancillary systems embodied within said transector device. The duration of time with which a given solenoid element is actuated is determined by the timer and latch mechanism; whereas the order in which said solenoids are actuated is determined by the sequencer element. The command signals are operated upon by the decoder, signal processor and comparator element. Each separate and distinct solenoid element is equivalent to the next said automated solenoid element within the complement unless otherwise indicated and the single circuit disclosed in FIG. 52 operates the entire array or complement of said automated solenoid means.

Figure 110:
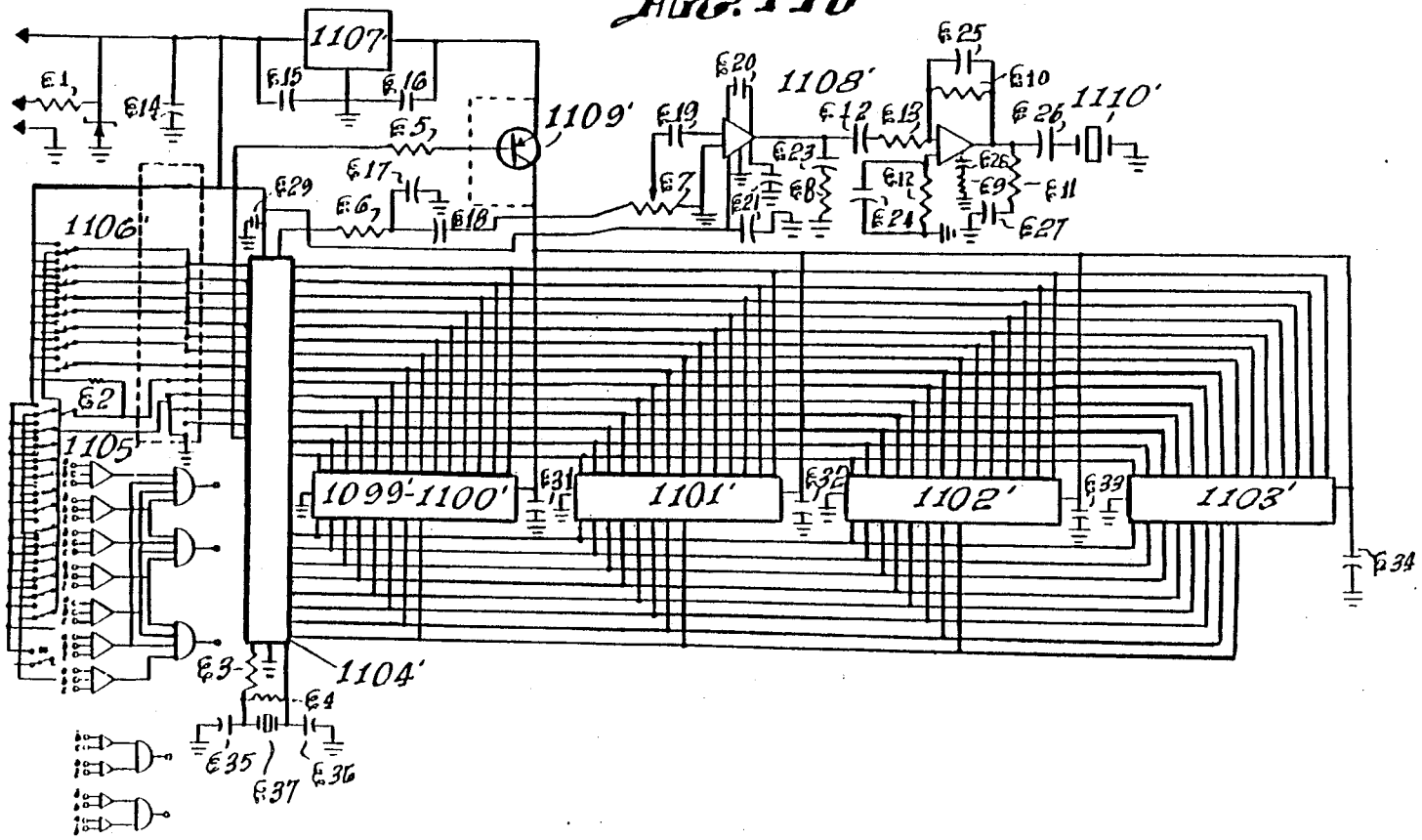
FIG. 110 is representative of a basic schematic denoting a modified electronic speech synthesizer element embodied within the transector device.

FIG. 110 is representative of a basic schematic of a modified electronic speech synthesizer, which is embodied within the transector device. The extended vocabulary is in excess of 1,000 words, and more than 20 phrases, which is announciated in either a male voice, a female voice or both voices. As with preceding figures all components are commerically available by such manufactes as Intel, IBM, National Semiconductor and others. Numerals 1099 through 1103 depicts equivalent speech ROM IC's which contain relevant speech data, where as the IC denoted by numeral 1104 represents the actual speech processor. An encoder signal digitizer and auto-keying complex is described by numeral 1105 and the manual keying sequencer is indicated by numeral 1106. The systems resistor elements are denoted by alphanumeric values ξ 1 through ξ 13 and the various capacitor components are noted by ξ 14 through ξ 35. Numerals 1106, 1107 and 1108 describes a typical voltage transistor element. ξ 36 denotes a crystal oscillator, whereas numeral 1110 describes a piezoelectric wafer which is utilized as a speaker unit. Analog to digital conversion of analog signals are necessarily performed during speech recognition and synthesis of speech by the transector device. Signals converted into digital impulses must be prefiltered to remove frequency components above what is defined by those skilled in the art, as the half sampling frequency; inoder to eliminate ambient white noise generated from the environment, which can distort information to be processed or otherwise acted upon by the CPU. The most fundamental talking integrated circuits are digital to analog converters, which upon receiving an appropriate sequence of commands from the CPU playback digitized and speech stored in the memory of one or more microprocessors. It is perferred, but not critical to the function of the transector unit that microprocessors with stored verbal commands, instructions and tones be embodied within the transector device. Microprocessors equipped with stored verbal commands or instructions are preferred because presently they sound more natural, have a higher reliability or lower incidence of fault and are more versatile then conventional synthetic language systems. The preferred microprocessor elements embody digitized signal equivalent of analog speech or voice patterns derived from encoded signals obtained from one or more human hosts. Since several hosts can be encoded on a single microprocessor element several different voices, genders, languages or dialects can be embodied within a single microprocessor unit, as previously indicated in the specification.

Figure 110A:
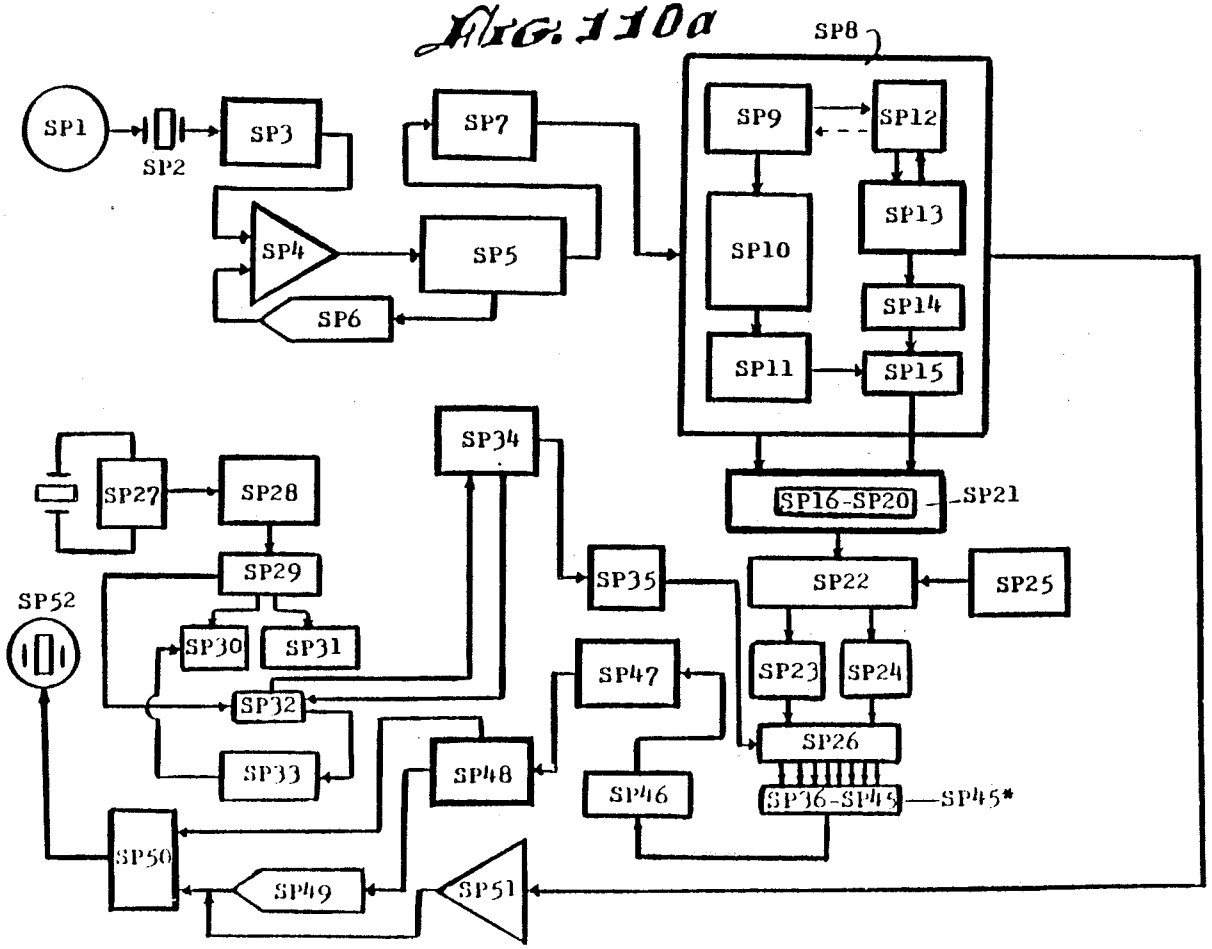
FIGS. 110*a*, 110*b* are block diagrams concisely illustrating the speech processing and speech recognition systems embodied within the aforesaid transector device.

FIG. 110*a* discloses briefly in part various filter topologies equivalent to the type of units embodied within the speech processing elements of the transector device. Six separate and distinct filter types are disclosed in FIG. 53*a* and each said filter type is assigned a single numeric value. Numerals 121 through 126 collectively designate the basic circuit designs from which the active, passive and switch capacitor types of filter elements; which implemented the speech processing unit of the transector device. Since the design function and implementation of the aforementioned filter types are standard separate numeric values are not assigned to separate component parts of each circuit. The integrated circuit units, capacitors, ground resistive and switching elements are obvious and readily understandable to those skilled in the art.

Figure 110B:
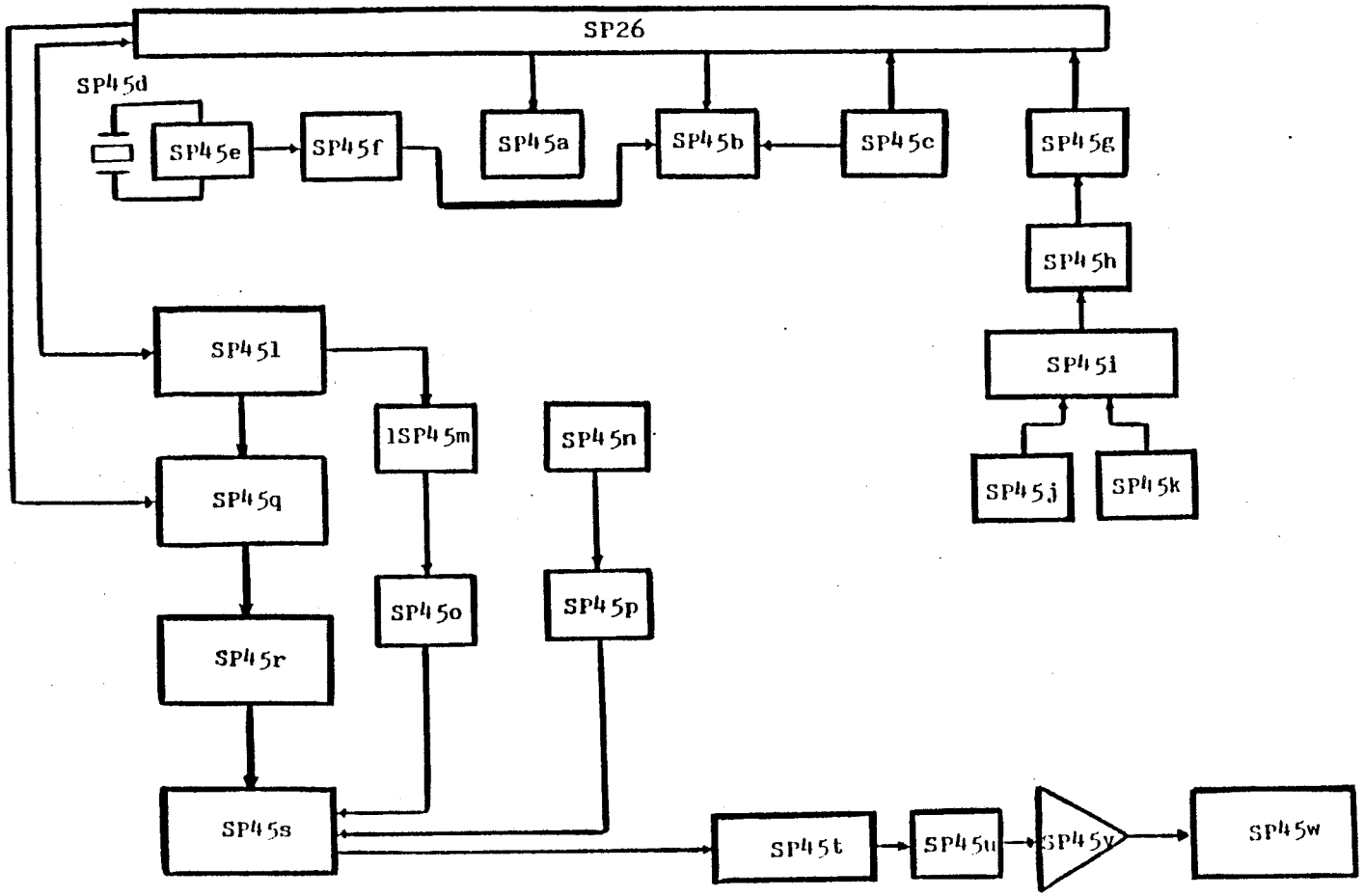
Figure 84:
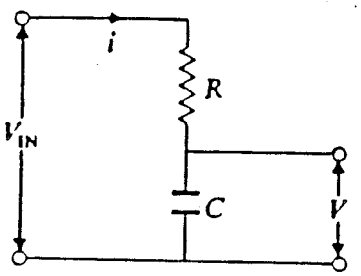

FIG. 110*b* is a block diagram concisely illustrating the systems operation of the speech processing element of the transector unit. Analog verbal input is introduced, as indicated, by numeral SP1 to piezoelectric transduction element SP2, which transmits the data to an analog then to digital converter element SP3, which samples the incoming data. Information processed by element SP3 is conveyed to comparator means SP4, which compares incoming signals with stored values and transfers the data to process SP5; which performs successive approximations and functions as a logic register element. Data acted upon by element SP5 is divergently sent to digital/analog converter element SP6, which re-enters comparator means SP4 for reprocessing and a number of successive filter elements operating collectively as a filter bank, indicated by number SP7. Data filtered from element SP7 enters CPU element SP8 to be acted upon. The CPU unit collectively defined by number SP8 embodies: a parameter extractor, numeral SP9, a comparator bank with stored data statistical parameters, numeral SP10 an expert system, number SP11 a short term storage process, SP12 global memory element described by SP13 an additional storage access element defined by number SP14 and a process wherein decisions regarding speech recognition and synthesis are conducted.

Once decisions regarding recognition of speech input have been implemented by element SP15 of CPU SP8, then process SP21 is actuated. It is within process SP21* where the appropriate response to verbal inquires or voice commands elicited by the user or others are implemented by engaging the proper synthesizer format to be accessed by the CPU. Element SP21 engages Address Bus SP22, which in enable mode enlists ROM element SP23 RAM element SP24 and is engaged by Address Arithmatic unit SP25. Elements SP23 SP24 interface with Data Bus SP26 which engages either simultaneously or in succession a number of separate and distinct chip or microprocessor elements containing the necessary vocabulary to synthesize the appropriate verbal respond, as indicated by numeral SP45* The Data Bus described by number SP26 is additionally implemented by elements SP27 through SP46. Elements SP27, SP28 and SP29 entail a clock means, program counter and EPROM unit, respectively. The ROM address is enlisted as process SP28 enlists process SP29 EPROM process, SP29, is implemented both from a verbal key processor and manual key pad element, not shown in the figure. Process SP29 additionally enlists RAM element SP30, Barrel Shifter means SP31 and ALU element, as described by numeral SP32. Process SP32 enlists on Over Flow Detection means SP33, which re-enlists RAM process SP30. Element SP32 additionally enlists the operation of accumulator element SP34 which engages Scaler process SP35 which in turn engages Data Bus means SP26. Element SP26 engages processes SP36 to SP45 which contain the optimium number of integrated circuit element, 1—n, encoded with a sufficient quantity of digitized signals to compose a large variety of verbal responses, in the form of complete sentences in the event of a medical emergency, to answer inquires or to reply to commands from the user or others in the immediate vicinity of the user. The proper syntax, grammer and sequencing of complete sentences in the synthesized response are coordinated by element SP46, which is designated as a synthetic speech collator unit. Process SP46 enlists I/O controller element SP47 which engages Data Registor process SP48. Element SP49 enlists DAC digital to analog convert means, which actuates the output MUX process, SP50, described by number SP51 The analog output is conveyed to a piezoelectric emitter unit described by number SP52, which transduces the speech output signals into analog pressure waves to be heard by the user or others in the immediate vicinity of the user.

* Process SP21 embodies processes SP16 to SP20, inclusive.

FIG. 110*b* is a block diagram briefly illustrating the operation of a single integrated circuit or microprocessor element described by element SP45* of FIG. 53*a*. Numeral SP45* of FIG. 53*a* enbodies an optimium of number of separate and distinct equivalent chips or integrated circuit elements. Each chip or integrated circuit element operates exactly the same as the other microprocessor element; however each said chip element is encoded with a different complement or text of digitized signals entailing a different set of instructions or information embodied within the chip element. The Data Bus disclosed by numeral SP33 enlists word decoder element SP45*a* Speech ROM Control element SP45*b* and is assisted by ALU Control and Interpolation element SP45*c* of the given chip. Each chip is additionally supplied with a ceramic oscillator, number SP45*d* a clock and Power Down Control element, as described by SP45*e* and Auxillary Counter Means designated by SP45*f* Element SP45*e* enlists element SP45*f* which acts on the Speech Data ROM Control element SP45*b* of the chip. The Data Bus SP26 interfaces with the Speech Data ROM, SP45*g* which is addressed by Address Register SP45*h* Alphanumeric values SP45*i* SP45*j* and SP45*k* describe a Message Latch and Control element, Select Lines and Control Lines, respectively. A Pitch, Gain and Interpolation RAM element described by element SP45*l* and Bandcenter and Bandwidth Coefficient RAM means defined by element SP45*q* interfaces with Data Bus element SP26. Process SP45*l* engages Pitch element SP45*m* which enlists Filter Process SP45*o;* whereas Noise Generator SP45*n* enlists Filter Process SP45*p*. Element SP45*q* engages process SP45*r* which is a coefficient Lookup ROM element containing 256×10 bits. Elements SP45*r* enlists process SP45*s*, which entails eighteen second-order sections 10×15 bit multipliers. Element SP45*m* SP45*n* through filters SP45*o* SP45*p* engage process SP45*s* at separate addressible interface points. Process SP45*s* enlists Pulse Width Moduation D/A element SP45*t* and the data signals processed by element SP45*t* are conveyed to Smoothing Filter SP45*u*. Signals transmitted from element SP45*u* are enhanced by Power Amplifier SP45*v*. Data from element SP45*w* sequentially enters process SP46, the Speech Collator unit, along with data taken in turn from other equivalent Power Amplifier elements associated with other chips, as described earlier in FIG. 110*b*.

* Process SP21 embodies processes SP16 to SP20, inclusive.

When processing a signal for analysis, recognition or for some other purpose, the spectrum and/or content of the signal at different frequencies must be evaluated in the real world. Since the CPU for purposes in a linear discrete arithmatic logic unit it is reasonable to evaluate a discrete portion of data within a finite period of time and infinite intergrals are evaluated as linear discrete processes, in order to yield first and second order approximations of data within a finite real time interval. The process of windowing allows linear discrete evaluation of a spectrum of data with marginal losses in temporal accumulation of information or evaluation of data. Optimal evaluation of a spectrum of a segment of a signal is briefly described in the equation herein below:

$$\begin{aligned} X_s(f) &= \int_{-\infty}^{\infty} w(t)x(t)e^{-j\sin 2\pi ft}\,dt \\ &= \int_{-\infty}^{\infty} w(t)x(t)(\cos 2\pi ft - j\sin 2\pi ft)dt \\ &= \int_{-\infty}^{\infty} w(t)x(t)\cos 2\pi ft\,dt \\ &\quad - j\int_{-\infty}^{\infty} w(t)w(t)\sin 2\pi ft\,dt \end{aligned}$$

where $X_s(f)$ = spectrum at frequency $f$
$x(t)$ = time function
$w(t)$ = window If w(t) is evaluated as zero outside some given interval from $t_1$ to $t_2$ then the expression can additionally be expressed, as $$\begin{aligned} X_s(f) &= \int_{t_1}^{t_2} w(t)x(t)\cos 2\pi ft\,dt \\ &\quad - j\int_{t_1}^{t_2} w(t)x(t)\sin 2\pi ft\,dt. \end{aligned}$$

Where spectral magnetudes are generated for storage as perceptually salient features, a discrete temporal approximation or DFT (discrete Fourier transformation) embodying a window function is required. To store a finite amount of frequency amplitudes and to analyze a finite quantity of speech values within a discrete interval of time requires a DFT implemented with a window function similar to the type expressed herein below:

$$\begin{aligned} X_s(k) &= \sum_{n=0}^{N-1} w(n)x(n)e^{-j(2\pi nk/N)} \\ &= \sum_{n=0}^{N-1} w(n)x(n)\left(\cos\frac{2\pi nk}{N} - j\sin\frac{2\pi nk}{N}\right) \\ &= \sum_{n=0}^{N-1} w(n)x(n)\cos\frac{2\pi nk}{N} \\ &\quad - j\sum_{n=0}^{N-1} w(n)x(n)\sin\frac{2\pi nk}{N}. \end{aligned}$$

where k is the frequency index, n is the time index, N is the quantity of points in the time sequence and normalization of the scale of frequency is instituted, such that, the frequency $2\pi$ corresponds to the frequency that the original time wave form is sampled; yielding an effective measure of the spectral content of each analyzed segment.

Filtering of discrete time signals as for linear filtering, where the output of the system is dependent on the present, on past inputs and past outputs if recursive, as indicated by the following expression $$y(t) = f[x(t-u).\ y(t-v)]$$

where $y$ = output signal
$x$ = input signal
$0 \leqq u < \infty < v < \infty$
$u, v$ = time variables indicating memory of system with regard to past inputs and outputs (respectively)

a resistor and a capacitor with a perfect impulse at the input yields $$y(t) = e^{-HRC-} \text{ for } t \geqq 0 \text{ at the output.}$$

however in general filtering computations are in the form described herein below $$y(n) = \sum_{k=1}^{N} b_k y(n-k) + \sum_{k=0}^{M} a_k x(n-k).$$

FIGS. 111, 111*a* and 111*b* are a series of concise diagrams and related mathematical expressions, transducing electrical, mechanical and fluid dynamics into common parameters of force for the CPU element embodied within the aforementioned transector device. Electric resistance monitored as GSR, ECG in relation to shock administered to a designated living target is of paramount or main issue if target neutralization entails capture for purposes of interrogation. The measurement of mechanical force such as force rigidity, fluid dynamics are important in the determination of cardiovascular parameters and respiration of living designated targets in the non-lethal neutralization process.

Figure 112:
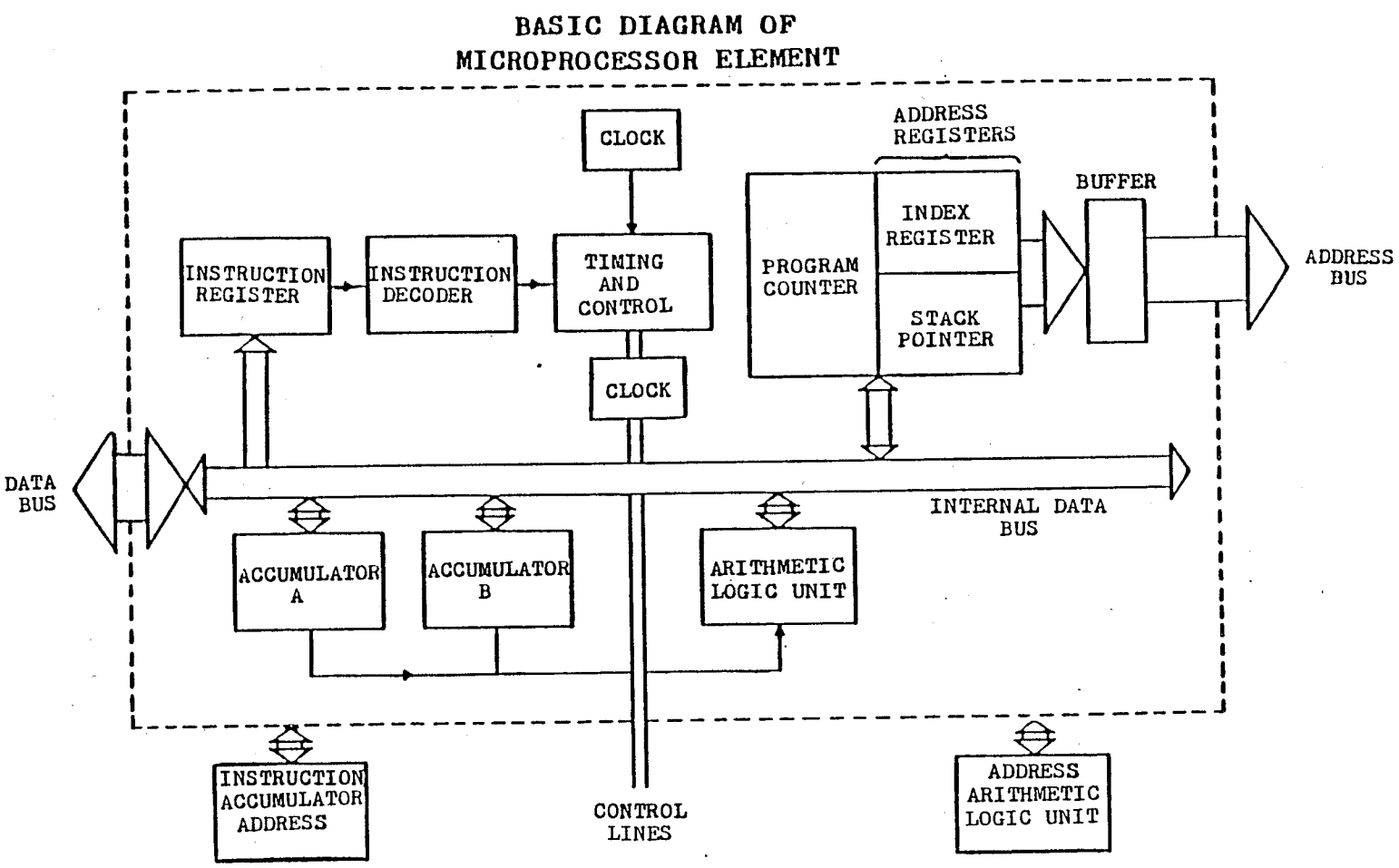
FIG. 112 entails the basic diagram of the microprocess or processor element embodied within the transector device.

FIG. 112 entails a block diagram for the microprocessor element embodied within the CPU and ancillary system embodied within and external to said transector device. The said microprocessor is of course the basic building block of computational systems, logic element and comparator means embodied within and ancillary to said transector device. There are several tens of thousands equivalent microprocessor elements embodied within and ancillary to said transector device. The component subelements embodied within said microprocessor element and minor modifications entailed with same said unit are straight forward and readily understandable to those skilled in the art.

Figure 113:
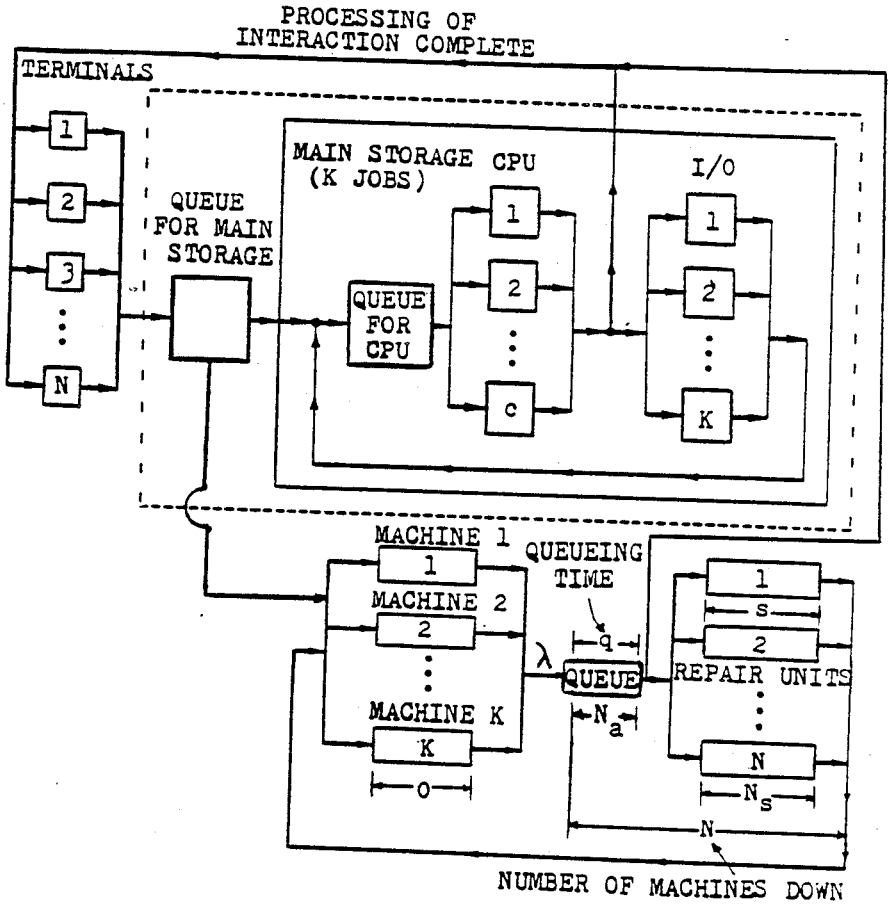

FIG. 113 describes a modified block diagram originally proposed by Boyse and Warn indicative of a multiprogram queueing system wherein the CPU effects repairs or modification within systems. The aforesaid model is applicable to the reassignment of warhead to projectile, delivery systems, the automated electronic bypassing of mechanical and electronic means with said transector device in favor of alternate subtitute means. There are six constraints which are consistant with the operation of said model. The system embodied within said model operates such multiple CPU's and/or microprocessor elements with said CPU's are treated as separate and discrete servers and a fixed multiprogramming level K, such that the main memory element queueing remains continuous with respect to K parallel I/O servers in the absense of queueing for I/O service. The service times at both the CPU's microprocessors and the I/O stations terminea is either exponential or constant. Additionally, the think time has a general distribution with mean E(t) and the CPU and I/O overlap and are flexible with regards to the operation of the transector device. The I/O operation is initiated when a page fault is keyed or a fault is flagged wherein the job or activity in the CPU execution must be terminated, until said page is available to be assessed by the main memory. It is assumed that the full I/O complement is overlapped in the CPU operation. The average CPU usage interval between page faults is described by E(S). The average number of CPU intervals required per job or interaction is defined by n and mE(S) is the average time per component or system interaction and E(O) is the average service time of an I/O request. K describes both the multiprogramming level and the number of parallel I/O servers. N is the number of active terminals or microprocesses available for I/O interactions and E(t) is described as the average think time. The principal output statistics are defined by the term p which is the average CPU utilization $\pi_T$ is the average throughput in the number of interactions per time interval of time and the average response time which is defined by the term W. The term W is the average time from submission of a request for a CPU or microprocessor interaction until said interaction is completed by the aforesaid CPU. The CPU or microprocessors effects repairs in accordance with Boyse and Warn solve for pin the D/D/C/K/K systems repair queueing system yielding $$\rho = \min\left\{\frac{K}{c(1 + E[O]/E[s])}, 1\right\}.$$

and the aforesaid automated repair queueing system with n automated repair unit D/D/C/K/K queueing system described by the equations herein below $E[O] = 1/\alpha$ = operating time per machine (constant).

$E[s] = 1/\mu$ = repair time per machine by one repair (constant).

$$\rho = \min\left\{\frac{K}{c(1 + E[O]/E[s])}, 1\right\}.$$

-continued $$\lambda = \frac{c\rho}{E[s]} = c\rho\mu.$$

$$W_q = E[q] = \frac{K}{\lambda} - E[O] - E[s].$$

$$W = W_q + E[s].$$

$L = \lambda W$ = average number of machines down.

$L_q = \lambda W_q$ = average number of machines waiting for repair.

The exponential case wherein exponential I/O service and exponential CPU is implemented by M/M/C/K/K such that $$\rho = \lambda E[s]/c.$$

where the successive computation listed herein below yields h such that, $$\frac{p_n}{p_o} = \begin{cases} \binom{K}{n}\left(\frac{E[s]}{E[O]}\right)^n, & n = 1, 2, \ldots, c \\ \frac{n!}{c!c^{n-c}}\binom{K}{n}\left(\frac{E[s]}{E[O]}\right)^n, & n = c + 1, \ldots, K. \end{cases}$$

$$p_o = \left[1 + \sum_{n=1}^{K}\binom{p_n}{p_o}\right]^{-1},$$

$$p_n = \binom{p_n}{p_o}p_o, \; n = 1, 2, \ldots, K,$$

$$L_q = \sum_{n=c+1}^{K}(n - c)p_n,$$

$$W_q = \frac{L_q(E[O] + E[s])}{K - L_q},$$

and, finally, $$\lambda = \frac{K}{E[O] + W_q + E[s]}.$$

FIG. 114 entails a modified version of the central server model for multi-programming. It is assumed that the subsystems at various substations or terminal are active enough to operate continuously once the transector device is actuated assuring that an interaction is always pending upon the completion of the preceeding interaction. There are M-1 I/O systems equipt with its own queue and each exponentially distributed with an average service rate of ui(i=2,3, . . . M) and the CPU is assumed to provide exponential service with an average rate of u. The completion or execution of a CPU interval initiates the return of a job to the CPU with a probability of $P_1$ requiring a service at I/O which services the job at a probability $p_i$ where i=2,3, . . . M. The execution or completion of the I/O service institutes that the job returns to the CPU for queueing another cycle. The state of the system can be exprssed as $K=(K_1, K_2, \ldots, K_M)$ where $K_i$ is the number of job interactions at the i the queueing or service, then with algorithm and deviations from Buzen the probability for the system is expressed as p $(K_1, K_2, \ldots, K_M)$, such that, the system in state K is designated by the expression $$p(k_1, k_2, \ldots, k_M) = \frac{1}{G(K)} \prod_{i=2}^{M} \left( \frac{\mu_1 \rho_i}{\mu_i} \right)^{k_i},$$

where $G(K)$ is defined so as to make the probabilities sum to 1.

$$\text{Thus } G(K) = \sum_{k \in S(K,M)} \prod_{i=2}^{M} \left( \frac{\mu_1 \rho_i}{\mu_i} \right)^{k_i},$$

where $$S(K, M) = \left\{ (k_1, k_2, \ldots, k_M) \,\middle|\, \sum_{i=1}^{M} k_i = K \text{ and each } k_i \geqq 0 \right\}.$$

It has been shown by Feller that there are $$\binom{M+K-1}{M-1} = \binom{M+K-1}{K} \text{elements in } S(K, M).$$

Contained herein below is a brief summary of Buzen's algorithm. The parameters of the central service model are arbitrarily set such that $u_1$, $p_i$ for $i=1,2,\ldots,M$) such that the algorithm will generate G(K) defined by P(n, K−n) PK(n)=P(n jobs in queue 1 and K−n jobs in queue 2) with G(K−1), G(K−2), . . . , G(1), G(0)=1 with the structure and terms of the Buzen algorithm and cable taken from Buzen and elucidated by Allen and presented herein below Step 1 [Assign values to the $x_i$] Set $x_i = 1$ and then set $x_i = \mu_i p_i/\mu_i$ for $i = 2,3, \ldots, M$.
Step 2 [Set initial values] Set $g(k, 1) = 1$ for $k = 0, 1, \ldots, K$ and set $g(0, m) = 1$ for $m = 1,2, \ldots, M$.
Step 3 [Initialize k] Set k to 1.
Step 4 [Calculate kth row] Set
$g(k, m) = g(k, m-1) + x_m g(k-1, m)$, $m = 2, 3, \ldots, M$.
Step 5 [Increase k] Set k to k + 1.
Step 6 [Algorithm complete?] If $k \leqq K$ return tp Step 4. Otherwise terminate the algorithm. Then $g(n, M) = G(n)$ for $n = 0, 1, \ldots, K$.

Buzen's Algorithm for Computing G(K)

| | $x_1$ | $x_2$ | $x_3 \ldots x_m$ | $\ldots x_M$ |
|---|---|---|---|---|
| 0 | 1 | 1 | 1 1 | 1 |
| 1 | 1 | g(1, 2) | . . . | g(1, M) = G(1) |
| 2 | 1 | g(2, 2) | . . . | g(2, M) = G(2) |
| 3 | 1 | g(3, 2) | . . . | g(3, M) = G(3) |
| . | | | g(k − 1, m) | . |
| . | | | ↓ x | . |
| . | | | ↓ $x_m$ | . |
| k | 1 | g(k, 2) | g(k, m − 1) → g(k, m) | g(k, M) = G(k) |
| . | | | | . |
| . | | | | . |
| . | | | | . |
| K | 1 | g(K, 2) | . . . | g(K, M) = G(K) |

Buzen algorithm develops the technique for calculating G(0) 1, G(2), . . . , G(K) whereby server utilizations are determined by $$\rho_i = \begin{cases} G(K-1)/G(K), & i = 1 \\ \mu_1 \rho_1 p_i/\mu_i, & i = 2, 3, \ldots, M. \end{cases}$$

and the throughput $\lambda_T$ expressed in jobs per unit time is given by $$\lambda_T = \mu_1 \rho_1 \rho_1.$$

It also follows from Buzen's general response time low that the average response time W where in N number of terminals or access points exist is given by the expression $$W = (N/\lambda_T) - E[t] = (N/\mu_1 \rho_1 \rho_1) - E[t].$$

$\lambda_T$ is the mean rate at which programs transverse the path indicated as the new program and with the application of Littles formula $L = \lambda W$ it is concluded that $W = K/\lambda_T$.

Figure 115:
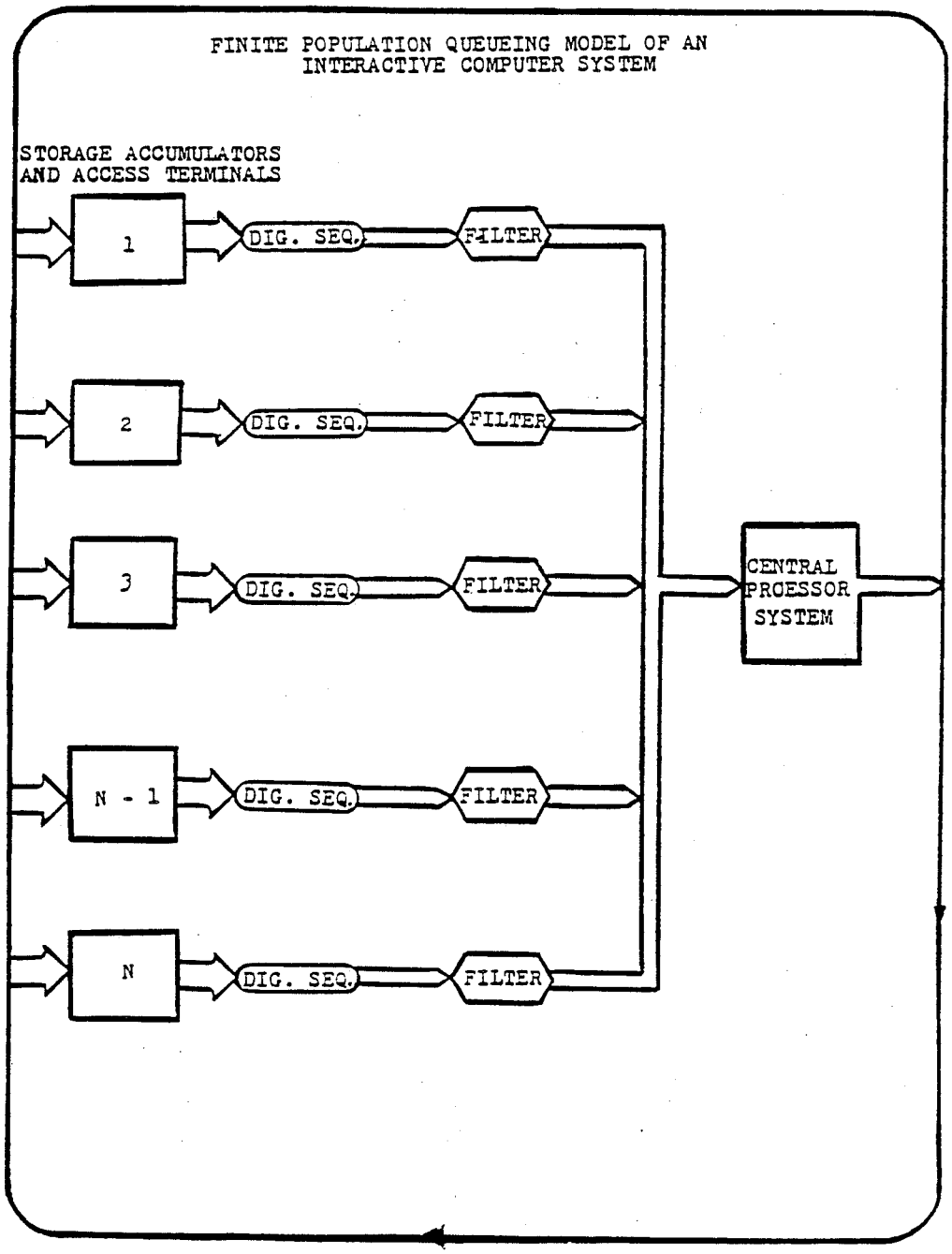
FIG. 115 is a block diagram describing a finite population queueing model for the interactive computer system embodied within said transector device.

FIG. 115 is a block diagram describing a finite population queueing model for the interactive computer system embodied within the aforesaid transector device. The CPU distributes computational and logic facilities to a given task by assigning subsystems such as microrprocessors to complete portions of said tasks. The CPU service time has the constraint that the Laplace-Stieltyes transforms must be rational, which applies to the think time. Mathematically the average think time is described by the expression $E(t) = 1/\alpha$; with $E[S] = 1/u$ corresponding to the average CPU service time yielding the expression $$p_0 = \left[ \sum_{n=0}^{N} \frac{N!}{(N-n)!} \left( \frac{E[s]}{E[t]} \right)^n \right]^{-1} = \left[ \sum_{n=0}^{N} \frac{N!}{(N-n)!} \left( \frac{\alpha}{\mu} \right)^n \right]^{-1}$$

where the CPU utilization is described by $$p = 1 - po,$$

and the average throughput time $\lambda_T$ is defined by $$\lambda_T = u, p_1 \rho_1$$

the average response time is described by $$W = \frac{NE[s]}{1 - p_o} - E[t]$$

FIGS. 115*a*, 115*b* describes in concise detail various commonly available programs for computing the statistics for preemptive and non-preemptive queueing system and probable estimates corresponding to the 95th percentile. The abovementioned programs are similar to those embodied within programs governing the queueing of systems internal to the operation of the transector device.

Figure 115C:
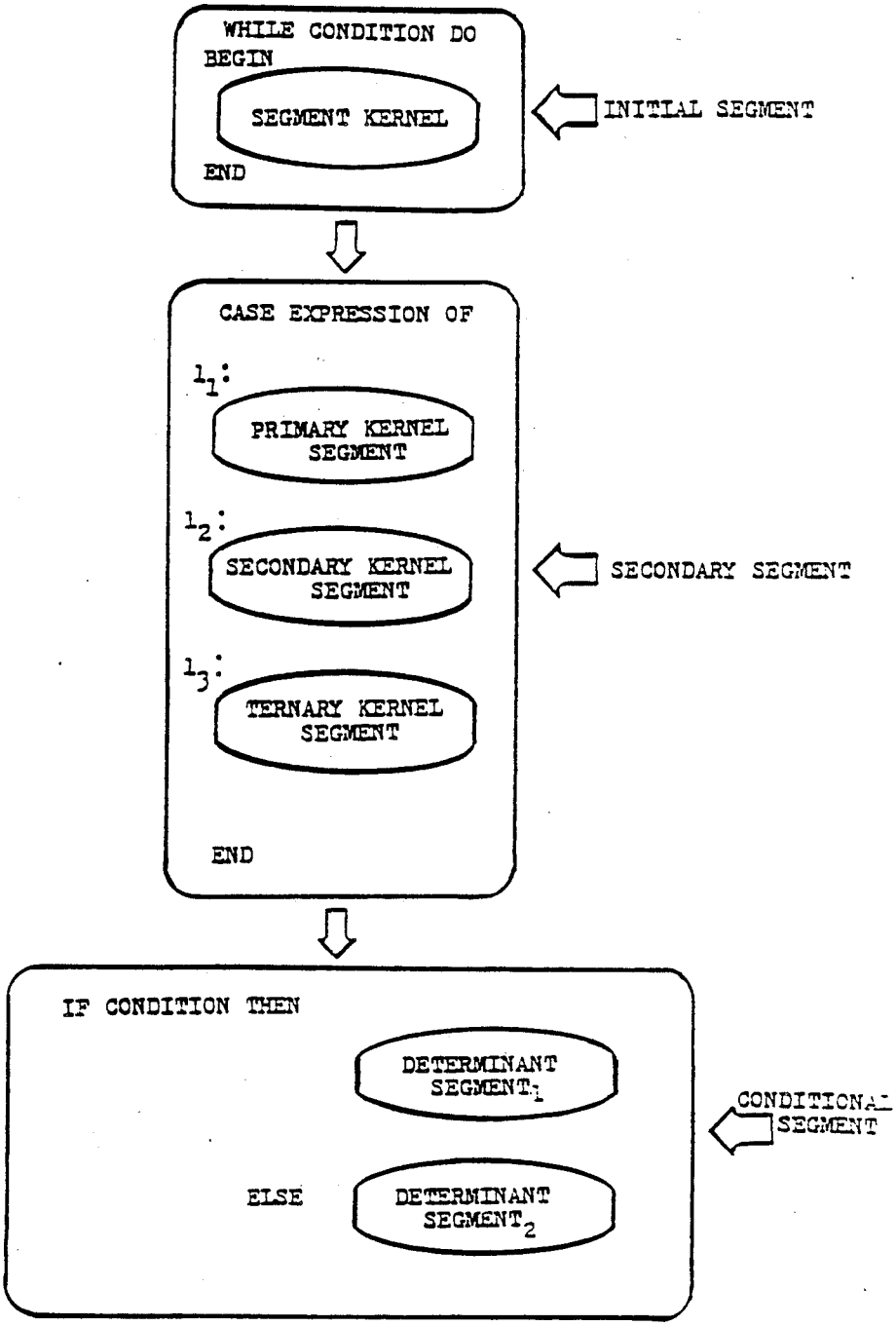

FIGS. 115*c*, 115*d* entail block diagrams disclosing the basic design features embodied within the interactive programming of said transector device. The terms and structures embodied within the aforesaid figures are readily understandable to those skilled in the art. The conition to begin is contained within the initial segment. The initial segment containing the preamble is immediately followed by the secondary segment emboding the case of expression or declaration for the primary, secondary and ternary kernel segments. Data generated by the preceding segment is assessed based on various parameters forming lemeas or separate and distinct conditional truths which are analyzed by determinant segments embodied within the conditional segment. Lastly, the main program embodies the full complement of subprograms nested within said means program or nested programs.

Figure 116:
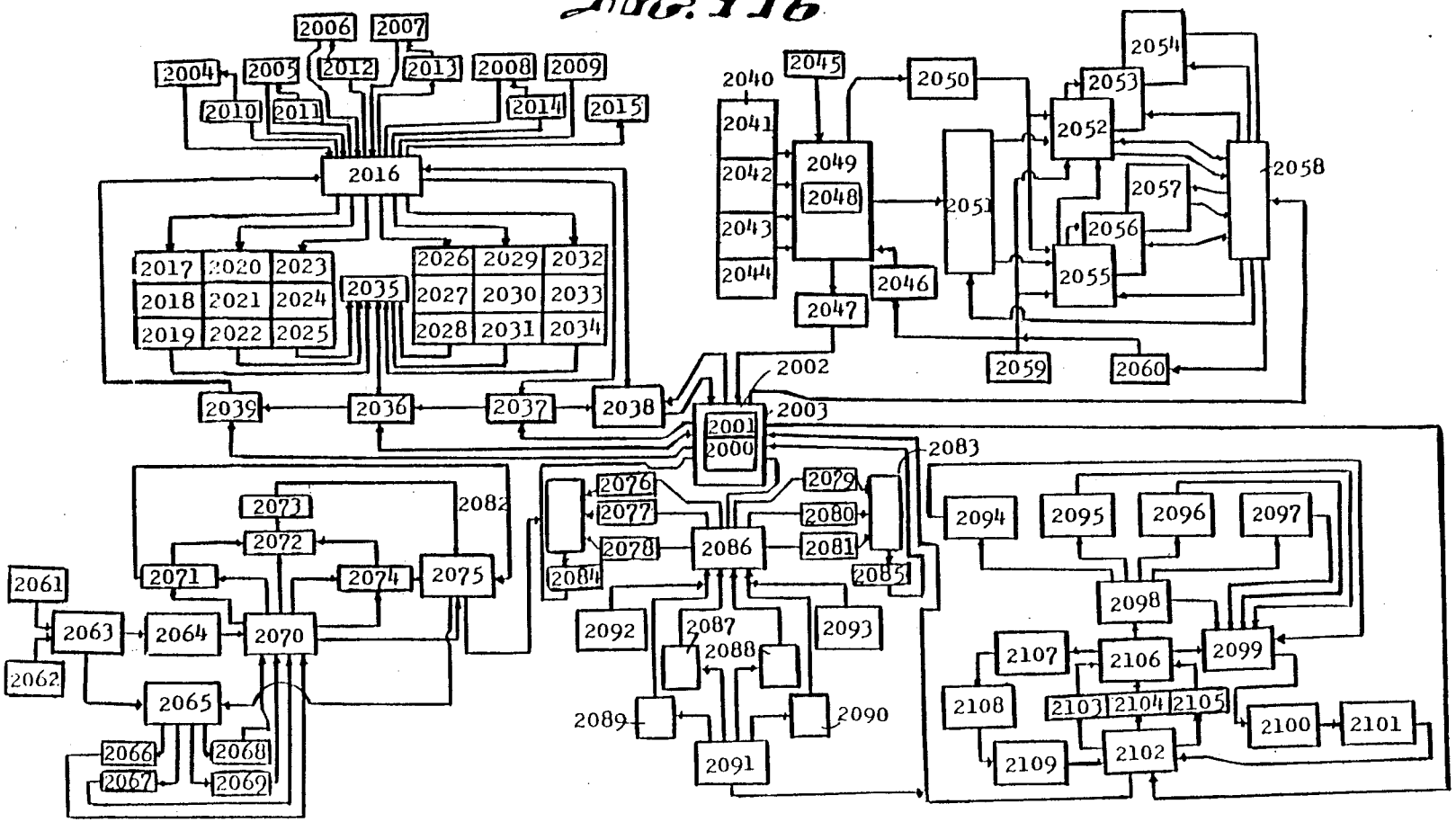
FIGS. 116 to 116*e* are block diagrams illustrating in part the operation of the CPU embodied within the transector device in relation to other systems embodied within said transector device or ancillary to said devices operation.
Figure 116A:
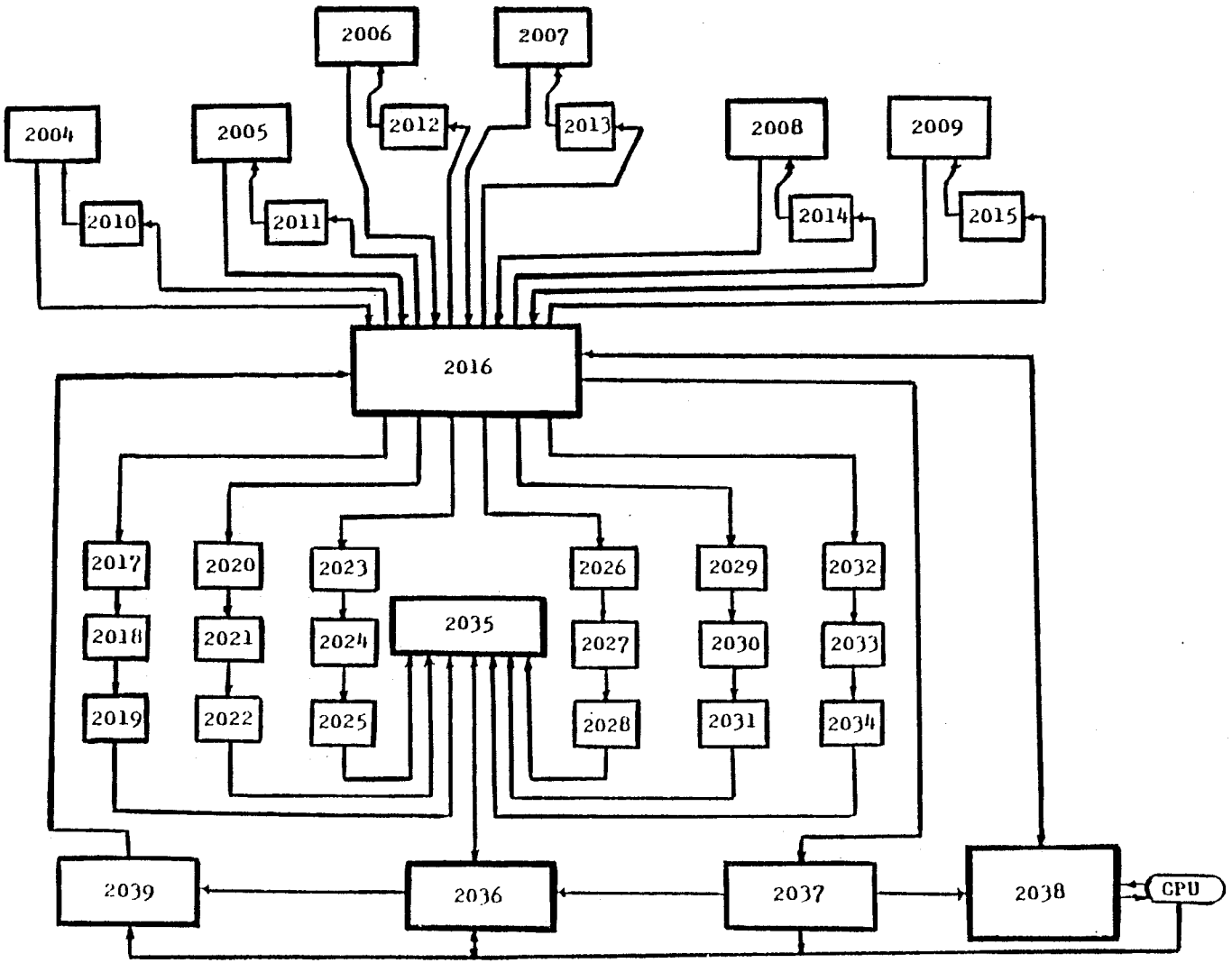
Figure 116B:
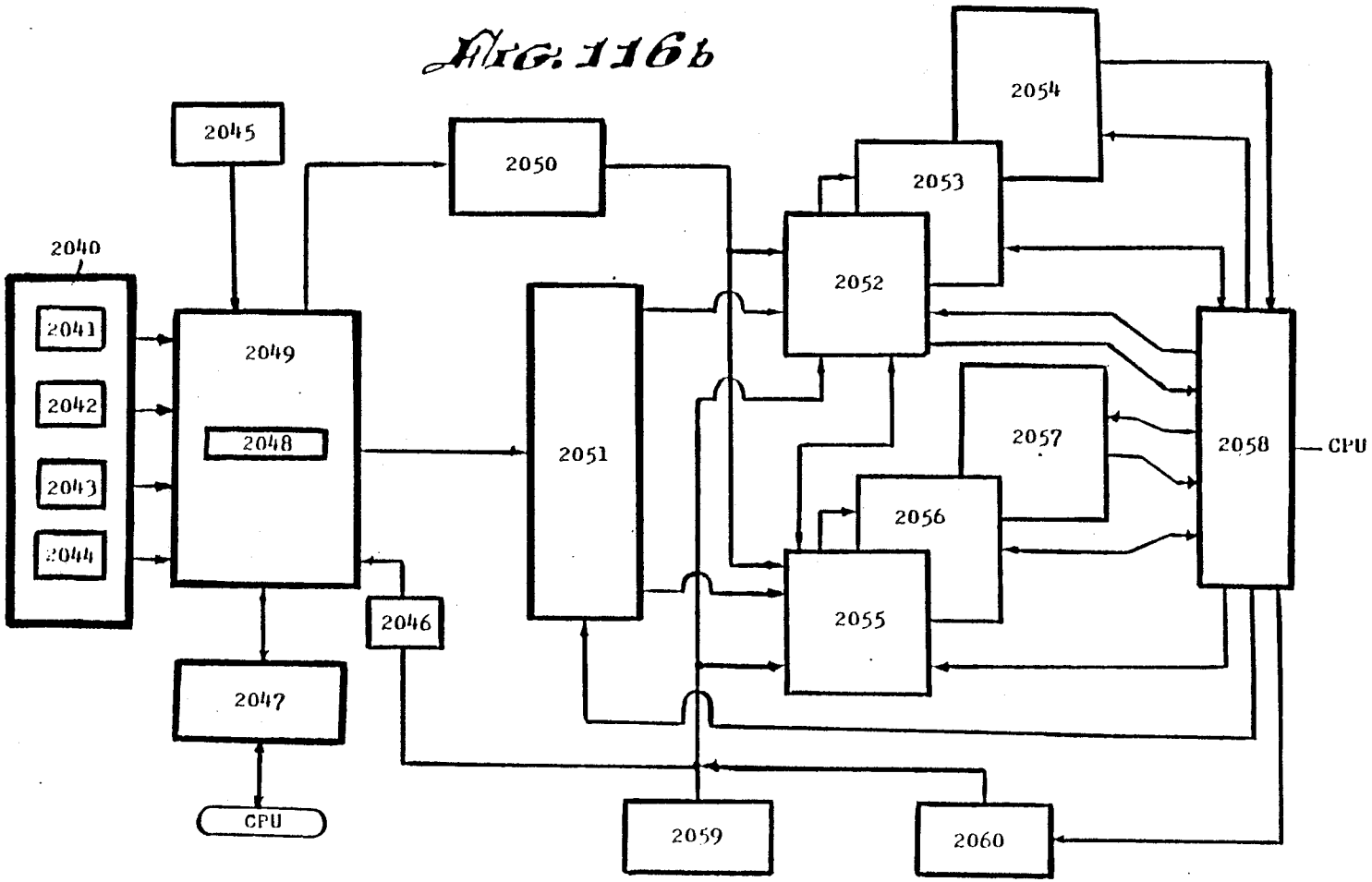
Figure 116C:
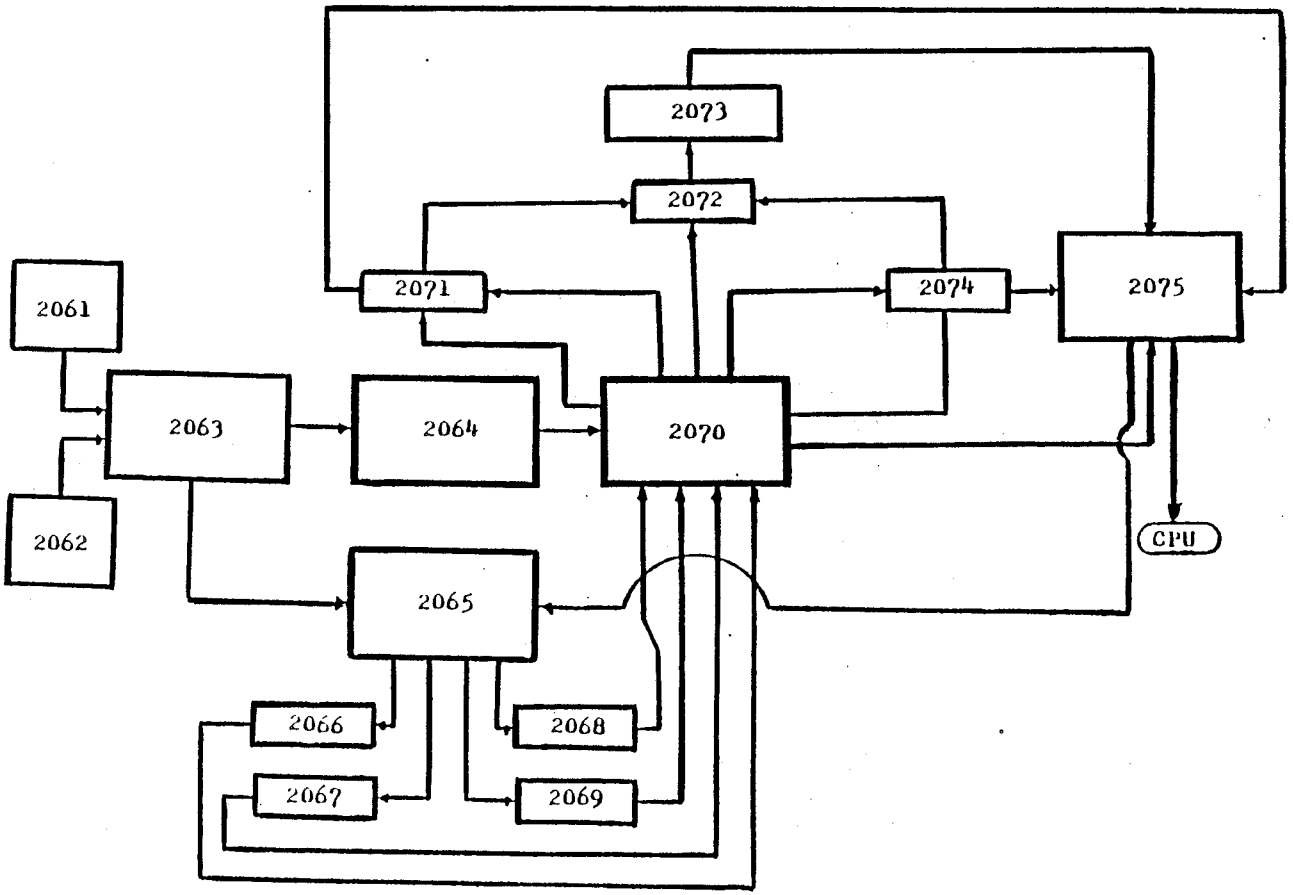
Figure 116D:
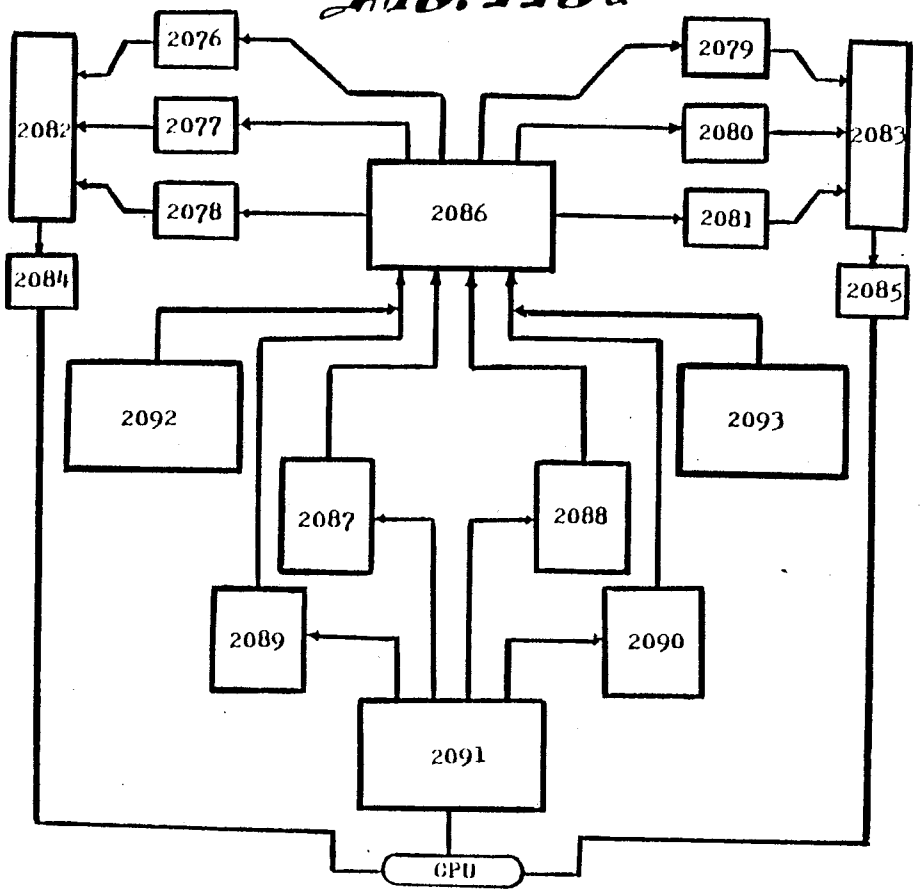
Figure 116:
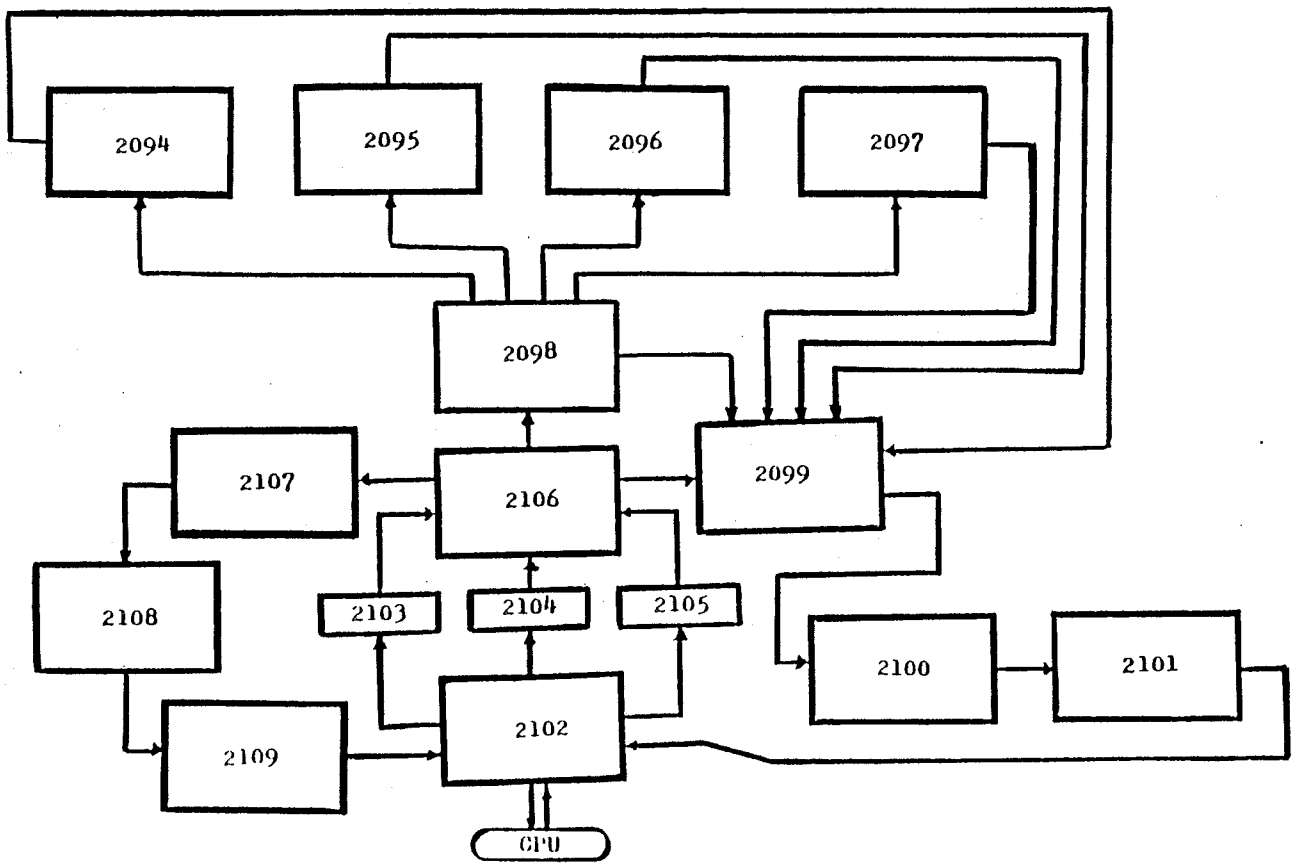

FIGS. 116 to 116e are block diagrams illustrating in part the operation of the CPU embodied within the transector device in relation to other systems embodied within said transector device or ancillary to said devices operation. The numeric values assigned to elements in FIG. 116 correspond to equivalent numeric anecdotation defined in FIGS. 116a through 116e. Numbers 2000, 2001, 2002 of FIG. 116 corresponds to the centrally located CPU, a peripheral input/output electro-optical bridge and a bidirectional analog/digital signal processing element. Elements 2004 through 2009 designate six separate and distinct sensory arrays. Numeric values 2004, 2005 and 2006 denote arrays which monitor ultraviolet, x-ray and infra-red emissions; whereas elements 2007, 2008, define radar, acoustic and laser designator sensory apparatus. The sensitivity of the aforesaid sensory elements described by numbers 2004 to 2009 are effected by electronic filter elements 2010 through 2015, which alter the electrical bias of said sensors. Numeral 2016 represents a bidirectional electronic sequencer means 2016, which allocates sensor elements, logic circuits and assigns portions of CPU 2000 memory based on command signals received from sensory allocation element 2039. Numerals 2017, 2018 and 2019 disclose a signal processing element, an electronic filter element and combination signal enhancer and signal amplifier element for processing signals derived from element 2004. Element 2018 and 2019 are equivalent to elements 2020 to 2022, elements 2023 to 2025, elements 2026 to 2028, elements 2029 to 2031 and elements 2032 to 2034, in operation and functions for sensory means 2004 through 2009, respectively. Data received from elements 2004 through 2034 is collated by data collator means 2035. Data from collator means 2035 to comparator means 2036, wherein said data obtained from different sensory elements is catagorized and statistically cross-referenced in order to confirm target acquisition. The status of internal elements embodied within a array of sensory elements and ancillary systems associated with said sensory means is monitored by element 2037. Element 2037 engages comparator means 2038 and ancillary controller means 2038; which effects the output and sensitivity of sensory means 2004 to 2019 by engaging elements 2010 to 2015 through control impulses conveyed by sequencer means 2016.

Targets greater than one hundred meters away from the transector device, but less than eighteen kilometers undergo target acquisition; whereby targets are identified, tracked and locked onto prior to launching a given projectile and/or warhead to engage and neutralize designated targets. Numeral 2040 denotes the target aquisition logistics package consisting of active emitter elements 2041 to 2044, which include active radar emitter, acoustic resonator, infra-red emitter means and laser designator element. Ancillary data regarding target position is provided by telemetry element 2045 which embodies surveillance by satellite, aerial, navel or land based forces. Data from elements 2040 through 2045 engages communications processor element 2049. Internal mapping of projectile routes to serviceable targets are provided by electro-optical transducer element 2047, which encodes the present structure and contours of the existing terrain relative to the spatial temporal constructs of celestial objects such as, the sun or other stars. Element 2046 provides viable construct to obivate the effects of weather on visiability, resolution of targets and velocity of projectiles. Obviously, rain, smog or fog will scatter laser emissions; whereas a head wind of 40 to 80 knots may cause sufficient turbulance to alter the velocity and/or flight path of said projectiles. Data compiled by processes 2048, 2049 is conveyed to processor element 2050, which translates data and conveys said data to intelligence processor means 2051; which the analyzes the source of data in relation to the deposition of targets and lists said target on the basis of priority. Data from processors 2050, 2051 engage interactive elements 2052, 2055 which embody an internal library containing a repertoire of expert programs regarding the immediate assignment of targets and the immediate assessment of the present situation. Element 2052 represents a card emboding the immediate assignment of targets based on a statistical priorty of neutralizing a given target within a group or cluster of probable targets. Element 2052 engages process 2053 which executes target planning and element 2053 enlists target acquisition means 2054 which identifies, pursues or tracks said target based on the behavior as well as the disposition of said target. Element 2055 assess the immediate situation based on the tactical, strategic and defensive capabilities of said targets in relation to the present existing environmental conditions. Element 2055 enlists the operation of element 2056 which analyzes the overall intelligence obtained from internal sensors and external sources. Element 2056 engages element 2057 which consists of a card emboding an expert program encapsulating the most up to date battle scenario, which entails continuous revisions on a moment to moment basis. The output of elements 2052 to 2057 are encoded into the volatile memory of the projectile means, described by element 2058. The inertial guidance system, number 2059, and internal stablizer module, number 2060 act to compensate for differences and velocity of the transector device. The transector device may not be stationary relative to said target, for example said transector may be mounted on a vehicle traveling towards or away from said target at an extreme velocity and at an arbitrary trajectory pattern, where such differences must be compensated for by the CPU's of said transector device and projectile means. (i.e. transector device is fired from a plane traveling in excess of 600 knots horizontally relative to a missile traveling towards or away of said plane with a velocity of 600 knots or more along a vertical axial plane relative to said transector device).

The range of the aforedaid targets is important to the subsequent engagement and neutralization of said targets. Numerals 2061, 2062 denote the actuation of internal systems by the user or automated elements which enlists element 2063, which specifies the type of projectile and warhead required to neutalize said targets. Element 2063 enlists holographic scanning means 2064 and ranging element 2065. Ranging element 2065 automates internal mechanisms which have the capacity to add or subtract propellant of a given projectile. Command element 2065 based on the computed range of designated targets will deplete or recharge fuel of said projectiles if a liquid fuel propellant is embodied within a said projectile. Means 2065 will mill and remove portions of fuel or fuse said propellants when a solid fuel propellant is embodied by a projectile. Numerals 2066, 2067 denotes means by which the addition or charging and a depleting or bleeding of fuel reserves from a projectile contain liquid fuel. Element 2068 represents an automated milling machine means which removes a metered portion of a solid fuel element; whereas element 2069 denotes an automated means which fuses or attaches additional fuel elements to said projectile to extend the range of said projectile. The successful completion of operations by elements 2064 through 2069 engages the autoload mechanism described by numeral 2070. If the warhead types embodied within the aforesaid projectile matches the type of warhead needed to neutralize designated targets than said projectiles and warheads are received by the autoload mechanisms, which loads said projectiles and warheads into the loading chamber defined by element 2072. Said projectiles emboding the aforementioned warheads leave or exit the loading chamber described by number 2072 and enter the firing chamber described by number 2073; wherein said projectiles and warheads are dispersed from the barrel of the transector device. If the warheads are not found within said projectiles then warhead substitution or replacement is initiated for a given projectile, as indicated by element 2071. If the warheads and projectiles can not be located within internal stores then the sequential firing of separate and distinct projectiles are instituted in order to neutralize targets which are inaccessible to single projectiles are enlisted by mean 2074. (i.e. targets projected by reinforced structures, which are penetrated by armor piercing projectiles immediately followed by projectiles with an explosive warhead, incindraries type of warhead, or a projectile with a warhead containing some carrier mediated volitile substances). The aforementioned monitored processes embodied within element 2071 and element 2074 are described in detail by FIGS. 101, 105 and 106 of the specifications, which describe the mechanism and algorithms by which warheads are substituted within single and multiple warheads. Upon said substitution elements 2071, 2074 re-engage means 2070. The status of elements 2065 to 2074 is monitored by sensory apparatus 2075.

The projections of carrier mediated volitiles (volitiles are volatile gases concentrated into a high pressure stream of liquified gas), from the barrel of the transector device is described by elements 2076 through 2093. The reservoir containing six classes of volitiles are described by elements 2076 through 2081. Elements 2076, 2077 and 2078 define reservoirs containing toxins, anesthetics and neural inhibitors. Elements 2079, 2080 and 2081 represent reservoirs containing hallucinogenic volitiles, cryogens and incindraries. Automated solenoid elements control the in flow and outflow of said volatile materials and act as governor elements for various inlet and outlet mechanism described previously in the specifications. Elements 2076 through 2081 embody automated solenoid elements. Volitile substances are released from reservoirs 2076 to 2081 where upon said substances enter mixing chambers 2082, 2083, respectively, and are dispersed from the barrel of said transector device as described by numbers 2094, 2095. Elements 2084, 2085 purge said mixing chamber and the sintered portion of the barrel. The automated inlet and outlet mechanisms are sequentially activated and deactivated by sequencer means 2086. The frequency and duration of dispersal of volitile substances are controlled by electronic elements 2087, 2088, which directly effect the output of the sequencer means 2086. The temperature and pressure of said volitile substances are governed by thermal induction element 2089 and automated pump means 2090. The output of said volitile substance by elements 2087 to 2090 are governed by the controller mechanism described by element 2091 which receives input both from the CPU, number 2000, and sensory elements 2092, 2093, which monitors the internal status of the systems.

Numerals 2094, 2095, 2096 and 2097 disclose the electric discharge element incorporated within the barrel of the transector device, the radiofrequency element the laser device and the acoustic emitter element. Elements 2094 through 2097 are collectively actuated by the electronic sequencer means 2098. Elements 2094 through 2098 are monitored by a sensory and are collectively described by number 2099, Data received by element 2099 is conveyed to feedback mechanism 2100 which embodies an error detection means and comparator element. Feedback means 2100 engages compensatory means 2101, which sends commands to controller element 2102 to adjust the output parameters of elements 2094 through 2097. Controller unit 2102, which regulates the output power, receives and transmits information to the CPU which sets such parameters as the frequency, pulse shape and pulse length or durations of said pulse, which are defined by secondary control units 2103, 2104 and 2105, respectively.

Elements 2103, 2104 and 2105 engage the pulse distributor element, which is defined by numeral 2106 which engages sequencer means 2098. The output or performance of the pulse distribution 2106 and elements 2103, 2104 and 2105 is monitored by sensory means 2107. Element 2107 engages feedback element 2108, which engages compensate or unit 2109. Elements 2099, 2100 and 2101 are equivalent to elements 2107, 2108 and 2109 in both structure and function.

Figure 117:
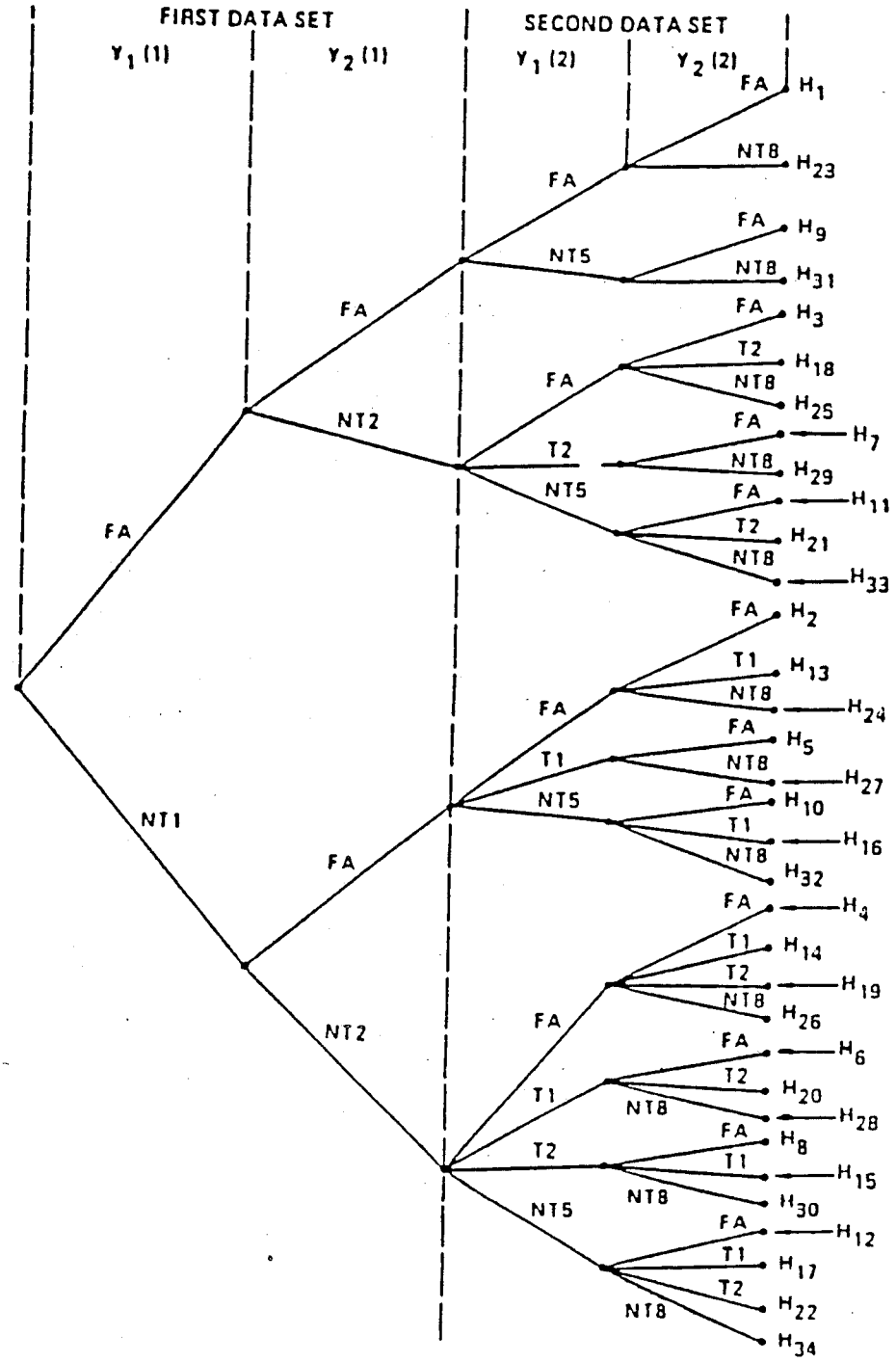
Figures 119, 120:
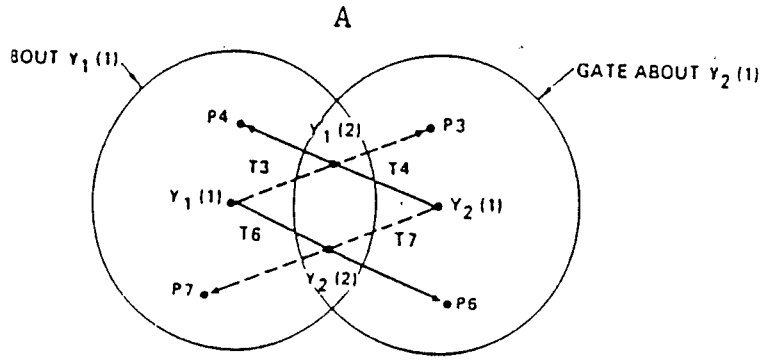
FIGS. 119 to 122 describes the hypothesis matrix taken after the third scan after subjecting said hypothesis to the introduction of data reduction techniques such as pruning.

FIGS. 117, 118 illustrates the formation of a hypothesis tree and the corresponding data matrix which it accompanies, which indicates that thirty-four hypotheses are formed from only two scans of data containing two observations per scan. Originally described by Blackman. FIGS. 119, 120 illustrates the effects of pruning as a means to eliminate low probability hypotheses coupled with the process of statistical combination, which consolidates tracks, also described by Blackman. FIGS. 123, 124 are indicative of an approach known as cluster of hypotheses a data reduction technique wherein gates of tracks falling within overlaping clusters are eliminated by mathematical association and reduced to single characteristic categories originally described by Ried and then Blackman. The basic purpose of clustering is to reduce a large tracking problem containing large volumes of observational data into smaller more manageable ones which can be rapidly solved independently. Each cluster will have its own set of observations corresponding tracks, a hypothesis matrix and a set of probabilities and associated hypotheses. FIGS. 119, 120 and FIGS. 121, 122 describe hypothesis matrix taken after a third scan whereas the hypothesis matrix described in FIGS. 117, 118 define only two scans.

The generation of hypothesis tree as illustrated in FIG. 117 would be impractical without the implementation of data reduction techniques involving pruning, combination, clustering or other such methods. Here the term FA corresponds to all observations taken to be galse alarms, NT refers to the observation which initiates track number 1 and T1 is the observation. y, (k) is the jith observation received on the scan k. Observations $y_1(1)_1$ $y_2(1)$ are either labeled as false alarms (FA) or new tracks ($NT1_1$ $NT_2$), such that after the first observation is received there are two branches generated with the following hypotheses

*FA*: observation taken to be a false alarm;

*NT*1: observation initiates the new track number 1. Thereafter, the track is referred to as *T*1;

*T*1: observation associated with existing track 1.

$H_1$:$y_1(1)$ = *FA*.$H_2$:$y_1(1)$ becomes *NT*1

It is possible that the first observation may be determined to be a false alarm (FA) and therefore the previous hypothesis and track return and their previous number must be adjusted for, such that, upon receipt of observation $y_2(1)_1$ $H_1$ and $H_2$ become $$H_1: y_1(1)=FA,\ y_2(1)=FA$$

$$H_2: y_1(1)=NT1,\ y_2(1)=FA$$

It is assumed that a single target produces only one observation per scan and no tracks existed at this time prior to the initial observation $y_1$ (1) which can not be correlated with NT1. The option that observation $y_1$ (1) initiates a new track is considered, such that, two more hypotheses are created, as described by $$H_3: y_1(1)=FA,\ y_2(1)=NT2$$

$$H_4: y_1(1)=NT1,\ y_2(1)=NT2$$

An identical track will often appear in more than one hypothesis for example NT1 appears in both $H_2$ and $H_4$. If the first observation from the second data set $y_1$ (2) is determined to be a false alarm then the first four hypotheses become $$H_1: y_1(1)=FA,\ y_2(1)=FA,\ y_1(2)=FA$$

$$H_2: y_1(1)=NT1,\ y_2(1)=FA,\ y_1(2)=FA$$

$$H_3: y_1(1)=FA,\ y_2(1)=NT2,\ y_1(2)=FA$$

$$H_4: y_1(1)=NT1,\ y_2(1)=NT2,\ y_1(2)=FA.$$

Additionally if the gating relationships are satified the association of $y_1$ (2) with tracks T1 and T2 will be considered. T1 is contained in previous hypotheses $H_2$, $H_4$ and two more current hypotheses linking $y_1$ (2) with $T_1$ and the subsequent inclusion of $y_1$ (2) must be redefined to be T3. T1 is further linked to $y_2$ (2), such that the next two current hypothesis are $$H_5: y_1(1)=NT1,\ y_2(1)=FA,\ y_1(2)\rightarrow T1=T3$$

$$H_6: y_1(1)=NT1,\ y_2(1)=NT2,\ y_1(2)\rightarrow T1=T3.$$

Equivalently, for the two options $y_1$ (2) is assigned to T2, such that $$H_7: y_1(1)=FA,\ y_2(1)=NT2,\ y_1(2)\rightarrow T2=T4$$

$$H_8: y_1(1)=NT1,\ y_2(1)=NT2,\ y_1(2)\rightarrow T2=T4$$

The hypotheses associated with the new track options are described by $$H_9: y_1(1)=FA,\ y_2(1)=FA,\ y_1(2)=NT5$$

$$H_{10}: y_1(1)=NT1,\ y_2(1)=FA,\ y_1(2)=NT5$$

$$H_{11}: y_1(1)=FA,\ y_2(1)=NT2,\ y_1(2)=NT5$$

$$H_{12}: y_1(1)=NT1,\ y_2(1)=NT2,\ y_1(2)=NT5.$$

Eight tracks containing a maximium number of two component observations, which are defined herein below within brackets, such that, (i) One Point Tracks $T1 = y_1(1),\quad T2 = y_2(1)$ $T5 = y_1(2),\quad T8 = y_2(2)$ (ii) Two Point Tracks $T3 = [y_1(1),y_1(2)],\quad T4 = [y_2(1),y_1(2)]$ $T6 = [y_1(1),y_2(2)],\quad T7 = [y_2(1),y_2(2)]$ The process continueous with observations $y_2$ (2) resulting in the generation of 34 hypotheses, as indicated by the hypothesis tree and corresponding hypothesis matrix described in FIGS. 117, 118. The aforementioned matrix table and hypothesis tree serve to illustrate the accelerated rate at which hypotheses are incurred or generated. Reid and others have estimated that with the addition of another data set emboding two observations to the hypothesis tree and corresponding to tabular hypothesis matrix described FIGS. 117, 118 that in excess of five hundred, hypotheses would be generated. The number of tracks generated per scan exceed ten orders of magnitude when data scans occurs at a rate of one every ten milliseconds. The need to consolidate and reduce the number of hypotheses by ranking, pruning, combining or clustering is paramont to the overall operation of the vehicular device.

Alternately ranking hypothesis based on simularities of state estimates and covariance quantities as for example a bases of comparing target track A of one hypothesis with target B of another hypothesis, such that, $$|x_{Ai} - x_{Bi}| \leqq \beta \sqrt{p_{Aii} + p_{Bii}}$$

and $$p_{An} < \gamma p_{Bn},\ p_{Bii} < \gamma p_{Aii}$$

whereby i is indexed over all estimation states with B=0.1 and v=2.0. If it is determined by the program that the hypotheses can be combined then each track pair can be combined by implementing the following formulas, $$x = \frac{p_1 x_A + p_1 x_B}{p_1 + p_2}$$

with covariance matrix P expressed by, $$P = \frac{p_1 P_A + p_2 P_B + \frac{p_1 p_2}{p_1 + p_2}(x_A - x_B)(x_A - x_B)^T}{p_1 + p_2}$$

where $P_1$ and $P_2$ refer to the probabilities associated with the aforesaid hypotheses being combined with one another. The probability associated with the combined hypothesis (Pc) becomes the sum of the probabilities of similar hypotheses described by the expression ($Pc=P_1+P_2$).

FIGS. 119, 120 illustrates the effects of both pruning and combining hypotheses and clustering of said hypotheses based on the teaching of Breckman, Reid and others. The combination of tracks utilizing the N-scan criterion or similarity test as a basis of combining hypotheses is illustrated by illustration A of FIG. 119. The probability of one hypothesis that is to be retained is agumented by the probabilities of similar or equivalent deleted hypotheses. Data points $y_1$ (2) and $y_2$ (2) each fall within the validation gates of the tracks initiated on the previous scan. It is assumed that a low probability of false alarm; which appears to be weighted, such that, hypotheses $H_{15}$ and $H_{20}$, each of which embodies two, two point tracks that survives pruning. Virtually all hypotheses are deleted with the exception of $H_{15}$, $H_{20}$, and all enters are equivalent except those entries following below data points $y_1$ (1) and $y_2$ (1) which are associated T1 and T2, respectively. Illustration A of FIG. 119 indicates that tracks T3, T4, T6, T7 and the corresponding remaining predicted positions P3, P4, P6 and P7. Illustration B of FIG. 121 describes the hypothetical regions of validation associated with the aforesaid predicted positions of said tracks for the interval of time corresponding to the next scan. Data point $y_1$ (3) is in close proximity to predicated position P6 of track T6 to form T9, and is assumed to survive pruning; whereas $y_2$ (3) is not close to P4. Track T9 is included in all three aforesaid hypotheses and is removed from said hypotheses to form a new cluster, as indicated in the table of reduced hypotheses matrix taken after the third scan. Track T9 is described by the following relation, $$T9=[y_1(1), y_2(2), y_1(3)]$$

Track T9 initiates a new cluster with a single hypothesis which is valid because none of the observations contained within T9 are embodied within the three hypotheses remaining in the previous cluster, as indicated herein below, $$H_1\text{: } T4=[y_2(1), y_1(2)], y_2(3)=FA$$

$$H_2\text{: } T11=[y_2(1), y_1(2), y_2(3)]$$

$$H_3\text{: } T4=[y_2(1), y_1(2)], y_2(3)=NT12$$

Figures 121, 122:
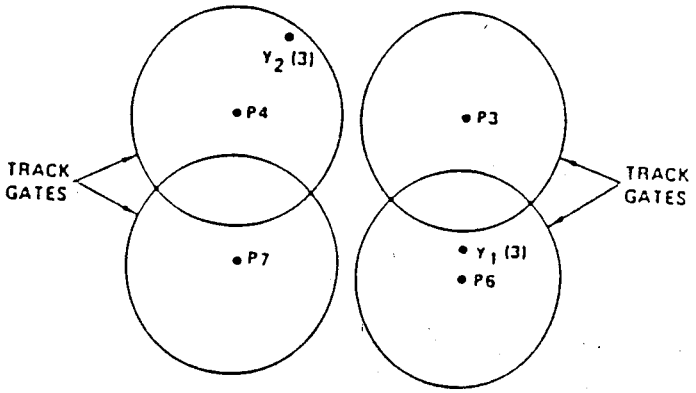

The above hypotheses where described in illustration A of FIG. 121 and denotes the simplest case of targets passing by one another while heading in separate directions. New clusters are initiated any time an observation does not fall within the gates of previous tracks contained within existing clusters. When the observations fall within the gates of two tracks from different clusters, the said clusters are combined or merged prior to processing with the observations forming a super-cluster. The set of tracks and observations of said super-cluster is the sum of those in prior clusters. Additionally, when an observation falls within the gates of two or more tracks originating within two different clusters, said clusters are merged such that, the merging is completed prior to the observation being processed. Further, the number of hypotheses is a new super cluster is the product of the number of hypotheses in prior clusters and the associated probability are products of the prior probabilities.

Another method for assessing observational data referred as the All Neighbors Data Association, ANDA, combines the hypotheses accumulated after each scan before the next scan is processed. ANDA first proposed by Bar-Shalom and Tse includes the methods of probabilistic data association PDA which leads to a modified tracking filter known as PDAF and a special case of the MHT method called JPDA. The JPDA and or PDA method is geared to access target track input so the probabilities are computed on the bases of previously established tracks in contrast to the MHT method in which options are computed for the measurements. The PDA method establishes the presence of target tracks in the presences of extraneous signals generated by clutter multiple image subposition or various returns which undergo distortion. Breckman has proposed the following problem which effectively explicates the PDA method. The probability of detection PD and the gate is determined to be large enough so that the target return when present will fall within the track gate PG, such that, $P_G \cong 1.0$. It is additionally assumed that the extraneous return density to be Poisson with density B, which includes new targets and false returns described by the expression.

$$\beta=\beta_{NT}+\beta_{FT}$$

Given N observations taken within the gate of track i, the initial condition $H_2$ where none of the observations are valid with N+1 hypotheses formed, the probability of Ho is proportional to p'; o, where, $$P_{10}=\beta^N(1-P_0)$$

Equivalently the probability of hypothesis Hj (j 1,2, . . . ,N) the observation j is the valid return which is proportional to $$p'_{ij} = \frac{\beta^{N-1}P_p e^{-\frac{dV}{2}}}{(2\pi)^{M2}\sqrt{|S_1|}} \cdot j = 1,2, \ldots, N$$

and the probabilistic Pij associated with the N−1 hypotheses are computed through the normalization equation $$p_{ij} = \frac{p'_{ij}}{\sum_{j=ii}^{N} p'_{ij}}$$

The factor B $^{N-1}$ cancels during the normalization process and therefore the expression is excluded from the computation of Pij, which upon simplification reduces to $$p_{\mu} = \begin{cases} \dfrac{h}{h + \sum_{i=1}^{N} a_N}, & j = 0 \text{(no valid observation)} \\ \dfrac{a_{ij}}{h + \sum_{i=1}^{N} a_{il}}, & 1 \leqq j \leqq N \end{cases}$$

where $$b = (1 - P_b)\beta(2\pi)^{M12}\sqrt{|S_1|}$$

$$a_{ij} = P_b e^{-\frac{a_i 2}{2}}.$$

Based on the works of Bar-Shalom and Tse the hypotheses are merged where a weighted sum of residuals undergo Kalman filtering associated with the N observations, such that, $$\bar{y}_i(k) = \sum_{j=1}^{v} p_y \bar{y}_y(k)$$

where $$\bar{y}_{ij}(k) = y_j(k) - H\bar{x}_i(k|k-1)$$

$$y_j(k) = \text{observation } j \text{ received at scan } k$$

Upon Kalman filtering updates the subscript i denoting track i is omitted, such that $$\bar{x}(k|k)=\bar{x}(k|k-1)+K(k)y(k)$$

with the gain, K(k), and the covariance derived from scan k is modified in accordance to equation $$P(k|k)=P^*(k|k)+dP(k)$$

where P (K | K) is the Kalman covariance that would be computed for a single return were present and dP(k) is an increment added to indicate the effect of uncertain correlation. Equations defining po(K | K) and dP(K) are described by expression $$p^o(k|k) = p_{io}P(k|k-1) + (1-p_{io})P^*(k|k)$$

$$dP(k) = K(k)\left[\sum_{i=1}^{v} p_4\bar{y}_4\bar{y}_4^T - \bar{y}\bar{y}_i^T\right]K^T(k)$$

with P*(K | K) being the Kalman covariance, such that, $$p^*(k|k)=[1-K(k)H]P(k|k-1)$$

The term dp(k) increases the covariance to the observations embodied within the track gate and the a posteriori probabilities upon combination of equations, $$\bar{y}_i(k) = \sum_{i=1}^{v} p_4\bar{y}_{ij}(k)$$

where $$\bar{y}_{ij}(k) = y_j(k) - Hx_i(k|k-1)$$

$$y_j(k) = \text{observation } j \text{ received at scan } k$$

deleting of subscript i for track i, such that, $$\bar{y} = p_1\bar{y}_1$$

$$dP(k) = K[p_1\bar{y}_1\bar{y}_1^T - \bar{y}\bar{y}^T]K^T = p_1(1-p_1)\,K\bar{y}_1\bar{y}_1^TK^T$$

which gives a maximum correction for uncertainty where the probability that the observation P1 equals 0.5 and if two measurements are in the gate, such that P1=P2=0.5, Po=0, the covariance correction term becomes, $$dP=0.25K(\bar{y}_1-\bar{y}_2)(\bar{y}_1-\bar{y}_2)^TK^T.$$

The JPDA method will be discussed presently because of its application in sonar and other surveillance systems. The JPDA method is equivalent to the PDA technique with the exception that the association probabilities are computed using the full complement of tracks and observations. The probability computation of $$\frac{h}{b+\sum_{i=1}^{N} a_{il}},\ \frac{a_{ij}}{b+\sum_{i=1}^{N} a_{i1}},$$

or Pij, must be extended to include multiple tracks in which multiple observations fall within the validation gate of said tracks as described by Breckman in illustration A of FIG. 123. Illustration A of FIG. 123 discloses three observations 01, 02, and 03 inscribed within the gate of predicted position P1 of track T1; whereas 02 and 03 fall within gate of track T2. Here the JPDA method computes weighted residual for T1 based on the previous aforesaid observations; however the weights for 02, 03 are reduced and the residual for T2 will be formed using 02, 03. The basic difference between the hypothesis matrix previously described and the JPDA approach is that said approach is target orientated emphasizing hypothetical alternatives to target tracks. The corresponding table B of FIG. 124 also formulated by Breckman describes the associated hypothesis probabilities. The numbers assigned to the tracks, such that, the numeral 0 represents a null assignment or no observations to a given track and gij refers to the Gaussian likely function associated with the assignment observation j to track i. The aforesaid table illustrates the structure for computing the hypothesis probabilities $PH_1$ and No, N are assigned to the numbers of observations and tracks that denote certain common factors which may appear in P' H1. Given the common factor $B^{(No-NT)}$ when No>NT: whereas the common factor is $1-PD^{(NT-No)}$, if NT>No. The probability of detection PD is direct, the probabilities PH1 are normalized and computed in a standard manner where NH is the total number of hypotheses, such that, $$P^o(k|k) = p_{io}P(k|k-1) + (1-p_{io})P^*(k|k)$$

$$dP(k) = K(k)\left[\sum_{i=1}^{N} p_{ij}\bar{y}_{ij}\bar{y}_{ij}^T - \bar{y}\bar{y}_i^T\right]K^T(k)$$

and $$P(H_1) = \frac{P'(H_1)}{\sum_{i=1}^{N_H} P'(H_1)}$$

Illustration A of FIG. 123 exhibits a two dimensional measurement in which, $$M = 2.\sqrt{|S_i|} = \sigma_i^-\sigma_i^-$$

and with numerical values $$\sigma_i^- = \sigma_i^- = 1,\ \beta = 0.03.\ P_D = 0.7$$

$$d_{11} = 1,\ d_{12}^2 = 2,\ d_{13}^2 = 4$$

$$d_{22}^2 = 2.5_d_{23}^2 = 3$$

Table B of FIG. 124 lists the probabilities associated with the hypotheses. The observation j is optimally assigned to track i to compute the probability Pij and the sum is to be taken over said probabilities from said hypotheses in which the assignment occurs, such that, probabilities, $$p_{10}=P(H_1)+P(H_5)+P(H_8)=0.011+0.041+0.032-=0.084$$

$$P_{11}=P(H_2)+P(H_6)+P(H_9)=0.086+0.306+0.239-=0.631$$

$$p_{12}=P(H_3)+P(H_{10})=0.053+0.145=0.198$$

$$p_{13}=P(H_4)+P(H_7)=0.019+0.068=0.087$$

for track 1 and $$p_{20}=P(H_1)+P(H_2)+P(H_3)+P(H_4)=0.169$$

$$p_{21}=0$$

$$p_{22}=P(H_5)+P(H_6)+P(H_7)=0.415$$

$$p_{23}=P(H_8)+P(H_9)+P(H_{10})=0.416$$

for track 2. The expected heavily weighted events are computed to be the assignment of 01 through T1 and 02 or 03 through T2. The associated probability is taken to be zero in the case of $P_{21}$ if said observation does not fall within the gate of a given track just as j; o indicates null condition or no assignment.

Figure 125:
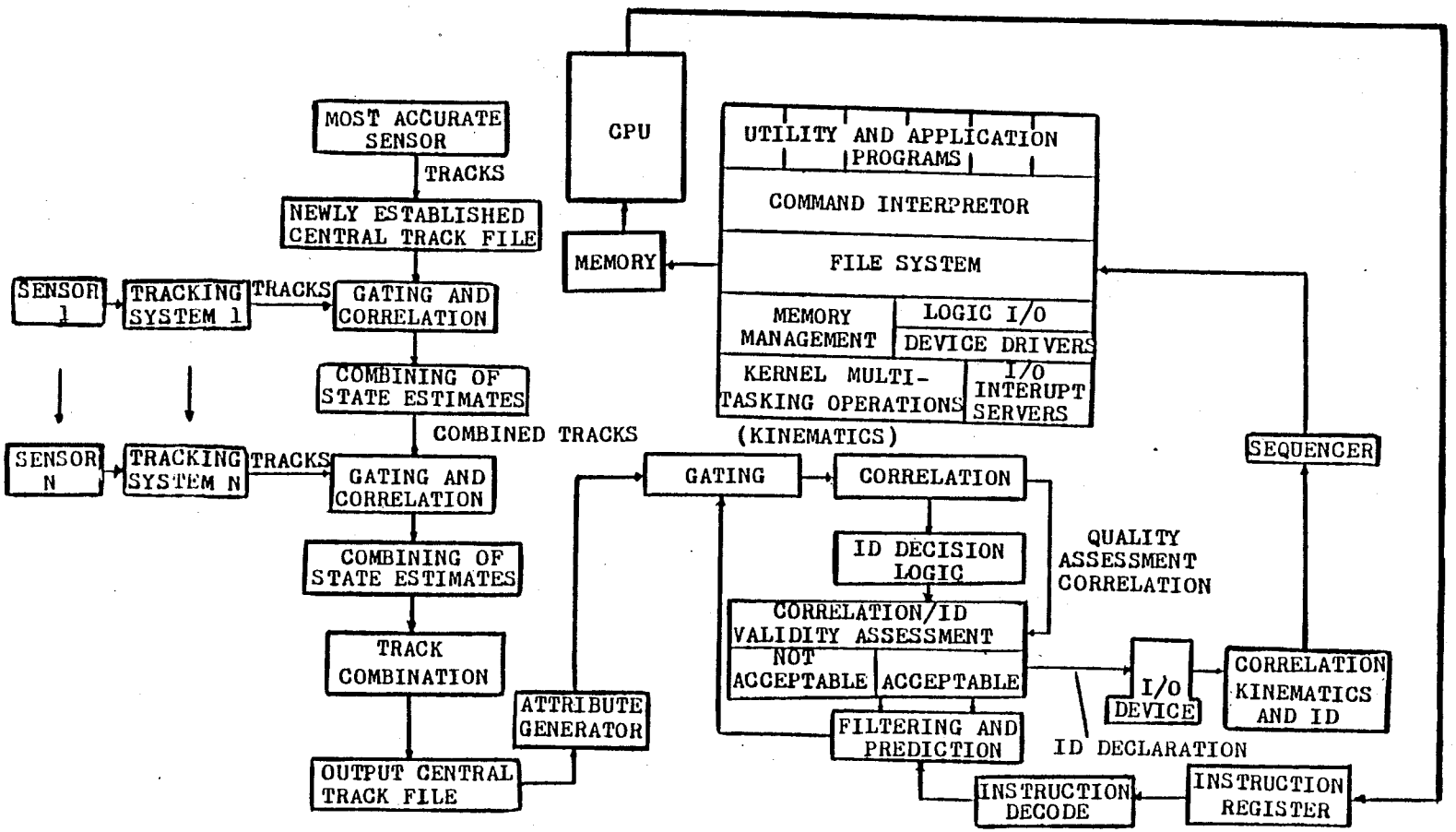
FIG. 125 describes the implementation of a system deploying an array of sensors in accordance with the MTT theory.

The conformation of multiple targets within the contexts of the MTT theory is more precisely accomplished with the implementation of a system deploying an array of sensory elements, as described in FIG. 125. The use of multiple sensors requires the compilation, correlation, identification and subsequent analyses of data from different types of sensory means in order to procure target identification. Programs emboding statistical formats collate and rank data regarding target attributes including but not limited to characteristic acoustical infra-red and radar emissions discerning the size, shape, range, speed and other properties associated with targets. Additionally, kinetmatic attributes such as relative position, range, speed, et ceter can be reduced to steady state variable vectors under condition of dynamic flux when said attributes are correlated with other data concerning the disposition of targets. The primary application of the Denpster-Shafer method also known as evidential reasoning readily links itself to multiple sensor data where the miscorrelation and/or uncertainty exists in the identification of targets. Attribute data is used directly in the correlation process to identify targets. Sensors allocated for tracking targets have their own separate and distinct track files. Tracks embodied within said track files are established on the basis of measurements received from the individual sensors which are implemented by data exchanged between said data sensors and the central track file, which continuously updates said track file of the sensor level tracking means, enabling said central track file to form a synergistic composite.

The advantages of said sensor level tracking means are a reduction in data-bus loading, a reduction in computational loading and a probability of surviving degradation due to the distribution of tracking capabilities. Multiple sensors convey different data and data containing redundant information to be processed. There is communication between sensors and between the sensor elements and the central track file which is utilized to update sensor level track files when deploying the multisensor fusion technique wherein the central level tracks are updated with sensor level track data and the multiple hypotheses. The tracking approach is integrated at the central level when said sensor level tracks data are combined in order to minimize the problem of uncorrelated measurement error, inaccuracies in tracking, false correlation in regions effected by clutter, false image patterns and the degradation of data incurred by electronic counter measures and less frequent scans. Central level tracking enhance continuously and track confirmation. Different types of sensor elements will under dynamic conditions exhibit different thresholds, levels of resolution or abilities to identify, confirm and sustain tracks. The implementation of data detected by different types of sensors allocated for each track greatly increases the probability of track acquisition and survaliance for a given sensor. Radar sensors even in a phased array may loose a track when subjected to clutter, glutches or fading in a return of signals due to radar cross-section scintillation which would otherwise be retained by an infra-red (CCD) sensor array, acoustical signals processed by differential sonar scanners. The synergistic interaction of different sensors optimizes the tracking process and air born objects are more accurately assessed by radar in regards to range, absolute distances and structural configuration, whereas high resolution acoustics determines sounds attributes associated with targets and infradetection yeilds more accurate measurements in angle or identify specific heat structures. The overall real time required to acquire, track and correlate target signatures is diminished by as much as four orders of magnetude by track to track correlation and combining sensor level tracks which essentially identify the same target.

Different types of sensory elements can be adjusted to maintain different state estimation vectors, such that, there exists a difference in the covariance matrices reducing the time necessary to make calculations when using state estimates and corresponding covariance elements common to multiple sensors. The Wiener and Bar-Shalom describe a method by which the chi-square properties of the difference in the state estimation vectors xi, xy for recent estimates at arbitrary scan k, such that tracks which are not updated within the same interval of time are extrapolated to some common joint. Two tracks are taken at scan k, yeild state vector estimates and covariance matrices track $i$: $x_1(k)$, $P_1(k)$ track $j$: $x_j(k)$, $P_j(k)$ The difference vector dij formed at scan k gives common state estimates, $$d_{ij}=\hat{x}_i-\hat{x}_j$$

where subscript k is omitted,

If said tracks are independent, the covariance matrix Uij for dij is defined by, $$U_{ij}=P_i+P_j$$

with Gaussian distribution, $$R^2=d_{ij}^T U_{ij}^{-1} d_{ij}$$

will have the chi-square, $X^2n$, with the number of degrees of freedom, n, equal to the number of elements in the state vectors. Perodic tests to accept or reject the hypothesis that two tracks are derived from the same source are defined by similarity threshold Ts, such that, $$R^1 \geqq T_s, \text{ tracks are not from the same source}$$

$$R^2 < T_s, \text{ tracks are from the same source}$$

which is based on the chi-square prperties of $R^2$ requiring experimentation and optimally choosen as a function of target density. The resultant formulation of $R^2$ is not entirely valid because of error correlation between the sensor estimates. Said error correlation in accordance with Bar-Shalom modifies covariance matrix Vij. The cross covariance matrix Pij is defined by the initial correlation, such that for K>0 values of Pij (K|K) are calculated based on recursive relationship, $$P_{ij}(k|k)=A_i(k)B(k-1)A_j^T(k)$$

where $$A_i(k)=1-K_i(k)H_i$$

$$A_j(k)=1-K_j(k)H_j$$

$$B(k-1)=\Phi_i P_q(k-1|k-1)\Phi_j^T+Q(k-1)$$

The subscripts i, j refers to sensor system i, j, whereas Φ, K, H, and Q defines Kalman filtering elements. Substituting the modified covariance describes previous yeilds, $$U_4=P_i+P_d-P_4-P_4^T.$$

Tracks determined to originate from the same source are combined into a single vector, which minimizes the expected error, such that, $$x_i=x_i+C[x_j-x_i]$$

$$C=[P_i-P_{ij}]U_{ij}^{-1}$$

and the covariance matrix associated with the estimate of the previous equation yield, $$P_c=P_i-[P_i-P_{ij}]U_{ij}^{-1}[P_i-P_{ij}]^T$$

Figure 126:
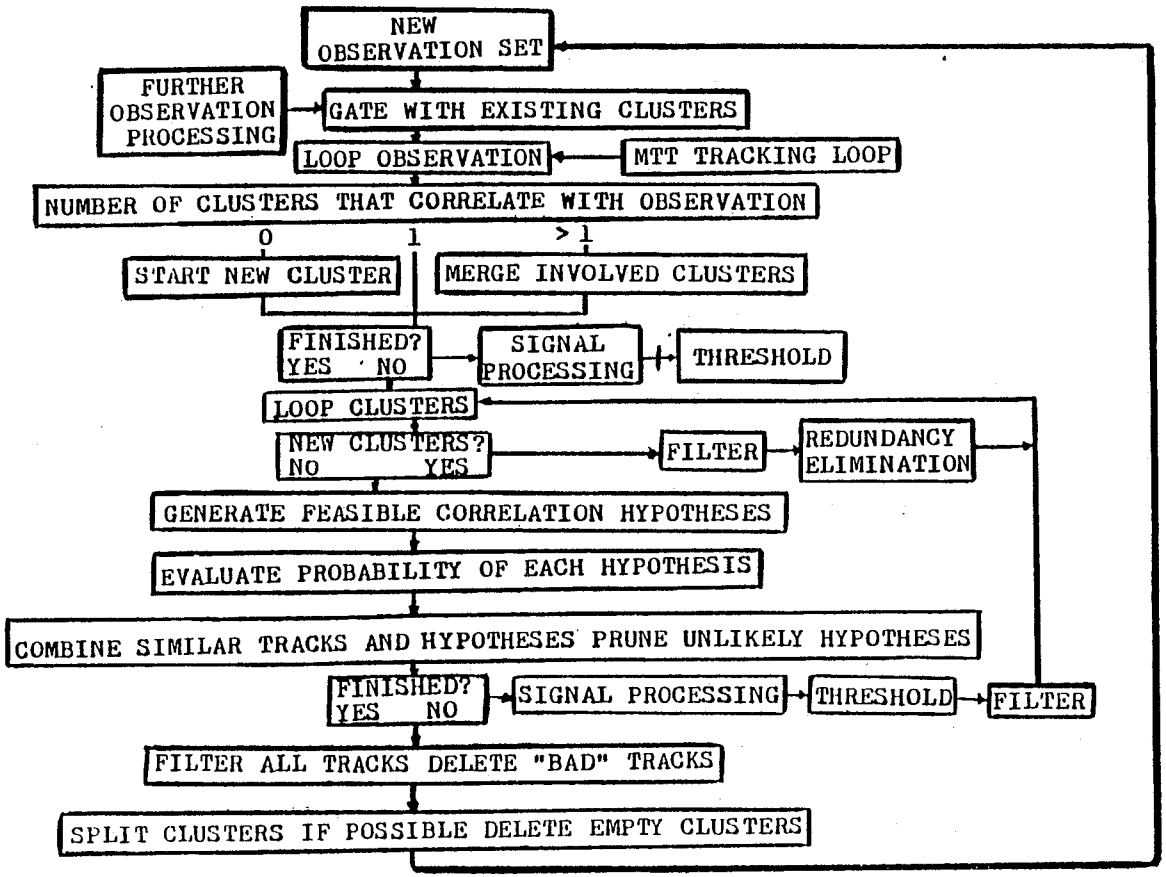
FIG. 126 represents a modified high level flow chart of the multiple hypotheses track algorithm.

The correlation of sensor-level tracks into central-level tracks form new state estimates as indicated in FIG. 125 involves the same type of logic involved in the observation to track correlation discused previously in regards to elements contained within said Figure. Sensor-level tracks are extrapolated to some common fusion time point then the central or global track file is initalized with the track file from the most accurate sensor means which has the highest resolution, the lowest absolute threshold and the lowest detection error ratio of any of the aforesaid sensory means the track files from the other sensors are correlated one at a time with the central-level tracks and new state estimates formulated, as indicated in the flow chart disclosed in FIG. 126. If the correlation of sensor-level tracks obtained from different sensory means are taken in repetition and the gating criteria are satisfied, then potential correlation between sensor-level tracks that have been rejected in the past need not be reconsidered saving time.

Data output tracks are accumulated in the output central file which accumulates data in attribute generator means. Radar doppler signitures describing the target profile the infra-red signiture designated the mean radiance or thermal re-emission of said targets, acoustic emissions of specific engines, motorized units or sonar profiles derived from said targets forming target types. It is necessary to maintain attribute and target type estimates in the event one or more attributes are assigned to more than one target type. Certain sensor-level data processors directly converts measured attributes into target type specifically those detecting analog signals emitted from targets, such as those optical and electronic elements, which detect chemical species emitted from said targets. It is obvious that there is no need to include attribute and target type information in the overall correlation and target identification process. Track files will contain estimated probabilities for attributes and target types with the initial values given by a priori probabilities which are updated by post priori observations.

The general Bayesian structure of discrete quantities and statistical inference methods leads itself most readily to solve the problem of estimating attributes and target types. The measurement process for attribute estimation updates are defined by the relationship.

$$P(X_m|X) = \text{probability of receiving measurement } X_m \text{ given that the true quantity is } X$$

Upon receiving data the aforesaid updated can be computed on the basis of Bayes rule where $$P(X|X_m) = \frac{P(X_m|X)P(X)}{P(X_m)}$$

and $$P(X) = \text{prior probability associated with } X$$

$$P(X_m) = \sum_N P(X_m|X)P(X)$$

such that, P (X|Xm) becomes the new prior probability upon receiving additional data. The previous equation provides a method by which the estimated probabilities of target type and attribute classes or states can be asertained based directly on the measurements Xm.

The accumulation of attribute data assists the estimation of the target type and excludes certain alternatives. The relationships between expected attributes and target types by the implementation of present data with prior accumulated data is defined by matrix M (B|A), such that, $$M(B|A)_{ij} = P(b_j|u_1) = \text{conditional probability of attribute } b_j \text{ given target type } a_i$$

Pearl teaches a special case of inference where the parent node A refers to a target type with state ai, the descendents are indicated by B, C with state bj and cj, respectively; are denoted sibling elements and are related through said parent node, such that $$P(bj\ cj|ai)=P(bj|ai)P(cj|ai)$$

Additionally the probability of attribute bj is represented by the product of two terms and a normalizing constant $\alpha$B in the expression $$P(b_j)=\alpha_s\lambda(b_j)q(b_j)$$

where $A(b_j)=P(B_m|b_j)$ $q(b_j)=P(b_j|D^u(B))$ $B_m$=set of direct measurements on attribute B $D^u(B)$=data entering the estimate of B from above, The above equation indicates that the probability associated with bj is the product of the term based upon the direct measurement, Bm of B described by $\lambda$ ($b_j$) and indirect term $D^u$(B). Term $D^u$ (B) includes data that goes into the estimation of A based on prior information on A, which is based on the direct measurement of A and indirect measurements on A using attributes C, D, et certain, other than B. The indirect term is defined by $$q(b_j) = \sum_i \left[ \frac{P(b_j|a_i)\ P(a_i)}{r(B - a_i)} \right]$$

where r(B→a,) is the contribution from an estimate of B to the attribute data. Kinematic data and attribute data are combined and correlated with observation of existing tracks or initiate new tracks. The a posteriori probability of measured kinematic data is described by the expression, $$f(\bar{y}) = \frac{e^{\frac{d1}{2}}}{(2\pi)^{M\,2}\sqrt{|2|}}$$

where $d^2=\bar{y}^TS^{-1}\bar{y}$ $y$=residual vector (difference between predicted and measured quantities)

$S$=residual covariance matrix $|S|$=determinant of S $M$=measurement dimension

Upon implementation the generalized a posteriori probability associated with kinematic data $\bar{y}$ and attribute data Zm becomes $$f(\bar{y}, Z_m) = \frac{e^{\frac{d2}{1}}}{(2\pi)^{M\,2}\sqrt{|S|}}\ P(Z_m|D_r)$$

where P(Zm/Dp) or its logarithm can be utilized in the multiple tree hypothesis.

Validity assessment, identity declaration eventually enter higher logic functions as operators within kernels associated with multiple task operations as disclosed in FIG. 66. Dempster and Shafer teach a method of evidential reasoning applicable when combining data by multiple sensors so that data is more accurate and more convient, lowering the level of uncertainty in determining whether or not a target is a friend, foe, or neutral. The implementation of evidential reasoning is exemplified by the set of n mutually exclusive and detailed proposition for target type $t_1, t_2 \ldots, t_n$ having assigned probability mass, m($t_1$), to any of the original propositions or disjunctions of said propositions. A disjunction is described as the proposition that a target is of the type $t_1$, $t_2$ which is also expressed at $t_1$ V$t_2$). Additionally, there are $2^n-1$ general propositions emboding all possible disjunctions assigned masses and said masses which are summed over the entire complement of said propositions must equal unity. The uncertainity m$\theta$ is a mass assignment to the disjunction of the entire complement of the original propositions described by the expression, $$m(\theta)=m(a_1va_2v\ldots va_n)$$

The aforesaid masses can be assigned to the negation of propositions, such that, the mass assigned to the negation of $t_1$ is described by, $$m(\bar{a}_1)=m(a_2va_3v\ldots va_n)$$

The support for a given proposition is the sum of the full complement of masses assigned directly to said propsition. The support spt ($t_1$) for the basic proposition $t_1$ is the mass associated with $t_1$ (spt($t_1$) m($t_1$)). More complexed propositions where the target is either $t_1$, $t_2$ or $t_3$ the following expression is utilized to make the determination is described herein below, $$spt(a_1va_2va_1)=m(a_1)+m(a_2)+m(a_3)+m(a_1.va_2)+m(a_1va_2)+m(a_2va_3)+m(a_1va_2va_3)$$

The plausibility of a given proposition is the sum of all mass not assigned to its negation, such that, $$pls(a_i)=1\ spt(\bar{a}_i)$$

Alternately, pls ($t_1$) can be computed for all masses associated with ai and all disjunctions, including $\theta$, that contain ai $$pls(a_i)=m(a_1)+m(a_1va_2)+\ \ldots\ +m(\theta)$$

The plausibility of $t_i$ defines the mass that is free to move the support $t_i$ and the internal [spt($t_i$) pls($t_i$)] represents the uncertainity interval with an arbitrary ignorance factor of [0.1] and a certain probability of 0.6, [0.6, 0.6]. Sensor resources are allocated on the basis of high probabilities that targets are a certain type alluding to geometric designs, inherent lethality or level of threat and the established kinematic parameters, such as the range, distance, velocity and the time required before reaching the lethal radius of said target. The CPU additionally functions to refine the sensitivity of the sensor and is based on the expected gain in utility allocating said sensors to given track which is found by comparing the utility of the expected state of knowledge before and after sensor allocation. Said utility is expressed by U(Q) where Q=$\sigma_x/\sigma$xD and $\sigma$ x/$\sigma$xD is the ratio of the true estimation-error standard deviation or $\sigma$x to the estimation-error standard deviation, 6×D. The marginal or expected utility for track update with a specified sensor is estimated by the expression, $$U_O=MAX[P_TU_d.(1-P_T)U_{ND}]$$

said marginal utility is optimally weighted by the probability of detection $P_D$. The term $U_D$ utility associated with declaring target presence when the target is determined to be present whereas $U_{WD}$ is the utility associated with correctly declaring the target to be absent. The probability that a sensor will report a target to be present is described herein below:

$$P(R)=P(R|T)P_r+P(R|\bar{T})(1-P_r)$$

and $$P(\bar{R})=1-P(R)$$

where

P(T|R)=probability of target presence given a potential sensor report of target presence P(T|$\bar{R}$)=probability of target presence given a potential sensor report that the target is not present P(R|T)=conditional probability that the sensor will report target presence given that it is present P(R|$\bar{T}$)=conditional probability that the sensor will report the target present when it is not Similar definitions hold for the terms P($\bar{R}$|T), P($\bar{R}$|$\bar{T}$), P($\bar{T}$|R). and P($\bar{T}$ $\bar{R}$). The a posteriori probabilities of target presence is conditional upon the events that said reports are to be presently described by R, such that, $$p(T|R)=\frac{P(R|T)P_T}{P(R)},\ P(T|\bar{R})=\frac{P(\bar{R}|T)P_T}{P(\bar{R})}$$

The expected utility after sensor allocation is averaged over the events that said sensor report target present R and absent R. The terms $U_{SR}$ and $U_{SR}$ are the expected utilities after sensor detection for the aforesaid events, such that, $$U_{SR}=MAX[P(T|R)U_D,\ P(\bar{T}|R)U_{ND}]$$

$$U_{SR}=MAX[P(T|\bar{R})U_D,\ P(\bar{T}|\bar{R})U_{ND}]$$

The averaging over said sensor events the expected utility after sensor allocation is $$U_r=P(R)U_{SR}+P(\bar{R})U_{SR}$$

where the marginal utility is defined by $U_s-U_o$.

Figure 127:
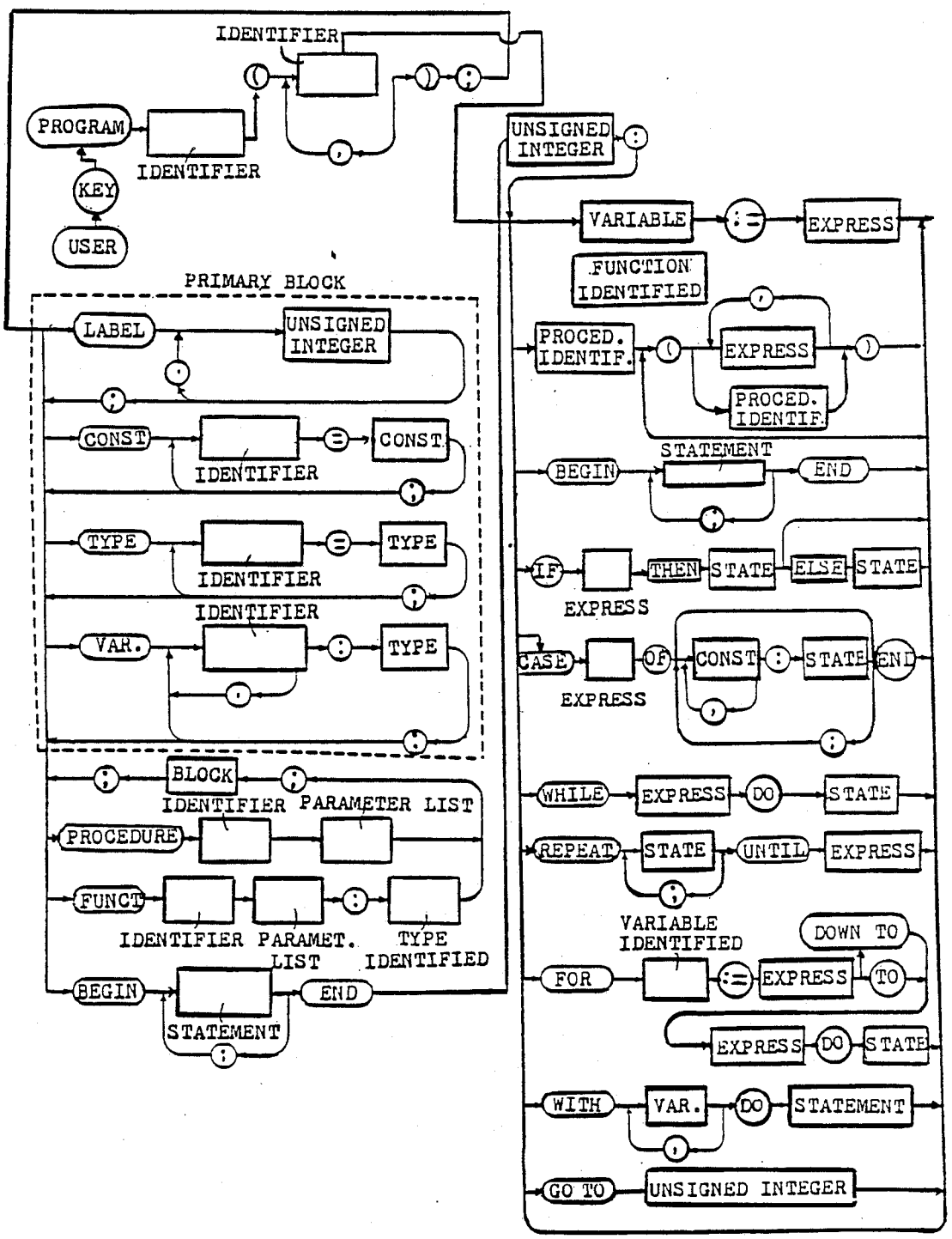
FIGS. 127 through 127*d* exemplifies in detail the structure, disposition and subsequent implementation of interactive programs embodied within expert programs encoded within the CPU and microprocessor elements of the transector device and ancillary systems.
Figure 12:
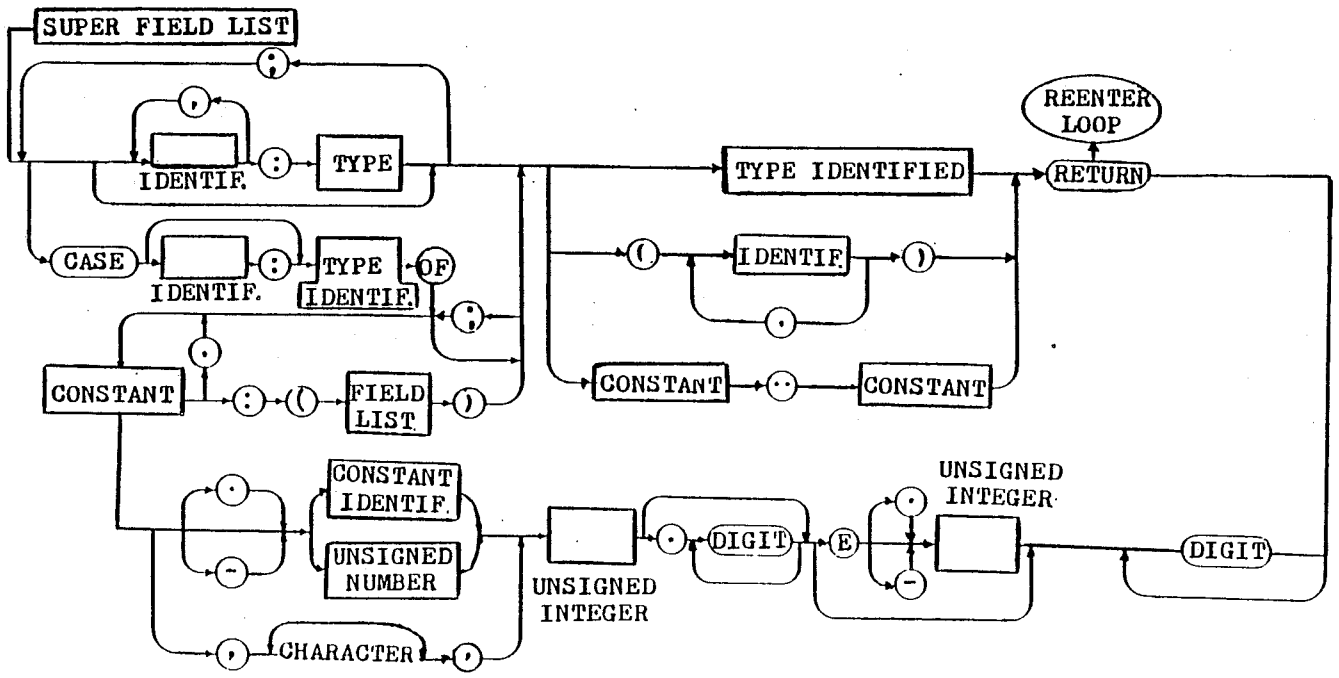
Figure 127B:
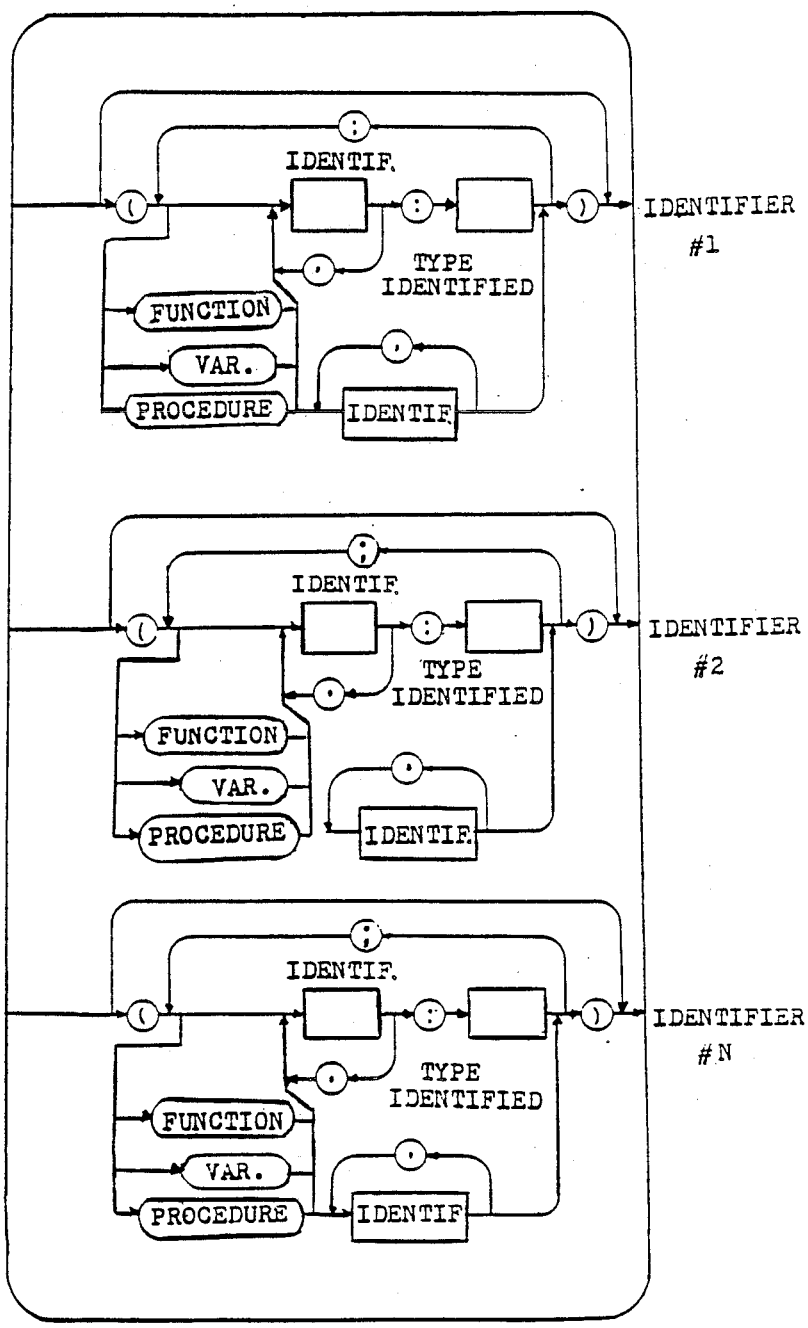
Figure 12:
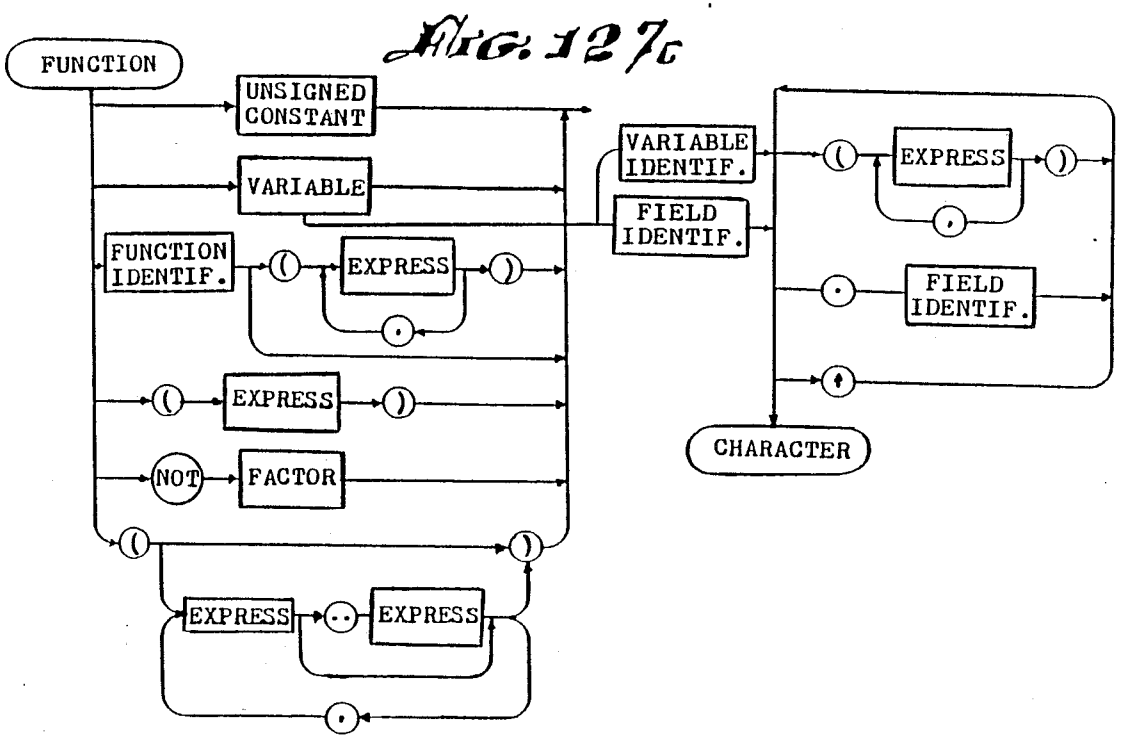
Figure 127D:
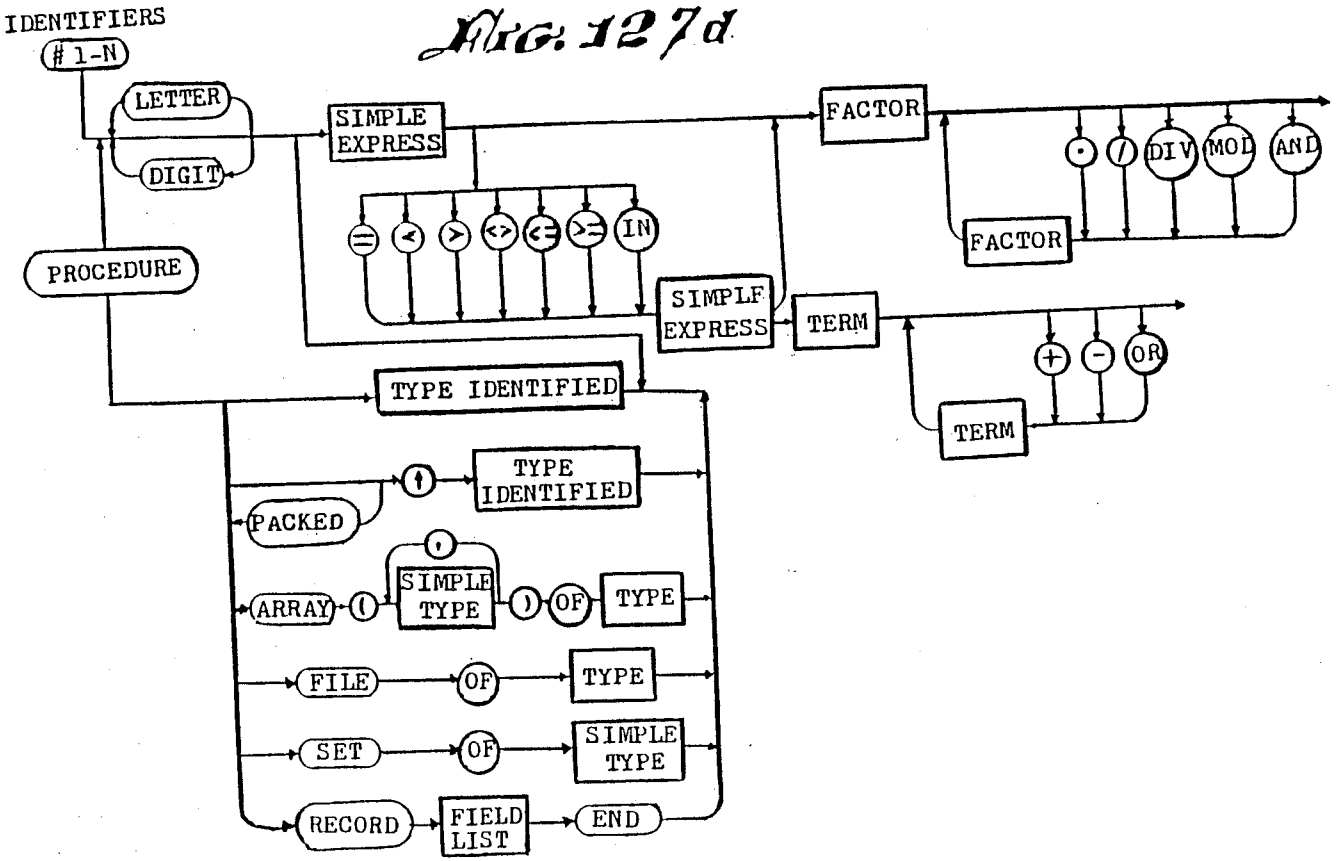

FIG. 127 through 127*d* exemplifies in detail the design and structure and the method by which interactive programs embodied within expert programs are encoded within the CPU and microprocessor elements contained within the CPU and microprocessor elements of the transector device and ancillary systems. The typical program contains a preamble identifying terms, the precedures to be conducted forming the methodology and the specifications of functions, factors, subterms and the like which are operated upon during the execution of a given program. Irregardless of the number of subprograms nested within a main or primary program or the complexity of routines and subroutines encapsulated within said subprograms the structure and design features presented in the above-mentioned figures remain consistant with those embodied within the CPU and ancillary structures of the transector device.

FIG. 128 denotes a concise program illustrating one type of syntex language and structure which assists in the implementation of interactive programs embodied within expert programs described in FIGS. 127 through 127*d*. Here the data entering the program keys the actuation of the main program, which is preceded by the target acquisition process. The said program is arbitrary and must consider in an exemplary manner rather than in a limiting sense. Additionally, the foregoing exemplary algorithms, programs and related matter presented in the specifications should be considered language non-specific, which is the rational for presenting some programs in fortran, pascal, or other languages. The CPU is meant to be user specific and user compatable, once the initial code sequence is keyed to unlock and actuate the aforesaid transector device.

FIG. 129 entails a comparision of continuous time and discrete transforms. The type of mathematical formulas depicted in FIG. 129 are exemplary of those equations used in algorithms to analyze data retrieved from sensors during the target aquisition process and related processes. The convolution property of DFT when combined with the input segmentation into blocks of length−N is known as fast convolution which is the optimium method to implement long or continuous input signals, medium length filters and extended temporal multiplication or addition processes. Circular convolutions are used to compute the linear convolution if a signal filter M and a block with signal length B such that the input signal is segmented into length B non-overlapping blocks and the output overlap is implemented with a process known as the output add method yielding a circular convolution of length L=M+B−1 for each input segments. If the complete input signal is segmented into K length−B block then the time necessary to compute a fast convolution is described by $$T_{fast}=T_{fft}+2KT_{fft}+KLT_{aux}$$

whereby $T_{fft}$ is the time required for a length L-FFT and Taux is the time required for auxillary calculations and corresponds to the time required for point by point frequency domain multiplications. The term $2KT_{fft}$ is indicative of the forward transforms of said blocks and the inverse transform of the product of the data transforms and the filter transforms; whereas K represents the point by point multiplications of transform values and auxillary overlap-add circulations. The most efficient form of FFT uses dimensions of equivalent lengths and said lengths is known as the radix of the algorithm. The DFT of length N is related to the radix R by the equation $N=R^M$; wherein each radix has a length R and M describes the number of dimensions.

FIGS. 130, 130*a* describe in detail the autocorrelation for continuous signals emitted or otherwise acquired from designated targets. Said figures consist of a modified block diagram describing signal acquisition, a diagram of signal processing and equations describing in detail the operation of the autocorrelation process. Functions of autocorreoation are performed on data signals during the process of signal enhancement, filtering and various techniques associated with repetition of signals allowing the implementation of data reduction processes.

FIG. 131 illustrates a concise exemplary program for calculating the standard deviation and variance and concise mathematical formulas contained within said program responsible for the implementation of said program. The program and corresponding assemblage of mathematical formulas which are responsible for algorithms embodied within programs calculating standard deviations for target acquisition, warheads assignment to said targets and choosing the means of neutralization of said targets. The calculations of standard deviation implements the catagorization traits exhibited by designated targets and provides an alternate approach to probabilistic analysis of targeting.

FIG. 132 describes a well known program by which data accumulated during the acquisition process for designated targets can be identified upon the application of data reduction techniques to said data placed within the guidelines of a second order curve fit. Second order linear approximations are made of target attributes exhibiting complex behavior patterns forming third, fourth, or higher order equations. The aforesaid program and implementation of said program accomplishes the function as the mathematical implementation of the Best Fit Method.

Figure 133:
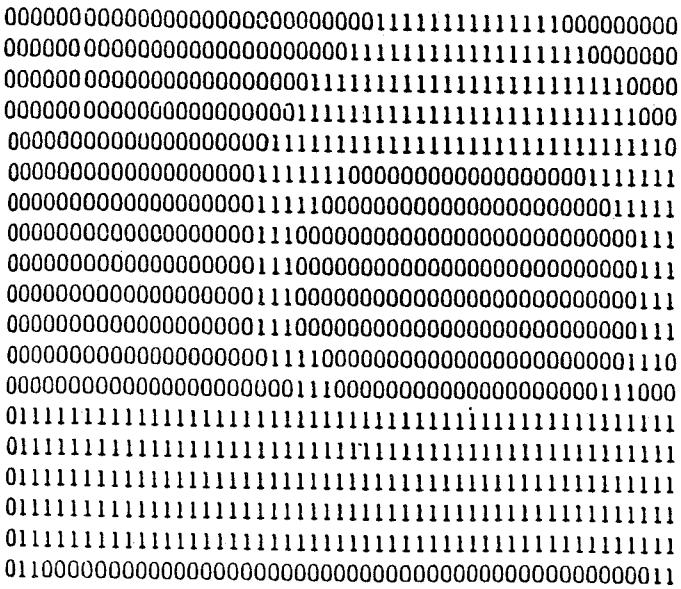
FIGS. 133 to 133*b* describes in concise detail the three stages by which a single digitized signal emitted by a designated target is isolated, identified by comparison and repetition and subjected to data reduction techniques.
Figure 133A:
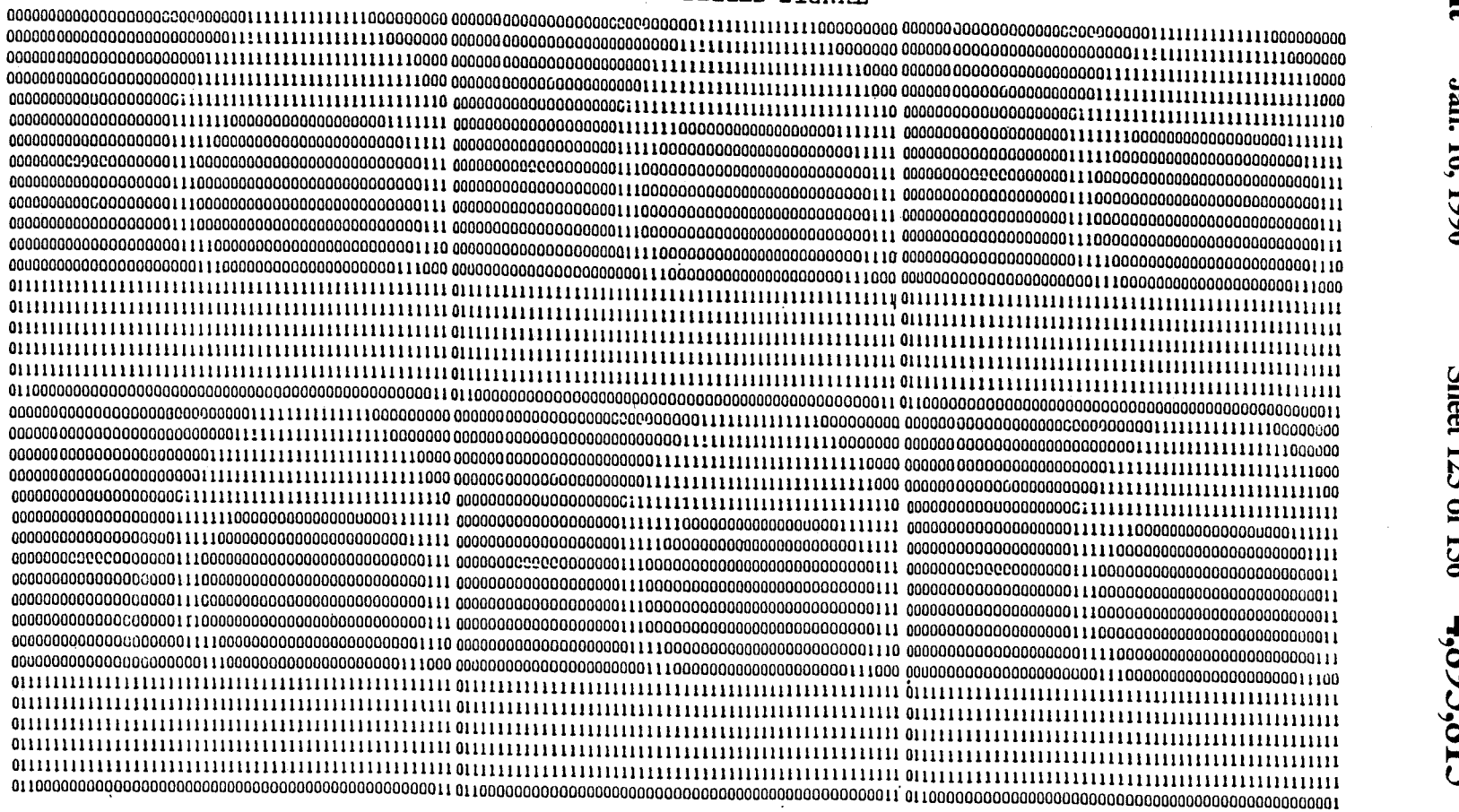

FIG. 133 describes in concise detail the three stages by which a single digitized signal emitted by a designated target is isolated by comparision and repetition and subjected to data reduction techniques. A single digitized signal obtained from a given designated target is isolated upon identification. Target acquisition embodies target pursuit, target tracking and ancillary processes, requiring a scanning rate in excess of ten hits per second. The greater the scanning rate the higher the frequency or repetition rate per second, which is an arbitrary interval of time. Equivalent or repetitive digitized signals of equivalent targets necessarily occur directly as a function of time and it is advantageous to reduce the size of a given sample in order to avoid overloading logic circuit and comparator elements responsible for the acquisition process. If signals obtained from designated targets are repetitive and equivalent then said data is digitized and digital values representing only a fraction of the attributes are exhibited by a single designated target after said target has been initially identified; thereby reducing the data and computational time needed for target reduction.

Figure 134B:
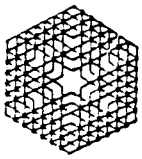
FIGS. 134 to 134*b* is a pictorial representation of the data reduction process within a single optical field element of the transector device.
Figure 134A:
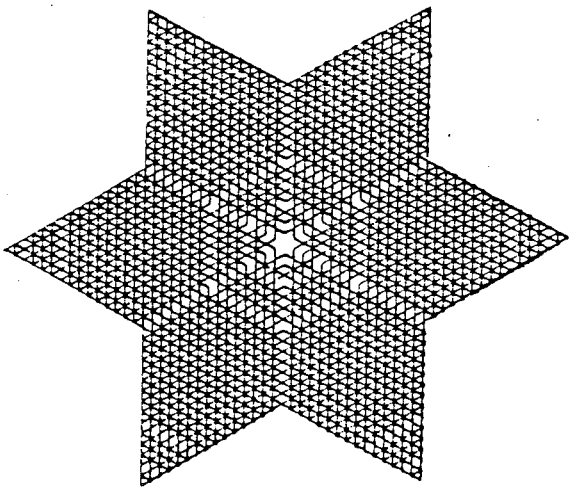
Figure 134:
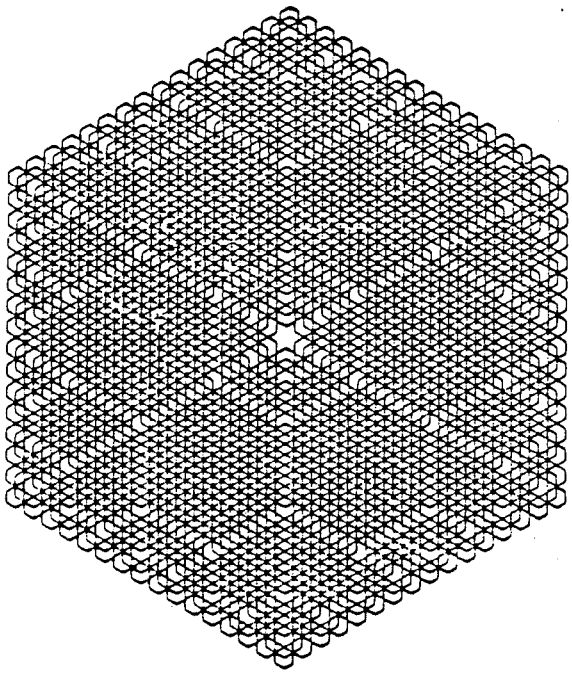

FIGS. 134 to 134*b* are pictorial representations of the data reduction process obtained within a single optical field element of the transector device. The number of optical fields generated per a one second interval of time can range between $10^4$ to in excess of $10^9$ bytes per second. The narrowing of an optical field is but another example of data reduction, which was illustrated in FIG. 72.

Figure 135:
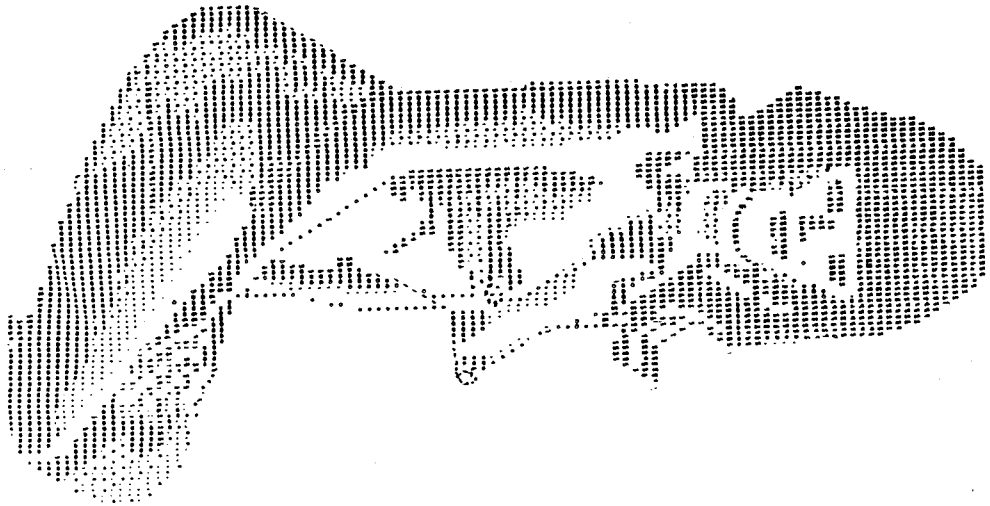
FIG. 135 is an pictorial illustration of a unlocking code exemplary of the type used to actuate the very first transector device.

FIG. 135 is an pictorial illustration of a unlocking code exemplary of the type used to actuate the very first transector device. Although somewhat whimsical encoded numbers or passwords release of automated systems to the user required the most unlikely encryptic code and visual punch up. Other codes and visual punch ups can be systematically programmed as frequently as passwords are changed.

FIG. 136 entails a concise digitized description of a single three dimensional time vector occupied by a single designated target within an arbitrary real time frame of ten microseconds. Said signal is arbitrarily choosen, exemplary of the type of signals generated by designated targets. The aforesaid signals consists of three spatial dimensional components which correspond to length, height and width displacement vectors and a fourth temporal component corresponding to some arbitrary real time vector. The spatial vector representations are presented in there digitized formats indicated by the vectors x, y and z, which are assigned to their respective x, y, z axis. The digitized signal corresponding to the aforesaid temporal interval is designated by the term t. The entire digitized spatial temporal complement defined by the parameters x, y, z and t are to be taken in an illustrative rather than in a literal manner.

FIGS. 137 through 137*c* describe a well known modification of a Cooley Tukey Radix—8DIF FFT program. The program embodied within FIGS. 75 through 75*c* are similar to those programs utilized to implement data acquisition programs embodied within the CPU and/or microprocessor element of said transector device and ancillary systems. The program originally proposed by Burves should be taken in an illustrative rather than a literal manner, since only two dimensional vectors are scanned; whereas at least four dimensions are scanned, as previously indicated. Additionally, the radix and corresponding lengths including N are several orders of magnitude larger than those parameters indicated in said figures.

---

Some Key Relationships For Guided Weapons (One-On-One)

$P_{ACQ}$ ~ Probability the Correct Target Is Acquired $P_{FT}$ ~ Probability a False Target Is Acquired Prior To Correct Target Acquisition $P_{GUIDE}$ ~ Probability the Weapon Seeker Maintains Lock On the Target and the Weapon Guides All the Way To Target Closure $P_{HIT}$ ~ Probability the Weapon Selects "Correct" Aim Point and Hits the Target Within Desired Miss Distance $P_{KILL/HIT}$ ~ Probability the Target Is Defeated R ~ Weapon Reliability With These Simple Definitions-One-On-One Performance Is:

$P_{KILL} = P_{ACQ}(1-P_{FT})\,P_{GUIDE}\,P_{HIT}\,P_{KILL/HIT}\,R$

Conclusions Derived From Simple Definitions (For Guided Weapons)

Probability of Target Acquisition ($P_{ACQ}$)

Probability of False Target Acquisition ($P_{FT}$)

$P_{ACQ} = P_{ACQ}$ [Delivery Accuracy, Target Location Errors, Search ($P_{FT}$) = ($P_{FT}$) Area, Search Time, Range, Sensor/Seeker Field of View, Clutter, Target Signature(s), Field of View Scan Efficiency, Signal Processing Time, Weather, Countermeasures, etc.]

Probability of Continuous Guidance ($P_{GUIDE}$)

$P_{GUIDE} = P_{GUIDE}$ [Target Behavior (i.e., Fading, Shadows, Glint/Scintillation, etc.); Target Tracking Loop Characteristics, Guidance/Autopilot Characteristics, Airframe Performance, Clutter Leakage, Weather, Countermeasures, etc.]

Probability of Closure To Design Miss Distance ($P_{HIT}$)

$P_{HIT} = P_{HIT}$ [Aimpoint Selection Probability ($P_{AIM\text{-}P}$), Aimpoint Tracking Equivalent Noise ($g_{min}$); Autopilot/Airframe Time Constant ($\tau$), Weather, Countermeasures, etc.]

Probability of Target Defeat Given a Hit ($P_{KILL/HIT}$)

$P_{KILL/HIT} = P_{KILL/HIT}$ [Warhead Lethality, Target Vulnerability, Aimpoint, Miss Distance, Defeat Criteria, Impact Angles, etc.]

Some Key Relationships For Improved Sensing Munitions (One-On-One)

$P_{FP}$ ~ Probability That One or More Targets Are Located In the Munition Footprint $P_{FF}$ ~ Probability That the Sensor False Fires Prior To Target Detection and Fire $P_{DET\&FIRE}$ ~ Probability That the Sensor Detects and Fires At An Appropriate Target $P_{HIT}$ ~ Probability That the Warhead Impacts the Target At Desired Aiming Area (Similar To Guided Weapon Miss Distance)

$P_{KILL/HIT}$ ~ Probability the Target Is Defeated

R ~ Munition Reliability

Performance Relationships For One-On-One Is $P_{KILL} = P_{FP}\,P_{DET\&FIRE}(1-P_{FF})\,P_{HIT}\,P_{KILL/HIT}\,R$ Sensor/Seeker Requirements Are Inextricably Tied To Mission Requirements and System/Employment Concept Probability Of Target Detection ($P_D$)

$$P_D = P_D\left(\frac{P_T}{P_N + P_C}\right)$$

$P_S$ = Target Signal $P_N$ = Sensor Noise $P_C$ = Clutter

Passive MMW Signatures

Target = Reflection ($r_T$) Of "Cold" Sky Radiance $P_T = P_T(r_T A_T)\ r_T = 0.9$ Clutter = Reflection $r_c$ Of "Cold" Sky $P_C = P_C(r_c P_c)\ r_c = 0.2$ -continued Active Target Signatures Target = Reflection Of Transmitted Energy ($\sigma_T$)
$P_T = P_T(\sigma_T)$
Clutter = Reflection Of Transmitted Energy ($\sigma_o$)
$P_C = P_C(\sigma_o A_c)$ $$\text{MTI IMPROVEMENT FACTOR I} = \left(\frac{S_o/C_o}{S_I/C_I}\right)_{Average}$$

SUBCLUTTER VISIBILITY SCV = ($C_I/S_I$) Allowed Average
CLUTTER VISIBILITY V = ($S_O/C_O$) Required
CLUTTER ATTENUATION CA = ($C_I/C_O$)
I = SCV X V = CA X ($S_O/S_I$) Average

*ISM Is An Army Term: USAF Term Is Sensor Fuzed/Munition (SFM)

The priority of a designated target depends on the initial acquisition the characteristic of said track or directional vector exhibited by said target the velocity of said target and the immediate threat posed by the aforesaid target. The user based transector must determine whether the target is within optimium range and whether or not a first intercept and kill or neutralization assignment can be implemented. The maneuverability of the missle in relation to said target must exceed four to six times the maneuver capability of said target, in order to effect a successful intercept and subsequent engagement. The interval of time between launches of missiles $T_L$ depends on the number of designated targets, $D_T$, assigned to the number of warheads available, $W_T$, the velocity of said target, $V_T$, relative to the velocity of said missile, $V_M$, and the number of scans required per second to track said target, which depends on the number of guidance channels open $N_G$ and the number of targets illuminated $T_L$ per second.

The time between launch is described by the equation herein below $$T_L \int_{0\to\infty}^{\text{init.}\to\infty} = f\left(\frac{\left(1+\frac{V_T}{V_M}\right)(T_H+Ts)}{\frac{N_G}{T_L}}\right)$$

where $T_H$ is the temporal interval of homing in on a target,

Ts represents the number of searches required for a temporal interval, $$\int_{0\leftarrow\text{lim.}}^{\text{init}\to\text{lim.}} = \sum_{n>10}^{i=1} n\frac{dx}{dt}$$

$T_L$ is the number of target illuminated at greater than ten hits per second.

There is no limits to be placed on the said transector device in regards to size which effects range. The transector presented in this disclosure represents light deliver systems with a maximium range of ten to eighteen kilometers, therefore target engagement must occur optimally within the boost or coast phase of a designated target, unless the sustained flight corresponds to a low level missile such as a cruise, exocet, or equivalent system.

Figure 140:
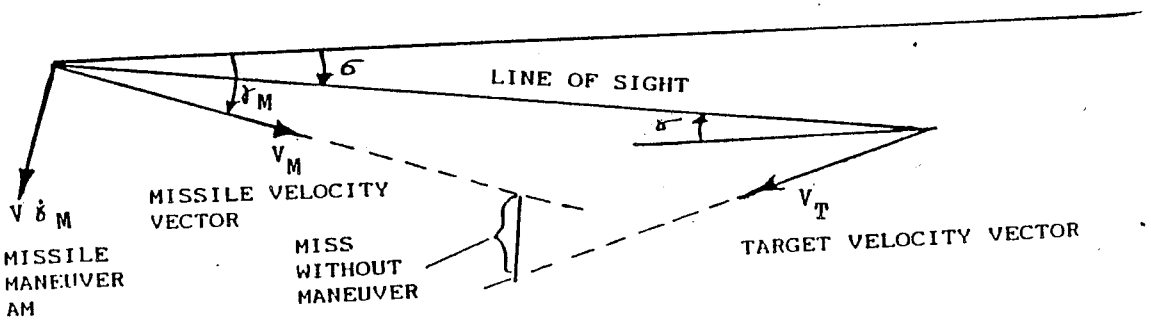

FIGS. 138 through 142 consist of a series of well defined diagrams and equations describing parameters of missile tracking and engagement. FIG. 138 describes the process of initial missile sizing to meet range, velocity and maneuverability implemented with close form solutions. FIG. 139 describes the parameter associated with target acquisition, some types of sensors embodied within the transector or missile element, the search and duel factors corresponding to homing, range, velocity and angular uncertainties. FIG. 140 corresponds to the use of proportional navigation implemented by terminal guidance. FIG. 141 describes the effects on targeting of said missile in relation to the operation of an inertial guidance system i.e. autopilot means. FIG. 142 describes primary factors governing acquisition, where radar is employed to implement said targeting. The equations presented in FIGS. 138 through 142 implement algorithms for programs involved in the acquisition, pursuit and subsequent engagement of targets.

Although various alterations or modifications may be suggested by those skilled in the art, it is the intention of the inventor(s) to embody within the patent warranted hereon all changes and modifications as reasonably and properly come within the scope of contributions to the art, without departing from the spirit of the invention.

What is claimed is:

1. A transector system for tracking and neutralizing a designated target body, including:

sensing means for sensing signals associated with any body within the range of the system and producing an output signal characteristic of that body;

central computer means including signal processing means coupled to said sensing means and responsive to said output signal to digitize and store the same;

said computer means including, in addition, repertoire storage means and comparator means;

said repertoire storage means having stored therein digitized signals representing the signals emanating from the target body;

said comparator means being coupled to said sensing means and to said repertoire storage means for comparing output signals from said sensing means with said stored digitized signals in said repertoire storage means and for producing a lock-on output signal when said output signal from said sensing means corresponds to said digitized signal representing said target body;

said signal processing means including means to determine the range, azimuth and elevation of each body, the signals from which are being sensed, and, in particular, producing a digital location signal representative of the location of the target body when the lock-on signal occurs;

projectile means including a projectile computer, said projectile computer having projectile signal-processing means and volatile storage means therein;

said volatile storage means being coupled, before launch of said projectile, to said signal processing means for updating said projectile computer with the latest digitized target body location signal;

said projectile computer including an expert program for controlling said projectile signal-processing means and for controlling the flight of said projectile.

2. A system according to claim 1 which includes, in addition, source means to illuminate said target body with radiant energy.

3. A system according to claim 2 in which said source means is a laser.

4. A system according to claim 2 in which said source means is a radar signal generator.

5. A system according to claim 2 in which said source means is an acoustic signal source.

6. A system according to claim 1 in which said projectile includes multiple warheads.

7. The system according to claim 6 in which said projectile has a conductive casing through which internally carried high-voltage equipment may be discharged into the target body upon contact therewith by said projectile.

8. The system according to claim 6 in which said projectile has a conductive casing through which internally carried electromagnetic emitter means wherein radiation may be discharged into the region adjacent to or emboding said target body.

9. A system according to claim 1 in which said projectile has a nozzular casing through which target-body-disabling, volatile chemicals may be dispersed.

10. A system according to claim 1 in which said projectile has a sintered casing through which target-body-disabling, volatile radioactive chemicals may be dispersed.

11. A system according to claim 1 in which said projectile has a sintered casing through which target-body-disabling, netting may be dispersed to ensnare said target body.

12. A system according to claim 1 in which said central computer means and said projectile computer means are interactive.

13. The system according to claim 1 in which said projectile means includes means for re-processing propulsive materials in said projectile.

* * * * *